US008764551B2

(12) United States Patent
Fujisawa et al.

(10) Patent No.: US 8,764,551 B2
(45) Date of Patent: Jul. 1, 2014

(54) GAMING MACHINE, AND CONTROL METHOD OF SAME

(71) Applicants: Universal Entertainment Corporation, Tokyo (JP); Aruze Gaming America, Inc., Las Vegas, NV (US)

(72) Inventors: Masumi Fujisawa, Tokyo (JP); Kenta Kitamura, Tokyo (JP); Kenji Enokido, Tokyo (JP)

(73) Assignees: Universal Entertainment Corporation, Koto-Ku, Tokyo (JP); Aruze Gaming America, Inc., Las Vegas, NV (US)

( * ) Notice: Subject to any disclaimer, the term of this patent is extended or adjusted under 35 U.S.C. 154(b) by 0 days.

(21) Appl. No.: 13/783,265

(22) Filed: Mar. 2, 2013

(65) Prior Publication Data

US 2013/0231174 A1 Sep. 5, 2013

(30) Foreign Application Priority Data

Mar. 5, 2012 (JP) ..... 2012-047850

(51) Int. Cl.
*G07F 17/00* (2006.01)
*G07F 17/32* (2006.01)

(52) U.S. Cl.
CPC ..... *G07F 17/326* (2013.01)
USPC ..... 463/20

(58) Field of Classification Search
USPC ..... 463/1, 16, 20, 21, 23, 30, 31
See application file for complete search history.

(56) References Cited

U.S. PATENT DOCUMENTS

| | | | | | |
|---|---|---|---|---|---|
| 5,766,074 | A * | 6/1998 | Cannon et al. | 463/16 |
| 6,126,165 | A * | 10/2000 | Sakamoto | 273/143 R |
| 6,142,875 | A * | 11/2000 | Kodachi et al. | 463/20 |
| 6,319,124 | B1 * | 11/2001 | Baerlocher et al. | 463/20 |
| 6,497,617 | B1 * | 12/2002 | Yoshida | 463/20 |
| 2003/0190945 | A1 * | 10/2003 | Bussick et al. | 463/20 |
| 2004/0214637 | A1 * | 10/2004 | Nonaka | 463/31 |
| 2005/0282613 | A1 * | 12/2005 | Pryzby et al. | 463/20 |
| 2007/0066391 | A1 * | 3/2007 | Kojima | 463/31 |
| 2007/0238512 | A1 * | 10/2007 | Sato | 463/20 |
| 2011/0250947 | A1 | 10/2011 | Okamoto | |

FOREIGN PATENT DOCUMENTS

| | | | | |
|---|---|---|---|---|
| JP | 10000263 A * | 1/1998 | | A63F 7/02 |
| JP | 2001062033 A * | 3/2001 | | A63F 5/04 |

OTHER PUBLICATIONS

English Abstract for JP 10000263 A.*
English Abstract for JP 2001062033 A.*

* cited by examiner

*Primary Examiner* — William Brewster
*Assistant Examiner* — Jason Skaarup
(74) *Attorney, Agent, or Firm* — KMF Patent Services, PLLC; Kenneth M. Fagin, Esq.; S. Peter Konzel, Esq.

(57) ABSTRACT

A gaming machine 1: variably displays a plurality of symbols on a lower image display panel 141 in response to an external input; randomly determining symbols 501 to be rearranged on the lower image display panel 141; determining one of game results based on the symbols 501 randomly determined; execute a common indication effect common to all the game results; and after common indication effect is executed, executes an individual indication effect according to the game result determined while the symbols are variably displayed.

6 Claims, 141 Drawing Sheets

FIG.4

INDICATION EFFECT TABLE

| IDENTIFICATION NAME | COMMON INDICATION EFFECT | INDIVIDUAL INDICATION EFFECT |
|---|---|---|
| FEATURE INDICATION 1 | DRAGON BREATH INDICATION | BALL-APPEARANCE INDICATION |
| FEATURE INDICATION 2 | DRAGON BREATH INDICATION | BALL-NON-APPEARANCE INDICATION |
| HIGH PAYOUT INDICATION | BIG DRAGON RISE | REEL-DRAGON APPEARANCE INDICATION |
| MIDDLE PAYOUT INDICATION | BIG DRAGON RISE | SLOW-REEL INDICATION |
| WILD-STOP INDICATION | – | WILD-STOP INDICATION |
| ... | ... | ... |

FIG.11

DETAILED CLASSIFICATION

| NO. | FIRST REEL | SECOND REEL | THIRD REEL | FOURTH REEL | FIFTH REEL | TABLE |
|---|---|---|---|---|---|---|
| 1: | ○ | ○ | ○ | ○ | ○ | TABLE E-1 |
| 2: | × | ○ | ○ | ○ | ○ | TABLE E-2 |
| 3: | ○ | × | ○ | ○ | ○ | TABLE E-1 |
| 4: | ○ | ○ | × | ○ | ○ | TABLE E-1 |
| 5: | ○ | ○ | ○ | × | ○ | TABLE E-1 |
| 6: | ○ | ○ | ○ | ○ | × | TABLE E-1 |
| 7: | × | × | ○ | ○ | ○ | TABLE E-3 |
| 8: | × | ○ | × | ○ | ○ | TABLE E-2 |
| 9: | × | ○ | ○ | × | ○ | TABLE E-2 |
| 10: | × | ○ | ○ | ○ | × | TABLE E-2 |
| 11: | ○ | × | × | ○ | ○ | TABLE E-1 |
| 12: | ○ | × | ○ | × | ○ | TABLE E-1 |
| 13: | ○ | × | ○ | ○ | × | TABLE E-1 |
| 14: | ○ | ○ | × | × | ○ | TABLE E-1 |
| 15: | ○ | ○ | × | ○ | × | TABLE E-1 |
| 16: | ○ | ○ | ○ | × | × | TABLE E-1 |
| 17: | × | × | × | ○ | ○ | TABLE E-4 |
| 18: | × | × | ○ | × | ○ | TABLE E-3 |
| 19: | × | × | ○ | ○ | × | TABLE E-3 |
| 20: | × | ○ | × | × | ○ | TABLE E-2 |
| 21: | × | ○ | × | ○ | × | TABLE E-2 |
| 22: | × | ○ | ○ | × | × | TABLE E-2 |
| 23: | ○ | × | × | × | ○ | TABLE E-1 |
| 24: | ○ | × | × | ○ | × | TABLE E-1 |
| 25: | ○ | × | ○ | × | × | TABLE E-1 |
| 26: | ○ | ○ | × | × | × | TABLE E-1 |
| 27: | × | × | × | × | ○ | TABLE E-5 |
| 28: | × | × | × | ○ | × | TABLE E-4 |
| 29: | × | × | ○ | × | × | TABLE E-3 |
| 30: | × | ○ | × | × | × | TABLE E-2 |
| 31: | ○ | × | × | × | × | TABLE E-1 |

○: 4-CONSECUTIVE WILD SYMBOL STOPPED
×: 4-CONSECUTIVE WILD SYMBOL NOT STOPPED

FIG.12

RANDOM EFFECT DETERMINATION TABLE

| NO. | TABLE | FEATURE INDICATION 1 (DEFINITE) | FEATURE INDICATION 2 (INCLUDING FAKE) | HIGH PAYOUT INDICATION | MIDDLE PAYOUT INDICATION | WILD-STOP INDICATION | NO EFFECT | TOTAL |
|---|---|---|---|---|---|---|---|---|
| 1 | TABLE A | 20 | 20 | 0 | 0 | 0 | 60 | 100 |
| 2 | TABLE B | 0 | 10 | 0 | 0 | 0 | 90 | 100 |
| 3 | TABLE C | 0 | 0 | 50 | 20 | 0 | 30 | 100 |
| 4 | TABLE D | 0 | 0 | 0 | 50 | 0 | 50 | 100 |
| 5 | TABLE E-1 | 0 | 0 | 0 | 0 | 55 | 45 | 100 |
| 6 | TABLE E-2 | 0 | 0 | 0 | 0 | 25 | 75 | 100 |
| 7 | TABLE E-3 | 0 | 0 | 0 | 0 | 35 | 65 | 100 |
| 8 | TABLE E-4 | 0 | 0 | 0 | 0 | 3 | 97 | 100 |
| 9 | TABLE E-5 | 0 | 0 | 0 | 0 | 2 | 98 | 100 |

FIG.13

| NO. | EFFECT | RELIABILITY |
|---|---|---|
| 1 | FEATURE INDICATION 1 (DEFINITE) | 100.0% |
| 2 | FEATURE INDICATION 2(INCLUDING FAKE) | 33.3% |
| 3 | NO EFFECT | 1.0% |

FIG.14

| NO. | EFFECT | FREQUENCY (%) | FREQUENCY (1/N) |
|---|---|---|---|
| 1 | EFFECT TOTAL | 3.71% | 1/26.9 |

| NO. | EFFECT | FREQUENCY (%) | FREQUENCY (1/N) |
|---|---|---|---|
| 1 | FEATURE INDICATION 1 (DEFINITE) | 0.33% | 1/300.0 |
| 2 | FEATURE INDICATION 2(INCLUDING FAKE) | 1.00% | 1/100.0 |
| 3 | HIGH PAYOUT INDICATION | 0.17% | 1/591.5 |
| 4 | MIDDLE PAYOUT INDICATION | 0.54% | 1/186.1 |
| 5 | WILD-STOP INDICATION | 1.67% | 1/59.8 |
| 6 | NO EFFECT | 96.29% | 1/1.0 |

FIG.15

FREQUENCY SATISFYING RANDOM DETERMINATION CONDITION

| NO. | TABLE | RANDOM DETERMINATION CONDITION | OCCURRENCE POSSIBILITY | FREQUENCY (1/N) |
|---|---|---|---|---|
| 1 | TABLE A | TRIGGER_A 3K (FEATURE) | 1.67% | 1/60.0 |
| 2 | TABLE B | TRIGGER_A 2K (TENPAI) | 6.67% | 1/15.0 |
| 3 | TABLE C | 20 TIMES OR MORE PAYOUT WON | 0.34% | 1/295.7 |
| 4 | TABLE D | 10 TIMES OR MORE, BUT LESS THAN 20 TIMES OF PAYOUT WON | 0.84% | 1/119.3 |
| 5 | TABLE E-1 | 4-CONSECUTIVE WILD SYMBOL STOPPED (FIRST REEL) | 1.14% | 1/87.4 |
| 6 | TABLE E-2 | 4-CONSECUTIVE WILD SYMBOL STOPPED (SECOND REEL) | 2.42% | 1/41.3 |
| 7 | TABLE E-3 | 4-CONSECUTIVE WILD SYMBOL STOPPED (THIRD REEL) | 0.87% | 1/115.0 |
| 8 | TABLE E-4 | 4-CONSECUTIVE WILD SYMBOL STOPPED (FOURTH REEL) | 2.39% | 1/41.9 |
| 9 | TABLE E-5 | 4-CONSECUTIVE WILD SYMBOL STOPPED (FIFTH REEL) | 3.09% | 1/32.4 |
| 10 | TABLE E TOTAL | 4-CONSECUTIVE WILD SYMBOL STOPPED | 9.91% | 1/10.1 |

NUMBER OF TIMES PASSED

| | | | | |
|---|---|---|---|---|
| 12 | 11 | 9 | 9 | 12 |
| 13 | 14 | 16 | 16 | 13 |
| 13 | 14 | 16 | 16 | 13 |
| 12 | 11 | 9 | 9 | 12 |

FIG.23

REEL POSITION NUMBER

| FIRST REEL | SECOND REEL | THIRD REEL | FOURTH REEL | FIFTH REEL | |
|---|---|---|---|---|---|
| 0 | 0 | 0 | 0 | 0 | UPPERMOST STAGE |
| 1 | 1 | 1 | 1 | 1 | SECOND STAGE |
| 2 | 2 | 2 | 2 | 2 | THIRD STAGE |
| 3 | 3 | 3 | 3 | 3 | LOWERMOST STAGE |

FIG.24

| No | FIRST REEL | SECOND REEL | THIRD REEL | FOURTH REEL | FIFTH REEL |
|---|---|---|---|---|---|
| 1 | 0 | 0 | 0 | 0 | 0 |
| 2 | 0 | 0 | 0 | 1 | 0 |
| 3 | 0 | 0 | 0 | 1 | 2 |
| 4 | 0 | 0 | 1 | 1 | 1 |
| 5 | 0 | 0 | 1 | 2 | 3 |
| 6 | 0 | 1 | 2 | 3 | 3 |
| 7 | 0 | 0 | 1 | 0 | 0 |
| 8 | 0 | 1 | 2 | 1 | 0 |
| 9 | 0 | 1 | 0 | 1 | 0 |
| 10 | 0 | 1 | 1 | 1 | 0 |
| 11 | 0 | 0 | 2 | 0 | 0 |
| 12 | 0 | 0 | 3 | 0 | 0 |
| 13 | 1 | 1 | 1 | 1 | 1 |
| 14 | 1 | 1 | 1 | 0 | 1 |
| 15 | 1 | 1 | 1 | 2 | 1 |
| 16 | 1 | 1 | 0 | 0 | 0 |
| 17 | 1 | 1 | 2 | 2 | 2 |
| 18 | 1 | 0 | 1 | 2 | 3 |
| 19 | 1 | 1 | 2 | 1 | 1 |
| 20 | 1 | 1 | 0 | 1 | 1 |
| 21 | 1 | 0 | 0 | 0 | 1 |
| 22 | 1 | 0 | 1 | 0 | 1 |
| 23 | 1 | 2 | 2 | 2 | 1 |
| 24 | 1 | 2 | 1 | 2 | 1 |
| 25 | 1 | 2 | 3 | 2 | 1 |
| 26 | 2 | 2 | 2 | 2 | 2 |
| 27 | 2 | 2 | 2 | 1 | 2 |
| 28 | 2 | 2 | 2 | 3 | 2 |
| 29 | 2 | 2 | 1 | 1 | 1 |
| 30 | 2 | 2 | 1 | 2 | 2 |
| 31 | 2 | 3 | 2 | 1 | 0 |
| 32 | 2 | 2 | 3 | 3 | 3 |
| 33 | 2 | 2 | 3 | 2 | 2 |
| 34 | 2 | 1 | 1 | 1 | 2 |
| 35 | 2 | 1 | 2 | 1 | 2 |
| 36 | 2 | 1 | 0 | 1 | 2 |
| 37 | 2 | 3 | 2 | 3 | 2 |
| 38 | 2 | 3 | 3 | 3 | 2 |
| 39 | 3 | 3 | 3 | 3 | 3 |
| 40 | 3 | 3 | 3 | 2 | 1 |
| 41 | 3 | 3 | 3 | 2 | 3 |
| 42 | 3 | 3 | 1 | 0 | 0 |
| 43 | 3 | 3 | 2 | 2 | 2 |
| 44 | 3 | 3 | 2 | 1 | 0 |
| 45 | 3 | 3 | 0 | 3 | 3 |
| 46 | 3 | 3 | 1 | 3 | 3 |
| 47 | 3 | 3 | 2 | 3 | 3 |
| 48 | 3 | 2 | 1 | 2 | 2 |
| 49 | 3 | 2 | 2 | 2 | 2 |
| 50 | 3 | 2 | 3 | 2 | 2 |

FIG.94

| | REEL1 | REEL2 | REEL3 | REEL4 | REEL5 | |
|---|---|---|---|---|---|---|
| 1 | ANIMATION CONTINUING | ANIMATION CONTINUING | ANIMATION CONTINUING | | | 3 OF A KIND |
| 2 | ANIMATION CONTINUING | ANIMATION CONTINUING | ANIMATION CONTINUING | ANIMATION CONTINUING | ANIMATION CONTINUING | 5 OF A KIND |
| 3 | | | | | | |

FIG.98

| REMAINING COUNT NUMBER | SECOND BY WHICH INCREMENT FOR ONE COUNT IS CARRIED OUT |
|---|---|
| 1～2 | ABOUT 2.10 SECONDS |
| 3 | ABOUT 1.70 SECONDS |
| 4 | ABOUT 1.30 SECONDS |
| 5 | ABOUT 1.20 SECONDS |
| 6～7 | ABOUT 1.00 SECONDS |
| 8～9 | ABOUT 0.80 SECONDS |
| 10～11 | ABOUT 0.70 SECONDS |
| 12 | ABOUT 0.60 SECONDS |
| 13～17 | ABOUT 0.50 SECONDS |
| 18～23 | ABOUT 0.40 SECONDS |
| 24～30 | ABOUT 0.30 SECONDS |
| 31～45 | ABOUT 0.24 SECONDS |
| 46～50 | ABOUT 0.18 SECONDS |
| 51～80 | ABOUT 0.16 SECONDS |
| 81～100 | ABOUT 0.13 SECONDS |
| 101 OR HIGHER | REWRITE |

FIG.99

| THRESHOLD | SECONDS |
|---|---|
| DECIMAL ODDS OF 1 OR LOWER | 0.5 SECOND |
| DECIMAL ODDS OF 1 TO LESS THAN 1.5 | 1 SECOND |
| DECIMAL ODDS OF 1.5 TO LESS THAN 2.5 | 2 SECONDS |
| DECIMAL ODDS OF 2.5 TO LESS THAN 3.5 | 3 SECONDS |
| DECIMAL ODDS OF 3.5 TO LESS THAN 4.5 | 4 SECONDS |
| DECIMAL ODDS OF 4.5 TO LESS THAN 5.5 | 5 SECONDS |
| DECIMAL ODDS OF 5.5 TO LESS THAN 6.5 | 6 SECONDS |
| DECIMAL ODDS OF 6.5 TO LESS THAN 7.5 | 7 SECONDS |
| DECIMAL ODDS OF 7.5 TO LESS THAN 8.5 | 8 SECONDS |
| DECIMAL ODDS OF 8.5 TO LESS THAN 9.5 | 9 SECONDS |
| DECIMAL ODDS OF 9.5 TO LESS THAN 10.5 | 10 SECONDS |
| DECIMAL ODDS OF 10.5 TO LESS THAN 11.5 | 11 SECONDS |
| DECIMAL ODDS OF 11.5 TO LESS THAN 12.5 | 12 SECONDS |
| DECIMAL ODDS OF 12.5 TO LESS THAN 13.5 | 13 SECONDS |
| DECIMAL ODDS OF 13.5 TO LESS THAN 14.5 | 14 SECONDS |
| DECIMAL ODDS OF 14.5 TO LESS THAN 15.5 | 15 SECONDS |
| DECIMAL ODDS OF 15.5 TO LESS THAN 16.5 | 16 SECONDS |
| DECIMAL ODDS OF 16.5 TO LESS THAN 17.5 | 17 SECONDS |
| DECIMAL ODDS OF 17.5 TO LESS THAN 18.5 | 18 SECONDS |
| DECIMAL ODDS OF 18.5 TO LESS THAN 19.5 | 19 SECONDS |
| DECIMAL ODDS OF 19.5 TO LESS THAN 20.5 | 20 SECONDS |
| DECIMAL ODDS OF 20.5 TO LESS THAN 21.5 | 21 SECONDS |
| DECIMAL ODDS OF 21.5 TO LESS THAN 22.5 | 22 SECONDS |
| DECIMAL ODDS OF 22.5 TO LESS THAN 23.5 | 23 SECONDS |
| DECIMAL ODDS OF 23.5 TO LESS THAN 24.5 | 24 SECONDS |
| DECIMAL ODDS OF 24.5 TO LESS THAN 25 | 25 SECONDS |
| DECIMAL ODDS OF 25 TO LESS THAN 50 | 30 SECONDS |
| DECIMAL ODDS OF 50 OR HIGHER | 35 SECONDS |

IDLE STATE

DURING HELP

DURING GAME

DURING TAKE WIN OR GAMBLE

IDLE STATE (LANGUAGE SWITCH IMPOSSIBLE)

DURING HELP (LANGUAGE SWITCH IMPOSSIBLE)

DURING GAME (LANGUAGE SWITCH IMPOSSIBLE)

DURING TAKE WIN OR GAMBLE (LANGUAGE SWITCH IMPOSSIBLE)

FIG.102

| TYPE OF BUTTON | IDLE STATE | DURING GAME | DURING ERROR | DURING AUDIT | TAKE WIN OR GAMBLE |
|---|---|---|---|---|---|
| HELP | ON | OFF | OFF | OFF | ON |
| LANGUAGE SWITCH | ON | OFF | OFF | OFF | OFF |
| VOLUME | ON | ON | OFF | OFF | ON |
| NUMBER OF LINES | ON (WHEN SELECTABLE) | OFF | OFF | OFF | OFF |
| BET AMOUNT | ON | OFF | OFF | OFF | OFF |
| PAY TABLE | ON | OFF | OFF | OFF | ON |

FIG.103

| AREA | DISPLAYED NATIONAL FLAG | DISPLAYED LANGUAGE | DISPLAYED BUTTON | DAT/TGA NAME |
|---|---|---|---|---|
| U.S.A. | U.S.A. OR CHINA | ENGLISH (USA) | | BTN_FLAG_U_CHAM |
| | | CHINESE (CHN) | | BTN_FLAG_U_AMCH |
| OTHERS | UNITED KINGDOM OR CHINA | ENGLISH (UK) | | BTN_FLAG_U_CHAM |
| | | CHINESE (CHN) | | BTN_FLAG_U_EGCH |
| LANGUAGE SWITCH INVALID | — | — | PAY TABLE | — |

FIG.106

| SCREEN | CONTROL PANEL | OPERATION |
|---|---|---|
| EXIT | HELP | SHIFT TO NORMAL SCREEN |
| PREV. | BET ×1 | SHIFT TO PREVIOUS PAGE |
| NEXT | BET ×2 | SHIFT TO NEXT PAGE |

FIG.111

| AREA | DISPLAYED LANGUAGE | NATIONAL FLAG | FUNCTION/ TOUCH BUTTON |
|---|---|---|---|
| NORTH AMERICA | ENGLISH | U.S.A./CHINA | U.S. FLAG IS ON THE TOP |
| MACAU | ENGLISH | U.S.A./CHINA | U.S. FLAG IS ON THE TOP |
| OTHERS | ENGLISH | U.S.A./CHINA | U.S. FLAG IS ON THE TOP |

FIG.142

| NO. | SETTING | DISPLAY SAMPLE |
|---|---|---|
| 1 | RUSSIAN FEDERATION RUBLE | 12,345,678.99R |
| 2 | KAZAKHSTAN TENGE | 12,345,678.99KZT |
| 3 | LATVIA LAT | 12,345,678.99LS |
| 4 | UKRAINE HRYVNA | 12,345,678.99HRV |
| 5 | BELARUSSIAN ROUBLE | 12,345,678.99BR |
| 6 | RUMANIAN LEU | 12,345,678.99LEI |
| 7 | EURO | (EUR)12,345,678.99 |
| 8 | US DOLLAR | $12,345,678.99 |
| 9 | SOUTH AFRICAN RAND | R12,345,678.99 |
| 10 | NAMIBIAN DOLLAR | N$12,345,678.99 |
| 11 | BOTSWANA PULA | P12,345,678.99 |
| 12 | TANZANIAN SHILLING | TSH12,345,678.99 |
| 13 | MAURITIUS RUPEE | RS12,345,678.99 |
| 14 | SEYCHELLES RUPEE | SR12,345,678.99 |
| 15 | ZAMBIAN KWACHA | K12,345,678.99 |
| 16 | KENYAN SHILLING | KSH12,345,678.99 |
| 17 | HONG KONG DOLLAR | HK$12,345,678.99 |
| 18 | MALAYSIAN RINGGIT | RM12,345,678.99 |
| 19 | PHILIPPINE PESO | PHP12,345,678.99 |
| 20 | THAILAND BAHT | 12,345,678.99B |
| 21 | AUSTRALIAN DOLLAR | $12,345,678.99 |
| 22 | NEW ZEALAND DOLLAR | $12,345,678.99 |
| 23 | MEDAL | 12,345,678.99 |
| 24 | COLOMBIAN PESO | $12345678.99 |
| 25 | VENEZUELA BOLIVAR | BS12,345,678.99 |
| 26 | SOUTH KOREAN WON | W12,345,678.99 |
| 27 | MACAU PATACA | MOP12,345,678.99 |
| 28 | SINGAPOLE DOLLAR | S$12,345,678.99 |
| 29 | CANADA DOLLAR | $12,345,678.99 |
| 30 | CHILLI PESO | $12,345,678.99 |

FIG.143A

| NO. | FILE NAME | USED POSITION | START CONDITION | DELETE CONDITION | NOTE |
|---|---|---|---|---|---|
| 1 | IDLE_01 | FOR ADVERTISEMENT | CREDIT IS 0 | CREDIT ENTRY | ONLY THIS FILE IS LOOPED DURING ADVERTISEMENT |
| 2 | IDLE_02 | DURING NORMAL GAME | CREDIT IS 1 OR MORE | CREDIT IS 0 ANOTHER LED EFFECT IS PROVIDED | THIS EFFECT IS PROVIDED WHEN NO OTHER EFFECT IS PROVIDED |
| 3 | FG_IN | FREE GAME INTRODUCTION SCREEN | WHEN INTRODUCTION OF FREE GAME IS STARTED | WHEN FREE GAME SPIN IS STARTED | |
| 4 | FG_SPIN | DURING FREE GAME | WHEN FREE GAME SPIN IS STARTED | WHEN FREE GAME ENDED | |
| 5 | PICK_IN | INTRODUCTION SCREEN DURING SHENLONG BONUS | WHEN INTRODUCTION OF BONUS IS STARTED | | |
| 6 | PICK_IDLE | WHEN SELECTION IS WAITED DURING SHENLONG BONUS | WHEN BONUS SELECTION IS STARTED | | |
| 7 | PICK_1 | WHEN LEVEL 1 IS ALIGNED DURING SHENLONG BONUS | WHEN LEVEL 1 IS ALIGNED DURING SHENLONG BONUS | TOTAL WIN SCREEN | |
| 8 | PICK_2 | WHEN LEVEL 2 IS ALIGNED DURING SHENLONG BONUS | WHEN LEVEL 2 IS ALIGNED DURING SHENLONG BONUS | WHEN ROULETTE IS STARTED | |
| 9 | PICK_3 | WHEN LEVEL 3 IS ALIGNED DURING SHENLONG BONUS | WHEN LEVEL 3 IS ALIGNED DURING SHENLONG BONUS | WHEN ROULETTE IS STARTED | |
| 10 | PICK_4 | WHEN LEVEL 4 IS ALIGNED DURING SHENLONG BONUS | WHEN LEVEL 4 IS ALIGNED DURING SHENLONG BONUS | WHEN ROULETTE IS STARTED | |
| 11 | PICK_5 | WHEN LEVEL 5 IS ALIGNED DURING SHENLONG BONUS | WHEN LEVEL 5 IS ALIGNED DURING SHENLONG BONUS | WHEN ROULETTE IS STARTED | |
| 12 | PICK_ J | WHEN JACKPOT IS WOND DURING SHENLONG BONUS | WHEN JACKPOT IS WOND DURING SHENLONG BONUS | WHEN DISPLAYING JACKPOT WINNING | |
| 13 | ROU_A_1_1 | 100% WHEN WINNING OCCURS AT THE BOTTOM ONE OF THE LEFTMOST ROULETTES | WHEN ROULETTE IS STARTED | WHEN ROULETTE IS STOPPED | |
| 14 | ROU_A_2_1 | 50% WHEN WINNING OCCURS AT THE LEFTMOST ROULETTE, SECOND FROM THE BOTTOM | WHEN ROULETTE IS STARTED | WHEN ROULETTE IS STOPPED | |
| 15 | ROU_A_2_2 | 50% WHEN WINNING OCCURS AT THE LEFTMOST ROULETTE, SECOND FROM THE BOTTOM | WHEN ROULETTE IS STARTED | WHEN ROULETTE IS STOPPED | |

FIG.143B

| NO. | FILE NAME | USED POSITION | START CONDITION | DELETE CONDITION | NOTE |
|---|---|---|---|---|---|
| 16 | ROU_A_3_1 | 34% WHEN WINNING OCCURS AT THE LEFTMOST ROULETTE, SECOND FROM THE BOTTOM | WHEN ROULETTE IS STARTED | WHEN ROULETTE IS STOPPED | |
| 17 | ROU_A_3_2 | 33% WHEN WINNING OCCURS AT THE LEFTMOST ROULETTE, SECOND FROM THE BOTTOM | WHEN ROULETTE IS STARTED | WHEN ROULETTE IS STOPPED | |
| 18 | ROU_A_3_3 | 33% WHEN WINNING OCCURS AT THE LEFTMOST ROULETTE, SECOND FROM THE BOTTOM | WHEN ROULETTE IS STARTED | WHEN ROULETTE IS STOPPED | |
| 19 | ROU_A_4_1 | 25% WHEN WINNING OCCURS AT THE UPPERMOST ONE OF THE LEFTMOST ROULETTES | WHEN ROULETTE IS STARTED | WHEN ROULETTE IS STOPPED | |
| 20 | ROU_A_4_2 | 25% WHEN WINNING OCCURS AT THE UPPERMOST ONE OF THE LEFTMOST ROULETTES | WHEN ROULETTE IS STARTED | WHEN ROULETTE IS STOPPED | |
| 21 | ROU_A_4_3 | 25% WHEN WINNING OCCURS AT THE UPPERMOST ONE OF THE LEFTMOST ROULETTES | WHEN ROULETTE IS STARTED | WHEN ROULETTE IS STOPPED | |
| 22 | ROU_A_4_4 | 25% WHEN WINNING OCCURS AT THE UPPERMOST ONE OF THE LEFTMOST ROULETTES | WHEN ROULETTE IS STARTED | WHEN ROULETTE IS STOPPED | |
| 23 | ROU_B_1_1 | 100% WHEN WINNING OCCURS AT THE LOWERMOST ROULETTE, SECOND FROM THE LEFT | WHEN ROULETTE IS STARTED | WHEN ROULETTE IS STOPPED | |
| 24 | ROU_B_2_1 | 50% WHEN WINNING OCCURS AT THE ROULETTE SECOND FROM THE LEFT AND SECOND FROM THE BOTTOM | WHEN ROULETTE IS STARTED | WHEN ROULETTE IS STOPPED | |
| 25 | ROU_B_2_2 | 50% WHEN WINNING OCCURS AT THE ROULETTE SECOND FROM THE LEFT AND SECOND FROM THE BOTTOM | WHEN ROULETTE IS STARTED | WHEN ROULETTE IS STOPPED | |
| 26 | ROU_B_3_1 | 34% WHEN WINNING OCCURS AT THE ROULETTE SECOND FROM THE LEFT AND SECOND FROM THE TOP | WHEN ROULETTE IS STARTED | WHEN ROULETTE IS STOPPED | |
| 27 | ROU_B_3_2 | 33% WHEN WINNING OCCURS AT THE ROULETTE SECOND FROM THE LEFT AND SECOND FROM THE TOP | WHEN ROULETTE IS STARTED | WHEN ROULETTE IS STOPPED | |
| 28 | ROU_B_3_3 | 33% WHEN WINNING OCCURS AT THE ROULETTE SECOND FROM THE LEFT AND SECOND FROM THE TOP | WHEN ROULETTE IS STARTED | WHEN ROULETTE IS STOPPED | |
| 29 | ROU_B_4_1 | 25% WHEN WINNING OCCURS AT THE TOP ROULETTE, SECOND FROM FROM THE LEFT | WHEN ROULETTE IS STARTED | WHEN ROULETTE IS STOPPED | |
| 30 | ROU_B_4_2 | 25% WHEN WINNING OCCURS AT THE TOP ROULETTE, SECOND FROM FROM THE LEFT | WHEN ROULETTE IS STARTED | WHEN ROULETTE IS STOPPED | |

FIG.144A

| NO. | FILE NAME | USED POSITION | START CONDITION | DELETE CONDITION | NOTE |
|---|---|---|---|---|---|
| 31 | ROU_B_4_3 | 25% WHEN WINNING OCCURS AT THE TOP ROULETTE, SECOND FROM THE LEFT | WHEN ROULETTE IS STARTED | WHEN ROULETTE IS STOPPED | |
| 32 | ROU_B_4_4 | 25% WHEN WINNING OCCURS AT THE TOP ROULETTE, SECOND FROM THE LEFT | WHEN ROULETTE IS STARTED | WHEN ROULETTE IS STOPPED | |
| 33 | ROU_C_1_1 | 100% WHEN WINNING OCCURS AT THE LOWERMOST ROULETTE, SECOND FROM THE RIGHT | WHEN ROULETTE IS STARTED | WHEN ROULETTE IS STOPPED | |
| 34 | ROU_C_2_1 | 50% WHEN WINNING OCCURS AT THE ROULETTE SECOND FROM THE RIGHT, AND SECOND FROM THE BOTTOM | WHEN ROULETTE IS STARTED | WHEN ROULETTE IS STOPPED | |
| 35 | ROU_C_2_2 | 50% WHEN WINNING OCCURS AT THE ROULETTE SECOND FROM THE RIGHT, AND SECOND FROM THE BOTTOM | WHEN ROULETTE IS STARTED | WHEN ROULETTE IS STOPPED | |
| 36 | ROU_C_3_1 | 34% WHEN WINNING OCCURS AT THE ROULETTE SECOND FROM THE RIGHT AND SECOND FROM THE TOP | WHEN ROULETTE IS STARTED | WHEN ROULETTE IS STOPPED | |
| 37 | ROU_C_3_2 | 33% WHEN WINNING OCCURS AT THE ROULETTE SECOND FROM THE RIGHT AND SECOND FROM THE TOP | WHEN ROULETTE IS STARTED | WHEN ROULETTE IS STOPPED | |
| 38 | ROU_C_3_3 | 33% WHEN WINNING OCCURS AT THE ROULETTE SECOND FROM THE RIGHT AND SECOND FROM THE TOP | WHEN ROULETTE IS STARTED | WHEN ROULETTE IS STOPPED | |
| 39 | ROU_C_4_1 | 25% WHEN WINNING OCCURS AT THE UPPERMOST ROULETTE, SECOND FROM THE RIGHT | WHEN ROULETTE IS STARTED | WHEN ROULETTE IS STOPPED | |
| 40 | ROU_C_4_2 | 25% WHEN WINNING OCCURS AT THE UPPERMOST ROULETTE, SECOND FROM THE RIGHT | WHEN ROULETTE IS STARTED | WHEN ROULETTE IS STOPPED | |
| 41 | ROU_C_4_3 | 25% WHEN WINNING OCCURS AT THE UPPERMOST ROULETTE, SECOND FROM THE RIGHT | WHEN ROULETTE IS STARTED | WHEN ROULETTE IS STOPPED | |
| 42 | ROU_C_4_4 | 25% WHEN WINNING OCCURS AT THE UPPERMOST ROULETTE, SECOND FROM THE RIGHT | WHEN ROULETTE IS STARTED | WHEN ROULETTE IS STOPPED | |
| 43 | ROU_D_1_1 | 100% WHEN WINNING OCCURS AT THE BOTTOM ONE OF THE RIGHTMOST ROULETTES | WHEN ROULETTE IS STARTED | WHEN ROULETTE IS STOPPED | |
| 44 | ROU_D_2_1 | 50% WHEN WINNING OCCURS AT THE RIGHTMOST ROULETTE, SECOND FROM THE BOTTOM | WHEN ROULETTE IS STARTED | WHEN ROULETTE IS STOPPED | |
| 45 | ROU_D_2_2 | 50% WHEN WINNING OCCURS AT THE RIGHTMOST ROULETTE, SECOND FROM THE BOTTOM | WHEN ROULETTE IS STARTED | WHEN ROULETTE IS STOPPED | |

FIG.144B

| NO. | FILE NAME | USED POSITION | START CONDITION | DELETE CONDITION | NOTE |
|---|---|---|---|---|---|
| 46 | ROU_D_3_1 | 34% WHEN WINNING OCCURS AT THE RIGHTMOST ROULETTE, SECOND FROM THE TOP | WHEN ROULETTE IS STARTED | WHEN ROULETTE IS STOPPED | |
| 47 | ROU_D_3_2 | 33% WHEN WINNING OCCURS AT THE RIGHTMOST ROULETTE, SECOND FROM THE TOP | WHEN ROULETTE IS STARTED | WHEN ROULETTE IS STOPPED | |
| 48 | ROU_D_3_3 | 33% WHEN WINNING OCCURS AT THE RIGHTMOST ROULETTE, SECOND FROM THE TOP | WHEN ROULETTE IS STARTED | WHEN ROULETTE IS STOPPED | |
| 49 | ROU_D_4_1 | 25% WHEN WINNING TAKES PLACE AT THE UPPERMOST ONE OF THE RIGHTMOST ROULETTES | WHEN ROULETTE IS STARTED | WHEN ROULETTE IS STOPPED | |
| 50 | ROU_D_4_2 | 25% WHEN WINNING TAKES PLACE AT THE UPPERMOST ONE OF THE RIGHTMOST ROULETTES | WHEN ROULETTE IS STARTED | WHEN ROULETTE IS STOPPED | |
| 51 | ROU_D_4_3 | 25% WHEN WINNING TAKES PLACE AT THE UPPERMOST ONE OF THE RIGHTMOST ROULETTES | WHEN ROULETTE IS STARTED | WHEN ROULETTE IS STOPPED | |
| 52 | ROU_D_4_4 | 25% WHEN WINNING TAKES PLACE AT THE UPPERMOST ONE OF THE RIGHTMOST ROULETTES | WHEN ROULETTE IS STARTED | WHEN ROULETTE IS STOPPED | |
| 53 | JACKPOT | WHEN DISPLAYING JACKPOT WINNING | WHEN ROULETTE IS STARTED | WHEN ROULETTE IS STOPPED | |
| 54 | BONUSPICK | BONUSPUICK | WHEN DISPLAYING JACKPOT WINNING | WHEN ROULETTE IS STOPPED | |
| 55 | BONUSPICK_BONUS | BONUSPUICK | WHEN ENTERING BONUSPUICK | WHEN BONUS OR FREE GAME OCCURS, OR WHEN RETURNING TO NORMAL GAME | |
| 56 | BONUSPICK_FREEGAME | BONUSPUICK | WHEN BONUS APPEARS IN BONUSPUICK | WHEN INTRODUCTION OF BONUS IS STARTED | |
| 57 | SELECT_2 | OBE-PICK BONUS | WHEN LEVEL 2 IS SELECTED DURING OBE-PICK BONUS | WHEN INTRODUCTION OF BONUS IS STARTED | |
| 58 | SELECT_3 | OBE-PICK BONUS | WHEN LEVEL 3 IS SELECTED DURING OBE-PICK BONUS | WHEN LED ENDS | |
| 59 | SELECT_4 | OBE-PICK BONUS | WHEN LEVEL 4 IS SELECTED DURING OBE-PICK BONUS | WHEN LED ENDS | |
| 60 | SELECT_5 | OBE-PICK BONUS | WHEN LEVEL 5 IS SELECTED DURING OBE-PICK BONUS | WHEN LED ENDS | |

FIG.145A

| NO. | FILE NAME | USED POSITION | START CONDITION | DELETE CONDITION | NOTE |
|---|---|---|---|---|---|
| 61 | SELECT_J | OBE-PICK BONUS | WHEN JACKPOT IS SELECTED DURING OBE-PICK BONUS | WHEN LED ENDS | |
| 62 | ROU_R_A_1 | OBE-PICK BONUS | WHEN THE BOTTOM ONE OF THE LEFTMOST ROULETTES IS DETERMINED | WHEN RETURNING TO NORMAL GAME | |
| 63 | ROU_R_A_2 | OBE-PICK BONUS | WHEN THE LEFTMOST ROULETTE, 2TH FROM THE BOTTOM IS DETERMINED | WHEN RETURNING TO NORMAL GAME | |
| 64 | ROU_R_A_3 | OBE-PICK BONUS | WHEN THE LEFTMOST ROULETTE, 3TH FROM THE BOTTOM IS DETERMINED | WHEN RETURNING TO NORMAL GAME | |
| 65 | ROU_R_A_4 | OBE-PICK BONUS | WHEN THE LEFTMOST ROULETTE, 4TH FROM THE BOTTOM IS DETERMINED | WHEN RETURNING TO NORMAL GAME | |
| 66 | ROU_R_B_1 | OBE-PICK BONUS | WHEN THE LOWERMOST ROULETTE, SECOND FROM THE LEFT IS DETERMINED | WHEN RETURNING TO NORMAL GAME | |
| 67 | ROU_R_B_2 | OBE-PICK BONUS | WHEN THE ROULETTE SECOND FROM THE LEFT AND 2TH FROM THE BOTTOM IS DETERMINED | WHEN RETURNING TO NORMAL GAME | |
| 68 | ROU_R_B_3 | OBE-PICK BONUS | WHEN THE ROULETTE SECOND FROM THE LEFT AND 3TH FROM THE BOTTOM IS DETERMINED | WHEN RETURNING TO NORMAL GAME | |
| 69 | ROU_R_B_4 | OBE-PICK BONUS | WHEN THE ROULETTE SECOND FROM THE LEFT AND 4TH FROM THE BOTTOM IS DETERMINED | WHEN RETURNING TO NORMAL GAME | |
| 70 | ROU_R_C_1 | OBE-PICK BONUS | WHEN THE LOWERMOST ROULETTE, SECOND FROM THE RIGHT IS DETERMINED | WHEN RETURNING TO NORMAL GAME | |
| 71 | ROU_R_C_2 | OBE-PICK BONUS | WHEN THE ROULETTE SECOND FROM THE RIGHT AND 2TH FROM THE BOTTOM IS DETERMINED | WHEN RETURNING TO NORMAL GAME | |
| 72 | ROU_R_C_3 | OBE-PICK BONUS | WHEN THE ROULETTE SECOND FROM THE RIGHT AND 3TH FROM THE BOTTOM IS DETERMINED | WHEN RETURNING TO NORMAL GAME | |
| 73 | ROU_R_C_4 | OBE-PICK BONUS | WHEN THE ROULETTE SECOND FROM THE RIGHT AND 4TH FROM THE BOTTOM IS DETERMINED | WHEN RETURNING TO NORMAL GAME | |
| 74 | ROU_R_D_1 | OBE-PICK BONUS | WHEN THE LOWER MOST ONE OF THE RIGHTMOST ROULETTES IS DETERMINED | WHEN RETURNING TO NORMAL GAME | |
| 75 | ROU_R_D_2 | OBE-PICK BONUS | WHEN THE RIGHTMOST ROULETTE, 2TH FROM THE BOTTOM IS DETERMINED | WHEN RETURNING TO NORMAL GAME | |

FIG.145B

| NO. | FILE NAME | USED POSITION | START CONDITION | DELETE CONDITION | NOTE |
|---|---|---|---|---|---|
| 76 | ROU_R_D_3 | OBE-PICK BONUS | WHEN THE RIGHTMOST ROULETTE, 3TH FROM THE BOTTOM IS DETERMINED | WHEN RETURNING TO NORMAL GAME | |
| 77 | ROU_R_D_4 | OBE-PICK BONUS | WHEN THE RIGHTMOST ROULETTE, 4TH FROM THE BOTTOM IS DETERMINED | WHEN RETURNING TO NORMAL GAME | |
| 78 | DE_IDLE | TIME FOR DECISION | TIME FOR DECISION, AFTER THE END OF INTRODUCTION | WHEN SELECTION IS ENTERED | |
| 79 | DE_CARD | TIME FOR DECISION | WHEN MAKING SELECTION IN CARD-PICK | WHEN SHIFTING THE SELECTION SCREEN | |
| 80 | DE_ORB | TIME FOR DECISION | WHEN MAKING SELECTION IN OBE-PICK | WHEN SHIFTING THE SELECTION SCREEN | |
| 81 | DE_SPIN | TIME FOR DECISION | WHEN SELECTING OBE SPIN | WHEN SHIFTING TO START SPINNING WAITING SCREEN | |
| 82 | CARD_IDLE | CARD-PICK BONUS | WHEN SHIFTING TO SELECTION WAITING SCREEN | WHEN SELECTED | |
| 83 | CARD_CREDIT | CARD-PICK BONUS | WHEN CREDIT IS SELECTED | WHEN SHIFTING TO SELECTION WAITING SCREEN | |
| 84 | CARD_END | CARD-PICK BONUS | WHEN END IS SELECTED | WHEN RETURNING TO NORMAL GAME | |
| 85 | SPIN_IDLE | OBE SPIN BONUS | WHEN SHIFTING TO START SPINNING WAITING SCREEN | WHEN SPINNING IS STARTED | |
| 86 | SPIN_SPIN | OBE SPIN BONUS | WHEN SPINNING IS STARTED | WHEN ROULETTE IS STOPPED | |
| 87 | SPIN_HIGH | OBE SPIN BONUS | WHEN THE ROULETTE STOPPS AT 5000 CREDIT | WHEN RETURNING TO NORMAL GAME | |
| 88 | SPIN_LOW | OBE SPIN BONUS | WHEN THE ROULETTE STOPPS AT 10 - 50 CREDIT | WHEN RETURNING TO NORMAL GAME | |

FIG.146A

| STATE | CONDITION | NORMAL |
|---|---|---|
| NORMAL GAME | NORMAL ROTATION | RSPNORMAL.SPN |
| NORMAL GAME | BONUS SYMBOL STOPS AT 1ST, 3RD REELS | RSPLONGREACH5.SPN |
| FREE GAME | 1 REEL IS EXPANDED IN THE FIRST SPINNING DURING FG | RSPFG1SPIN_1.SPN |
| FREE GAME | 2 REEL IS EXPANDED IN THE FIRST SPINNING DURING FG | RSPFG1SPIN_2.SPN |
| FREE GAME | 3 REEL IS EXPANDED IN THE FIRST SPINNING DURING FG | RSPFG1SPIN_3.SPN |
| FREE GAME | 4 REEL IS EXPANDED IN THE FIRST SPINNING DURING FG | RSPFG1SPIN_4.SPN |
| FREE GAME | 5 REEL IS EXPANDED IN THE FIRST SPINNING DURING FG | RSPFG1SPIN_5.SPN |
| FREE GAME | 1 REEL IS EXPANDED & BONUS STOPPS AT 1ST,3RD REELS IN THE 1ST SPINNNING DURING FG 1 | RSPFG1SPIN_1_LONG.SPN |
| FREE GAME | 2 REEL IS EXPANDED & BONUS STOPPS AT 1ST,3RD REELS IN THE 1ST SPINNNING DURING FG 1 | RSPFG1SPIN_2_LONG.SPN |
| FREE GAME | 3 REEL IS EXPANDED & BONUS STOPPS AT 1ST,3RD REELS IN THE 1ST SPINNNING DURING FG 1 | RSPFG1SPIN_3_LONG.SPN |
| FREE GAME | 4 REEL IS EXPANDED & BONUS STOPPS AT 1ST,3RD REELS IN THE 1ST SPINNNING DURING FG 1 | RSPFG1SPIN_4_LONG.SPN |
| FREE GAME | 5 REEL IS EXPANDED & BONUS STOPPS AT 1ST,3RD REELS IN THE 1ST SPINNNING DURING FG 1 | RSPFG1SPIN_5_LONG.SPN |
| FREE GAME | 1 REEL IS EXPANDED, WHEN SHIFTING TO 2ND SPINNING, DURING FG | RSPFGOTHER_1.SPN |
| FREE GAME | 2 REEL IS EXPANDED, WHEN SHIFTING TO 2ND SPINNING, DURING FG | RSPFGOTHER_2.SPN |
| FREE GAME | 3 REEL IS EXPANDED, WHEN SHIFTING TO 2ND SPINNING, DURING FG | RSPFGOTHER_3.SPN |
| FREE GAME | 4 REEL IS EXPANDED, WHEN SHIFTING TO 2ND SPINNING, DURING FG | RSPFGOTHER_4.SPN |
| FREE GAME | 5 REEL IS EXPANDED, WHEN SHIFTING TO 2ND SPINNING, DURING FG | RSPFGOTHER_5.SPN |
| FREE GAME | 1 REEL IS EXPANDED & BONUS STOPPS AT 1ST,3RD REELS, WHEN SHIFTING TO 2ND SPINNING, DURING FG | RSPFGOTHER_1_LONG.SPN |
| FREE GAME | 2 REEL IS EXPANDED & BONUS STOPPS AT 1ST,3RD REELS, WHEN SHIFTING TO 2ND SPINNING, DURING FG | RSPFGOTHER_2_LONG.SPN |

FIG.146B

| STATE | CONDITION | NORMAL |
|---|---|---|
| FREE GAME | 3 REEL IS EXPANDED & BONUS STOPPS AT 1ST,3RD REELS, WHEN SHIFTING TO 2ND SPINNING, DURING FG | RSPFGOTHER_3_LONG.SPN |
| FREE GAME | 4 REEL IS EXPANDED & BONUS STOPPS AT 1ST,3RD REELS, WHEN SHIFTING TO 2ND SPINNING, DURING FG | RSPFGOTHER_4_LONG.SPN |
| FREE GAME | 5 REEL IS EXPANDED & BONUS STOPPS AT 1ST,3RD REELS, WHEN SHIFTING TO 2ND SPINNING, DURING FG | RSPFGOTHER_5_LONG.SPN |
| NORMAL GAME | INDICATION OF THE REEL'S SLOW DOWN | RSPOMEN1.SPN |
| NORMAL GAME | INDICATION OF DRAGON APPEARANCE THROUGHOUT THE ENTIRE REEL | RSPOMEN2.SPN |
| NORMAL GAME | THE DRAGON AT THE UPPER PART OF THE SCREEN BLOWS FIRE, BUT NO BALL APPEARS | RSPOMEN3.SPN |
| NORMAL GAME | THE DRAGON AT THE UPPER PART OF THE SCREEN BLOWS FIRE, BUT NO BALL APPEARS | RSPOMEN4.SPN |
| NORMAL GAME | 4-CONSECUTIVE WILD SYMBOL STOP INDICATION | RSPOMEN_1XXXX.SPN |
| NORMAL GAME | 4-CONSECUTIVE WILD SYMBOL STOP INDICATION | RSPOMEN_X2XXX.SPN |
| NORMAL GAME | 4-CONSECUTIVE WILD SYMBOL STOP INDICATION | RSPOMEN_XX3XX.SPN |
| NORMAL GAME | 4-CONSECUTIVE WILD SYMBOL STOP INDICATION | RSPOMEN_XXX4X.SPN |
| NORMAL GAME | 4-CONSECUTIVE WILD SYMBOL STOP INDICATION | RSPOMEN_XXXX4.SPN |
| NORMAL GAME | 4-CONSECUTIVE WILD SYMBOL STOP INDICATION | RSPOMEN_12XXX.SPN |
| NORMAL GAME | 4-CONSECUTIVE WILD SYMBOL STOP INDICATION | RSPOMEN_1X3XX.SPN |
| NORMAL GAME | 4-CONSECUTIVE WILD SYMBOL STOP INDICATION | RSPOMEN_1XX4X.SPN |
| NORMAL GAME | 4-CONSECUTIVE WILD SYMBOL STOP INDICATION | RSPOMEN_1XXX5.SPN |
| NORMAL GAME | 4-CONSECUTIVE WILD SYMBOL STOP INDICATION | RSPOMEN_X23XX.SPN |
| NORMAL GAME | 4-CONSECUTIVE WILD SYMBOL STOP INDICATION | RSPOMEN_X2X4X.SPN |
| NORMAL GAME | 4-CONSECUTIVE WILD SYMBOL STOP INDICATION | RSPOMEN_X2XX5.SPN |

FIG.146C

| STATE | CONDITION | NORMAL |
|---|---|---|
| NORMAL GAME | 4-CONSECUTIVE WILD SYMBOL STOP INDICATION | RSPOMEN_XX34X.SPN |
| NORMAL GAME | 4-CONSECUTIVE WILD SYMBOL STOP INDICATION | RSPOMEN_XX3X5.SPN |
| NORMAL GAME | 4-CONSECUTIVE WILD SYMBOL STOP INDICATION | RSPOMEN_XXX45.SPN |
| NORMAL GAME | 4-CONSECUTIVE WILD SYMBOL STOP INDICATION | RSPOMEN_123XX.SPN |
| NORMAL GAME | 4-CONSECUTIVE WILD SYMBOL STOP INDICATION | RSPOMEN_12X4X.SPN |
| NORMAL GAME | 4-CONSECUTIVE WILD SYMBOL STOP INDICATION | RSPOMEN_12XX5.SPN |
| NORMAL GAME | 4-CONSECUTIVE WILD SYMBOL STOP INDICATION | RSPOMEN_1X34X.SPN |
| NORMAL GAME | 4-CONSECUTIVE WILD SYMBOL STOP INDICATION | RSPOMEN_1X3X5.SPN |
| NORMAL GAME | 4-CONSECUTIVE WILD SYMBOL STOP INDICATION | RSPOMEN_1XX45.SPN |
| NORMAL GAME | 4-CONSECUTIVE WILD SYMBOL STOP INDICATION | RSPOMEN_X234X.SPN |
| NORMAL GAME | 4-CONSECUTIVE WILD SYMBOL STOP INDICATION | RSPOMEN_X2X45.SPN |
| NORMAL GAME | 4-CONSECUTIVE WILD SYMBOL STOP INDICATION | RSPOMEN_XX345.SPN |
| NORMAL GAME | 4-CONSECUTIVE WILD SYMBOL STOP INDICATION | RSPOMEN_1234X.SPN |
| NORMAL GAME | 4-CONSECUTIVE WILD SYMBOL STOP INDICATION | RSPOMEN_123X5.SPN |
| NORMAL GAME | 4-CONSECUTIVE WILD SYMBOL STOP INDICATION | RSPOMEN_12X45.SPN |
| NORMAL GAME | 4-CONSECUTIVE WILD SYMBOL STOP INDICATION | RSPOMEN_1X345.SPN |
| NORMAL GAME | 4-CONSECUTIVE WILD SYMBOL STOP INDICATION | RSPOMEN_X2345.SPN |
| NORMAL GAME | 4-CONSECUTIVE WILD SYMBOL STOP INDICATION | RSPOMEN_12345.SPN |

FIG.147

| | COMMAND NAME | OVERVIEW |
|---|---|---|
| 1 | SHOW MODE | BONUS SYMBOLS ARE ALIGNED AT 1/20 CHANCES |
| 2 | NORMAL MODE | PLAYING WITH ORDINARY ODDS IS POSSIBLE |
| 3 | BONUS PICK | REARRANGEMENT OF THREE BONUS SYMBOLS |
| 4 | RESCUE PRESENT | WHEN REARRANGEMENT OF THREE BONUS SYMBOLS OCCURS, AND THE CREDIT PAYOUT IS SELECTED, RESCUE PRESENT OCCURS (ORDINARY PROCESSING WHEN OTHER BONUSES ARE SELECTED) |
| 5 | SCENARIO 1 FG BIG WIN | WHEN REARRANGEMENT OF THREE BONUS SYMBOLS OCCURS, AND THE FREE GAME IS SELECTED, BIG WIN OF X25 OR MORE HIGHER OCCURS IN THE 1ST ROTATION (ORDINARY PROCESSING WHEN OTHER BONUSES ARE SELECTED) |
| 6 | SCENARIO 2 FG RETRIGGER | WHEN REARRANGEMENT OF THREE BONUS SYMBOLS OCCURS, AND THE FREE GAME IS SELECTED, RETRIGGER OCCURS IN THE 1ST ROTATION (ORDINARY PROCESSING WHEN OTHER BONUSES ARE SELECTED) |
| 7 | JACKPOT | WHEN REARRANGEMENT OF THREE BONUS SYMBOLS OCCURS, AND SHENLONG OBE BONUS IS SELECTED, CHALLENGE FOR JACKPOT OCCURS. (ORDINARY PROCESSING WHEN OTHER BONUSES ARE SELECTED) |
| 8 | BIG WIN ANTICIPATION | RISE OF BIG DRAGON & SLOW-REEL INDICATION OCCURS, AND BIG WIN OCCURS (INDICATION 1) |
| 9 | VERY BIG WIN ANTICIPATION | RISE OF BIG DRAGON & REEL-DRAGON APPEARANCE INDICATION OCCUR, AND BIG WIN OCCURS (INDICATION 2) |
| 10 | WILD STOP ANTICIPATION | WILD STOP INDICATION OCCURS, AND THE 1ST TO 4TH REELS FORMS A 4-CONSECUTIVE WILD SYMBOL (INDICATION 5) |
| 11 | WILD STOP ANTICIPATION NO WIN | WILD STOP INDICATION OCCURS, AND THE 1ST REEL FORMS A 4-CONSECUTIVE WILD SYMBOL. BUT THERE IS NO WININING (INDICATION 5) |
| 12 | BLESS ANTICIPATION | DRAGON BREATH INDICATION OCCURS, AND BONUS STOPS ON THE 1ST AND 3RD REELS & NO BONUS STOPPS ON THE 5TH REEL (INDICATION 3) |
| 13 | FEATURE ANTICIPATION | DRAGON BREATH & BALL-APPEARANCE INDICATION OCCURS, AND THREE BONUS SYMBOLS ARE REARRANGED (INDICATION 4) |

FIG.148A

| | COMMAND NAME | OVERVIEW |
|---|---|---|
| 1 | NORMAL MODE | PLAYING WITH ORDINARY ODDS IS POSSIBLE |
| 2 | BONUS PICK | REARRANGEMENT OF THREE BONUS SYMBOLS |
| 3 | RESCUE PRESENT | |
| 4 | SCENARIO 1 FG BIG WIN | WHEN REARRANGEMENT OF THREE BONUS SYMBOLS OCCURS, AND THE FREE GAME IS SELECTED, BIG WIN OF X25 OR MORE HIGHER OCCURS IN THE 1ST ROTATION (ORDINARY PROCESSING WHEN OTHER BONUSES ARE SELECTED) |
| 5 | SCENARIO 2 FG RETRIGGER | WHEN REARRANGEMENT OF THREE BONUS SYMBOLS OCCURS, AND THE FREE GAME IS SELECTED, RETRIGGER OCCURS IN THE 1ST ROTATION (ORDINARY PROCESSING WHEN OTHER BONUSES ARE SELECTED) |
| 6 | JACKPOT | WHEN REARRANGEMENT OF THREE BONUS SYMBOLS OCCURS, AND SHENLONG OBE BONUS IS SELECTED, CHALLENGE FOR JACKPOT OCCURS. (ORDINARY PROCESSING WHEN OTHER BONUSES ARE SELECTED) |
| 7 | BIG WIN ANTICIPATION | RISE OF BIG DRAGON & SLOW-REEL INDICATION OCCURS, AND BIG WIN OCCURS (INDICATION 1) |
| 8 | VERY BIG WIN ANTICIPATION | RISE OF BIG DRAGON & REEL-DRAGON APPEARANCE INDICATION OCCUR, AND BIG WIN OCCURS (INDICATION 2) |
| 9 | WILD STOP ANTICIPATION | WILD STOP INDICATION OCCURS, AND THE 1ST TO 4TH REELS FORMS A 4-CONSECUTIVE WILD SYMBOL (INDICATION 5) |
| 10 | WILD STOP ANTICIPATION NO WIN | WILD STOP INDICATION OCCURS, AND THE 1ST REEL FORMS A 4-CONSECUTIVE WILD SYMBOL. BUT THERE IS NO WININING (INDICATION 5) |
| 11 | BLESS ANTICIPATION | DRAGON BREATH INDICATION OCCURS, AND BONUS STOPS ON THE 1ST AND 3RD REELS & NO BONUS STOPPS ON THE 5TH REEL (INDICATION 3) |
| 12 | FEATURE ANTICIPATION | DRAGON BREATH & BALL-APPEARANCE INDICATION OCCURS, AND THREE BONUS SYMBOLS ARE REARRANGED (INDICATION 4) |
| 13 | MANUAL RETRIGGER (KEY6) | RETRIGGER OCCURS WHEN "6" ON THE KEY BOARD IS PRESSED DURING FG |

FIG.148B

| | COMMAND NAME | OVERVIEW |
|---|---|---|
| 14 | 5 WILD | REARRANGEMENT OF 5 WILD SYMBOLS |
| 15 | 4 WILD | REARRANGEMENT OF 4 WILD SYMBOLS |
| 16 | 3 WILD | REARRANGEMENT OF 3 WILD SYMBOLS |
| 17 | 5 PIC_A | REARRANGEMENT OF 5 PIC_A SYMBOLS |
| 18 | 4 PIC_A | REARRANGEMENT OF 4 PIC_A SYMBOLS |
| 19 | 3 PIC_A | REARRANGEMENT OF 3 PIC_A SYMBOLS |
| 20 | 5 PIC_B | REARRANGEMENT OF 5 PIC_B SYMBOLS |
| 21 | 4 PIC_B | REARRANGEMENT OF 4 PIC_B SYMBOLS |
| 22 | 3 PIC_B | REARRANGEMENT OF 3 PIC_B SYMBOLS |
| 23 | 5 PIC_C | REARRANGEMENT OF 5 PIC_C SYMBOLS |
| 24 | 4 PIC_C | REARRANGEMENT OF 4 PIC_C SYMBOLS |
| 25 | 3 PIC_C | REARRANGEMENT OF 3 PIC_C SYMBOLS |
| 26 | 5 PIC_D | REARRANGEMENT OF 5 PIC_D SYMBOLS |
| 27 | 4 PIC_D | REARRANGEMENT OF 4 PIC_D SYMBOLS |
| 28 | 3 PIC_D | REARRANGEMENT OF 3 PIC_D SYMBOLS |
| 29 | 5 PIC_E | REARRANGEMENT OF 5 PIC_E SYMBOLS |
| 30 | 4 PIC_E | REARRANGEMENT OF 4 PIC_E SYMBOLS |
| 31 | 3 PIC_E | REARRANGEMENT OF 3 PIC_E SYMBOLS |
| 32 | 5 PIC_F | REARRANGEMENT OF 5 "A" SYMBOLS |
| 33 | 4 PIC_F | REARRANGEMENT OF 4 "A" SYMBOLS |
| 34 | 3 PIC_F | REARRANGEMENT OF 3 "A" SYMBOLS |
| 35 | 5 PIC_G | REARRANGEMENT OF 5 "K" SYMBOLS |
| 36 | 4 PIC_G | REARRANGEMENT OF 4 "K" SYMBOLS |
| 37 | 3 PIC_G | REARRANGEMENT OF 3 "K" SYMBOLS |
| 38 | 5 PIC_H | REARRANGEMENT OF 5 "Q" SYMBOLS |
| 39 | 4 PIC_H | REARRANGEMENT OF 4 "Q" SYMBOLS |
| 40 | 3 PIC_H | REARRANGEMENT OF 3 "Q" SYMBOLS |
| 41 | 5 PIC_I | REARRANGEMENT OF 5 "J" SYMBOLS |
| 42 | 4 PIC_I | REARRANGEMENT OF 4 "J" SYMBOLS |
| 43 | 3 PIC_I | REARRANGEMENT OF 3 "J" SYMBOLS |
| 44 | 5 PIC_J | REARRANGEMENT OF 5 "10" SYMBOLS |
| 45 | 4 PIC_J | REARRANGEMENT OF 4 "10" SYMBOLS |
| 46 | 3 PIC_J | REARRANGEMENT OF 3 "10" SYMBOLS |
| 47 | 5 PIC_K | REARRANGEMENT OF 5 "9" SYMBOLS |
| 48 | 4 PIC_K | REARRANGEMENT OF 4 "9" SYMBOLS |
| 49 | 3 PIC_K | REARRANGEMENT OF 3 "9" SYMBOLS |
| 50 | MANUAL REEL | DESIGNATION OF STOPPED RESULT IS POSSIBLE |

GAMING MACHINE, AND CONTROL METHOD OF SAME

CROSS REFERENCE TO RELATED APPLICATION

The present application claims priority from Japanese application No. 2012-047850, which was filed on Mar. 5, 2012, the entire disclosure of which is herein incorporated by reference.

BACKGROUND OF THE INVENTION

1. Field of the Invention

The present invention relates to a gaming machine configured to rearrange symbols after variably displaying the symbols, and a control method of such a gaming machine.

2. Description of Related Art

An example of a known slot machine is disclosed by U.S. Laid-Open Patent Application No. 2011/0250947. This slot machine operates in such a way that, when a player inserts a coin, bill or the like into an insertion slot of a slot machine and presses a spin button, symbols are scroll-displayed on a symbol display area provided on the front surface of a cabinet, and then the symbols are automatically stopped. Based on the state of the stopped symbols, various prizes such as a bonus are established.

In gaming machines such as the above mentioned traditional slot machine, a plurality of symbols are arranged in matrix in the symbol display area, and a game result is output according to the symbols along an activatable line set in the symbol display area.

However, in recent years, the symbol display area tends to have a large number of activatable lines intricately arranged, overlapping with one another. This makes it difficult for the player to recognize the game result based on the symbols arranged in the symbol display area.

In view of this problem, it is an object of the present invention to provide a gaming machine capable of providing multiple stages of indication effects based on the game results, thereby facilitating the player to know the game result.

SUMMARY OF THE INVENTION

A present invention is a method of controlling a gaming machine including: a symbol display device configured to variably display a plurality of symbols and then rearrange the same; an indication effect device configured to perform an indication effect; and a controller programmed to execute the following steps, the method comprising the steps of: the controller variably displaying the symbols in response to an external input; randomly determining symbols to be rearranged on the symbol display device; determining one game result out of a plurality of game results based on the symbols randomly determined; executing a common indication effect common to all the game results; and executing the individual indication effect according to the one game result, after the common indication effect is executed, while the symbols are variably displayed.

With the above structure, after the common indication effect which is common to all the game results is executed, an individual indication effect according to the game result determined is executed while the symbols are variably displayed. With this, after the common indication effect is executed, it is possible to branch the indication effect into different individual indication effects corresponding to different game results respectively. As the result, the player is able to easily understand the game result by looking at the individual indication effect according to the game result. Further, the indication effect is branched in multiple stages. Thus, information for specifying the game result is provided in multiple stages to the player. Further, the common indication effect corresponds to a plurality of game results. It is therefore possible to reduce the data resource.

Further, another aspect of the present invention is a gaming machine including: a symbol display device configured to display a game result out of a plurality of game results by variably displaying a plurality of symbols and rearranging them thereafter; an indication data storage device storing sets of individual indication data associated with the game results, and a set of common indication data associated with the sets of individual indication data; an indication effect device configured to execute an indication effect based on the common indication data and any one of the sets of individual indication data; and a controller configured to start a game, the controller being programmed to execute the following processes.

(A) randomly determining symbols to be rearranged on the symbol display device;

(B) determining at least one of the game results, based on the symbols determined in step (A);

(C) when the at least one of the game results determined in step (B) is a game result associated with any of the sets of individual indication data, determining whether to execute an individual indication effect based on that set of the individual indication data; and (D) when it is determined in step (C) that the individual indication effect is to be executed based on that set of individual indication data, executing the individual indication effect based on that piece of individual indication data, after executing the common indication effect based on the common indication data associated with that set of individual indication data, while the symbols are variably displayed on the symbol display device.

With the above structure, each game result is associated with a set of individual indication data, and a plurality of sets of individual indication data are associated with a set of common indication data. When executing an individual indication effect based on a set of individual indication data, a common indication effect is first executed based on the common indication data associated with the set of individual indication data. This way, after the common indication effect is executed based on the common indication data, it is possible to branch the indication effect into different individual indication effects based on the sets of individual indication data corresponding to different game results respectively. As the result, the player is able to easily understand the game result by looking at the individual indication effect according to the game result. Further, the indication effect is branched in multiple stages. Thus, information for specifying the game result is provided in multiple stages to the player. Further, the common indication effect corresponds to a plurality of game results. It is therefore possible to reduce the data resource.

Further, yet another aspect of the present invention is a gaming machine including: a symbol display device having activatable lines, which is configured to display a game result out of a plurality of game results by variably displaying a plurality of symbols and rearranging them in matrix thereafter; an indication data storage device storing sets of individual indication data associated with the game results, and a set of common indication data associated with the sets of individual indication data; an indication effect device configured to execute an indication effect based on the common indication data and any one of the sets of individual indication data; and a controller configured to start the game, and when a game result is such that a predetermined number or more of identical symbols are rearranged on any of the activatable lines, awarding a payout according to the symbols, and when the game result is such that a predetermined number or more of special symbols are rearranged on an activatable line, awarding a bonus game. the controller being programmed to execute the following processes.

(A) randomly determining symbols to be rearranged on the symbol display device;

(B) determining at least one of the game results, based on the symbols determined in step (A);

(C) when the at least one of the game results determined in step (B) is a game result associated with any of the sets of individual indication data, determining whether to execute an individual indication effect based on that set of the individual indication data;

(D) when it is determined in step (C) that the individual indication effect is to be executed based on that set of individual indication data, executing the individual indication effect based on that piece of individual indication data, after executing the common indication effect based on the common indication data associated with that set of individual indication data, while the symbols are variably displayed on the symbol display device; and (E) when it is determined in step (C) that the individual indication effect based on that set of individual indication data corresponding to the at least one of game results determined in step (B) is not executed, determining to execute at a predetermined probability an individual indication effect based on the common indication data associated with that set of individual indication data and another set of individual indication data associated with the common indication data, while the symbols are variably displayed on the symbol display device.

With the above structure, each game result is associated with a set of individual indication data, and a plurality of sets of individual indication data are associated with a set of common indication data. When executing an individual indication effect based on a set of individual indication data, a common indication effect is first executed based on the common indication data associated with the set of individual indication data. Further, when the individual indication effect based on the set of individual indication data is not executed, another individual indication effect is executed at a predetermined probability.

This way, after the common indication effect is executed based on the common indication data, it is possible to branch the indication effect into different individual indication effects based on the sets of individual indication data corresponding to different game results respectively. As the result, the player is able to easily understand the game result by looking at the individual indication effect according to the game result. Further, the indication effect is branched in multiple stages. Thus, information for specifying the game result is provided in multiple stages to the player. Further, the common indication effect corresponds to a plurality of game results. It is therefore possible to reduce the data resource. When the individual indication effect based on a set of individual indication data is not executed, another individual indication effect is executed at a predetermined probability. This improves an entertainment characteristic.

Further, in the gaming machine of the present invention, the pieces of individual indication data stored in the indication data storage device, which is associated with the piece of common indication data include: first individual indication data associated with a game result such that the predetermined number or more of the special symbols are rearranged on the activated line, and second individual indication data associated with a game result such that (the predetermined number—1) of special symbols are rearranged on the activated line.

Further, in the gaming machine of the present invention, the pieces of individual indication data stored in the indication data storage device, which is associated with the piece of common indication data include: third individual indication data associated with a game result such that a scaling factor of the payout is a first predetermined number or more; and fourth individual indication data associated with a game result such that the scaling factor of payout is at least a second predetermined number which is less than the first predetermined number.

The present invention provides a gaming machine capable facilitating the player to know the game result.

BRIEF DESCRIPTION OF THE DRAWINGS

FIG. 4 is an explanatory diagram of an indication effect table.

FIG. 11 is an explanatory diagram of a classification table.

FIG. 12 is an explanatory diagram of an effect random determination table.

FIG. 13 is an explanatory diagram showing reliability of a feature-in.

FIG. 14 is an explanatory diagram showing frequency of the indication effects.

FIG. 15 is an explanatory diagram showing the frequency satisfying condition for random determination.

FIG. 23 is an explanatory diagram showing the reel position numbers of pseudo reels.

FIG. 24 is an explanatory diagram showing reel position numbers corresponding to the activatable lines.

FIG. 94 is an explanatory diagram of the game screen.

FIG. 98 shows a table indicating relations between remaining count numbers and seconds.

FIG. 99 shows a table indicating relations between odds and seconds.

FIG. 102 is an explanatory diagram showing the on-state of the language switch touch button.

FIG. 103 is an explanatory diagram of the language switch touch button.

FIG. 106 is an explanatory diagram of the help button.

FIG. 111 is an explanatory diagram of an audit screen.

FIG. 113 is a front view of the control panel.

FIG. 114 is a front view of the control panel.

FIG. 115 is a front view of the control panel.

FIG. 116 is a front view of the control panel.

FIG. 117 is a front view of the control panel.

FIG. 118 is an explanatory diagram showing an operation status of the control panel.

FIG. 119 is an explanatory diagram showing an operation status of the control panel.

FIG. 120 is an explanatory diagram showing an operation status of the control panel.

FIG. 121 is an explanatory diagram showing an operation status of the control panel.

FIG. 122 is an explanatory diagram showing an operation status of the control panel.

FIG. 123 is an explanatory diagram showing an operation status of the control panel.

FIG. 124 is an explanatory diagram showing an operation status of the control panel.

Figure 125:
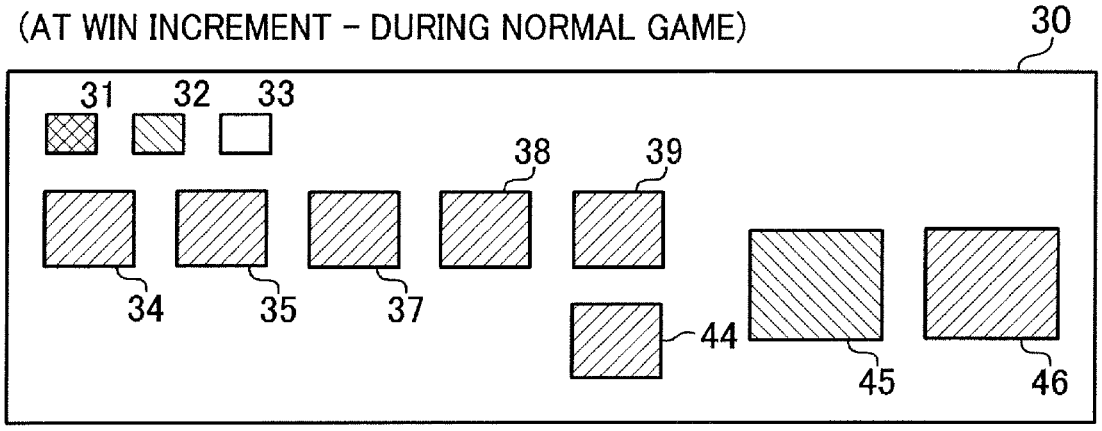

FIG. 125 is an explanatory diagram showing an operation status of the control panel.

Figure 126:
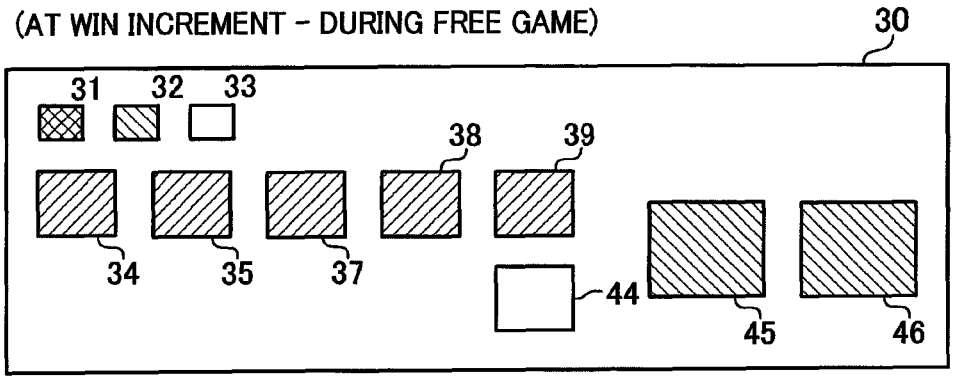

FIG. 126 is an explanatory diagram showing an operation status of the control panel.

Figure 127:
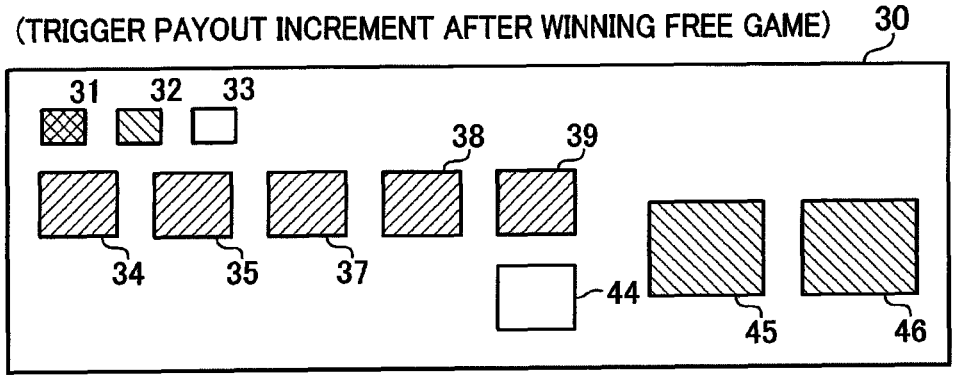

FIG. 127 is an explanatory diagram showing an operation status of the control panel.

Figure 128:
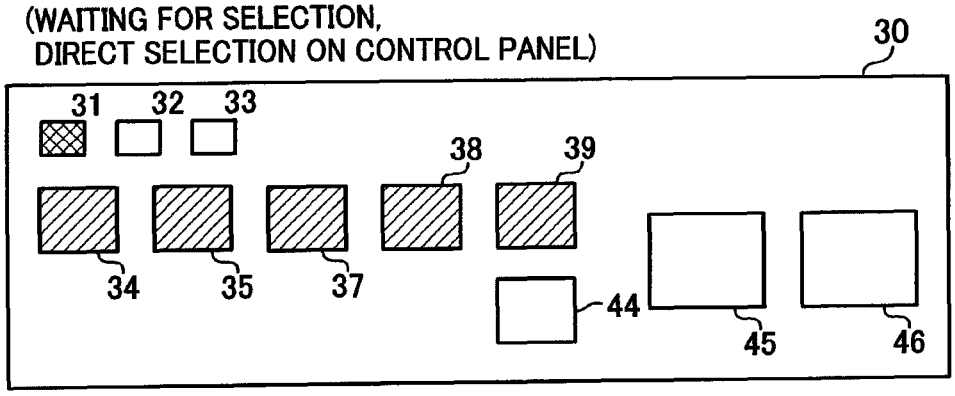

FIG. 128 is an explanatory diagram showing an operation status of the control panel.

Figure 129:
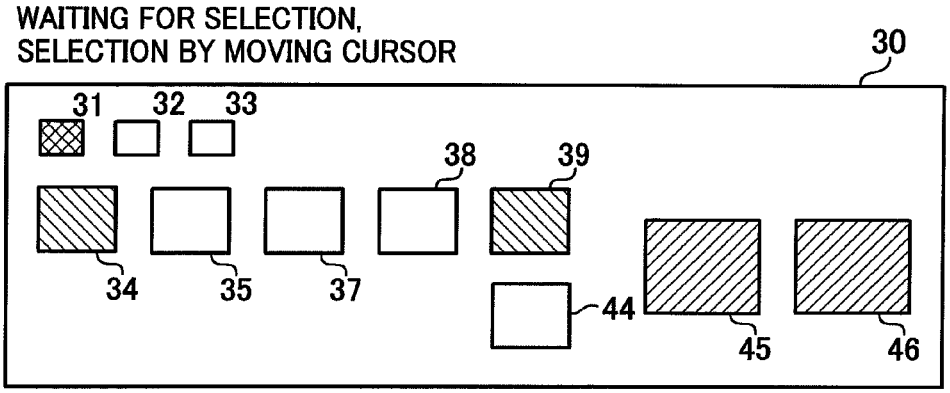

FIG. 129 is an explanatory diagram showing an operation status of the control panel.

Figure 130:
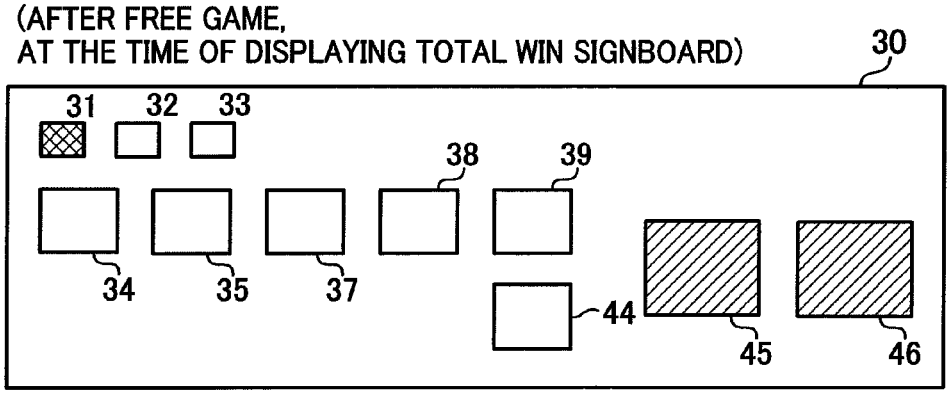

FIG. 130 is an explanatory diagram showing an operation status of the control panel.

Figure 131:
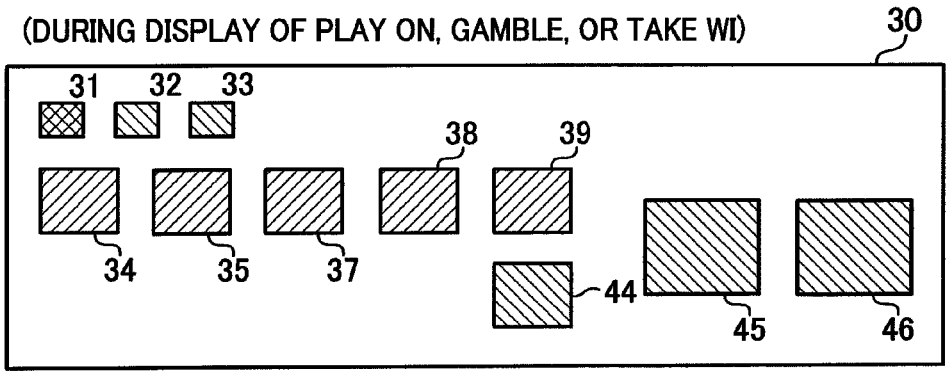

FIG. 131 is an explanatory diagram showing an operation status of the control panel.

Figure 132:
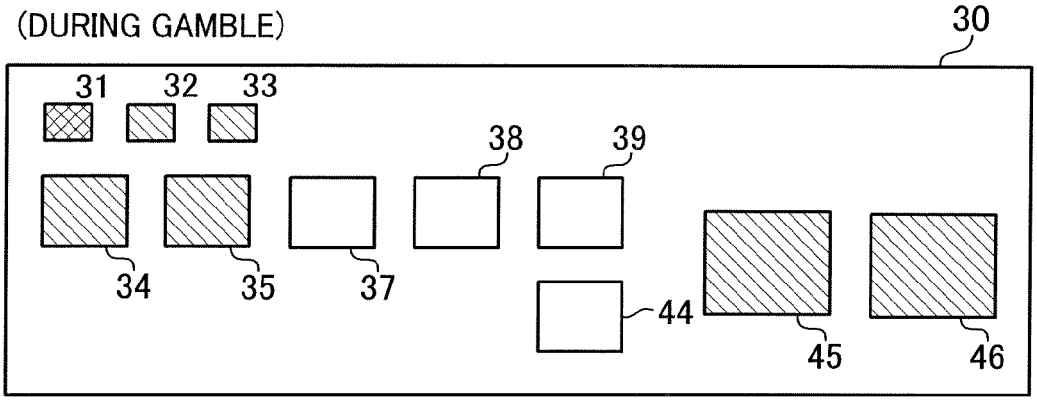

FIG. 132 is an explanatory diagram showing an operation status of the control panel.

Figure 133:
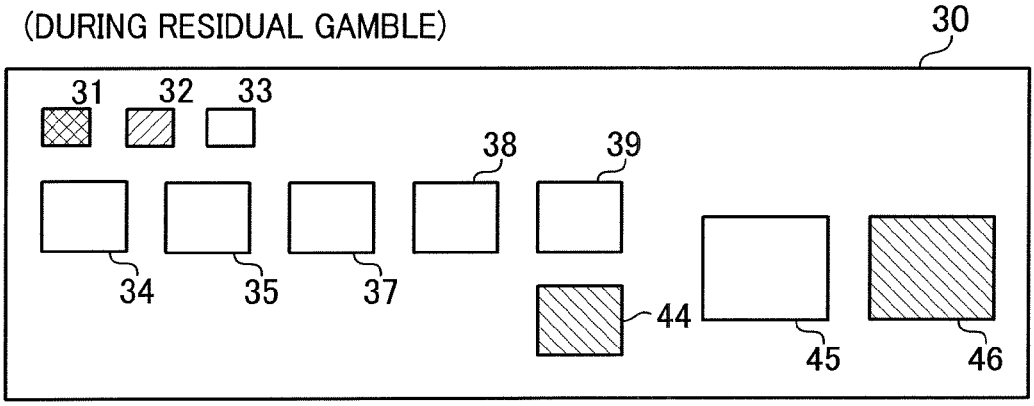

FIG. 133 is an explanatory diagram showing an operation status of the control panel.

Figure 134:
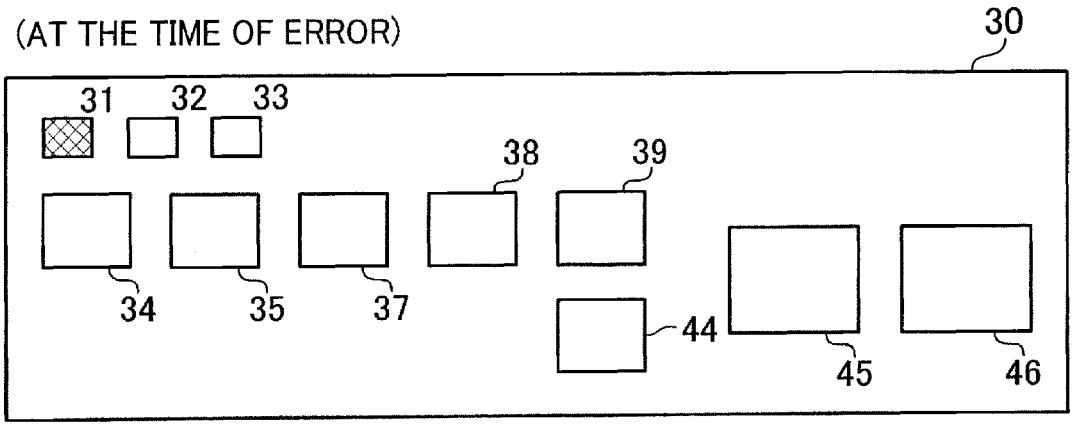

FIG. 134 is an explanatory diagram showing an operation status of the control panel.

Figure 135:
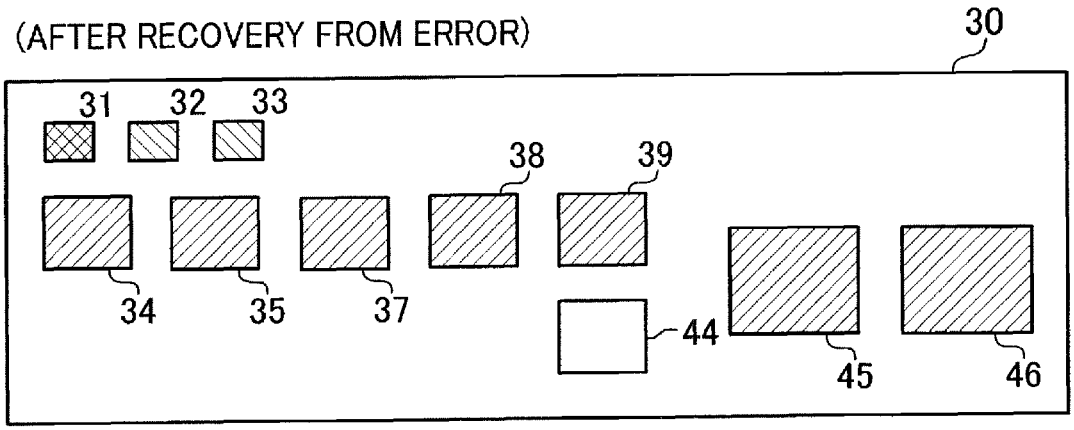

FIG. 135 is an explanatory diagram showing an operation status of the control panel.

Figure 136:
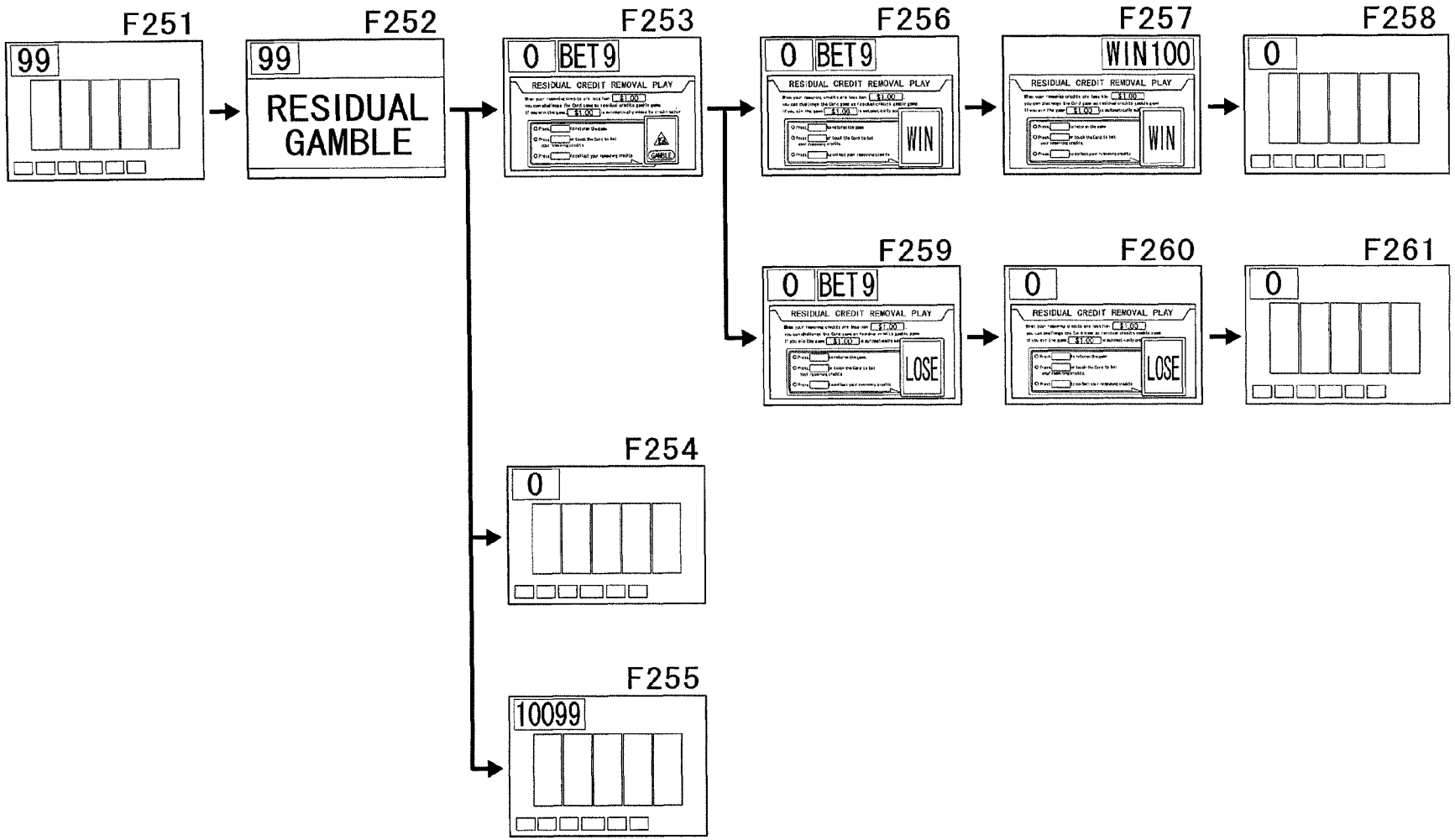

FIG. 136 is a flowchart of a gamble game.

Figure 137:
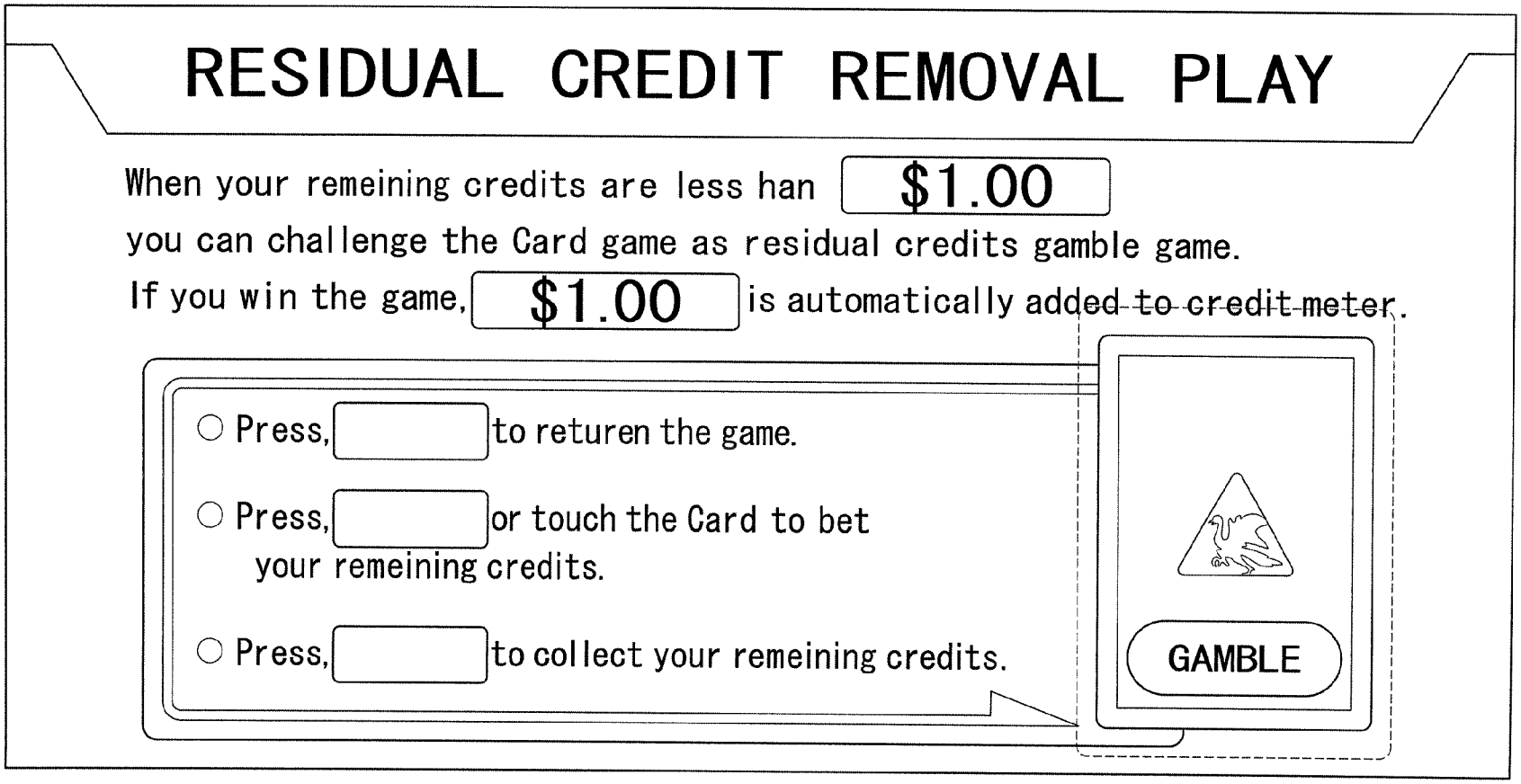

FIG. 137 is an explanatory diagram of a screen in the gamble game.

Figure 138:
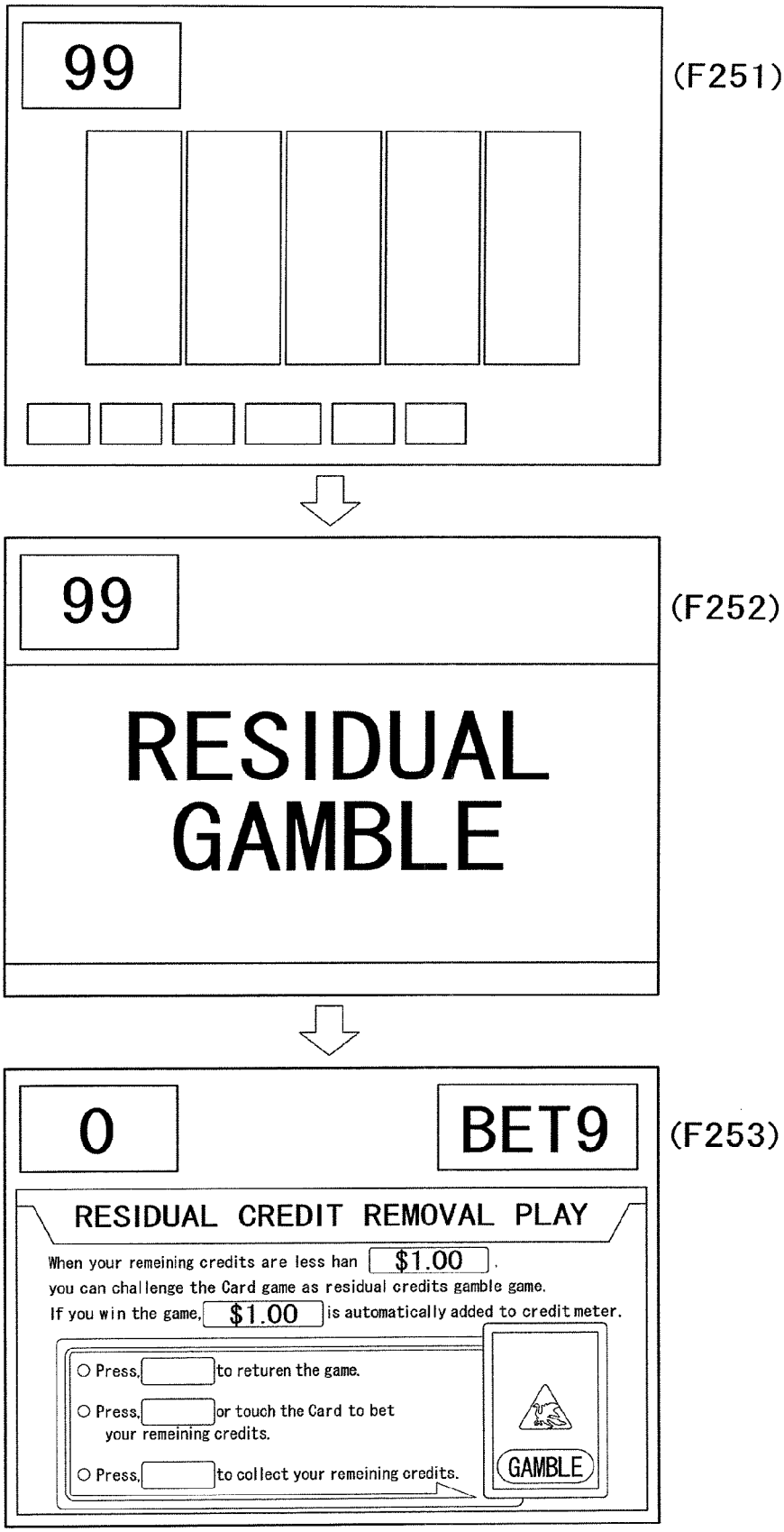

FIG. 138 is an explanatory diagram showing an operation process of the gamble game.

Figure 139:
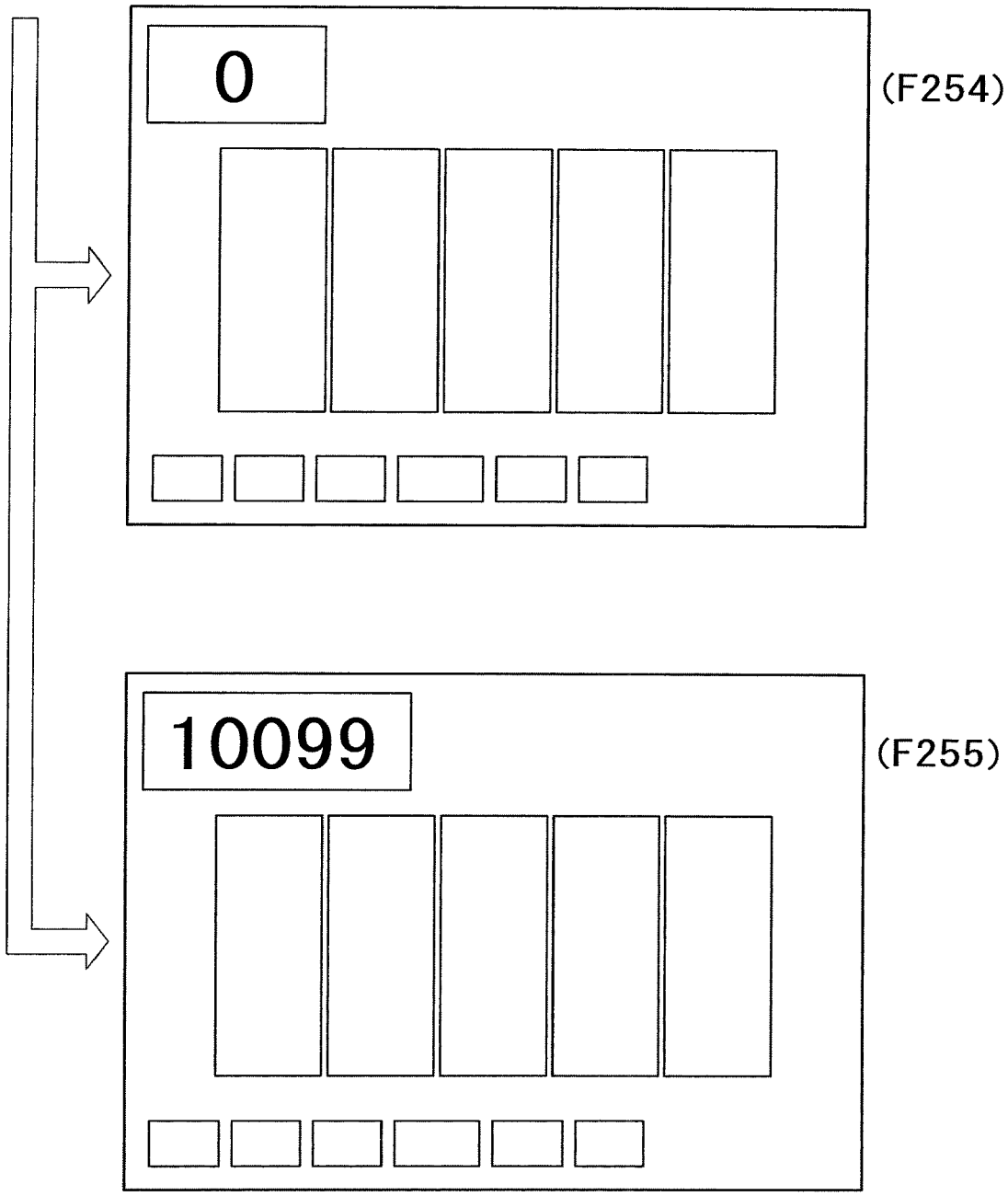

FIG. 139 is an explanatory diagram showing an operation process of the gamble game.

Figure 140:
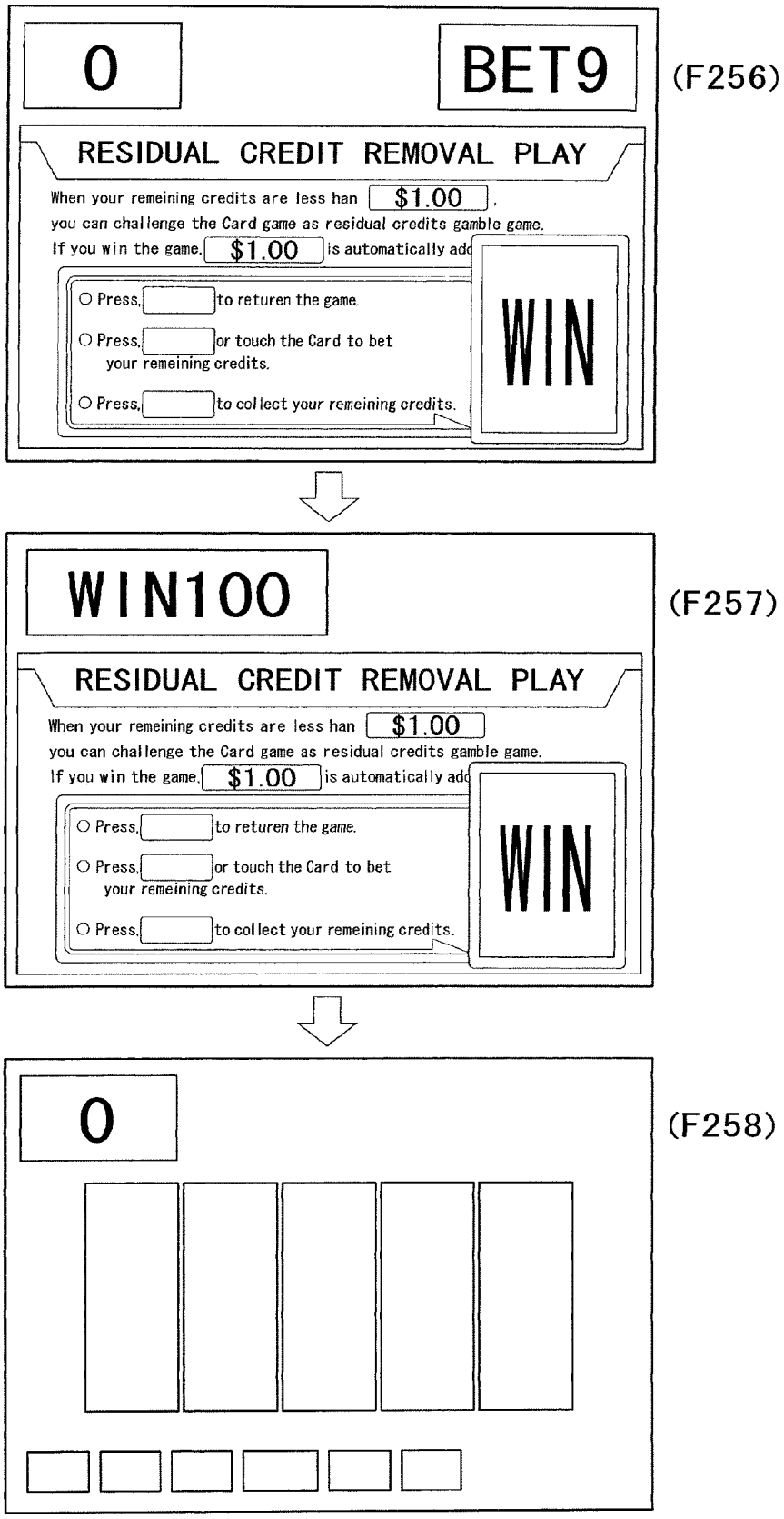

FIG. 140 is an explanatory diagram showing an operation process of the gamble game.

Figure 141:
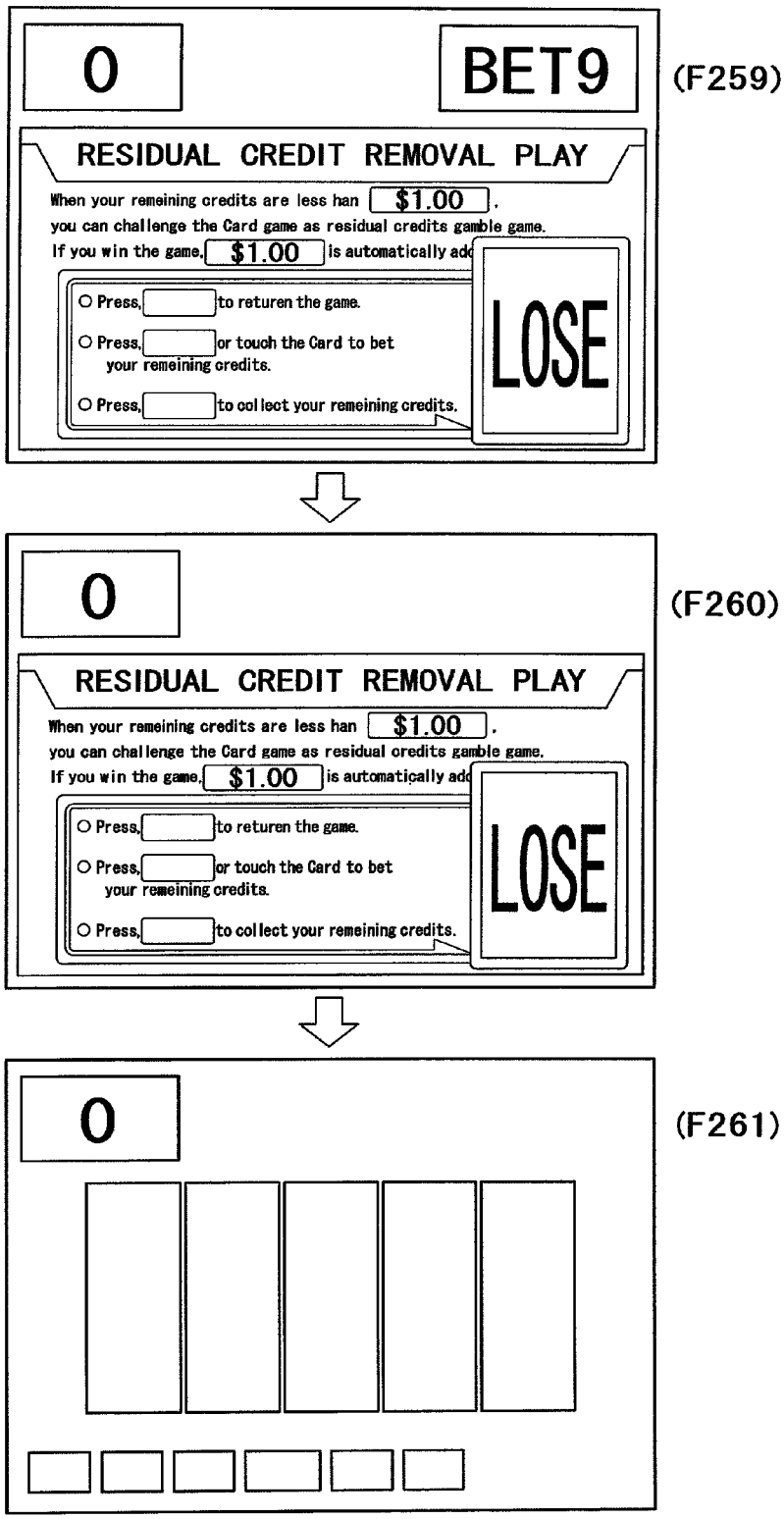

FIG. 141 is an explanatory diagram showing an operation process of the gamble game.

FIG. 142 is an explanatory diagram showing a display in a progressive meter.

FIG. 143A is an explanatory diagram of an LED table.

FIG. 143B is an explanatory diagram of an LED table.

FIG. 144A is an explanatory diagram of the LED table.

FIG. 144B is an explanatory diagram of the LED table.

FIG. 145A is an explanatory diagram of the LED table.

FIG. 145B is an explanatory diagram of the LED table.

FIG. 146A is an explanatory diagram showing variable-display table.

FIG. 146B is an explanatory diagram showing variable-display table.

FIG. 146C is an explanatory diagram showing variable-display table.

FIG. 147 is an explanatory diagram of presentation commands.

FIG. 148A an explanatory diagram of debug commands.

FIG. 148B an explanatory diagram of debug commands.

DESCRIPTION OF THE PREFERRED EMBODIMENTS

The following describes a gaming machine of the present invention with reference to attached drawings.

(Outline of Gaming Machine)

Figure 1:
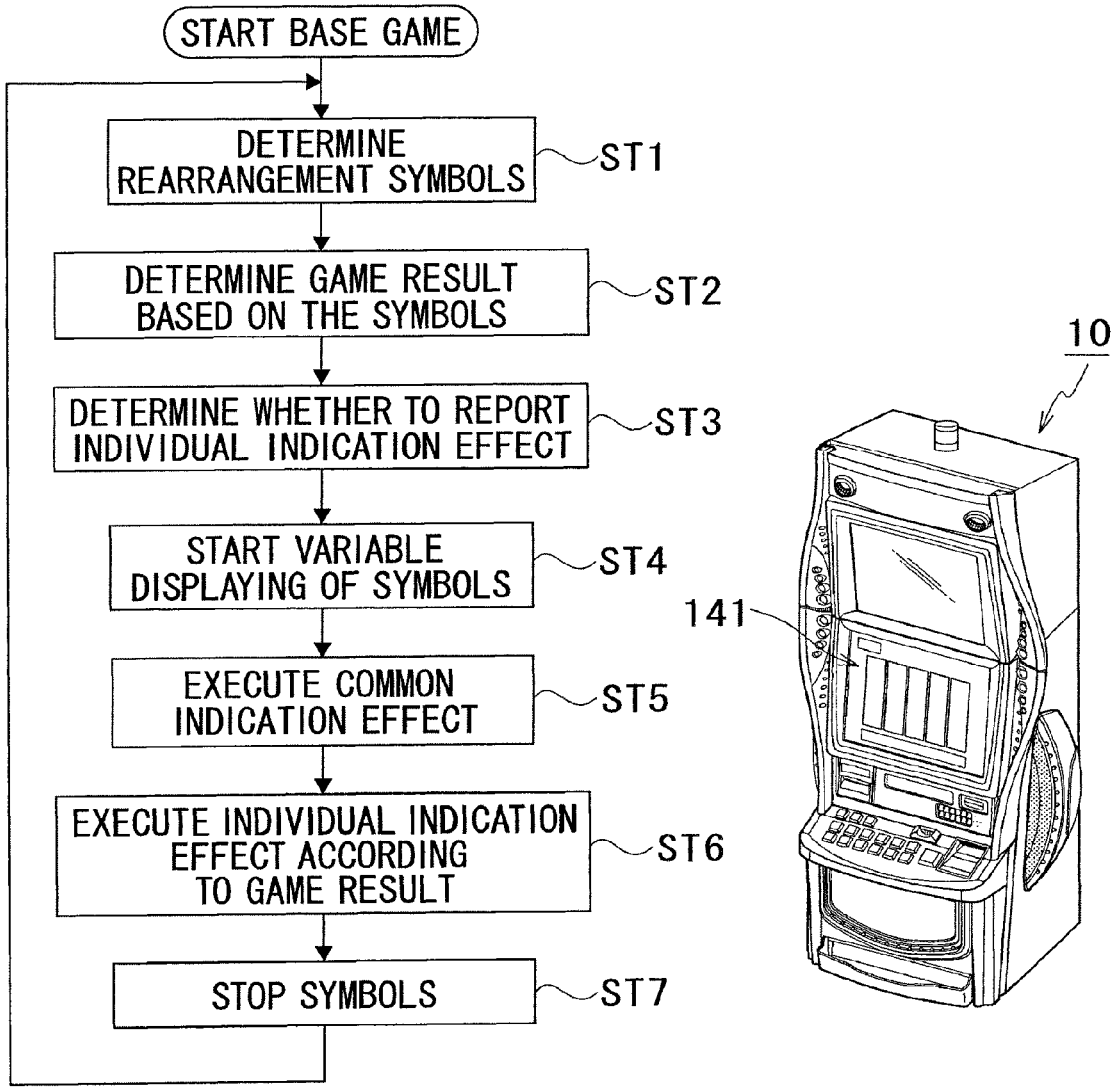
FIG. 1 is an explanatory diagram showing an operation status of the gaming machine.

As shown in FIG. 1, the gaming machine is structured so that, within a period of variably displaying a plurality of symbols, a common indication effect is executed, and then the indication effect branches to an individual indication effect out of a plurality of individual indication effects according to a game result.

Note that the gaming machine 300 is structured so as to enable participation of multiple players, and includes a plurality of slot machines 10 serving as gaming terminals. The slot machines 10 are connected to a center controller 200 (FIG. 2, FIG. 3) and a capable of conduct data communications with the center controller 200. The gaming machine 300 allows a base game such as a slot game to be run individually in each of the slot machines 10, and is capable of synchronizing the slot machines 10 with one another and running a common game on a common display device 700 or the like. Note that the connection between the slot machine 10 and the center controller 200 may be a wireless connection, a wired connection, or any combination of the wired and wireless connections.

Further, the unit of a bet amount may be money circulated in a country or an area such as Dollars, Yen, Euro, or game points used only in a hall having the gaming machine 300 or in a particular industry. Each of the slot machines is structured so that a game point is stored in a memory when a game medium is entered, and a game is run by using the game points stored. Thus, for example, betting may be use of game points, a bet amount may the number of game points used for running a game, and a payout may be a certain number of game points awarded based on the game result.

Figure 2:
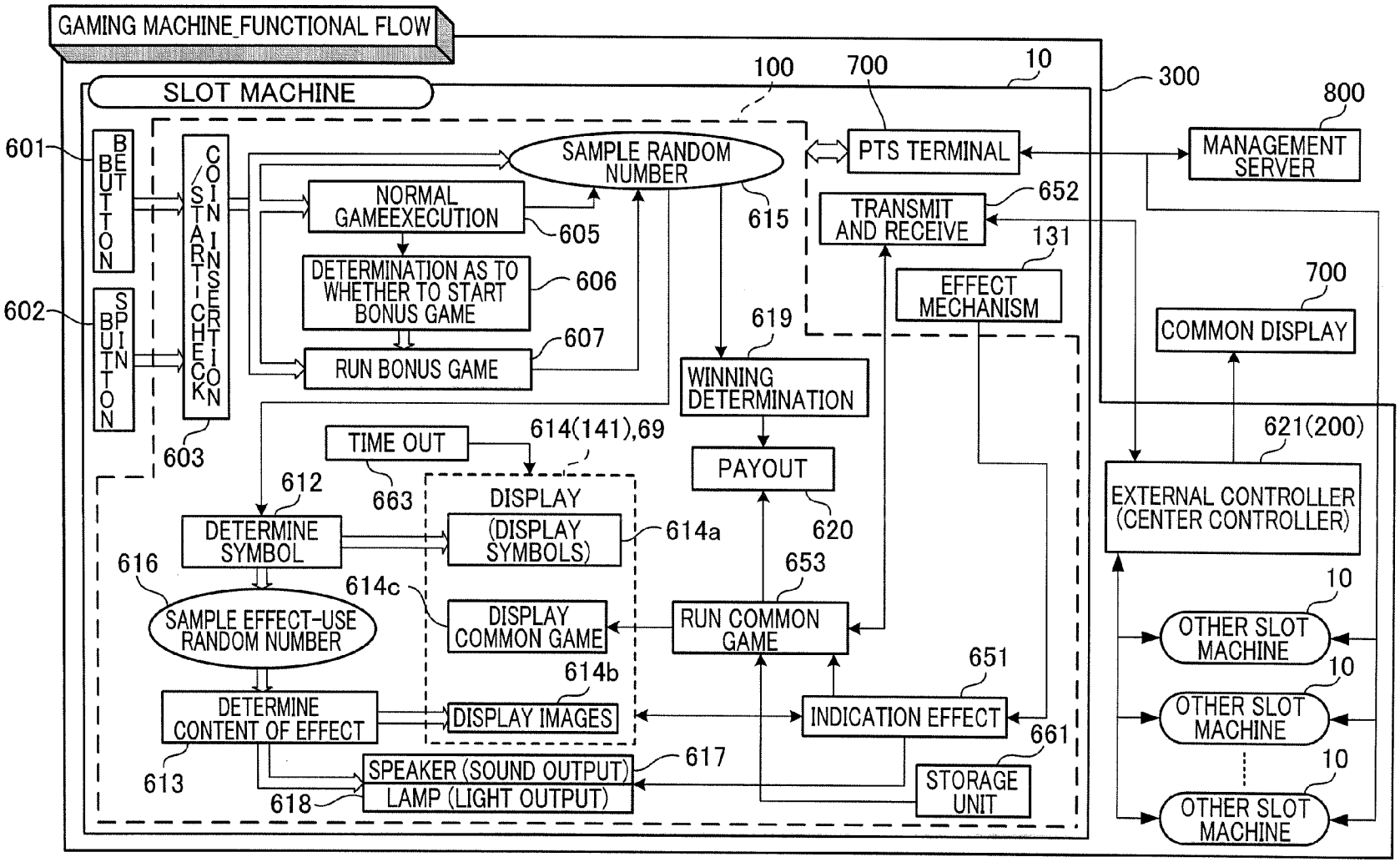
FIG. 2 shows a function flow of the gaming machine.

As shown in FIG. 2, the gaming machine 300 includes as a first structure: a lower image display panel 141 (symbol display device) configured to variably display and rearrange a plurality of symbols; and a controller programmed to execute processes described below.

Specifically, a terminal controller of each slot machine 10 executes the following steps. Namely, the slot machine 10 executes steps of: variably displaying a plurality of symbols in response to an external input; randomly determining symbols to be rearranged on a lower image display panel 141; determining a game result based on the symbols randomly determined; executing a common indication effect which is common to a plurality of game results; and after executing the common indication effect, executing an individual indication effect according to the game result determined while the symbols are variably displayed. The symbols to be rearranged which are randomly determined are hereinafter also referred to as resulting symbols. Further, variably displaying of the symbols is also referred to as "spin". Further, rearrangement of the symbols is also phrased as "the symbols are stopped".

Note that "game result with an individual indication effect" indicates an arrangement (combination) of symbols, a winning combination, symbols related to a winning combination, an amount of payout to be awarded, and the scaling factor of the payout, and the like. For example, the individual indication effect may be executed when the scaling factor of the payout to be awarded is a predetermined value or more. Further, the individual indication effect may be executed when the game result is such that running of a bonus game is determined. When arrangement of a predetermined number of special symbols (trigger symbols; also referred to as trigger A) on an activatable line (also referred to as a payline) is the bonus game running condition, the individual indication effect may be executed when the number of special symbols rearranged on the activatable line is less than the predetermined number by one. The individual indication effect may include "no-effect" such that no individual indication effect is executed after the common indication effect.

As described, after the common indication effect which is common to all the game results is executed, an individual indication effect according to the game result determined is executed while the symbols are variably displayed. This way, after the common indication effect is executed, it is possible to branch the indication effect into different individual indication effects corresponding to different game results respectively. As the result, the player is able to easily understand the game result by looking at the individual indication effect according to the game result. Further, the indication effect is branched in multiple stages. Thus, information for specifying the game result is provided in multiple stages to the player. Further, the common indication effect corresponds to a plurality of game results, which contributes to reduction of the data resource.

(Outline of Gaming Machine)

The "slot machines 10" are a type of gaming terminals in the gaming machine 300. Although the present embodiment deals with a case where the gaming terminals are the slot machines 10, the gaming terminals are not limited to the slot machines and may be any given gaming terminals provided that the gaming terminals have a terminal controller which enables the gaming terminals to independently run a base game.

The "base game" in the present embodiment is run in the slot machines 10. The base game is a slot game which rearranges a plurality of symbols 501. Note that the base game is not limited to the slot game, as long as the base game is a game runnable in the gaming terminals such as the slot machines 10, independently of one another. That is, the concept of the base game is opposite to that of the common game. For example, a later-described normal game and a bonus game are classified as the base game.

Rearrangement of the symbols in the slot game takes place in the lower image display panel 141. The slot game may include a normal game, a bonus game, a rescue process, and the like. The normal game executes processes of rearranging the symbols in the lower image display panel 141 on condition that a game value is bet, and awarding a normal payout according to the symbols rearranged. The bonus game is run when the symbols rearranged in the normal game meets a predetermined condition.

The "bonus game" is synonym of a feature game. The bonus game may be any type of game provided that the bonus game provides more advantageous gaming conditions than normal game. Further, it is possible to combine another bonus game as long as the gaming conditions are more advantageous to the player than the normal game. For example, the bonus game may realize, singly or in combination, a state where greater game values than that obtained in the normal game are obtainable; a state where winning of a game value occurs at a higher probability than the normal game; a state where the amount of game value consumed is less than that consumed in the normal game, or the like.

For example, the bonus game may be a game awarding a fixed payout, or a free game which requires betting of a less game value (encompassing 0) than that required in the normal game. Further, the bonus game may adopt a symbol random determination table with a higher payout rate than that of the normal game. Further, the bonus game may be a pickup bonus which provides player-selectable multiple choices. In this case, the choices may include a fixed payout, a free game, or the like. Further, the pickup bonus may include as its choices a trigger for another pickup bonus which enables the player to make a selection from multiple choices. Note that, the choices of the pickup bonus are preferably arranged randomly. Further, the choices of the pickup bonus are displayed so that the associated contents of the choices are not visible before the selection by the player. The bonus game of the present embodiment is detailed later. The rescue process is executed when a rescue start condition is met.

The "game value" means coins, bills, or equivalent electrically valuable information. The game value in the present invention is not particularly limited. For example, the game value may be game media such as medals, tokens, electronic money, tickets, or the like. The tickets are not particularly limited. For example, the tickets may be tickets each with a later-described barcode, or the like. Further, as mentioned above, the "game value" may be an electronic game points which are equivalent to the game media.

The "free game" is a game runnable with betting of a less game value than that required in the normal game. The expression "runnable with betting of a less game value"

encompasses betting of "0". Therefore, the "free game" may be a game which is runnable without betting of a game value, and which awards a certain amount of game value according to the symbols 501 rearranged. In other words, the "free game" may be a game started without consumption of the game value. On the other hand, the "normal game" is a game runnable on condition of betting of a game value, which awards a certain amount of game value according to the symbols 501 rearranged. In other words, the "normal game" is a game started with consumption of the game value.

The wording "rearrangement" means an arrangement of the symbols 501 after dismissing the previous arrangement of the symbols 501. The wording "arrangement" means the symbols 501 made visible to the player.

The "normal payout according to the symbols 501 rearranged" means a normal payout corresponding to a winning combination of the symbols rearranged. Further, the "bonus payout according to the symbols 501 rearranged" is a bonus payout corresponding to a winning combination of the symbols rearranged. Note that the "winning combination" is a combination of symbols that leads to a prize. The winning combination is detailed later.

The "state with a higher payout rate than that of the normal game" means: running of a free game, running of a game using a symbol table in which wild symbols 503*a* and trigger symbols 503*b* are increased or substituted for other symbols, or the like. The "rescue start condition" is, for example, a state in which the normal game is repeated an excessive number of times, i.e., the normal game is repeated a predetermined number of times or more; or a state in which the total amount of payout won is excessively small, i.e., the normal payouts and the bonus payouts won by a single player throughout a predetermined number or more of the normal games repetitively played totals a predetermined value or less. The "rescue process" is a process for rescuing the player. For example, the rescue process may be running of a free game, running of a game using a symbol table in which the wild symbols 503*a* and the trigger symbols 503*b* are increased or substituted for other symbols; awarding an insurance payout, or the like.

(Outline of Gaming Machine: Another Structure)

As shown in FIG. 1, a second structure of the gaming machine 300 includes: a symbol display device configured to display a game result out of a plurality of game results by variably displaying a plurality of symbols and rearranging them thereafter; an indication data storage device configured to store a plurality of sets of individual indication data each associated with a game result type, and common indication data associated with the sets of individual indication data; an indication effect device configured to execute an indication effect based on the individual indication data and the common indication data; and a terminal controller configured to start a game. The terminal controller executes the following steps.

Step (A) of randomly determining symbols to be rearranged on the symbol display device. Step (B) of determining a game result based on the symbols determined in step (A). Step (C) of, when the game result determined in step (B) is a game result associated with a set of individual indication data, determining whether to execute an individual indication effect based on that set of individual indication data. Step (D) of, when it is determined in step (C) that the individual indication effect based on the set of individual indication data is to be executed, executing the individual indication effect based on that individual indication data, after executing the common indication effect based on the common indication data associated with that set of individual indication data, while the symbols are variably displayed on the symbol display device. Examples of the indication effect device include: a lower image display panel 141, an upper image display panel 142, an effect mechanism 131, or the like.

The "common indication data associated with the sets of individual indication data" means an individual indication effect based on any of the sets of the individual indication data associated with the common indication data is executable after executing the common indication effect based on that common indication data. That is, the expression can be paraphrased as "common indication data corresponding to the sets of individual indication data", or "common indication data associated with the sets of individual indication data".

The gaming machine 300 may have a third structure in which the symbol display device of the second structure has an activatable line, and the symbols are rearranged in matrix after variably displaying the symbols. In the third structure, the terminal controller awards a payout according to the symbols, when the game result is such that a predetermined number or more of the same kind of symbols are rearranged on the activatable line, and yields a winning of a bonus game when the game result is such that a predetermined number or more of the special symbols are rearranged on the activatable line. Further, in addition to the second structure, the terminal controller executes step (E) of, when it is determined in step (C) that the individual indication effect based on that set of individual indication data corresponding to the game result determined in step (B) is not executed, determining to execute at a predetermined probability an individual indication effect based on the common indication data associated with that set of individual indication data and another set of individual indication data associated with the common indication data, while the symbols are variably displayed on the symbol display device.

Further, in addition to the third structure, the indication data storage device may be structured to store first individual indication data associated with a game result in which the a predetermined number or more of special symbols are rearranged on an activatable line and second individual indication data associated with a game result in which the number of special symbols rearranged on an activatable line is less than the predetermined number by one, the first individual indication data and the second individual indication data belonging to a single set of common indication data.

Further, in addition to the third structure, the indication data storage device may be structured to store third individual indication data associated with a game result in which the scaling factor of payout is a first predetermined value or more and fourth individual indication data associated with a game result whose scaling factor of payout is at least second predetermined number which is smaller than the first predetermined value, the third individual indication data and the fourth individual indication data belonging to a single set of common indication data.

As described, each game result is associated with a set of individual indication data, and a plurality of sets of individual indication data are associated with a set of common indication data. When executing an individual indication effect based on a set of individual indication data, a common indication effect is first executed based on the common indication data associated with the set of individual indication data. Further, when the individual indication effect based on the set of individual indication data is not executed, another individual indication effect is executed at a predetermined probability.

This way, after the common indication effect is executed based on the common indication data, it is possible to branch the indication effect into different individual indication effects based on the sets of individual indication data corresponding to different game results respectively. As the result, the player is able to easily understand the game result by looking at the individual indication effect according to the game result. Further, the indication effect is branched in multiple stages. Thus, information for specifying the game result is provided in multiple stages to the player. Further, the common indication effect corresponds to a plurality of game results. It is therefore possible to reduce the data resource. When the individual indication effect based on a set of individual indication data is not executed, another individual indication effect is executed at a predetermined probability. This improves an entertainment characteristic.

(Outline of Gaming Machine: Game Control Operation)

The gaming machine 300 having the above described structure is such that, within a period of variably displaying a plurality of symbols, a common indication effect is executed, and then the indication effect branches to an individual indication effect out of a plurality of individual indication effects according to a game result. In other words, the gaming machine adopts a game control method in which, after the common indication effect is given, the indication effect is branched and an individual indication effect out of the individual indication effects is given according to a game result while the symbols are variably displayed.

Specifically, the gaming method and the game control method of the gaming machine 300 includes the steps of: variably displaying a plurality of symbols in response to an external input; randomly determining symbols to be rearranged on the lower image display panel 141; determining a game result based on the symbols randomly determined; executing a common indication effect which is common to a plurality of game results; and after the common indication effect executed, executing an individual indication effect according to the game result determined, while the symbols are variably displayed.

More specific control operation of the indication effect in the base game of the slot machine 10 (gaming machine 300) is described with reference to the flowchart of FIG. 1.

In the slot machine 10 has the lower image display panel 141 serving as a symbol display device, in which an activatable line is set. Specifically, in the lower image display panel 141 is displayed a reel display area 150 including a plurality of pseudo reels (pseudo reels 151, 152, 153, 154, 155) (see FIG. 19). In each of the pseudo reels 151 to 155 are rearranged a plurality of symbols 501 after variably displaying of the same. Each of the pseudo reels 151 to 155 has four symbols 501 rearranged in up/down directions. That is, each of the pseudo reels 151 to 155 has symbols 501 in matrix of five columns and four rows (20 in total). The activatable line is set so that one of the symbols 501 in each of the pseudo reels 151 to 155 is selected (see FIG. 22). In the present embodiment, a payout according to the symbols is awarded when the game result is such that a predetermined number (three in the present embodiment) or more of the same kind of symbols are rearranged on the activatable line. Further, when the game result is such that a predetermined number or more of the special symbols are rearranged on the activatable line, the bonus game is won. Note that, in the present embodiment, the bonus symbol (trigger symbol 503*b*) only appears in the pseudo reel 151, 153, or 155. The bonus game starting condition is not limited to rearrangement of the bonus symbols on the activatable line, and the bonus game starting condition may be appearance of a predetermined number or more of the bonus symbols in the reel display area 150.

As shown in the flowchart of FIG. 1, in the base game, symbols to be rearranged on the pseudo reels 151 to 155 are first randomly determined (ST1). Then, the game result is determined based on the symbols determined (ST2). After that, whether to execute an individual indication effect according to the game result determined is determined (ST3).

The storage device mounted in the slot machine 10 stores a plurality of sets of individual indication data corresponding to the types of game results respectively, and common indication data associated with the sets of individual indication data. The sets of individual indication data and the common indication data are associated with each other as shown in indication effect table of FIG. 4. The indication effect table shows indication effects to be executed while symbols 501 are variably displayed on the lower image display panel 141. The identification name column shows names for identifying each of the indication effects. Further, the common indication effect column and the individual indication effect column show the contents of the indication effects.

For example, with the both "feature indication 1" and "feature indication 2", the "dragon breath indication" is associated as the common indication effect. In other words, the "dragon breath indication" is executed as the common indication effect in either one of these indication effects. Further, the individual indication effect associated with the "feature indication 1" and that associated with the "feature indication 2" are different from each other. In other words, when the indication effect is the "feature indication 1", the "dragon breath indication" is executed as the common indication effect, followed by the "ball-appearance indication" as the individual indication effect. On the other hand, that is, when the indication effect is the "feature indication 2", the "dragon breath indication" is executed as the common indication effect, followed by the "ball-non-appearance indication" as the individual indication effect. As should be understood from this, in either of the "feature indication 1" and the "feature indication 2", the common indication effect is executed, and the contents of the indication effect is branched in the individual indication effect. In other words, the individual indications "ball-appearance indication" and "ball-non-appearance indication" belong to the common indication effect of the "dragon breath indication". Similarly, in the "high payout indication" and the "middle payout indication", the "rise of big dragon" is executed as the common indication effect, and then the indication effect branches to the "reel-dragon appearance indication" or the "slow-reel indication". Note that the "wild-stop indication" only executes the individual indication effect and does not execute the common indication effect. As described, the identification name is given to each of the individual indication effects on one-to-one basis.

That is, in step ST3, there is determined which one of the individual indication effects is to be executed. Based on this, the type of the indication effects to be executed while the symbols 501 are variably displayed on the lower image display panel 141 is determined. Note that the individual indication effect determined may be the one corresponding to the game result determined, or the one not corresponding to the game result. When the individual indication effect determined is the one not corresponding to the game result, another individual indication effect belonging to the common indication effect associated with the individual indication effect corresponding to the game result is preferably determined. Then, after the indication effect is determined, variably displaying of symbols on the pseudo reels 151 to 155 is started (ST4). While the symbols are variably displayed, the common indication effect associated with the individual indication effect determined is executed (ST5). Specifically, the common indication data associated with the individual indication data is specified. Based on this common indication data, the common indication effect is provided to the lower image display panel 141 (ST6). After the common indication effect is executed, the individual indication effect determined in step ST3 is executed while the symbols are variably displayed (ST7).

(Indication Effect)

The following provides specific description on indication effects executed while the symbols are variably displayed in the gaming machine 300. Each of the indication effects is structured by a combination of a common indication effect and an individual indication effect, or only by an individual indication effect.

The indication effect "feature indication 1" executes the "dragon breath indication (FIG. 5)" as the common indication effect, and then executes the "ball-appearance indication (FIG. 6)" as the individual indication effect.

The indication effect "feature indication 2" executes the "dragon breath indication (FIG. 5)" as the common indication effect, and then executes the "ball-non-appearance indication" as the individual indication effect. Note that the "ball-non-appearance indication" is an indication effect such that no individual indication effect image is displayed.

The indication effect of the "feature indication 1" executes the "big dragon rise (FIG. 7)" as the common indication effect, and then executes the "reel-dragon appearance indication (FIG. 8)" as the individual indication effect.

The indication effect of the "feature indication 1" executes the "big dragon rise (FIG. 7)" as the common indication effect, and then executes the "slow-reel indication" as the individual indication effect.

The indication effect of the "wild-stop indication" executes no common indication effect, and executes the "wild-stop indication (FIG. 9)" as the individual indication effect.

Figure 5:
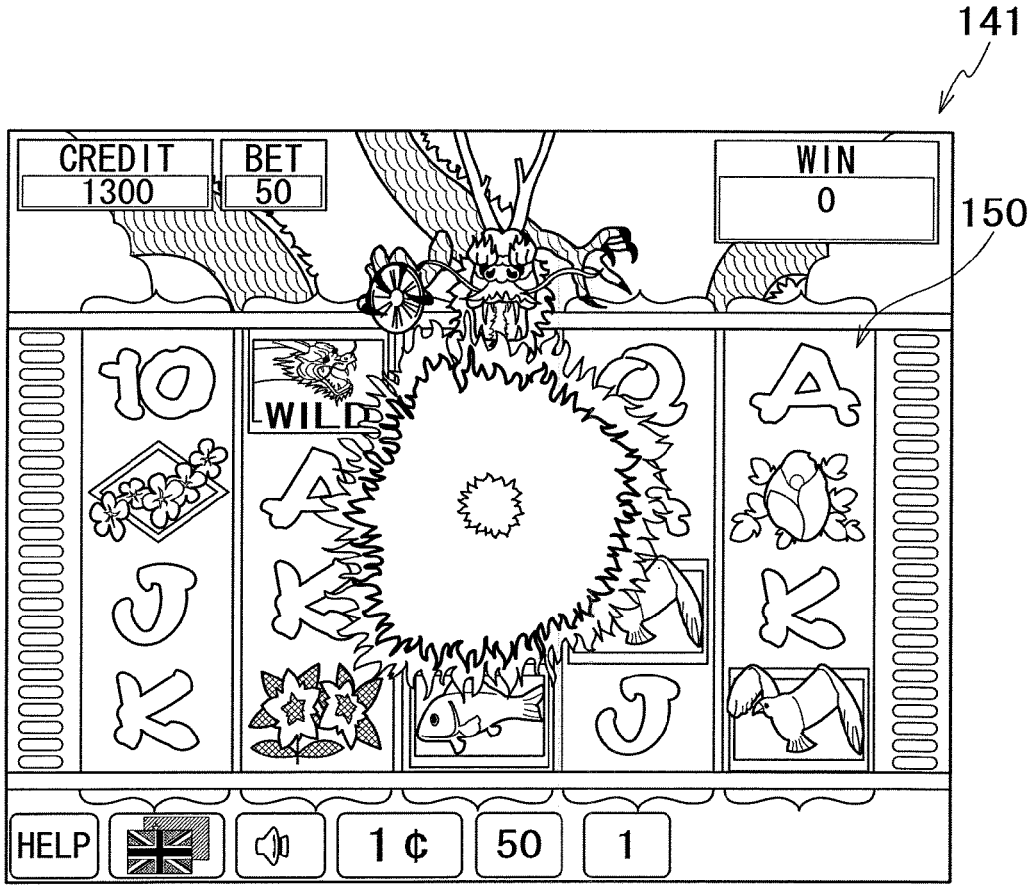
FIG. 5 an explanatory diagram a screen displaying an example indication effect.
Figure 6:
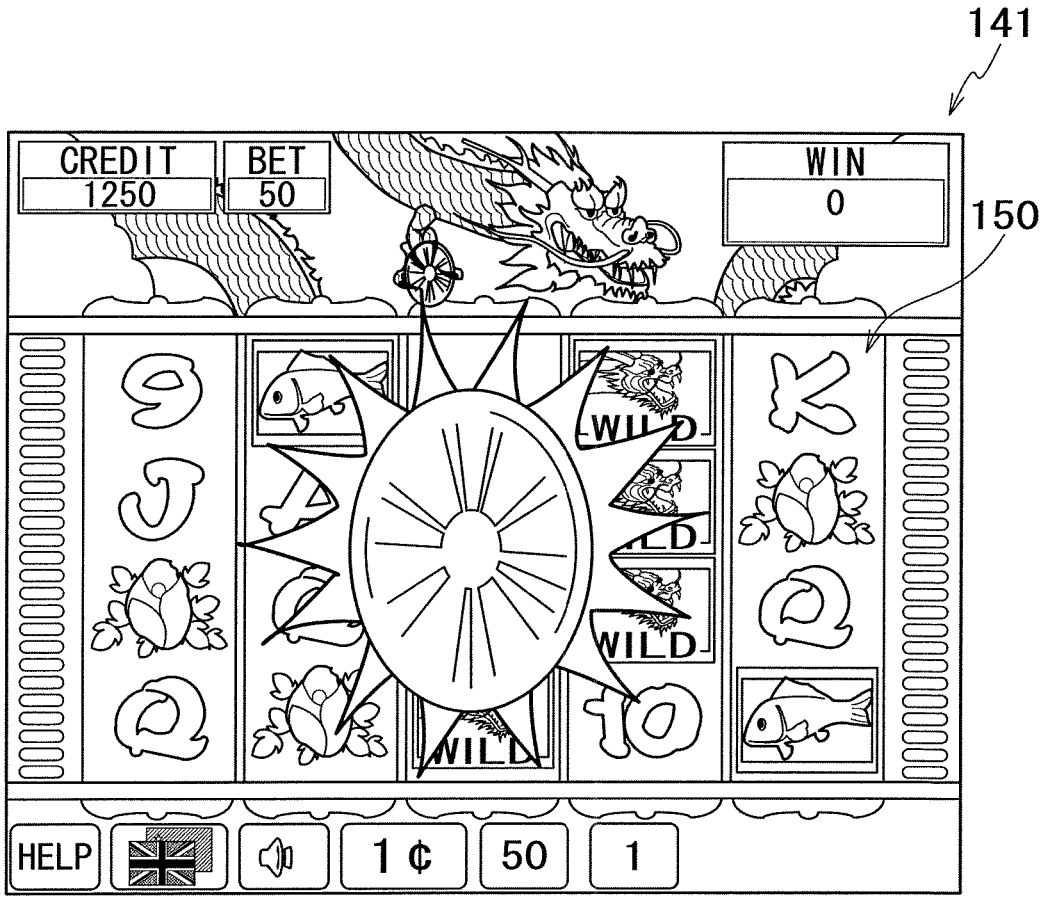
FIG. 6 an explanatory diagram a screen displaying an example indication effect.
Figure 7:
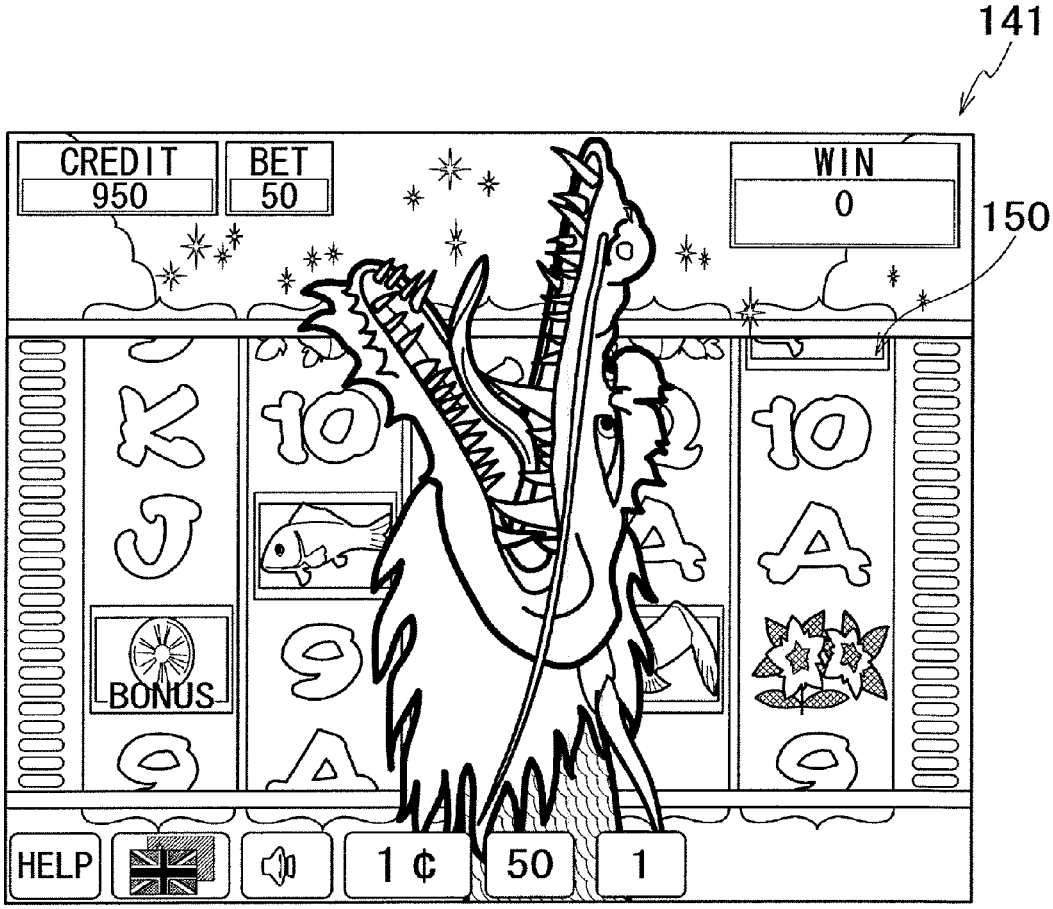
FIG. 7 an explanatory diagram a screen displaying an example indication effect.
Figure 8:
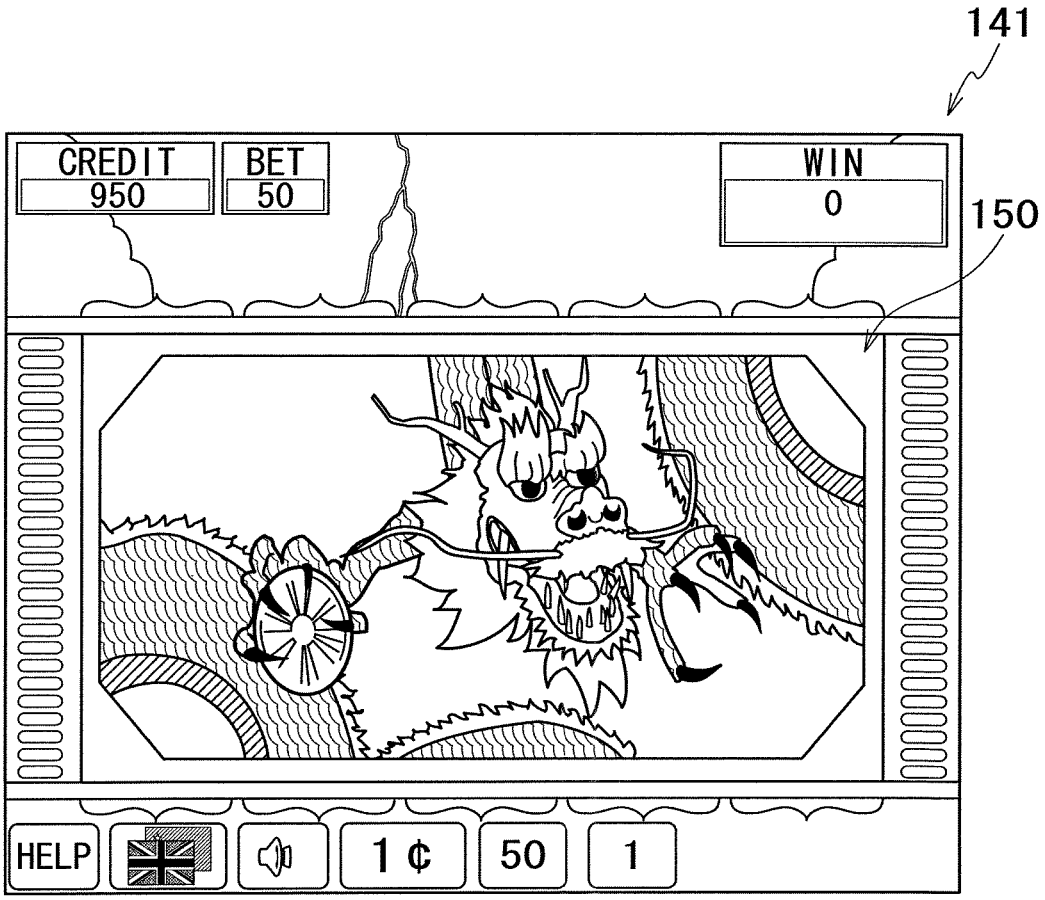
FIG. 8 an explanatory diagram a screen displaying an example indication effect.
Figure 9:
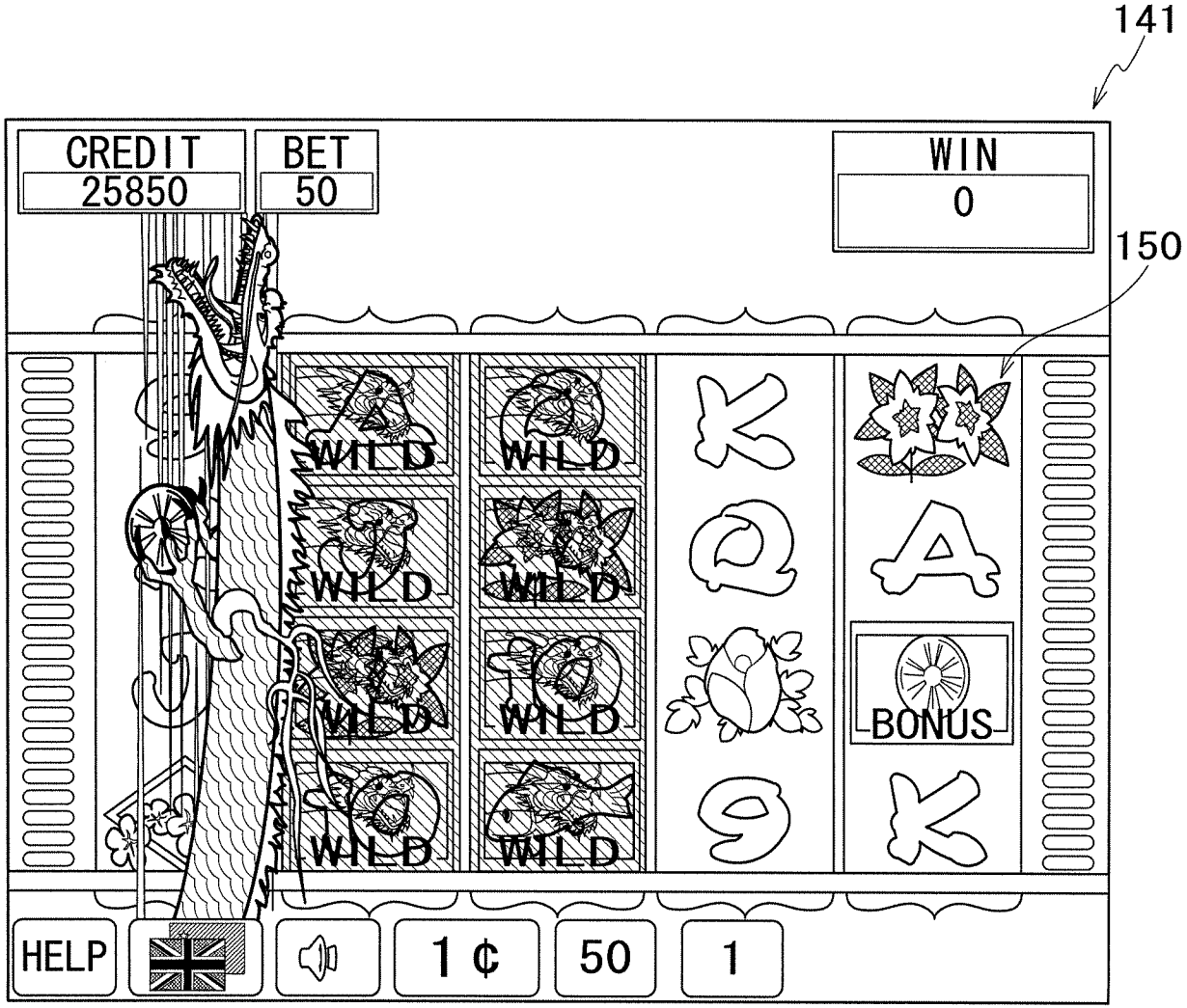
FIG. 9 an explanatory diagram a screen displaying an example indication effect.

As shown in FIG. 5, the "dragon breath indication" is a common indication effect that displays an effect image such that a dragon appears above the reel display area 150 of the lower image display panel 141, and blows fire to the reel display area 150. As shown in FIG. 6, the "ball-appearance indication" is an individual indication effect that displays an effect image such that the dragon passes above the reel display area 150 of the lower image display panel 141 and a ball appears at the center of the reel display area 150. As shown in FIG. 7, the "big dragon rise" is a common indication effect that displays an effect image such that the dragon passes from the lower side to the upper side of the reel display area 150 in the lower image display panel 141 and that stars appear above the reel display area 150. As shown in FIG. 8, the "reel-dragon appearance indication" is an individual indication effect that hides displaying of the pseudo reels 151 to 155 in the reel display area 150 of the lower image display panel 141, and displays an effect image such that the dragon is displayed in the entire reel display area 150 and lightning appears above the reel display area 150. As shown in FIG. 9, the "wild-stop indication" is an individual indication effect that displays an effect image such that the dragon passes from the lower side to the upper side of any of the pseudo reels 151 to 155 in the reel display area 150.

(Effect Random Determination)

Figure 10:
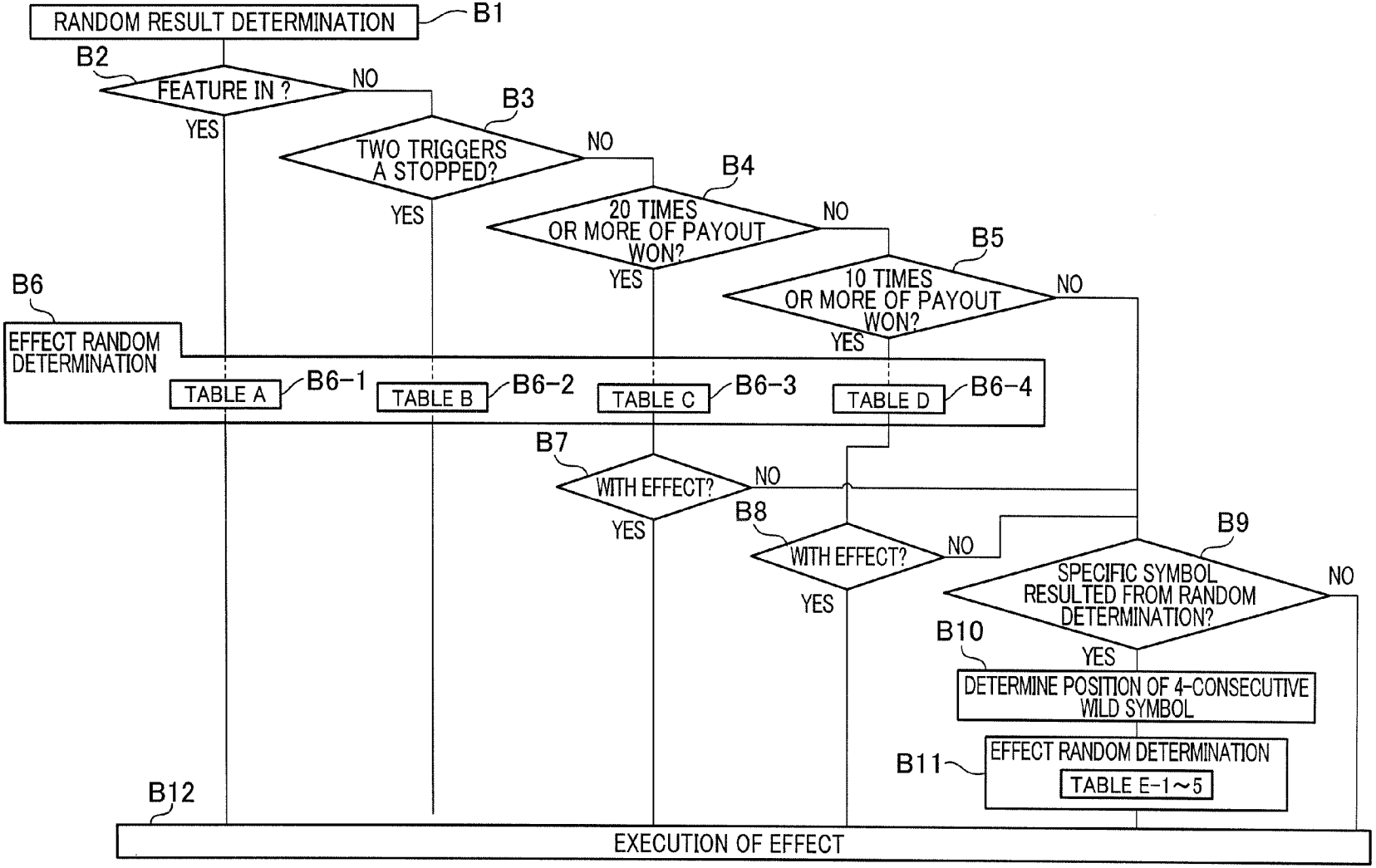
FIG. 10 is a flowchart showing an overview of the process randomly determining an indication effect.

The above described indication effects are randomly determined based on the game results. FIG. 10 shows a flow of randomly determining the indication effect. As shown in FIG. 10, random determination of the resulting symbols (symbols to be rearranged) (B1). Next, there is determined whether the game result is the one that causes feature-in (B2). Specifically, there is determined whether or not the game result includes three (predetermined number) or more of special symbols rearranged on the activatable line. If there is no feature-in (B2: NO), there is determined whether the game result includes the two (the number less than the predetermined number by one) special symbols (trigger A) rearranged on the activatable line (B3). When two special symbols are not rearranged on the activatable line (B3: NO), there is determined whether the game result includes rearrangement of symbols that yields a payout which is at least 20 times the bet amount (B4). If the game result does not yield the payout of at least 20 times the bet (B4: NO), there is determined whether the game result includes rearrangement of symbols that yields a payout which is at least 10 times the bet amount (B5).

When it is determined that the game result meets any of the conditions in step B2 to B5, random determination of the indication effect is executed using the effect random determination table (table A, table B, table C, and table D) according to the game result (B6). Specifically, when the game result is the one that causes feature-in (B2: YES), the table A is used for random determination of the indication effect (B6-1). When the game result is the one including two special symbols rearranged on the activatable line (B3: YES), the table B is used for random determination of the indication effect (B6-2). When the game result is the one that yields a payout of at least 20 times the bet amount (B4: YES), the table C is used for random determination of the indication effect (B6-3). When the game result is the one that yields a payout of 10 times the bet amount (B5: YES), the table D is used for random determination of the indication effect (B6-4).

Note that whether to execute the indication effect is determined after step B6-3 (B7). Further, whether to execute the indication effect is determined after step B6-4 (B8).

On the other hand, when it is determined that the indication effect is not executed in step B7 or B8 (B7: N0 or B8: NO), or when it is determined that the rearrangement of symbols does not yield the payout of at least 10 times the bet amount (B5: NO), there is determined whether the symbols rearranged include specific resulting symbols (B9). Note that the specific resulting symbols means rearranged symbols include a 4-consecutive wild symbol rearranged on any of the pseudo reels 151 to 155, and no special symbol is rearranged on the pseudo reel 151. The 4-consecutive wild symbol is a symbol that takes up areas for four normal symbols. In other words, the 4-consecutive wild symbol could take up the entire area (four symbol areas) of any one of the pseudo reels 151 to 155. Note that the above description about the specific resulting symbols reading "4-consecutive wild symbol rearranged on any of the pseudo reels 151 to 155" means that the 4-consecutive wild symbol is rearranged so as to take up the areas of at least one of the pseudo reels 151 to 155. The 4-consecutive wild symbol stopping on at least any one of the pseudo reels 151 to 155 brings about the same effect as four wild symbols stopping on the pseudo reels. The "wild symbol" means a symbol that can be substituted for any of the other symbols.

When the symbols rearranged include the specific resulting symbols (B9: YES), the result is sorted to any of the five types of results using the classification table of FIG. 11, based on which one or more of the pseudo reels 151 to 155 the 4-consecutive wild symbol is rearranged (B10). The classification table is described below. Note that the first reel to the fifth reel in the classification table corresponds to the pseudo reel 151 to the pseudo reel 105, respectively. In the classification table, the symbol "○" indicates that the 4-consecutive wild symbol is stopped, and the symbol "x" indicates that the 4-consecutive wild symbol is not stopped. The process of determining whether or not the 4-consecutive wild symbol is rearranged is executed sequentially from the first reel. For example, when the 4-consecutive wild symbol is stopped on the first reel and the fifth reel, rows of the classification table in which the symbol "○" appears on the first reel are extracted. Then, of those rows extracted, rows with "x" in the second reel are extracted, followed by extraction of those with "x" in the third reel, and those with "x" in the fourth reel, sequentially. Then, a row with "○" in the fifth reel is selected. In this case, the row No. 23 is selected and the game result is sorted to the "table E-1".

As the destination of sorting, one of five kinds, i.e., the "table E-1" to the "table E-5" is determined. That one of the "table E-1" to the "table E-5" is determined based on which one of the pseudo reels 151 to 155 the 4-consecutive wild symbol stopped. Then, using the table determined, the random determination of the indication effect is executed (B11). After that, the effect is reproduced (B12). That is, when it is determined in step B6 or step B11 that the indication effect is to be executed, an effect including the indication effect is reproduced. Further, when it is determined in step 9 that the symbols rearranged does not include the specific resulting symbols (B9: NO), only a normal effect (variable displaying of symbols and stopping of symbols, or the like).

The following describes the effect random determination table used in steps B6 and B11. As shown in FIG. 12, in the effect random determination table are set the probability of the indication effects for each of the tables (tables A to D, tables E-1 to E5). That is, which one of the tables is to be used is determined in steps B2 to B5 and step B9, and the indication effect is executed based on the table determined. For example, when the table A is used for executing the random determination of the indication effect, the "feature indication 1" is executed at a probability of 20%. The "feature indication 2" is executed at a probability of 20%. At a probability of 60%, no indication effect is executed. Further, for example, when the table E-1 is used for executing the random determination of the indication effect, the "wild-stop indication" is executed at a probability of 55%, and no indication effect is executed at a probability of 45%.

When the effect random determination table is viewed from a different view point, the feature indication 1 is executed only when the table A is selected. Further, the table A is selected, only when it is determined in step B2 that the game result is the one that causes feature-in. That is, executing the feature indication 1 informs the player that feature-in will occur.

The feature indication 2 is executed when the table A or the table B is selected. The table A is selected when it is determined in step B2 that the game result is the one that may lead to feature-in. The table B is selected when it is determined in step B3 that the game result includes rearrangement of two (predetermined number—1) special symbols (trigger A) on an activatable line. That is, executing the feature indication 2 informs the player that at least two special symbols are rearranged on an activatable line. Further, when it is determined that the game result is the one that may lead to feature-in, the feature indication 2 may be executed. This could cause the player to expect for rearrangement of the third special symbol.

That is, the reliabilities of feature-in (probability of occurrence of the feature-in) for the feature indication 1, the feature indication 2, and the cases without indication effect are as shown in FIG. 13. The reliability is 100%, when the feature indication 1 is executed. As such, the feature-in is determined when the feature indication 1 is executed. The reliability is 33.3% when the feature indication 2 is executed. Thus, the feature-in may be determined at a probability of 33.3%, when the feature indication 2 is executed. Further, the reliability is 1.0% when no indication effect is executed. Therefore, the probability of having the feature-in determined is 1.0%, when there is no indication effect.

Further, the high payout indication is executed only when the table C is selected. The table C is selected when it is determined in step B4 that the game result is the one that may yield a payout of at least 20 times the bet amount. In other words, executing of the high payout indication informs the player that the payout of at least 20 times the bet amount is determined.

Further, the middle payout indication is executed when the table C or the table D is selected. The table C is selected when it is determined in step B4 that the game result is the one that yields a payout of at least 20 times the bet amount. The table D is selected when it is determined in step B5 that the game result is the one that yields a payout of at least 10 times the bet amount. In other words, executing of the middle payout indication informs the player that a payout of at least 10 times the bet amount is determined. Further, even when it is determined that the game result is the one that yields a payout of at least 20 times the bet amount, there is a possibility that the middle payout indication may be executed. It is therefore possible to have the player expect for a payout of at least 20 times the bet amount.

FIG. 14 shows the frequency of the indication effect. FIG. 15 shows the frequency that satisfies the conditions for random determination using each table. That is, when the high payout indication is executed, a high payout of at least 20 times is yielded at a probability of once in 2.0 times. Further, when the middle payout indication is executed, a middle payout of at least 10 times, but less than 20 times is yielded at a probability of once in 2.2 times. Further, when the wild-stop indication is executed, a 4-consecutive wild symbol will stop on any one or more of the pseudo reels 151 to 155 at a probability of once in 5.9 times.

(Function Flow of Gaming Machine 300: Slot Machine)

The gaming machine 300 arranged as above includes, as shown in FIG. 2, slot machines 10 and an external controller 621 (center controller 200) connected to the slot machines 10 to be able to communicate therewith. The external controller 621 is able to communicate with the slot machines 10 provided in a hall.

Each slot machine 10 includes a BET button 601, a spin button 602, and a display 614 (such as a lower image display panel 141 shown in FIG. 1), and further includes a game controller 100 configured to control these units. The BET button 601 and the spin button 602 are kinds of input devices. The slot machine 10 further includes a transceiver unit 652 that makes it possible to perform data communication with the external controller 621.

The BET button 601 above has a function of receiving a bet amount input by the player. The spin button 602 has a function of receiving an instruction to start a game such as a normal game in response to an operation by the player, i.e., a start operation. The display 614 has a function of displaying still image information such as various symbols 501, numbers, and characters and moving image information such as effect movies. Furthermore, the display 614 has a touch panel 69 as an input device, and has a function of receiving various instructions input by a pressing operation by the player. The display 614 has a symbol display region 614*a*, an image display region 614*b*, and a common game display region 614*c*. The symbol display region 614*a* displays a reel screen including the symbols 501 shown in FIG. 1. The image display region 614*b* displays various types of effect image information (including the common indication effect and the individual indication effect) executed during a game, by means of moving images and still images. The common game display region 614*c* displays a common game.

Although in the present embodiment the symbol display region 614*a*, the image display region 614*b*, and the lower image display panel 141 are provided on the same screen, the disclosure is not limited to this arrangement. The common game display region 614*c* may be formed together with the symbol display region 614*a* and the image display region 614*b*, or may appear as a substitute only when a common game is run.

The game controller 100 includes a coin insertion/start-check unit 603, a normal game running unit 605, a bonus game start determining unit 606, a bonus game execution unit 607, a random number sampling unit 615, a symbol determining unit 612, an effect-use random number sampling unit 616, an effect determining unit 613, a speaker unit 617, a lamp unit 618, a winning determining unit 619, a payout unit 620, and an indication effect unit 651.

The normal game running unit 605 has a function of running a normal game when an operation of the BET button 601 is made. The bonus game start determining unit 606 determines whether to run a bonus game, based on a combination of the symbols 501 rearranged in the normal game. That is to say, the bonus game start determining unit 606 has a function of determining that a bonus game is obtained when a trigger symbol 503*b* or the like is rearranged in a predetermined condition, and shifting the process to the bonus game execution unit 607 so that a bonus game is run from the next unit game.

It is noted that "unit game" is a series of operations from the start of the receiving of a bet to a state in which an award can be established. For example, a unit game in the normal game includes a single bet time for receiving a bet, a single game time of rearranging stopped symbols 501, and a single payout time of a payout process of awarding a payout. A unit game in the normal game is termed unit normal game.

The bonus game execution unit 607 has a function of running a bonus game in which a free game is repeated only by an operation of the spin button 602.

The symbol determining unit 612 has functions of: determining symbols 501 to be rearranged with reference to a random number from the random number sampling unit 615; rearranging the determined symbols 501 on the symbol display region 614*a* of the display 614; outputting rearrangement information of the symbols 501 to the winning determining unit 619 and the indication effect unit 651; adding an increased specific symbol 503 to the symbols 501 that are used for symbol determination; replacing at least one of the symbols 501 used for the symbol determination with at least one of the increased specific symbols 503; and outputting an effect specifying signal to the effect-use random number sampling unit 616 based on the state of the rearrangement of the symbols 501.

The effect-use random number sampling unit 616 has a function of sampling an effect random number when receiving an effect instruction signal from the symbol determining unit 612 and a function of outputting the effect random number to the effect determining unit 613. The effect determining unit 613 has a function of determining the effect content by using the effect random number, an effect of outputting the image information of the determined effect content to the image display region 614*b* of the display 614, and a function of outputting audio/light information of the determined effect content to the speaker unit 617 and the lamp unit 618.

The winning determining unit 619 has a function of determining the presence of winning when obtaining rearrangement information of the symbols 501, which is a display state of rearrangement on the display 614, a function of calculating a payout amount based on the winning combination when it is determined that winning is achieved, and a function of outputting a payout signal to the payout unit 620 based on the payout amount. The payout unit 620 has a function of paying out a gaming value to the player, in the form of a coin, a medal, a credit, or the like. Furthermore, the payout unit 620 has a function of adding credit data corresponding to the credit to be paid out to credit data stored in an IC card inserted into the later-described PTS terminal 700.

The indication effect unit 651 has a function of executing an indication effect indicating a winning of a second bonus game, while the first bonus game is run (while the last selectable game is run). Further, the indication effect unit 651 may have a function of executing various indication effects at predetermined probabilities; and a function of indicating winnings of various bonus games and executing indication effects to indicate the type of the bonus game. The indication effect unit 651 may further have a function of, when the rearrangement information of the symbols 501 is obtained, randomly determining whether to execute various indication effects based on the rearrangement information; and a function of executing various indication effects by using the display 614, and by using output mechanisms such as the speaker 617 and the lamp 618 of the top box 12.

In addition to the above, the game controller 100 includes a storage unit 661 that stores various types of bet amount data. The storage unit 661 stores data in a rewritable manner, e.g., a hard disc device and a memory.

In addition to the above, the game controller 100 has a common game running unit 653. The common game running unit 653 has functions of: outputting bet amount information based on a bet amount bet on a normal game to the external controller 621 in each unit base game; executing a common game in response to a game start command from the external controller 621; and receiving a bet input through the BET button 601 for a bet amount corresponding to bet amount data for a common game, which is stored in the storage unit 661 and is bettable on a common game.

In addition to the above, the game controller 100 is connected to the PTS terminal 700. The PTS terminal 700 is a unit in which an LCD, a microphone, a human body detection camera, etc. are integrated, and has, for example, a function of executing an effect for a game by mutual communications with the game controller 100. In particular, the PTS terminal 700 has a card slot to which an IC card can be inserted. With this, the player is able to insert a IC card into the card slot and use the credits stored in the IC card in the slot machine 10. The mechanical structure of the PTS terminal 700 will be described later.

In addition to the above, when receiving credit data from the PTS terminal 700, the game controller 100 updates the credit display on the display 614. Furthermore, the game controller 100 outputs settled credit data to the PTS terminal 700 when the credits on a game are settled.

Furthermore, the PTS terminal 700 of each of the slot machines 10 constituting the gaming machine 300 is connected to the management server 800 to be able to communicate each other, and centrally manages the download of images, IC cards and credits.

(Function Flow of Gaming Machine 300: External Controller)

Figure 3:
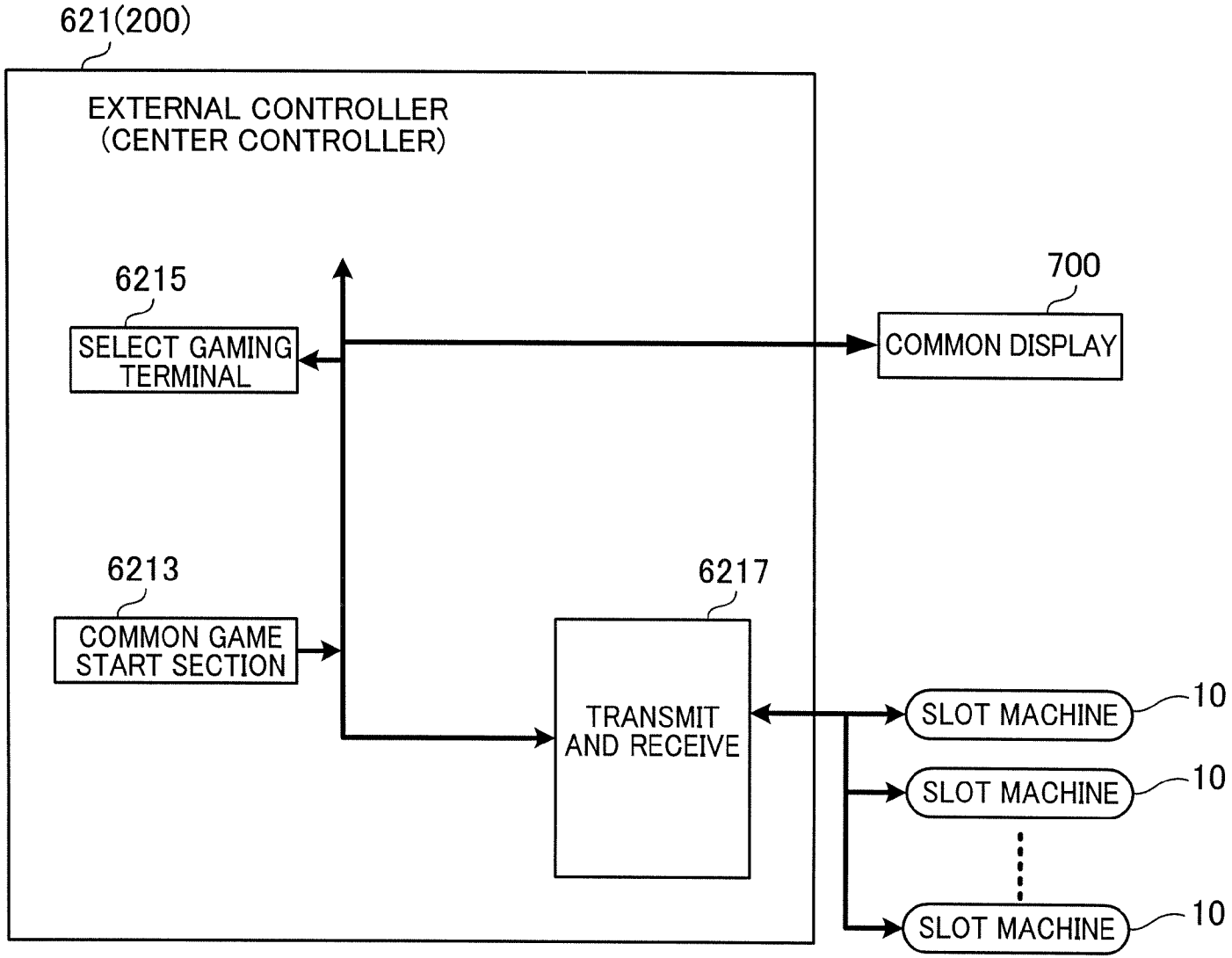
FIG. 3 shows a function flow of the gaming machine.

The slot machine 10 arranged as above is, as shown in FIG. 3, connected to the external controller 621. The external controller 621 has a function of remotely operating and monitoring the operation state of each slot machine 10 and processes such as changes in game setting values. Furthermore, the external controller 621 has a function of determining a common game start condition for each gaming terminal which is the slot machine 10, and executing a common game at a plurality of slot machines 10 when a determination result at any gaming terminal satisfies the common game start condition.

More specifically, the external controller 621 includes a common game start unit 6213, a gaming terminal selection unit 6215, and a transceiver unit 6217. The common game start determining unit 6213 has functions of: determining whether the common game start condition is established based on the accumulated bet amount information sent from the slot machine 10 in each unit base game; outputting a game start command to a plurality of slot machines 10; and displaying on the common display device 700 states until the common game start condition is established.

The determination as to whether the common game start condition is established is based on the accumulated bet amount information or based on all accumulated values that increase as the unit base game is repeated. For example, the number of times of running the base game and the game time of the base game may be used as the accumulated values.

In addition to the above, the common game start unit 6213 has a function of outputting a game start command to the slot machine 10 in which an accumulated value that increases as a result of the repetition of the base game satisfies a game running condition. With this, because the right to participate in the common game is not awarded to a slot machine 10 in which the accumulated value is lower than the minimum setting value, the common game start unit 6213 motivates the player to actively repeat the base game.

In addition to the above, the common game start unit 6213 has a function of monitoring a non-input time in which no start operation is performed, and outputting the game start command to the slot machines 10 except to the slot machine 10 in which the non-input time is equal to or longer than a timeout time. With this, the common game start unit 6213 is able to determine that no player is at a slot machine 10 where the base game has not been played at least for the timeout time, and able to avoid the execution of the common game at such a slot machine 10.

The gaming terminal selection unit 6215 has a function of selecting a specific slot machine 10 from the slot machines 10 and outputting a common game start command signal to that specific slot machine 10. The common game start command signal provides the specific slot machine 10 with the right to start the common game. The transceiver unit 6217 has a function of exchanging data with the slot machines 10.

(Operations of Gaming Machine 300)

The operations of the gaming machine 300 having the functional blocks above will be described. While in the present embodiment the "gaming terminal" shown in the flowcharts indicates a slot machine 10 executing a slot game, the disclosure is not limited to this arrangement.

(Operations of Slot Machine 10)

A slot machine 10 which is a gaming terminal executes terminal-side processes (A1) to (A7). More specifically, to begin with, a base game process (e.g., normal game) is executed (A1). That is, a series of operations below are executed.

(Coin-Insertion/Start-Check)

First, the slot machine 10 checks whether or not a BET button 601 has been pressed by a player, and subsequently checks whether or not a spin button 602 has been pressed by the player.

(Symbol Determination)

Next, when a spin button unit 602 has been pressed by the player, the slot machine 10 extracts a random number for symbol determination, and determines symbols 501 to be displayed for the player at the time of stopping the scroll of the symbol array, for respective video reels displayed on a display unit 614.

(Symbol Display)

Then the slot machine 10 starts the scroll of the symbol array of each video reel, and stops the scroll so that the determined symbols 501 are displayed for the player.

(Winning Determination)

Subsequently, as the rotation of the symbol array of each video reel is stopped, the slot machine 10 determines whether the combination of the symbols 501 displayed for the player is a combination related to winning.

(Payout)

When the combination of the symbols 501 displayed for the player is a combination related to winning, the slot machine 10 offers, to the player, benefit according to the combination.

For example, when a combination of symbols 501 related to a payout of coins has been displayed, the slot machine 10 pays out coins of the number corresponding to the combination of symbols 501 to the player.

Subsequently, whether to win a bonus combination is determined. When winning the bonus combination, a bonus game process is executed. On the other hand, when not winning the bonus combination, the normal game is run again. During a period in which the base game including such a normal game and bonus game is being run, execution state information indicating the start and end of the unit game such as the normal game and the bet amount on the unit game is transmitted to the external controller 621. With this, the external controller 621 centrally manages the execution state information of each slot machine 10.

(Operation of External Controller 621)

When the slot machines 10 operate as above, the external controller 621 executes the following center-side processes in synchronization with the slot machines 10.

To begin with, the external controller 621 receives the execution state information from each slot machine 10 and obtains the execution state of the base game. Thereafter, based on the number of the repetition of the base game, the accumulated bet amount, or the like, whether the common game start condition is established at any slot machine 10 is determined. When the common game start condition is not established, the acquisition of the execution state of the base game at each slot machine 10 is continued.

In the meanwhile, when the common game start condition is established, the game start command is simultaneously output to the slot machines 10 that satisfy the game running condition. Thereafter, a specific slot machine 10 is selected from the slot machines 10 satisfying the game running condition, and a common game start right instruction is output to the specific slot machine 10 (B4). Then, the result of the common game is randomly determined for each of the slot machines 10, and a payout or the like is awarded according to the result of the common game.

(Overall Structure of Gaming System)

A gaming system 350 including the gaming machine 300 having the functions above will be described.

Figure 16:
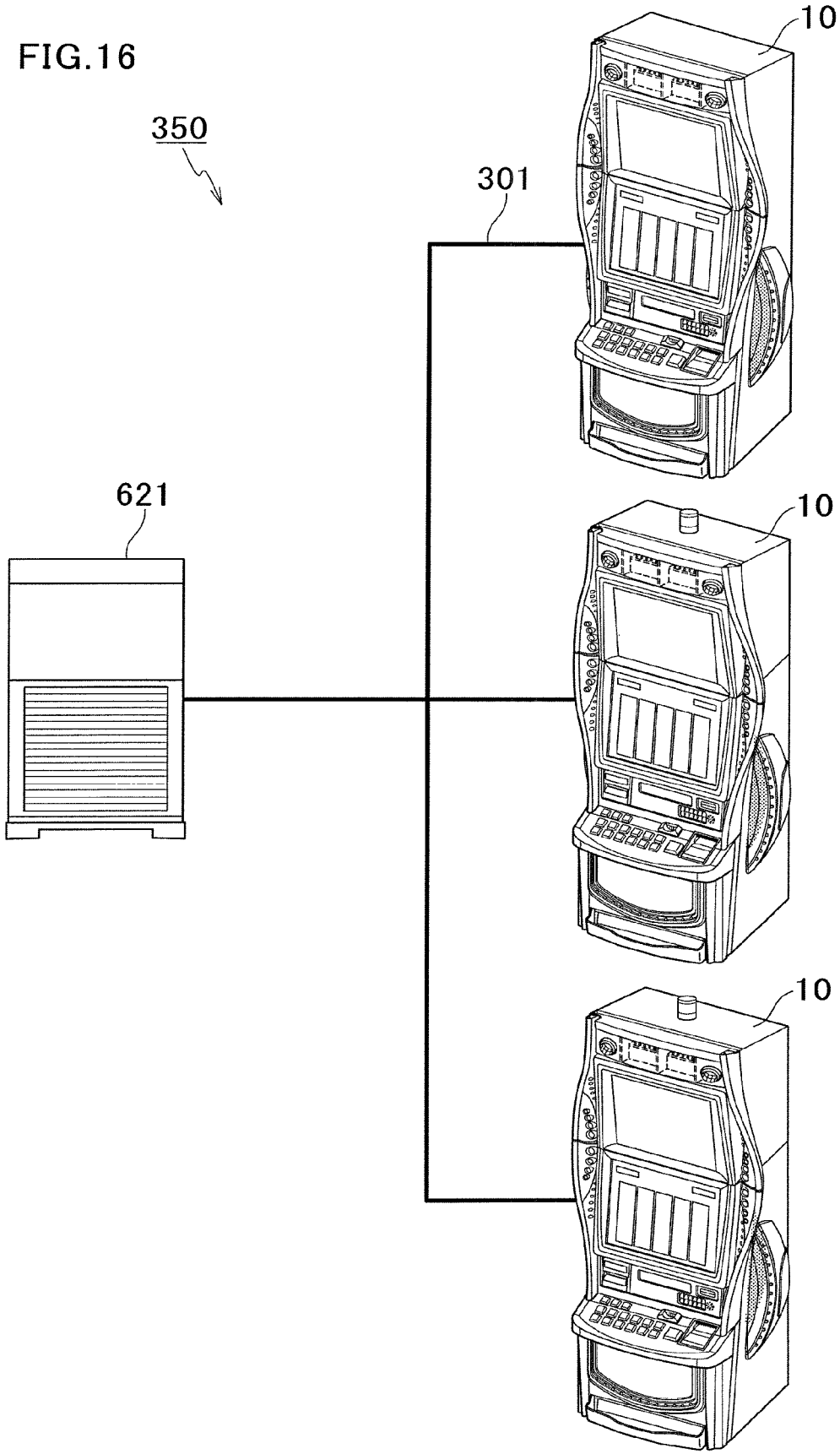
FIG. 16 is an explanatory diagram showing a connection structure of a gaming system.

As shown in FIG. 16, the gaming system 350 includes: the slot machines 10, and an external controller 621 connected to the slot machines 10 via a communication line 301.

The external controller 621 is configured to control the slot machines 10. In the present embodiment, the external controller 621 is a so-called hall server provided in a gaming facility where a plurality of slot machines 10 are provided. Each slot machine 10 has a unique identification number, and the external controller 621 determines the source of data sent from the slot machines 10 based on the identification number. Furthermore, the identification number is used to specify the transmission target, when data is sent from the external controller 621 to a slot machine 10.

The gaming system 350 may be constructed in a single gaming facility where various games such as casino games are playable or constructed for a plurality of gaming facilities. When constructed in a single gaming facility, the gaming system 350 may be constructed in each floor or section of the gaming facility. The communication line 301 may be wires or wireless, and is constructed by a dedicated line, a switched line, or the like.

Figure 17:
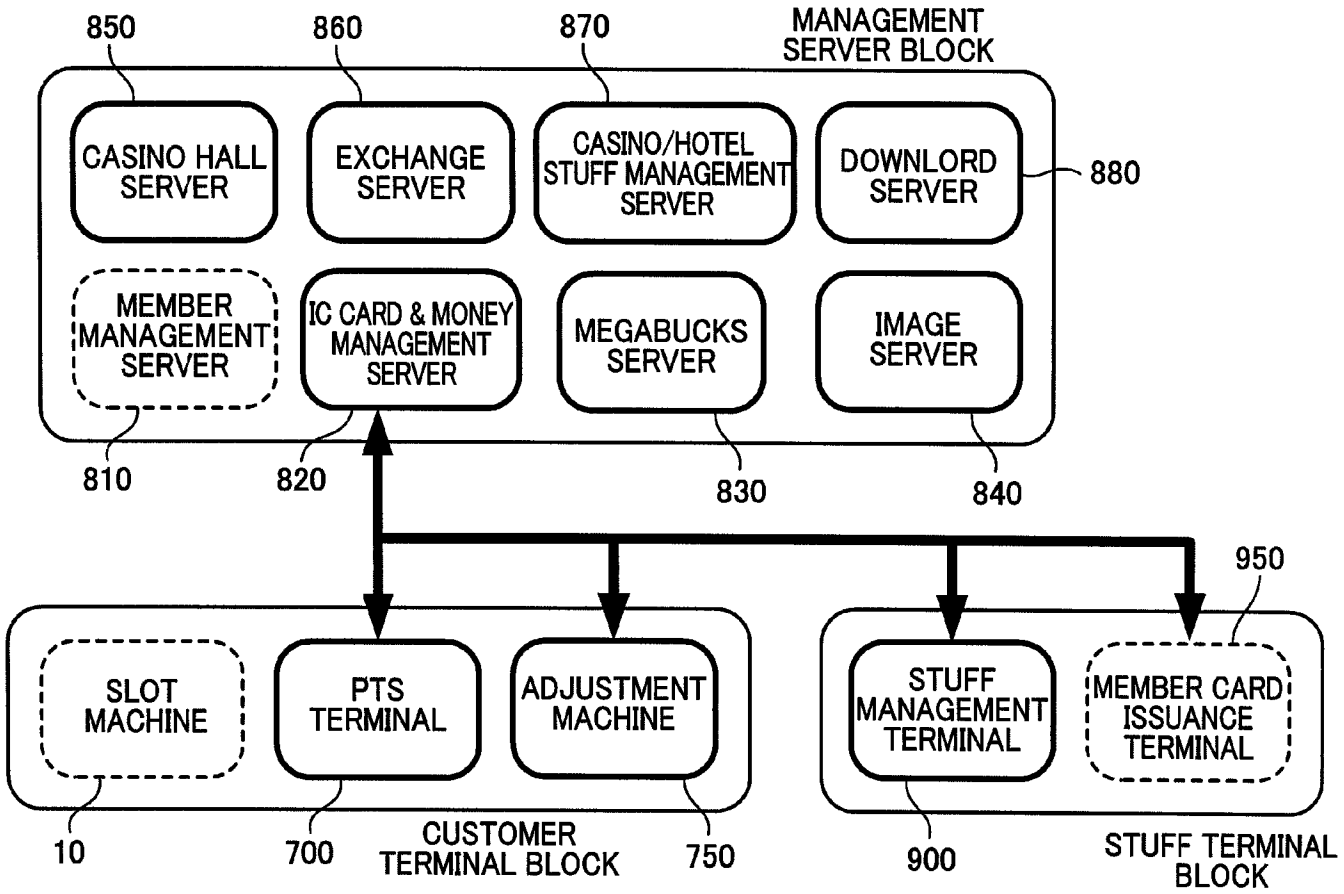
FIG. 17 is a block diagram of the gaming system.

As shown in FIG. 17, the gaming system is roughly divided into a management server block, a customer terminal block, and a staff terminal block. The management server block includes a casino hall server 850, an exchange server 860, a casino/hotel staff management server 870, and a download server 880.

The casino hall server 850 is a server for managing the entire casino hall where the slot machines 10 are provided. The exchange server 860 is a server for generating exchange rate data based on exchange rate information or the like. The casino/hotel staff management server 870 is a server for managing the staff members of the casino hall or a hotel related to the casino hall. The download server 880 is a server for, for example, downloading latest information such as game-related information and news and forwarding the information to players via the PTS terminal 700 of each slot machine 10.

The management server block includes a member management server 810, an IC card & money management server 820, a megabucks server 830, and an image server 840.

The member management server 810 is a server for managing member information or the like of the players of the slot machines 10. The IC card & money management server 820 is a server for managing IC cards used in the slot machines 10. More specifically, the IC card & money management server 820 is a server that stores fractional money data in association with an identification code and outputs the fractional money data to the PTS terminal 700. Furthermore, the IC card & money management server 820 generates and manages denomination rate data or the like. The megabucks server 830 is a server for, for example, managing Mega bucks which is a game in which the sum total of amounts bet on a plurality of slot machines 10 in a plurality of casino halls is dealt with as a payout. The image server 840 is, for example, a server that downloads latest images such as game-related images and news images and forwards the images to the player via the PTS terminal 700 of each slot machine 10.

The customer terminal block includes the slot machine 10, a PTS terminal 700, and a settlement machine 750. The PTS terminal 700 is attachable to the slot machine 10 and capable of mutually communicating with the management server 800. The settlement machine 750 exchanges money data stored in a player's IC card to real money and stores coins and bills in an IC card as money data.

The staff terminal block includes a staff management terminal 900 and a member card issuance terminal 950. The staff management terminal 900 is a terminal by which the staff of the casino hall manages the slot machines 10. In particular, in the present embodiment, the staff of the casino hall checks if the number of IC cards in the PTS terminal 700 is too large or too small. The member card issuance terminal 950 is a terminal by which a player obtains a member card to play games in the casino hall.

(PTS Terminal 700)

Figure 18:
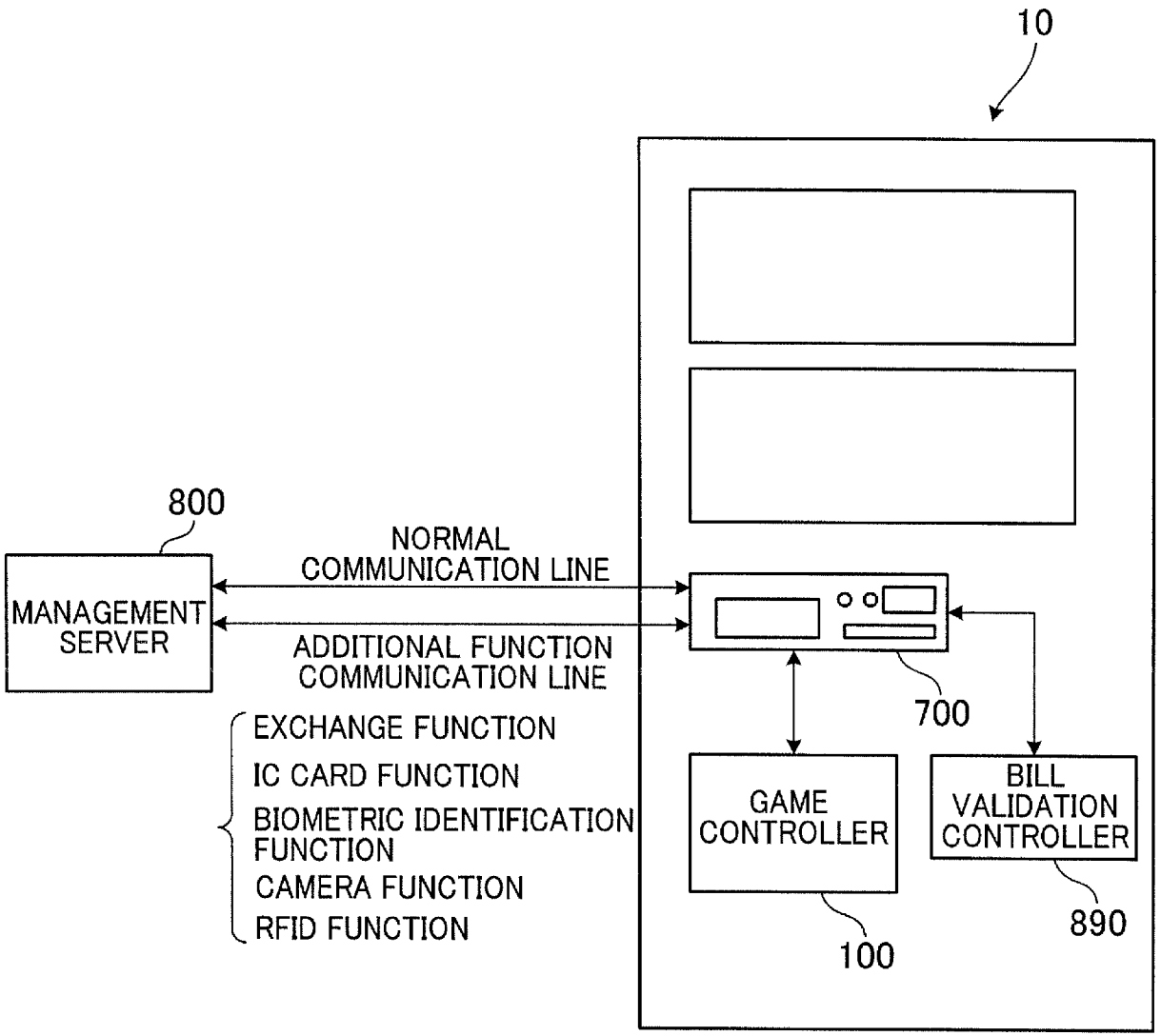
FIG. 18 is a block diagram of a PTS system.

The PTS terminal 700 is incorporated in a PTS system as shown in FIG. 18. The PTS terminal 700 attached to the slot machine 10 is arranged to be able to communicate with the game controller 100 of the slot machine 10 and the bill validation controller 890.

The PTS terminal 700 conducts sound and image effects in games and updates the credit data, based on the communications with the game controller 100. Furthermore, the PTS terminal 700 sends credit data to the bill validation controller 890, which is required at the time of the settlement.

In addition to the above, the PTS terminal 700 is connected to the management server 800 to be able to communicate therewith. The PTS terminal 700 and the management server 800 are connected with each other by two lines, namely, a normal communication line and an additional function communication line.

The PTS terminal 700 exchanges, by the normal communication line, data such as money data, identification code data, member information of a player. On the other hand, by the additional function communication line, the PTS terminal 700 conducts communications concerning newly-added functions. In the present embodiment, the PTS terminal 700 conducts, by the additional function communication line, communications concerning an exchange function, an IC card function, a biometric identification function, a camera function, and an RFID (Radio Frequency Identification) function of individual identification by radio waves.

(Mechanical Structure of Slot Machine)

Figure 19:
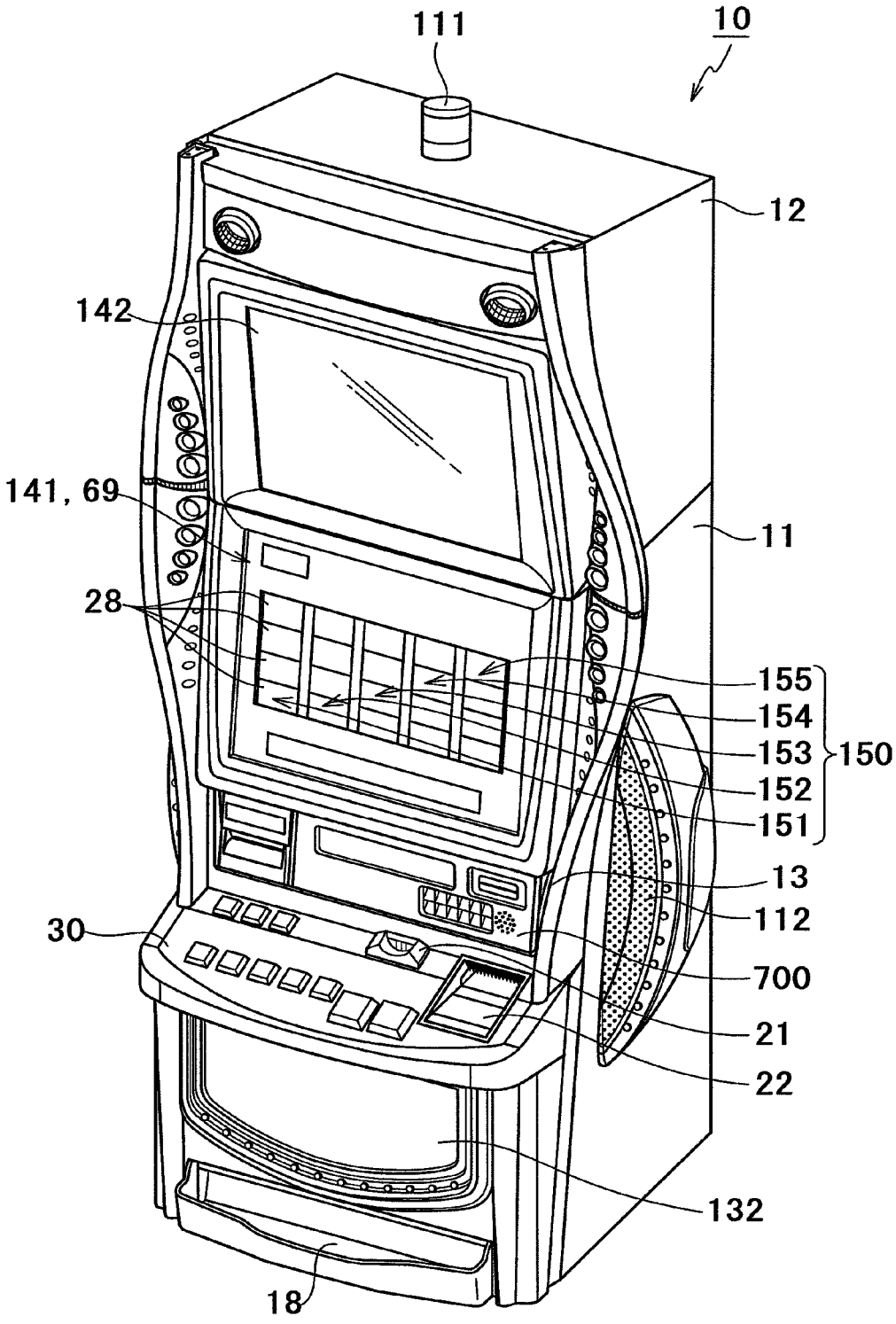
FIG. 19 is a perspective view of a slot machine in the gaming machine.

Referring to FIG. 19, the overall structure of the slot machine 10 will be described.

A coin, a bill, or electrically valuable information corresponding to these is used as a game medium in the slot machine 10. In the present embodiment, in particular, credit-related data such as money data stored in an IC card is used.

The slot machine 10 includes a cabinet 11, a top box 12 installed on the upper side of the cabinet 11, and a main door 13 provided at the front surface of the cabinet 11. 100

On the main door 13, a symbol display device termed lower image display panel 141 is provided. The symbol display device is formed by a transparent liquid crystal panel. The screen displayed on the lower image display panel 141 has a reel display area 150 at the central portion. The reel display area 150 is constituted by 20 display blocks 28 forming a matrix of 5 columns and 4 rows. The four display blocks 28 of each column form pseudo reels 151 to 155. On each of the pseudo reels 151 to 155, four display blocks 28 move downward with changes in speed, so that the symbols 501 on the display blocks 28 are vertically rotated (variably displayed) and then stopped, in other words, the symbols are rearranged. The details of the display screen on the lower image display panel 141 will be given later.

While the present embodiment the slot machines 10 are so-called video slot machines, some mechanical reels in the slot machines 10 of the present invention may be replaced by the pseudo reels 151 to 155.

On the front surface of the symbol display device is provided a touch panel 69. The touch panel 69 allows a player to input various instructions by touching the display screen of the lower image display panel 141. The input signal is transmitted from the touch panel 69 to the main CPU 71.

Below the lower image display panel 141 is provided a control panel 30. The control panel 30 is provided with buttons, a coin entry 21 for inserting coins into the cabinet 11, and a bill entry 22. More specifically, on the control panel 30, a change button 31, a cashout button 32, and a help button 33 are provided on the upper stage of the left area in front elevation, a 1-bet button 34, a 2-bet button 35, a 3-bet button 37, and a 5-bet button 38 are provided in the middle stage of the left area. Furthermore, on the control panel 30, a play-2-lines button 40, a play-5-lines button 41, a play-10-lines button 42, a play-20-lines button 43, a gamble button 44, a max bet button 45, and a spin button 46 are provided in the lower stage of the left area. Details of the control panel 30 will be given later.

On the lower front surface of the main door 13, i.e., below the control panel 30, a belly glass 132 on which a character of the slot machine 10 or the like is depicted are provided. Between the lower image display panel 141 and the control panel 30, the PTS terminal 700 is attached. In the PTS terminal 700, devices having a microphone function, a camera function, a speaker function, a display function and the like form a single unit. More specifically, the PTS terminal 700 includes an LCD, a human detection camera, a microphone, a bass reflex speaker, or the like. The human detection camera makes it possible to detect the presence of a player by the camera function. The microphone is used for the player's participation in a game by voice and the authentication of a player by voice recognition. The speaker produces sound effects in games and outputs notification sound when an IC card is left inserted. Furthermore, the speaker outputs notification sound when an inserted IC card is not authenticated.

In addition to the above, the PTS terminal 700 is provided with an LED and a card insertion slot. The LED emits light with plural colors to notify the remaining number of IC cards in a card stacker. The card insertion slot has a mechanism of allowing IC cards to be inserted and ejected. The IC card has a display region. The IC card is completely inside the machine when the player is playing games, and is ejected to expose the display region at the time of the settlement. This allows the player to recognize the credit-related data such as updated money data. Alternatively, the IC card may be arranged to expose the display region not to be completely inserted, even when the player is playing games. This allows the player to always recognize the update of the credits during games.

When it is confirmed by the human detection camera that no player is present at the time of the settlement of the credits, the IC card is drawn into and stored in the card stacker. With this arrangement, the IC card is not left inserted for a long time, even if the player left the machine without taking the IC card after recognizing that the remaining credits on the display region are small.

On the left and right side of the cabinet 11 are symmetrically provided speakers 112(output mechanism). The slot machine 10 executes the effect by outputting images, sound, and light, by means of the speakers 112 and the effect mechanism 131.

(Electrical Configuration of Slot Machine)

Figure 20:
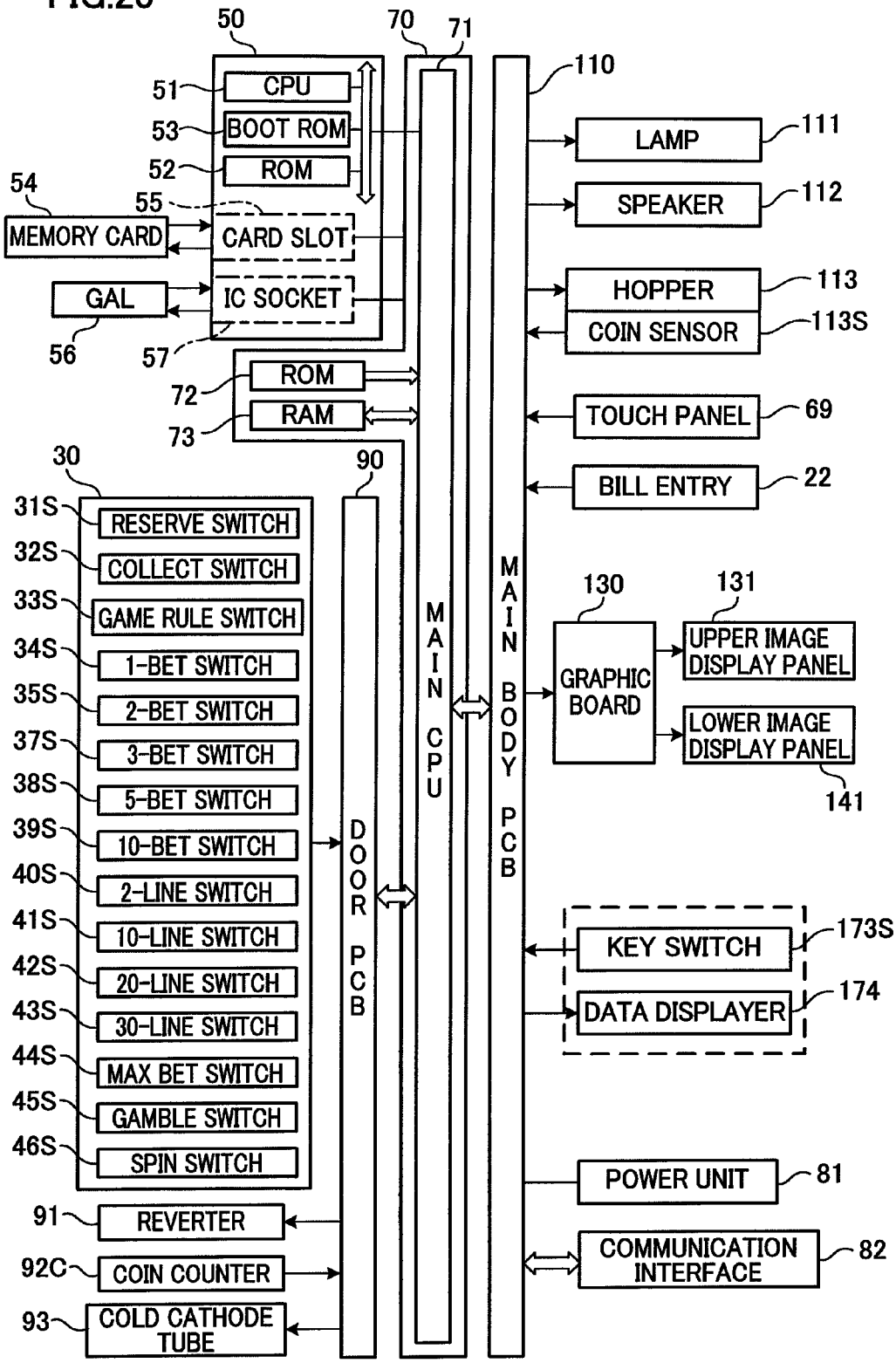
FIG. 20 is an electrical block diagram of the gaming machine.

Now, referring to FIG. 20 the configuration of a circuit in the slot machine 10 will be described.

A gaming board 50 is provided with: a CPU 51, a ROM 52, and a boot ROM 53, which are mutually connected by an internal bus; a card slot 55 corresponding to a memory card 54; and an IC socket 57 corresponding to a GAL (Generic Array Logic) 56.

The memory card 54 includes a non-volatile memory, and stores a game program and a gaming system program. The game program includes a program related to game progression and a program for producing effects by images and sounds the game program further includes a symbol determination program. The symbol determination program is a program for determining symbols to be rearranged on the display block 28.

The game program further includes sets of data such as: normal game symbol table data indicating a normal game symbol table that shows the relationship of each symbol in each symbol array of the display block, a code number, and a random number; bonus game symbol table data indicating a bonus game symbol table that shows the relationship of each symbol of each symbol array of the display block, a code number, and a random number; symbol number determination table data indicating a symbol column determination table; code number determination table data indicating a code number determination table; wild symbol increase amount determination table data indicating a wild symbol increase amount determination table; trigger symbol increase number determination table data indicating a trigger symbol increase number determination table; odds data indicating the relationship between the types and the number of symbols rearranged on an activatable line and a payout amount.

Further, the card slot 55 is configured so that the memory card 54 can be inserted thereinto and removed therefrom, and is connected to a motherboard 70 by an IDE bus. The type and contents of the game to be played on the slot machine 10 can be changed by drawing out the memory card 54 from the card slot 53S, writing another game program into the memory card 54, and inserting the memory card 54 into the card slot 53S.

The GAL 56 is a type of PLD (Programmable Logic Device) having a fixed OR array structure. The GAL 56 is provided with a plurality of input ports and output ports, and predetermined input into the input port causes output of the corresponding data from the output port.

Further, the IC socket 57 is configured so that the GAL 56 can be inserted thereinto and removed therefrom, and is connected to the motherboard 70 by a PCI bus. The contents of the game to be played on the slot machine 10 can be changed by replacing the memory card 54 with another memory card 54 having another program written therein or by rewriting the program written into the memory card 54 as another program.

The CPU 51, the ROM 52 and the boot ROM 53 mutually connected by the internal bus are connected to the motherboard 70 by a PCI bus. The PCI bus enables a signal transmission between the motherboard 70 and the gaming board 50, and power supply from the motherboard 70 to the gaming board 50.

The ROM 52 stores an authentication program. The boot ROM 53 stores a pre-authentication program, a program (boot code) to be used by the CPU 51 for activating the pre-authentication program, and the like.

The authentication program is a program (falsification check program) for authenticating the game program and the gaming system program. The pre-authentication program is a program for authenticating the aforementioned authentication program. The authentication program and the pre-authentication program are written along a procedure (authentication procedure) for proving that the program to be the subject has not been falsified.

The motherboard 70 is constituted by a commercial general-purpose mother board (printed writing board on which basic components for personal computers are mounted) and is provided with a main CPU 71, a ROM (Read Only Memory) 72, a RAM (Random Access Memory) 73, and a communication interface 82. This motherboard 70 is equivalent to the game controller 100 of the present embodiment.

The ROM 72 includes a memory device such as a flash memory, and stores a program such as BIOS (Basic Input/Output System) to be executed by the main CPU 71, and permanent data. When the BIOS is executed by the main CPU 71, processing for initializing predetermined peripheral devices is conducted; further, through the gaming board 50, processing of loading the game program and the gaming system program stored in the memory card 54 is started. In the present invention, the ROM 72 may be or may not be rewritable.

The RAM 73 stores data used for the operation of the main CPU 71 and programs such as the symbol determination program. For example, when the processing of loading the aforementioned game program, gaming system program or authentication program is conducted, the RAM 73 can store the program. The RAM 73 is provided with working areas used for operations in execution of these programs. Examples of the areas include: an area that stores the number of games, the number of bets, the number of payouts, the number of credits and the like; and an area that stores symbols (code numbers) randomly determined.

The communication interface 82 is for communicating with the external controller 621 such as a server, through the communication line 301. Further, the motherboard 70 is connected with a later-described door PCB (Printed Circuit Board) 90 and a body PCB 110 by respective USBs. The motherboard 70 is also connected with a power supply unit 81. Furthermore, the motherboard 70 is connected with the PTS terminal 700 by USB.

When the power is supplied from the power supply unit 81 to the motherboard 70, the main CPU 71 of the motherboard 70 is activated, and then the power is supplied to the gaming board 50 through the PCI bus so as to activate the CPU 51.

The door PCB 90 and the body PCB 110 are connected with input devices such as a switch and a sensor, and peripheral devices the operations of which are controlled by the main CPU 71.

The door PCB 90 is connected with a control panel 30, a reverter 91, a coin counter 92C and a cold cathode tube 93.

The control panel 30 is provided with a reserve switch 31S, a collect switch 32S, a game rule switch 33S, a 1-bet switch 34S, a 2-bet switch 35S, a 3-bet switch 37S, a 5-bet switch 38S, a 10-bet switch 39S, a play-2-lines switch 40S, a play-5-lines switch 41S, a play-10-lines switch 42S, a play-20-lines switch 43S, a max bet switch 44S, a gamble switch 45S, and a start switch 46S, which correspond to the above-described buttons. Each of the switches outputs a signal to the main CPU 71 upon detection of press of the button corresponding thereto by the player.

Inside the coin entry 36 are provided a reverter 91 and a coin counter 92C. The reverter 91 verifies validates a coin inserted into the coin entry 36, and discharges coins other than genuine coins through a coin payout exit. The coin counter 92C detects the received genuine coins and counts the number of the coins.

The reverter 91 operates based on a control signal output from the main CPU 71, and distributes valid coins validated by the coin counter 92C into a hopper 113 or a cash box. That is, coins are distributed into the hopper 113 when the hopper 113 is not filled with coins, while coins are distributed into the cash box when the hopper 113 is filled with coins.

The cold cathode tube 93 functions as a backlight installed on the rear face sides of the effect mechanism 131 and the lower image display panel 141, and lights up based on a control signal output from the main CPU 71.

The body PCB 110 is connected with the effect mechanism 131, the speakers 112, the hopper 113, a coin detecting portion 113S, the touch panel 69, the bill entry 22, a graphic board 130, a key switch 173S, and the data displayer 174. The speakers 112 output BGM sound or the like in accordance with a control signal output from the main CPU 71.

The hopper 113 operates based on a control signal output from the main CPU 71, and pays out coins of the specified number of payouts from the coin payout exit to an unillustrated coin tray. The coin detecting portion 113S outputs a signal to the main CPU 71 upon detection of coins paid out by the hopper 113.

The touch panel 69 detects a position on the lower image display panel 141 touched by a finger or the like of the player, and outputs a signal corresponding to the detected position to the main CPU 71.

The bill entry 22 authenticates the bills and receives genuine bills into the cabinet 11. The bills received by the cabinet 11 are converted onto the number of coins, and the credits equivalent to the converted coins are added as the credits owned by the player.

The graphic board 130 controls display of images conducted by the effect mechanism 131 and lower image display panel 141, based on a control signal output from the main CPU 71. The graphic board 130 is provided with the VDP (Video Display Processor) generating image data based on a control signal outputted from the main CPU 71, the video RAM temporarily storing the image data generated by the VDP, and the like. It is to be noted that the image data used in generation of image data by the VDP is included in the game program that has been read from the memory card 54 and stored into the RAM 73.

The graphic board 130 is provided with the VDP (Video Display Processor) generating image data based on a control signal outputted from the main CPU 71, the video RAM temporarily storing the image data generated by the VDP, and the like. It is to be noted that the image data used in generation of image data by the VDP is included in the game program that has been read from the memory card 54 and stored into the RAM 73.

The key switch 173S is provided in the keypad 173, and outputs a predetermined signal to the main CPU 71 when the keypad 173 has been operated by the player. The data displayer 174 displays data read by the card reader 172 and data inputted by the player through the keypad 173, based on a control signal outputted from the main CPU 71.

(Symbols, Combinations, or the Like)

The symbols 501, which are displayed on pseudo reels 151 to 155 of the slot machine 10, form a symbol array. Each symbol 501 constituting the symbol array has one of the code numbers 0 to 19 or more. Each symbol column is structured by a combination of the following symbols 501: "9", "10", "J", "Q", "K", "A", "picture A (PIC_A)", "picture B (PIC_B)", "picture C (PIC_C)", "picture D (PIC_D)", "picture E (PIC_E)", "wild" (wild symbol 503*a*), "BONUS" (trigger symbol 503*b*), or the like.

The four successive symbols 501 in the symbol array are, as shown in FIG. 19, displayed (provided) at the uppermost stage, the second stage, the third stage, and the lowermost stage of the display region of each of the pseudo reels 151 to 155, so that a symbol matrix of 5 columns and 4 rows is formed on the reel display area. The symbols 501 forming the symbol matrix start to scroll at least when a game starts in response to the pressing of the spin button 46. After a predetermined time elapses from the start of the scroll, the scroll of the symbols 501 stops (rearrangement).

In addition to the above, for the symbols 501, various winning combinations are set in advance. A winning combination indicates that an award is established. A winning combination is a combination in which symbols 501 having stopped on an activatable line is advantageous for the player. The advantageous state indicates states such as a state that coins corresponding to the winning combination are paid out, a state that the number of coins to be paid out is added to the credits, and a state that a bonus game starts.

The winning combination in the present embodiment is a combination in which a predetermined number or more of symbols 501 of at least one type are rearranged on an activatable line. When a particular type of symbols 501 is set as a scatter symbol, a winning combination is established when a predetermined number or more of such scatter symbols are rearranged, irrespective of the activatable line. Further, the number of activatable lines may be determined according to the amount of bet entered.

Although illustration is omitted, a symbol random determination table is used when determining the symbols 501 to be rearranged in the normal game. The symbol random determination table includes: symbols 501 of the display blocks 28 in each symbol column, code No. associated with each of the symbols 501, a number range associated with the code No., the number range one of twenty ranges which all together cover numbers 0 to 65535.

The numerical range of 0 to 65535 may be equally or unequally divided. When unequally divided, it is possible to adjust the probabilities of wining for the respective types of the symbols 501 by determining the ranges of the random numbers. In this regard, the ranges corresponding to the "BONUS" of the trigger symbol 503*b* of the specific symbol 503 and the "WILD" of the wild symbol 503*a* may be arranged to be narrower than the ranges of the other types of the symbols 501. In this case, results of games can be easily adjusted in accordance of the progress of the games, by arranging valuable types of the symbols 501 to be less likely to be won. It is possible to use a plurality of symbol random determination tables, according to the gaming status.

(Display Screen of Lower Image Display Panel 141)

An example of the display screen of the lower image display panel 141 in the operation process of the slot machine 10 above will be specifically described.

(Display Screen: Normal Game Screen)

Figure 21:
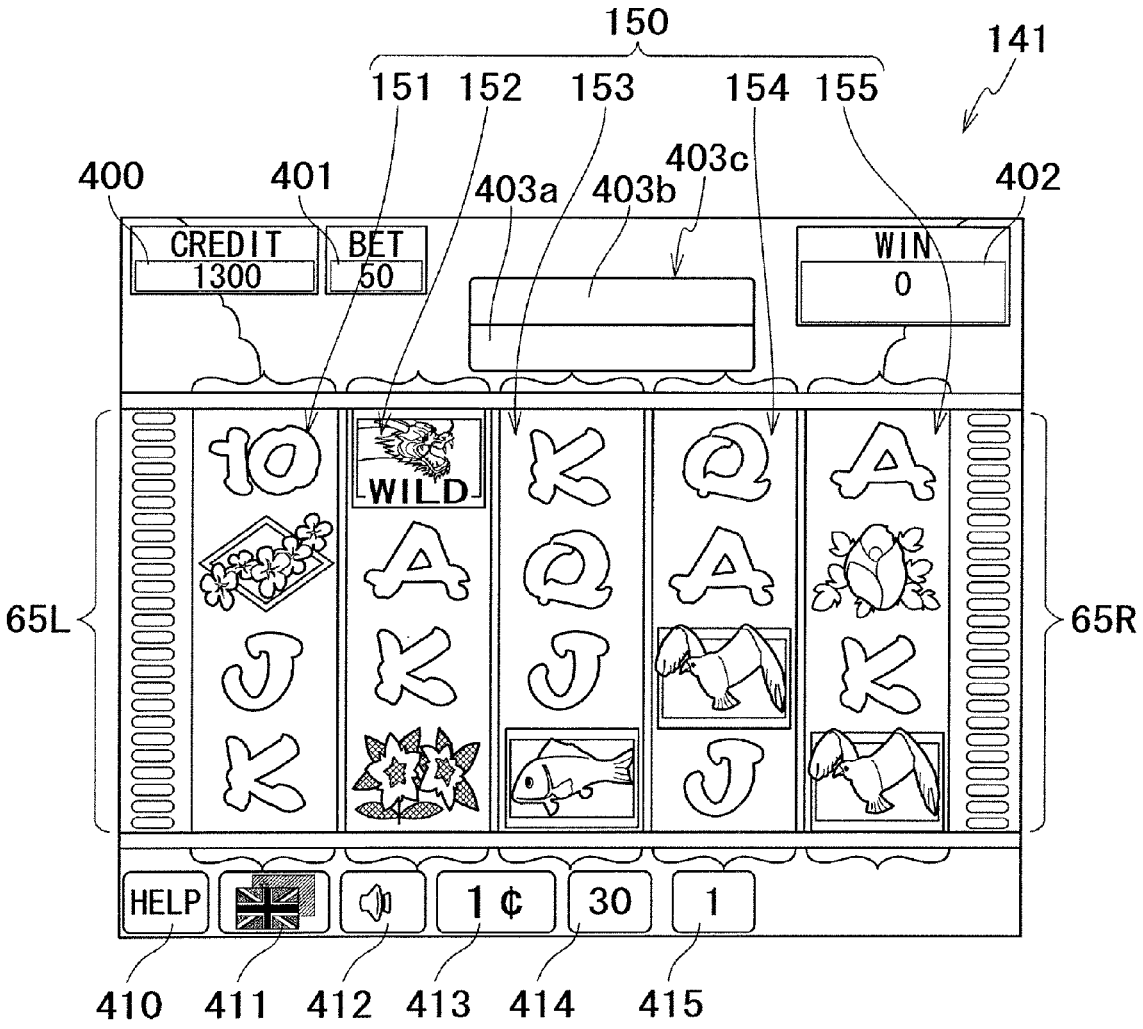
FIG. 21 is an explanatory diagram showing an exemplary display screen.

FIG. 21 shows an example of a normal game screen which is the display screen of the normal game.

More specifically, the normal game screen has a reel display area 150 which is provided at the central portion and has five columns of video reels 151 to 155 and activatable line occurrence parts 65L and 65R which is symmetrically provided to the left and right of the reel display area 150.

Above the reel display area 150 is arrange a credit meter 400, a bet meter 401, and a win meter 402. The credit amount display unit 400 and the bet-number display unit 401 are displayed at the left edge part when viewed from the player. In the meanwhile, the win meter 402 is provided at the right edge part when viewed from the player. Between the bet meter 401 and the win meter 402, a system font area 403*c* is provided. The system font area 403*c* has, in an upper stage and a lower stage, a bet information display region 403*a* and a game state display region 403*b*, respectively.

The credit meter 400 displays the total number of credits (remaining credits). The default value is 0. The value is increased and decreased as follows: When "take WIN", which indicates winning in a game, is achieved, the credit won in the game is added to the credit meter. When a game is played, the bet number is subtracted from the credit meter. The bet number is also subtracted when the collect ends.

The bet meter 401 displays "Total Bets". When a bet is placed for each of the activatable lines, the total bet is bet x the number of lines. The value is re-calculated in each game play. The win meter 402 displays the total obtained credits in an increment manner. The default value is 0. The win meter 402 switchably displays "Line XX Win XX" or "Total Win XX". The display is switched in sync with the display of activatable line at the time of the occurrence of winning. The content above is displayed after the occurrence of winning. The values are determined based on the activatable line at the occurrence of winning and the number of credits. Details of the win meter 402 will be given later.

The bet information display region 403*a* displays the bet information of a game (or the last game). In the first line, the number of bets per line is displayed. The display content is either singular or plural in line with the number of bets. More specifically, in case of one credit per line in the first line, "CREDIT" is displayed when the number of bets per line is 1. In the meanwhile, in case of two credits per line, "CREDITS" is displayed when the number of bets per line is 1. This content is displayed at the time of button selection by the player.

The game state display region 403*b* displays a current state of the game. A state display message is not displayed during the game, and the message "GAME OVER" is displayed when the game is over. When Gamble is waited for, "PLAY ON, GAMBLE or TAKE WIN" is displayed. The message is displayed until a button operation instructing Play-on or Gamble is conducted during the idle state or after the occurrence of winning.

In the meanwhile, below the reel display area 150 are provided a help touch button 410, a language switching touch button 411, a sound volume switching touch button 412, a denomination button 413, a number of lines selection touch button 414, and a bet per line selection touch button 415. These buttons 410, 411, 412, 413, 414, and 415 are provided left to right when viewed from the player.

The help touch button 410 displays the first page of the help screen 4101 when touched. The help touch button 410 is darkened when it is inactivated, e.g., during the rotation of the reels. The button is displayed when the normal screen is displayed. The button disappears in the help screen 4101, the free game screen and the double-up screen.

As the language switching touch button 411 is touched, the language is switched between English and Chinese. The language switching touch button 411 is activated only during the advertisement, and is darkened when it is invalidated, e.g., during the rotation of the reels.

The sound volume switching touch button 412 is used for switching the game sound volume at three stages. Each time the button is touched, the game sound volume is switched such that, for example, low→middle→high→small→middle. The button is displayed when the normal screen is displayed. The button disappears when the help screen 4101 is displayed.

The denomination button 413 displays the current denomination set in the AUDIT. This button is displayed when screens other than the AUDIT are displayed.

The number of lines selection touch button 414 is used for increasing or decreasing the number of activatable lines. In the present embodiment, this button is arranged not to be touchable because the number of lines is fixed to 50.

The bet per line selection touch button 415 makes it possible to conduct bet per line. When the button is touched, five selection buttons corresponding to the current bet configuration appear.

(Details of Display Screen: Activatable Line Boxes)

Figure 22:
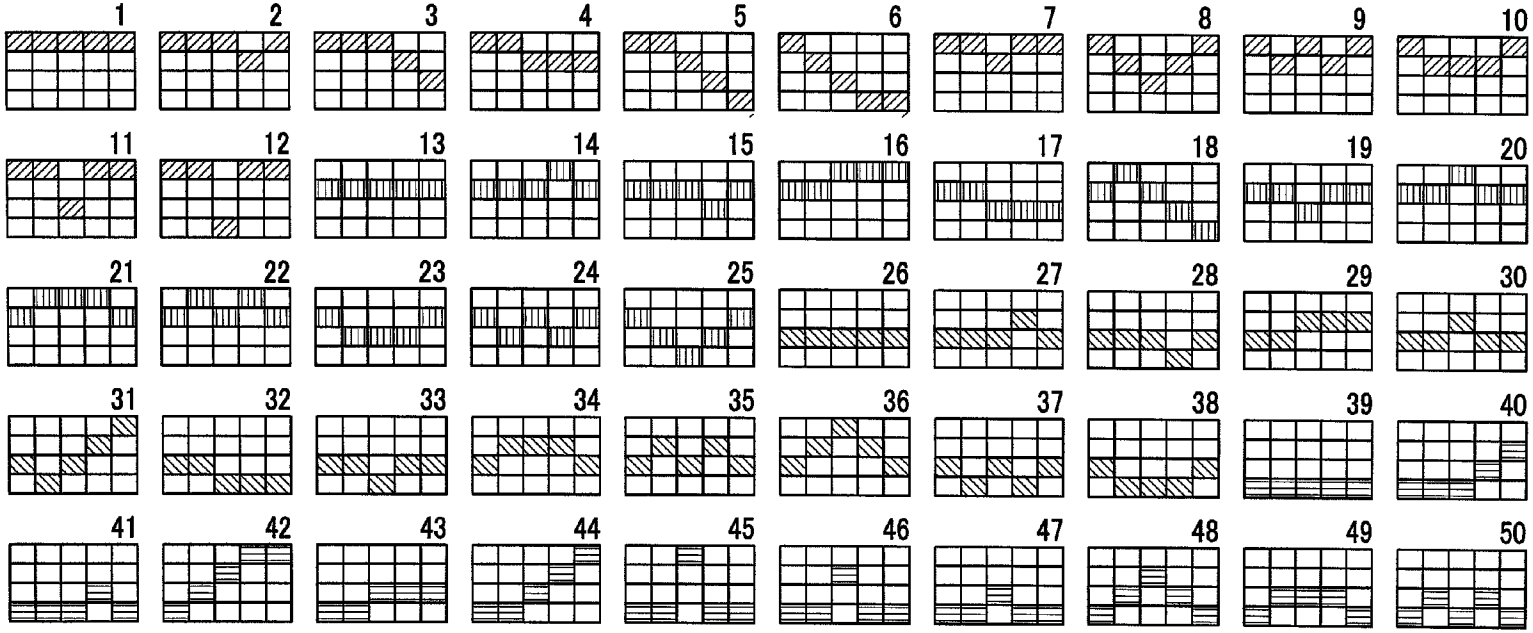
FIG. 22 is an explanatory diagram of activatable lines.

The lower image display panel 141 described above forms, as shown in FIG. 22, payline boxes in the reel display area 150. As the activatable line boxes forming four rows and five columns are combined, 50 activatable lines are formed. Further, FIG. 22 shows the frequency of use of each display block 28, for all the activatable lines. As shown in FIG. 23, the uppermost stage, the second stage, the third stage, and the lowermost stage of each of the pseudo reels 151 to 155 of the display block 28 are given reel position numbers ("0", "1", "2", "3"), respectively. The reel position numbers are referred to when setting activatable lines. Specifically, as shown in FIG. 24, for 50 different activatable lines, there are reel position numbers of each of the pseudo reels 151 to 155. For example, in the activatable line of "No. 1", the reel position number of "0" is set for all of the first reel to the fifth reel. As such, this activatable line passes through the uppermost stages of the pseudo reels 151 to 155.

(Bonus Game)

As the result of running the normal game in the above described structure, the bonus game is run if the rearrangement of symbols meets a predetermined condition. The bonus game is specifically described below. Note that in the following description indicates the display screen of the lower image display panel 141, unless otherwise specifically noted.

(Bonus Game: Basic Flow)

Figure 25:
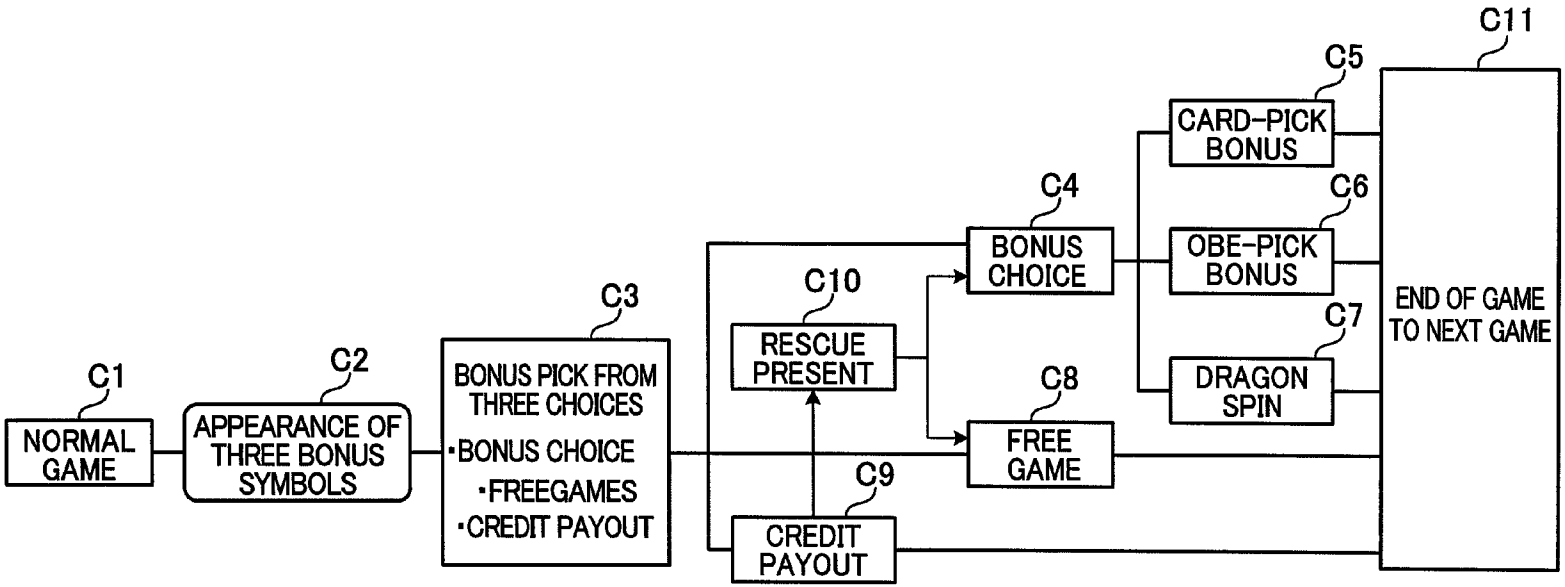
FIG. 25 is a flowchart showing a basic flow of a bonus game.

As shown in FIG. 25, in the normal game (C1), when a predetermined number (e.g. three) or more of "BONUS" (trigger symbol 503*b*) appearing on the activatable line (C2), the bonus game is started. When the bonus game is started, the "bonus pick" which allows selection of any of three types of bonus games is run (C3). In other words, the "bonus pick" is a pickup bonus. The selectable bonus games in the "bonus pick" include: a "bonus choice (BONUS CHOICE)", a "free game (FREE GAMES)", and a "credit payout".

In the bonus pick, if the "bonus choice" is selected, a "bonus choice" which allows selection from any of three types of bonus games is run (C4). That is, the "bonus choice" is the pickup bonus. The selectable bonus games in the "bonus choice" include: a "card pick bonus" (C5), an "obe pick bonus" (C6), and a "dragon spin bonus" (C7). After these bonus games end, the process returns to the normal game and the next game is run (C11). Note that the "bonus choice" is also referred to as "dragon bonus".

When the "free game" is selected in the bonus pick, the free game is run (C8). After the free game, the process returns to the normal game and the next game is run (C11).

When the "credit payout" is selected in the bonus pick, the credit is paid out (C9). Note that, when the predetermined condition is met, the "rescue present (RESCUE PRESENT)" is run as the bonus game. In the "rescue present", whether to run the "bonus choice" of C4 or run the free game of C8 is determined. On the other hand, when the predetermined condition is not satisfied, the process returns to the normal game and the next game is run, after the payout of the credit (C11).

The following describes more specifically the bonus game.

(Bonus Game: Bonus Pick)

Figure 26:
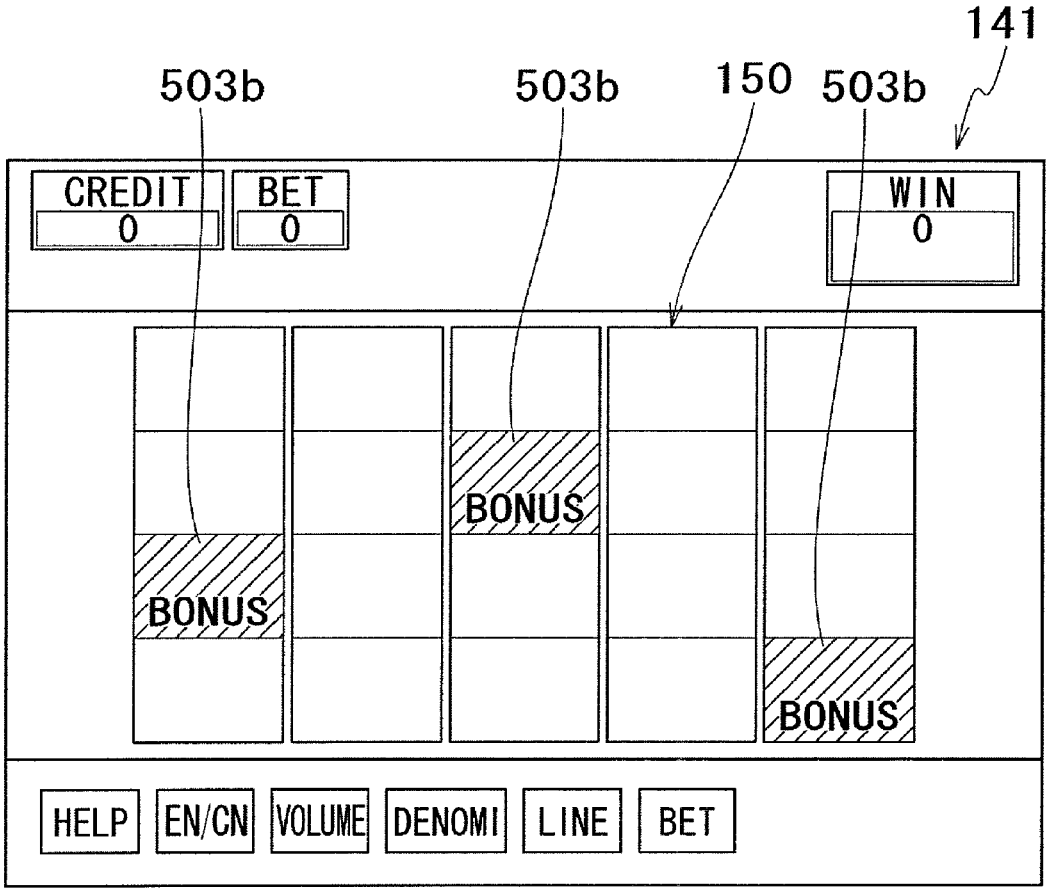
FIG. 26 is an explanatory diagram showing an exemplary display screen.

As shown in FIG. 26, when three or more bonus symbols (trigger symbols 503*b*) appear on the activatable line in the reel display area 150 of the lower image display panel 141 during the normal game, the bonus game is started and the bonus pick becomes runnable.

Figure 27:
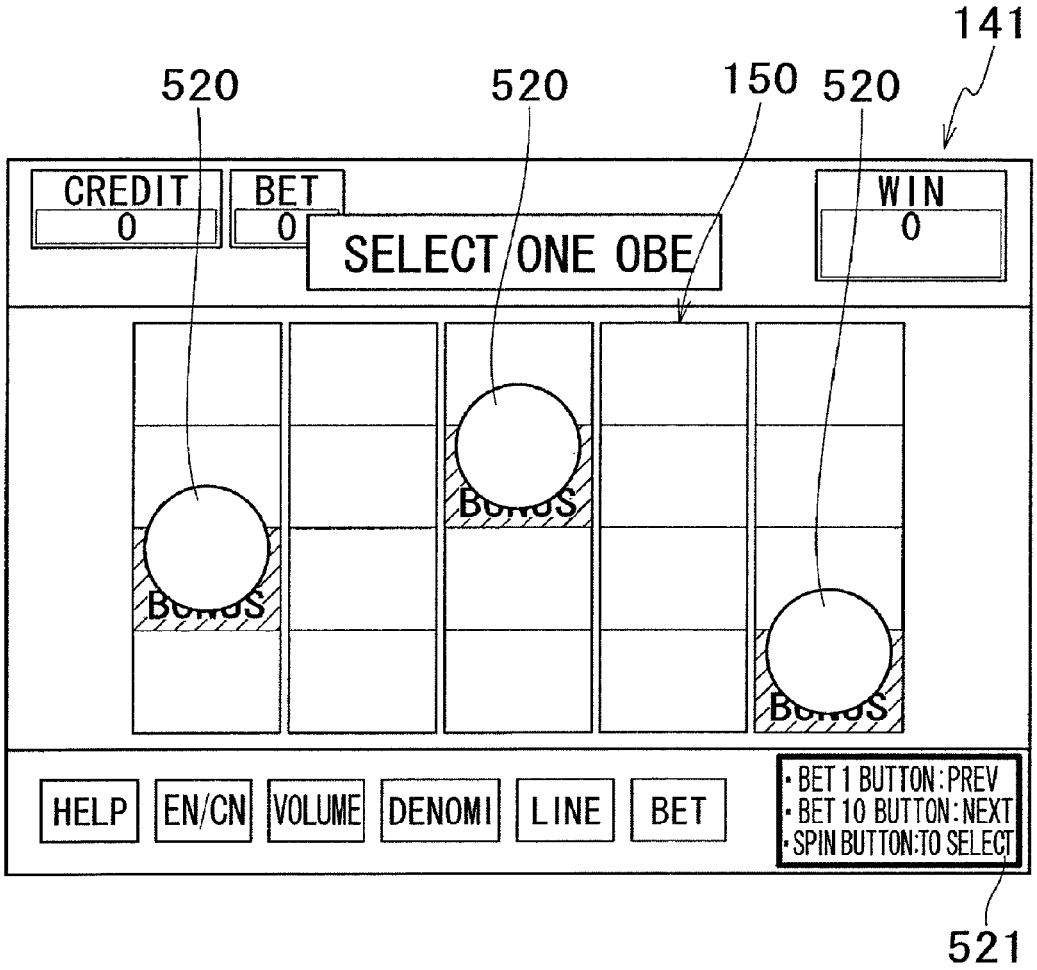
FIG. 27 is an explanatory diagram showing an exemplary display screen.
Figure 28:
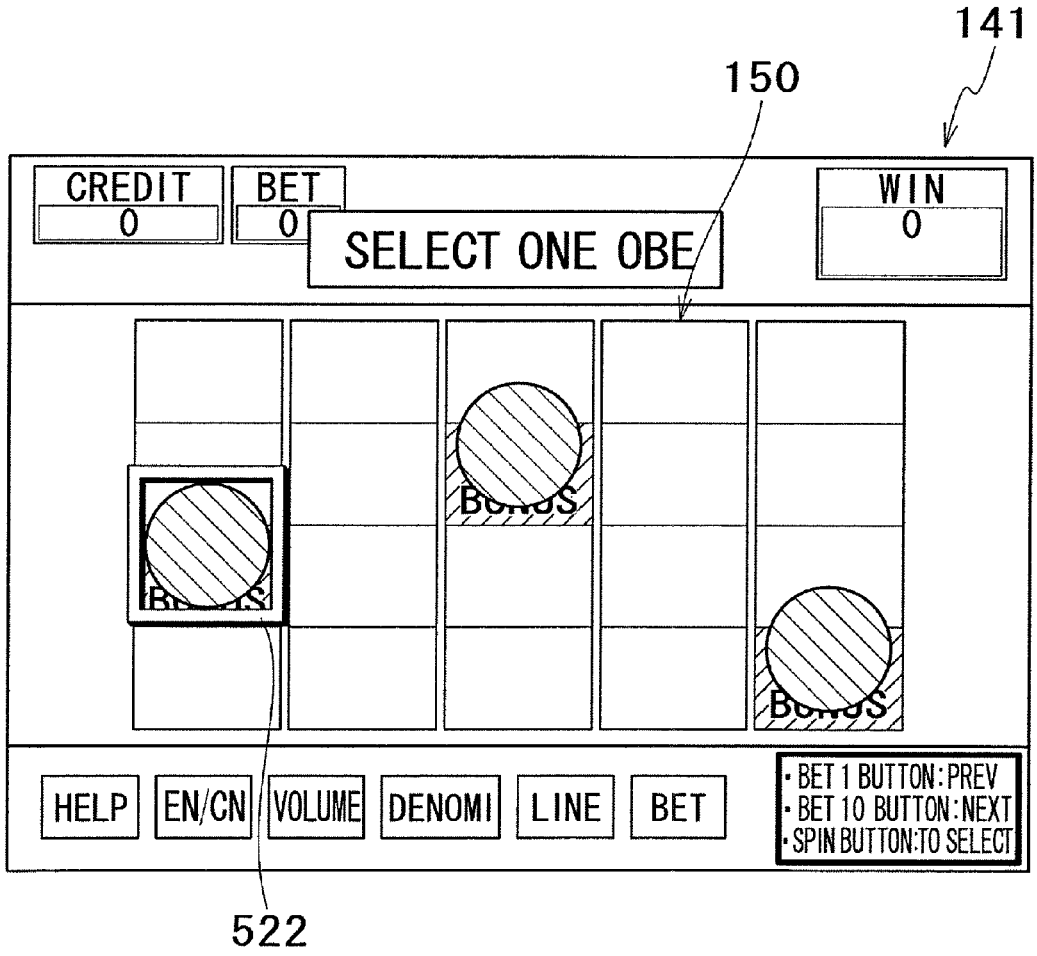
FIG. 28 is an explanatory diagram showing an exemplary display screen.

When the bonus game is started, a bonus pick screen is displayed as shown in FIG. 27. In the bonus pick screen are displayed bonus pick choices 520 based on the bonus symbols rearranged. Each of the bonus pick choices 520 is the trigger symbol 503*b* stopped, which is changed into an image having a shape of an obe. In the upper area of the screen is displayed text ("select one obe") prompting the player to select a bonus pick choice 520. In the lower right part of the screen is a control panel 30 displaying an operation navigation 521 for selecting a bonus pick choice 520.

Specifically, the player is able to change the bonus pick choice 520 by operating the 1-bet button 34 or the 10-bet button 39. As shown in FIG. 27, when the 1-bet button 34 or the 10-bet button 39 is operated, a rectangular cursor 522 surrounding the bonus pick choice 520 is displayed. That is, the bonus pick choice 520 on which the cursor 522 is displayed is the choice being selected. When the player further operates the 1-bet button 34 or the 10-bet button 39, the bonus pick choice 520 on which the cursor 522 is displayed is changed. When the player operates the spin button 46, the bonus pick choice 520 being selected is determined. Note that the bonus pick choice 520 is selectable by using the control panel 30, and is also selectable through the touch panel 69.

By selecting any of the three bonus pick choices 520 displayed, any one of the "bonus choice", the "free game", and the "credit payout" is selected as the bonus game. Note that, as shown in FIG. 27, which one of the bonus pick choices 520 is associated which one of the "bonus choice", the "free game", and the "credit payout" is not displayed.

Figure 29:
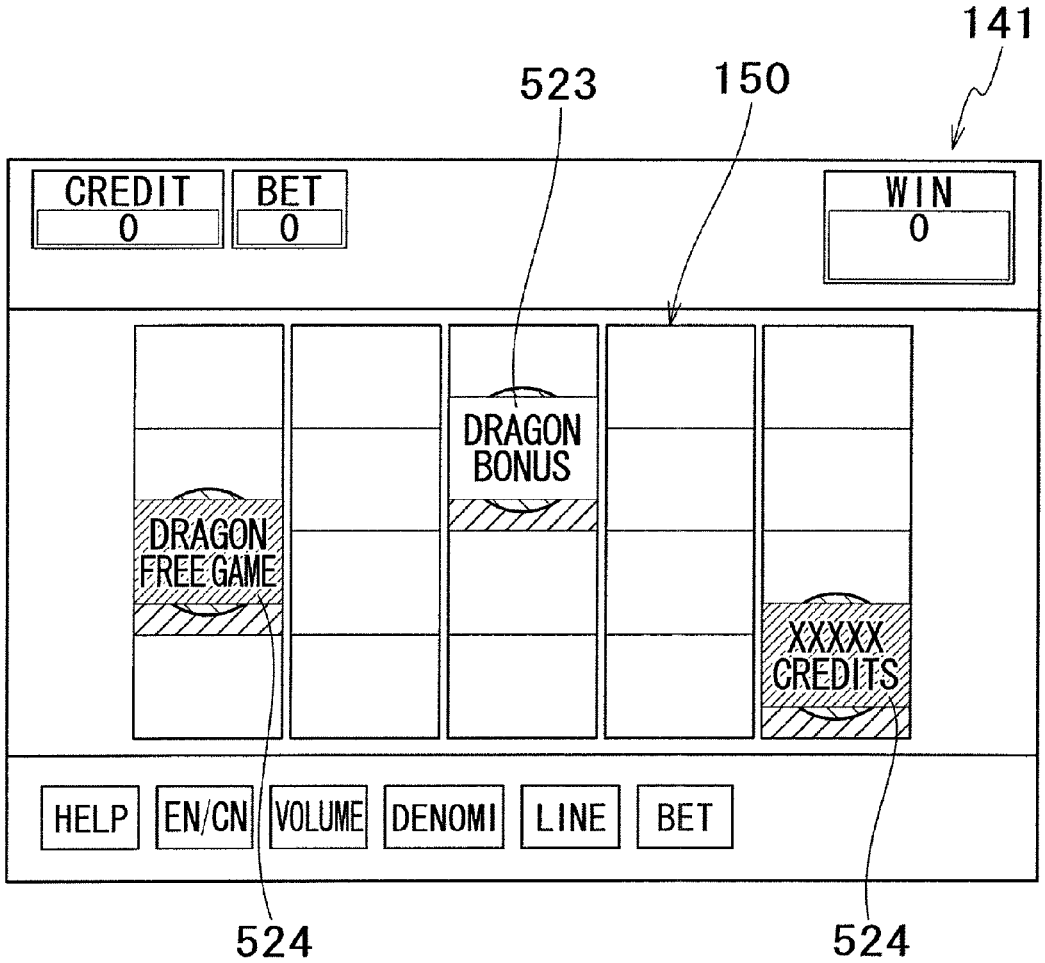
FIG. 29 is an explanatory diagram showing an exemplary display screen.

As shown in FIG. 29, when the player selects a bonus pick choice 520, a bonus pick selection result 523 is displayed in the position of the bonus pick choice 520 selected. In positions of those unselected bonus pick choices 520, bonus pick non-selection results 524 are displayed. The bonus pick selection result 523 is displayed immediately after the player selects the contents of the bonus game. Each of the bonus pick non-selection results 524 showing the contents of unselected bonus game is displayed a predetermined period (e.g., 2 seconds) after the bonus pick selection result 523 is displayed. Displaying of the bonus pick non-selection result 524 is grayed out. Further, FIG. 29 shows a screen in a case where the player has selected the "dragon bonus (bonus choice)".

Further after a predetermined period from point where the bonus pick non-selection result 524 is displayed, the display shifts to the introduction screen of the bonus game selected by the player.

(Bonus Game: Credit Payout)

Figure 30:
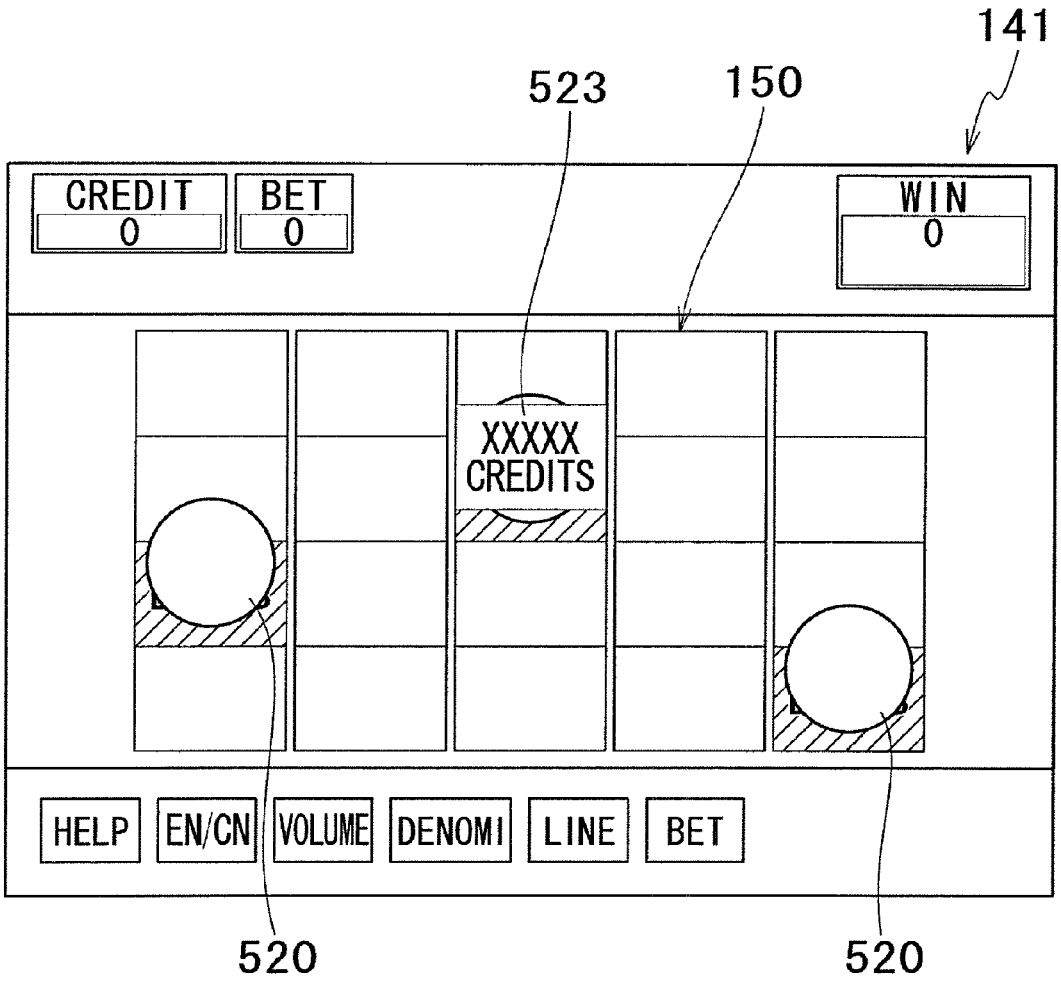
FIG. 30 is an explanatory diagram showing an exemplary display screen.

The following describes a case where the credit payout is selected in the bonus pick. FIG. 30 shows a selection result screen immediately after the credit payout is selected in the bonus pick. In this screen is displayed the bonus pick selection result 523 indicating that the credit payout has been selected. In the bonus pick selection result 523 indicating that the credit payout has been selected, an amount of the payout to be awarded to the player is indicated. Further, displaying of the bonus pick choices 520 not selected by the player is continued.

Figure 31:
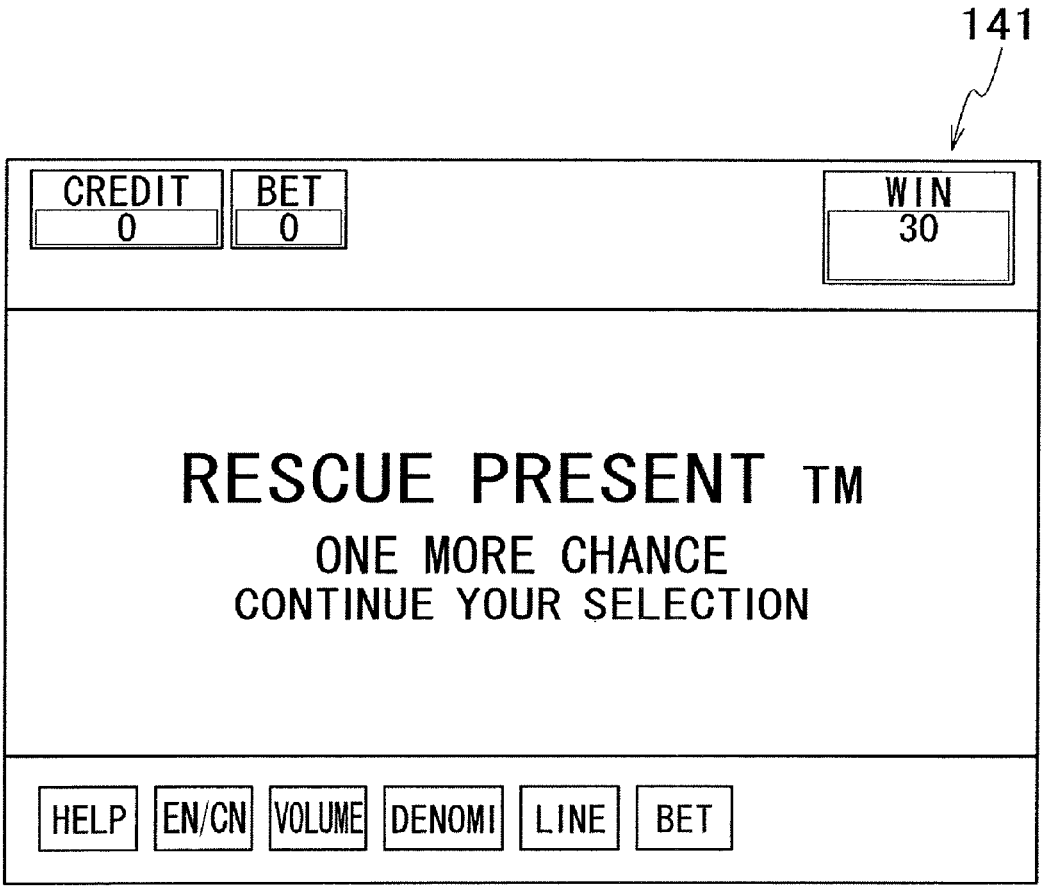
FIG. 31 is an explanatory diagram showing an exemplary display screen.

When the player selects the credit payout, whether to execute the "rescue present" is randomly determined. When the "rescue present" is won as the result of the determination, a screen shown in FIG. 31 indicating that the player won the "rescue present" is displayed 2 seconds after the player selects the bonus pick choice 520. The amount of payout to be awarded in the "credit payout" is added to the value of the win meter 402.

Figure 32:
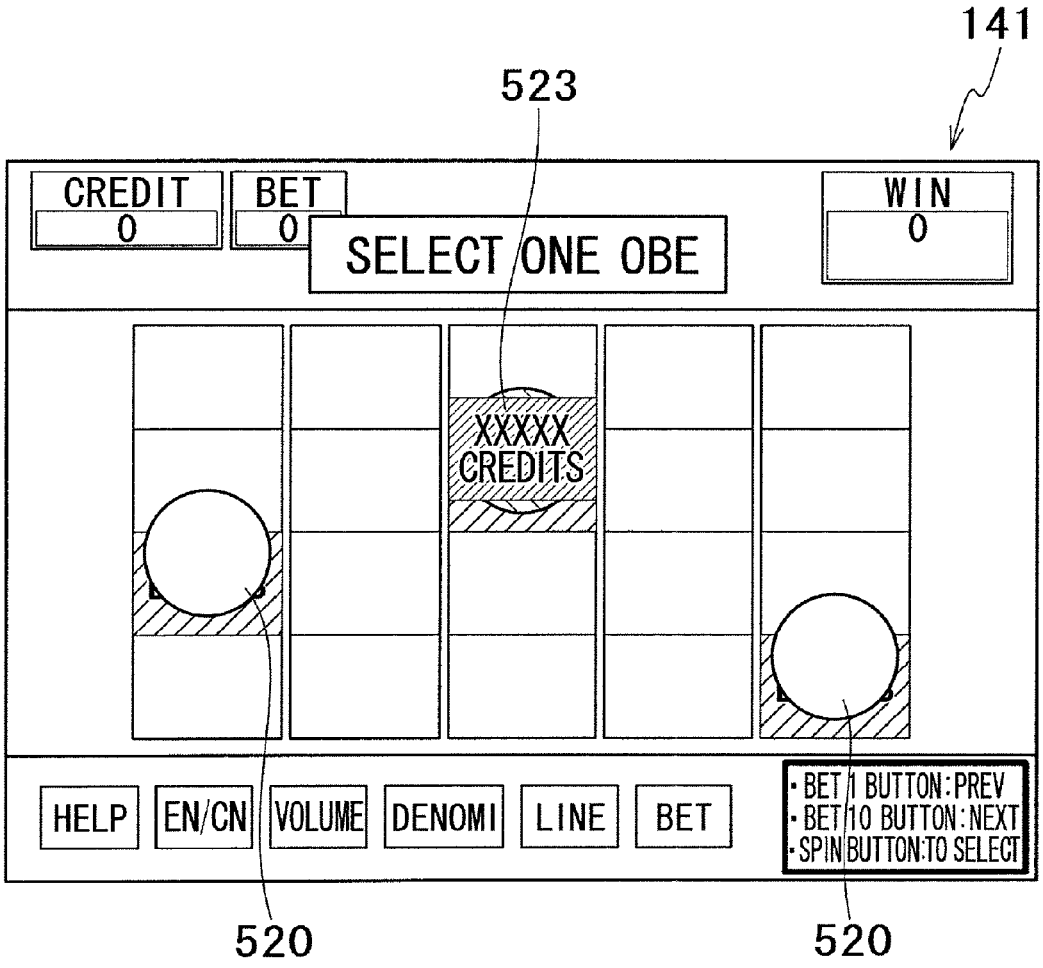
FIG. 32 is an explanatory diagram showing an exemplary display screen.
Figure 33:
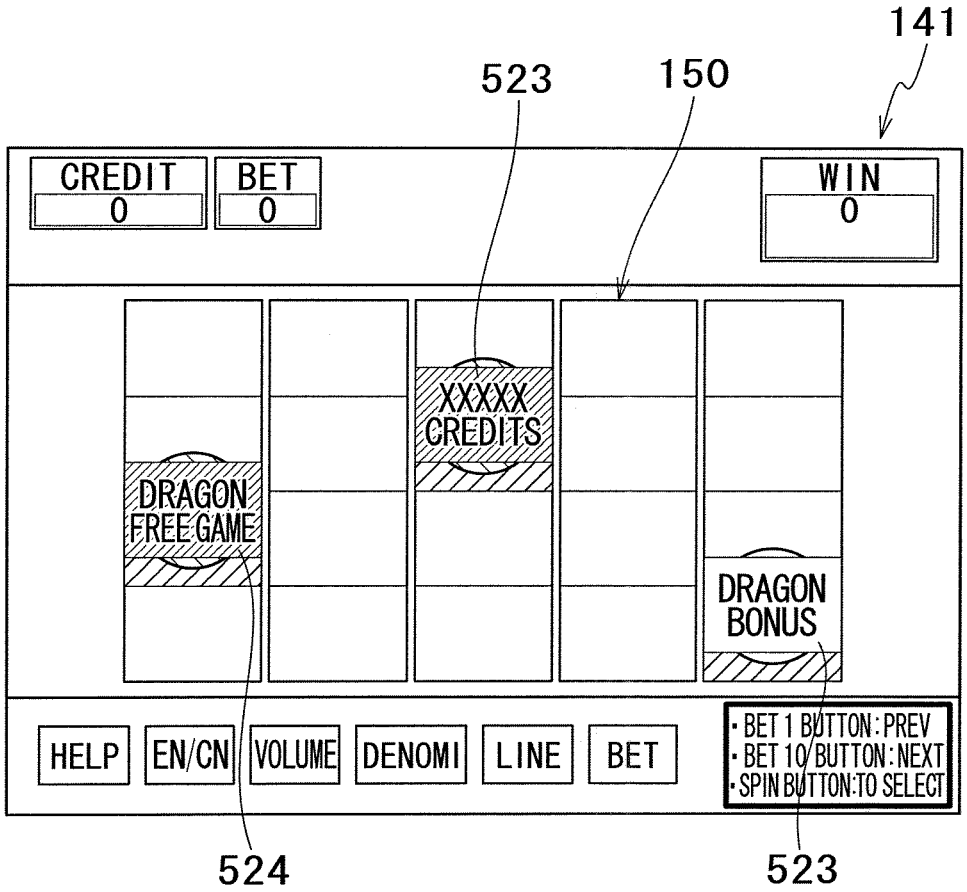
FIG. 33 is an explanatory diagram showing an exemplary display screen.

After that, as shown in FIG. 32, a screen is displayed for selecting one of the two bonus pick choices 520 not selected in FIG. 30. At this point, the bonus pick selection result 523 displays the amount of payout to be award to the player in gold text, and the rest in gray. As shown in FIG. 33, when one of the bonus pick choices 520 is selected, a bonus pick selection result 523 is displayed for the selected bonus pick choice 520, while a bonus pick non-selection result 524 is selected for the unselected selected bonus pick choice 520. Then, the displaying shifts to the introduction screen of the bonus game selected.

Figure 34:
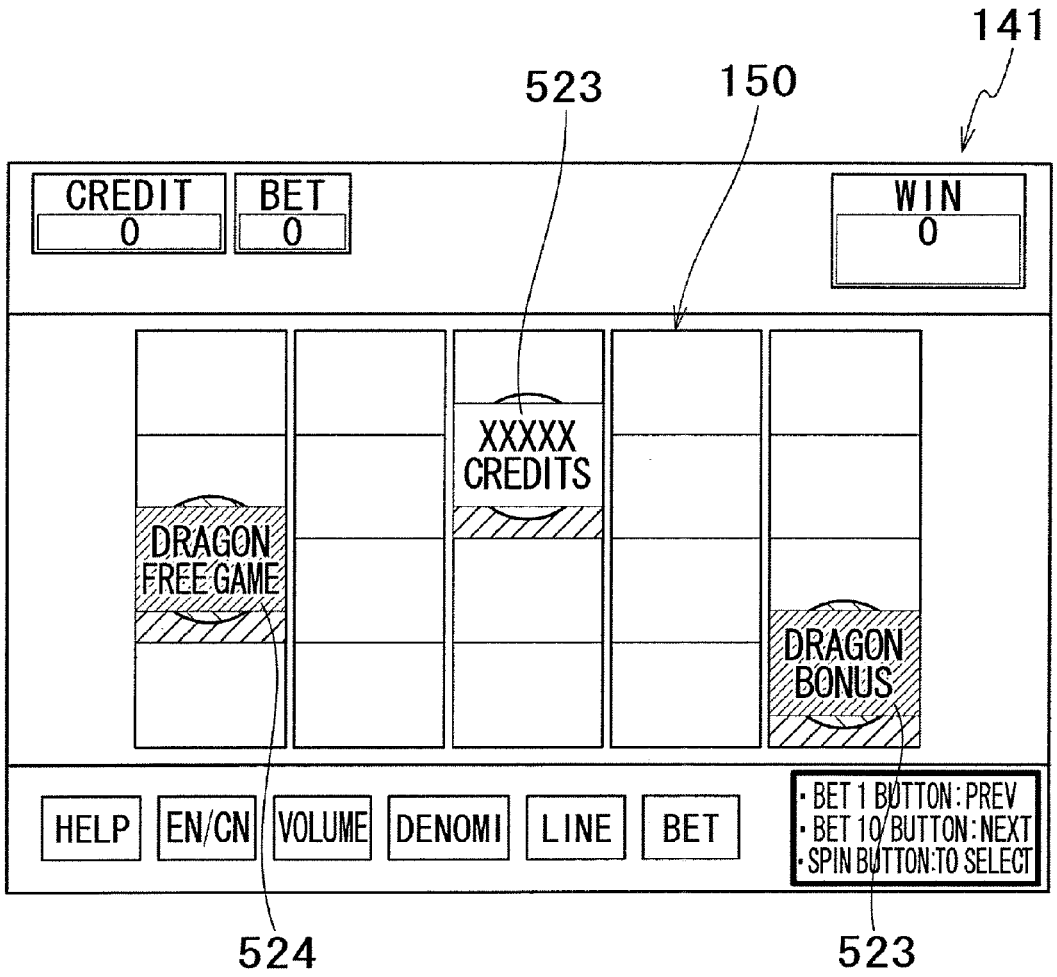
FIG. 34 is an explanatory diagram showing an exemplary display screen.

Further, when the "rescue present" is not won as the result of the random determination, a screen shown in FIG. 34 is displayed after a predetermined period from the point where the screen of FIG. 30 is displayed. In other words, the contents of the bonus game not selected by the player is displayed after the predetermined period from the point where the bonus pick selection result 523 is displayed. The bonus pick non-selection results 524 are displayed in gray.

(Bonus Game: Free Game)

The following describes a case where the free game is selected in the bonus pick. The free game is different from the normal game in that the slot game is run a predetermined number of times. In other words, the free game does not require a bet. Further, in the free game, one of the pseudo reels 151 to 155 is randomly selected in every game, and all the symbols on the selected pseudo reel become wild symbols 503*a*. The pseudo reel becoming whose symbols all become a wild symbol 503*a* is hereinafter also referred to as expand wild. When the pseudo reel is selected, for example, the lower image display panel 141 displays an effect such that the dragon moves to the selected pseudo reel. Further, in the free game, symbol columns for free game which are different from those of the normal game are used. As to the payout table (payout magnification), the same table used in the normal game is used. Note that, when three trigger symbols 503*b* appear in the free game, a predetermined number is added to the number of free games. This process in which three trigger symbols 503*b* appear and the predetermined number is added to the number of the free games is called "retrigger (RETRIGGER)".

Figure 35:
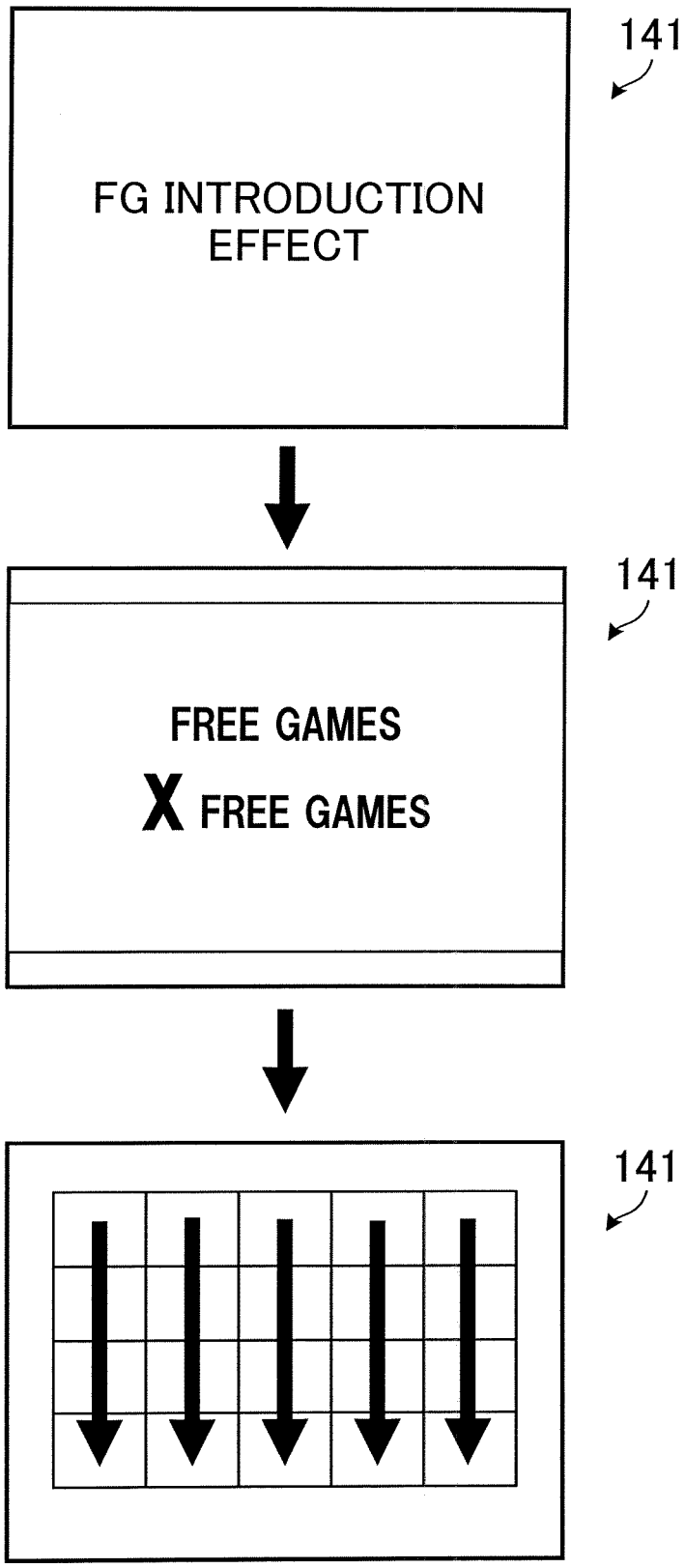
FIG. 35 is an explanatory diagram showing an exemplary display screen.

As shown in FIG. 35, when the free game is started, the screen is switched to the free game start screen after the free game introduction effect is executed. In the free game start screen is displayed text reading "X FREE GAMES", which indicates the number of free games. The first free game is started after the switching over to the free game screen. Note that, in the initial screen of the free game, the symbols are arranged in each of the pseudo reels 151 to 155 so that the symbol with the symbol code number "0" is positioned at the position associated with the reel position number "0" (i.e., uppermost stage).

Figure 36:
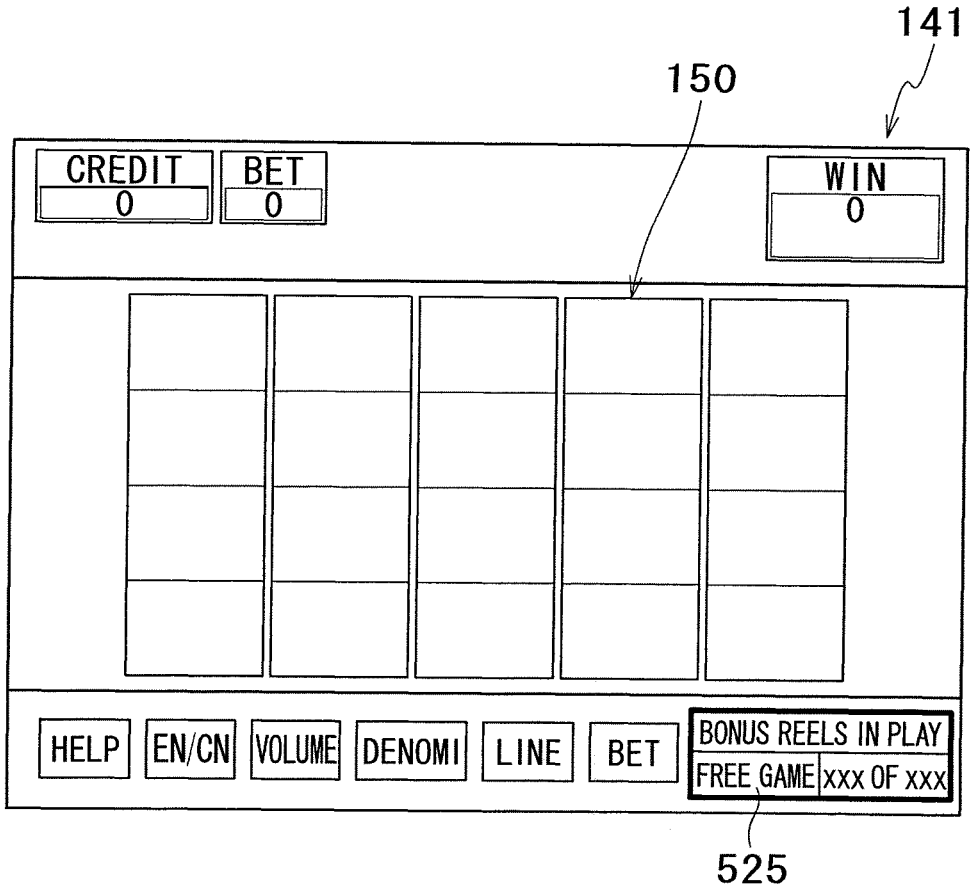
FIG. 36 is an explanatory diagram showing an exemplary display screen.

As shown in FIG. 36, in the lower right part of the free game screen, a free game counter 525 is displayed. In the upper stage of the free game counter 525 is displayed "BONUS REELS IN PLAY". This text indicates that symbol columns different from those of the normal game are in use. The text may be hidden temporarily by enlarging a part of the free game counter 525 or by a symbol animation. The game state in which the symbol columns different from those of the normal game is preferably indicated in the help screen. Further, in the lower left stage of the free game counter 525 is displayed "FREE GAME" which indicates the free game is running. The text "FREE GAME" is enlarged when variable display of the symbols starts. In the lower right stage of the free game counter 525 is displayed "○○○ OF XXX" indicating the number of free games in total and a counted number. The "XXX" in the text "○○○OF XXX" is a number indicating the number of free games in total. Further, the "○○○" is a number indicating the number of free games having run at the current point. The "○○○" and the "XXX" are enlarged when the variable display of the symbols is started, so as to let the player know of the progress one by one. Further, the "○○○" is incremented by 1 at the same time the variable displaying of the symbols is started, and the number is enlarged when an effect voice is output. The maximum digits of "○○○" and the "XXX" are both three.

Figure 37:
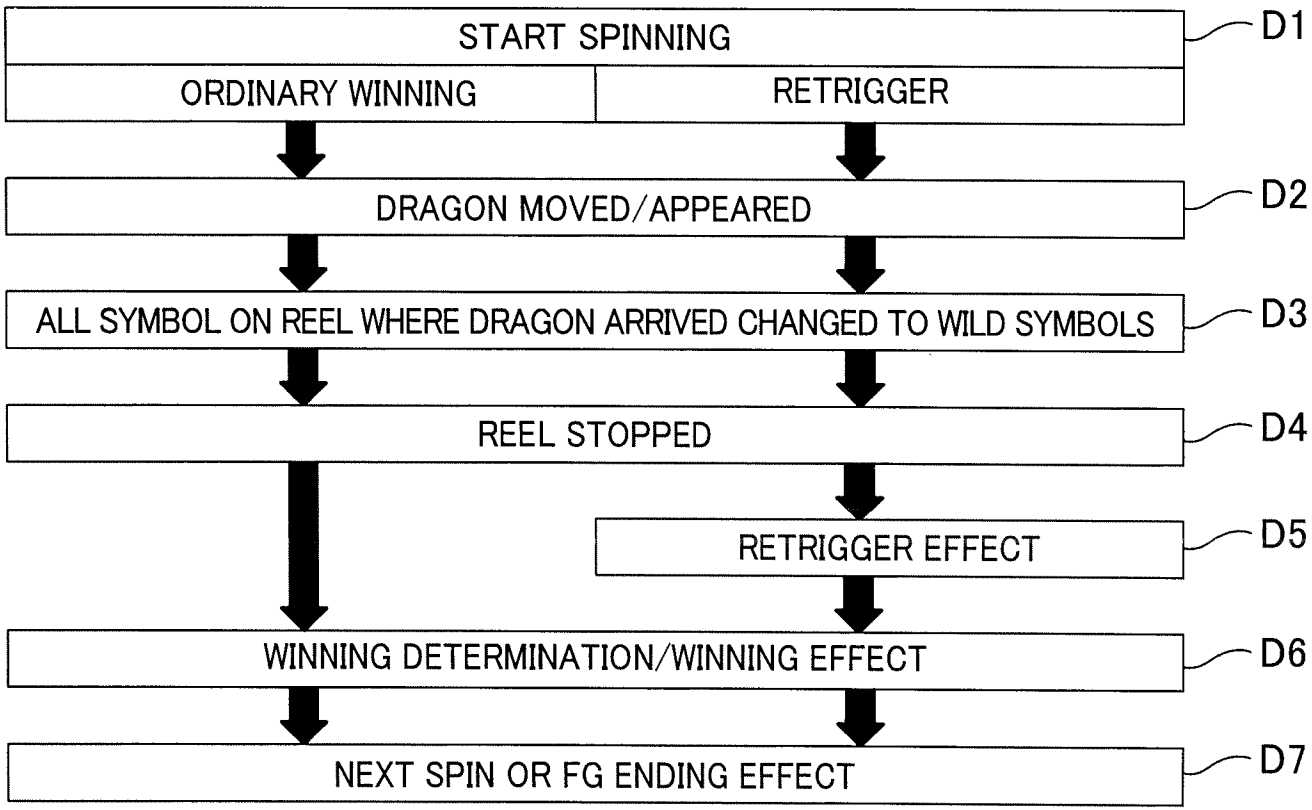
FIG. 37 is a flowchart of a free game.

With reference to FIG. 37, the following describes a flow of the free game. The winnings (WIN) of the free game includes: a payout (normal win) which is achieved when a predetermined number of symbols are rearranged on an activatable line; and a retrigger which is achieved when three trigger symbols 503*b* are rearranged. The following description applies to both of the winnings, unless otherwise specifically noted.

First, in the free game, spinning is started (D1). Then, the lower image display panel 141 displays an effect such that a dragon appears and moves (D2). Then, the symbols on any of the pseudo reels 151 to 155 where the dragon has moved to change into the wild symbols 503*a* (D3). In other words, the pseudo reel where the dragon has moved to has a wild symbol 503*a* rearranged in the uppermost stage, the second stage, the third stage, and the lowermost stage. Then, all the symbols of the pseudo reels 151 to 155 are stopped. When the winning is a retrigger, an effect for the retrigger is executed (D5). To the total number of free games shown on the free game counter 525, a predetermined number is added. Then, there is determined if any of the winning is achieved, and an effect according to the winning is executed (D6). When there is a remaining free game, shifting occurs to the next free game, and when the counted number of free games played matches the total number of free games, there is executed an effect for notifying the end of the free game (D7).

Figure 38:
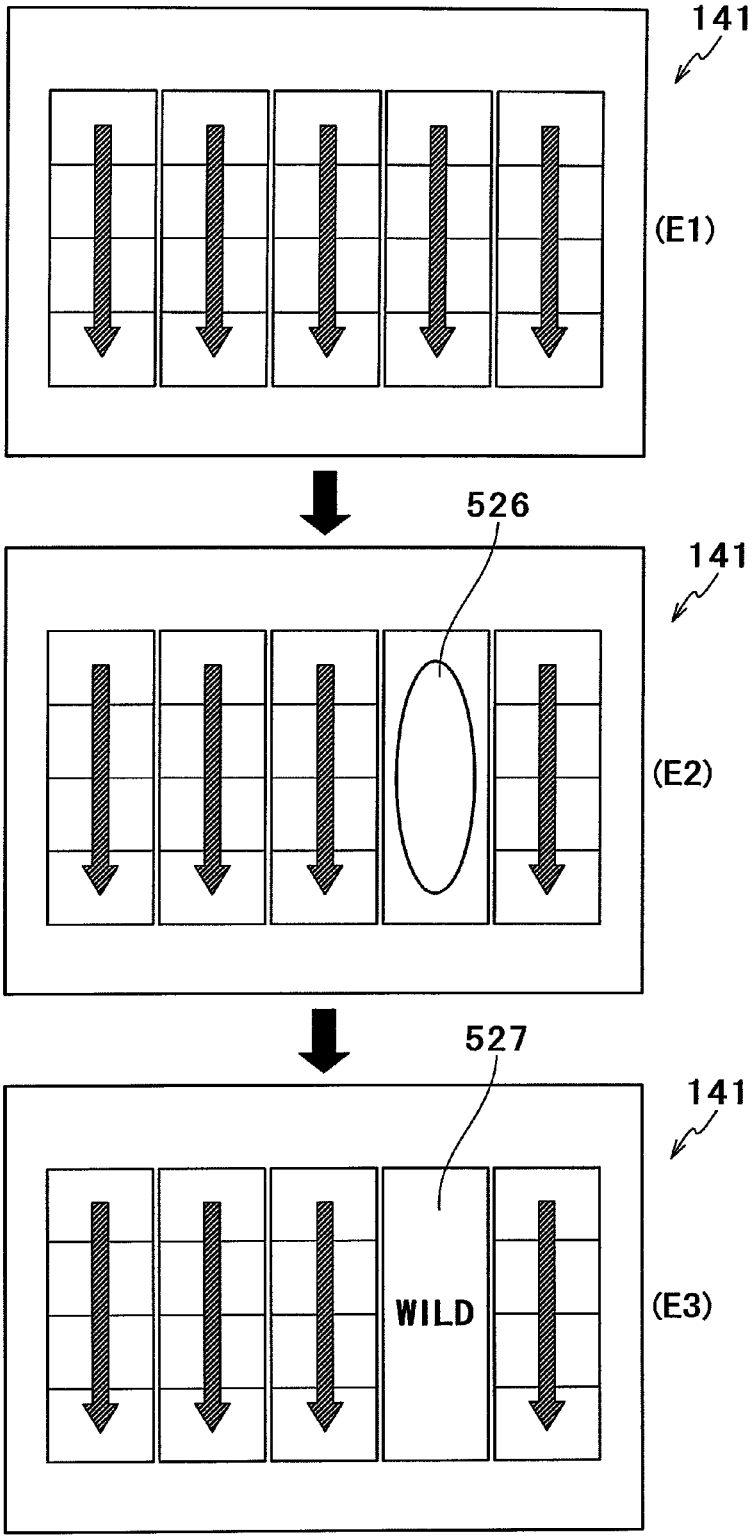
FIG. 38 is an explanatory diagram showing an exemplary display screen.
Figure 39:
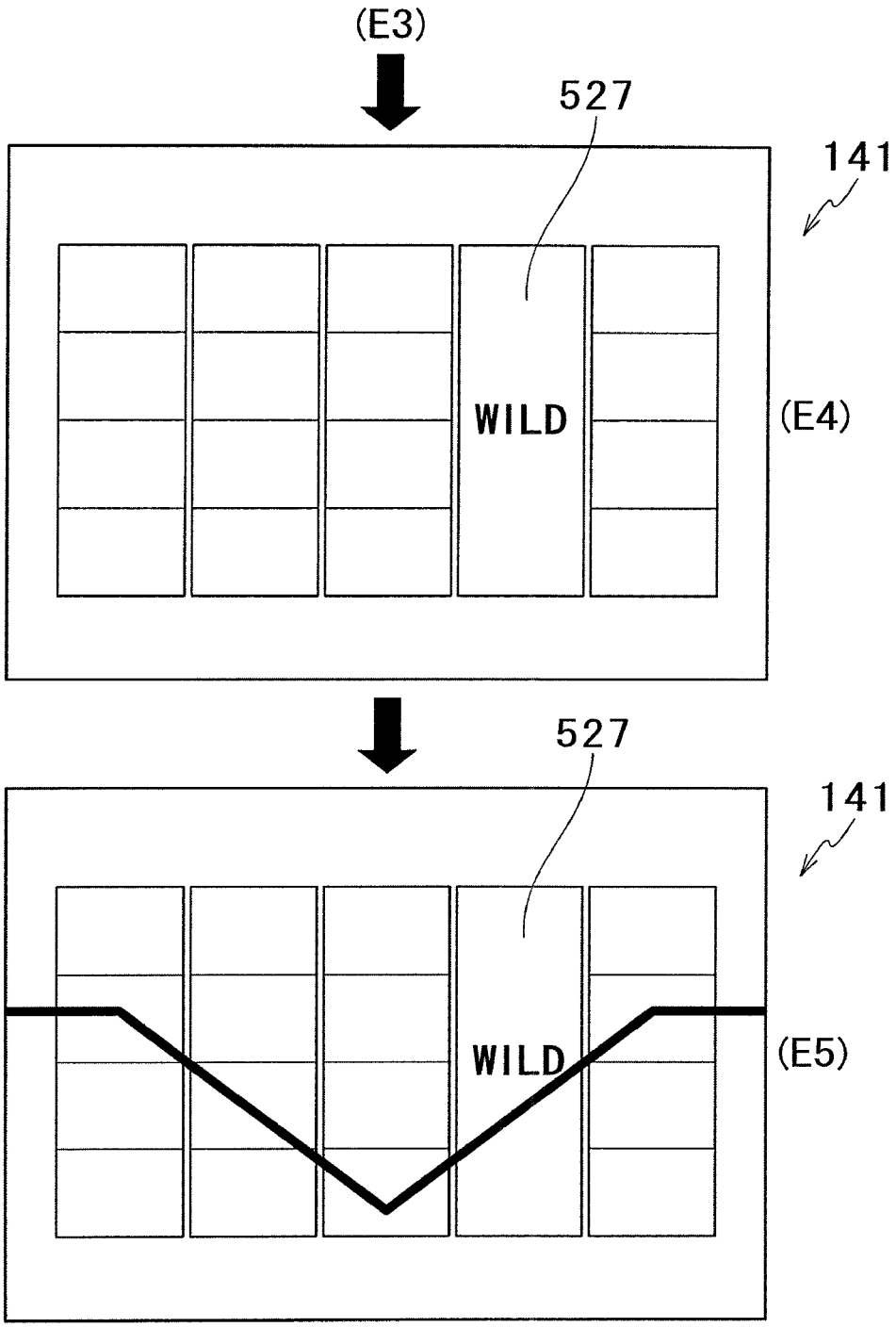
FIG. 39 is an explanatory diagram showing an exemplary display screen.

The following describes, with reference to FIG. 38 and FIG. 39, the effect such that the dragon appears and moves in the first spin of the free game. First, as shown in FIG. 38, variable display of the pseudo reels 151 to 155 is started (E1). Then, on any of the pseudo reels 151 to 155 randomly determined, an effect image 526 of the dragon is displayed (E2). Then, the pseudo reel on which the effect image 526 is displayed becomes an expand wild (E3). As shown in FIG. 39, the pseudo reel having become the expand wild stops with all of its symbols becoming a wild symbol (E4). Then, when a winning is achieved, a win effect is executed (E5), and then the next spin is started. If no winning is achieved, the next spin is started. In the win effect, the activatable line related to the winning is displayed.

Figure 40:
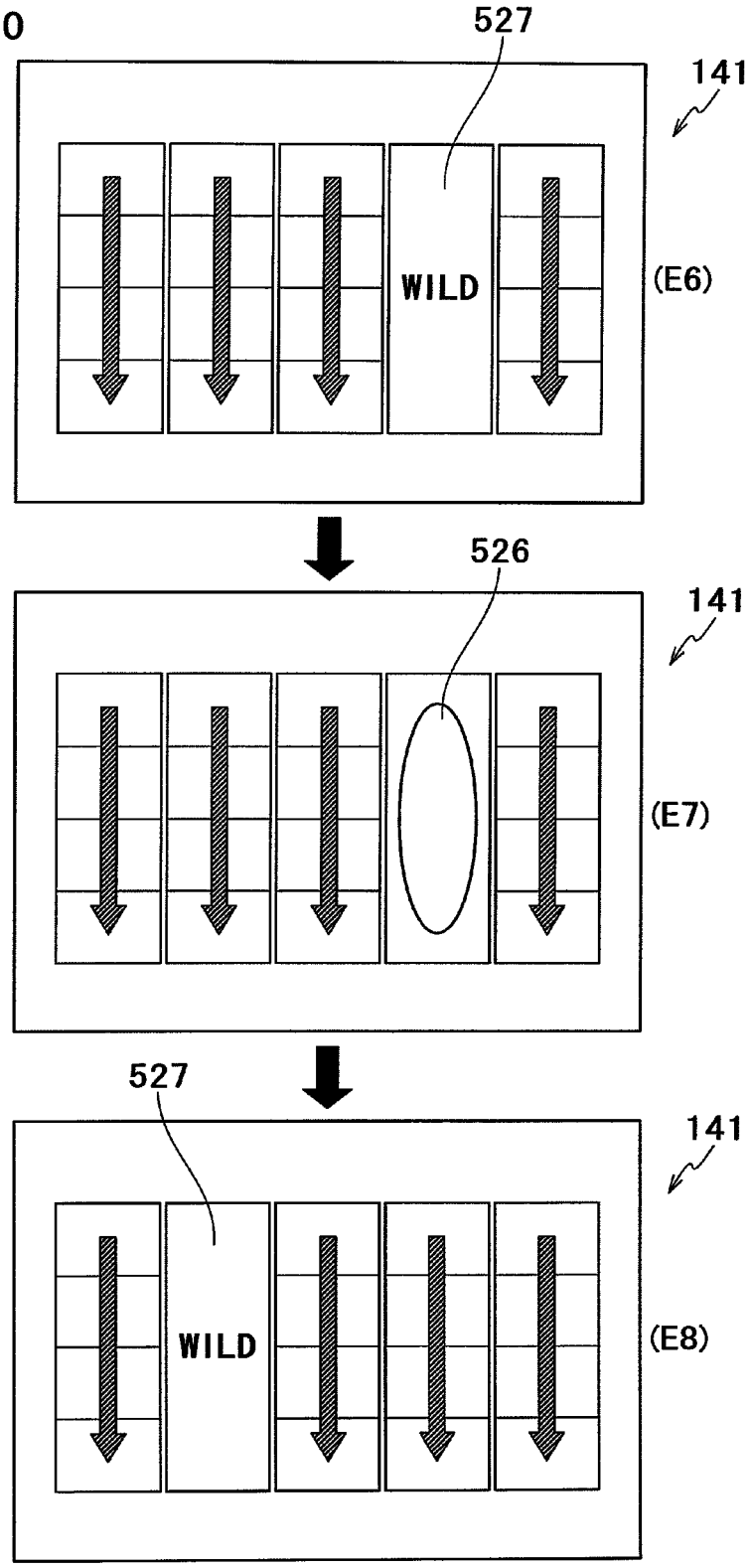
FIG. 40 is an explanatory diagram showing an exemplary display screen.
Figure 41:
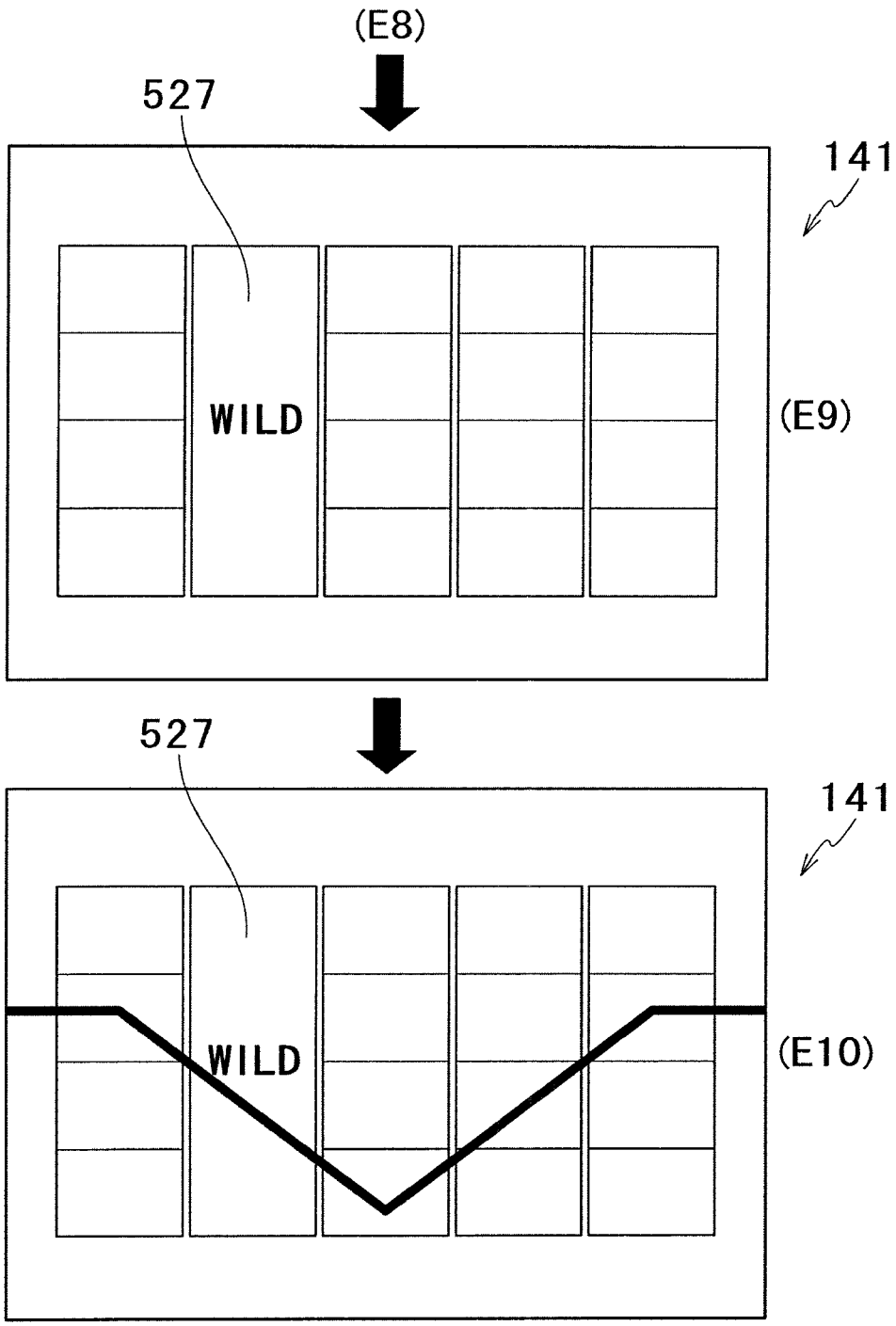
FIG. 41 is an explanatory diagram showing an exemplary display screen.

The following describes, with reference to FIG. 40 and FIG. 41, the effect such that the dragon appears and moves in the second and the subsequent spins of the free game. First, as shown in FIG. 40, variable display of the pseudo reels 151 to 155 is started (E6). Note that the pseudo reel having become the expand wild in the previous game continues to be an expand wild. Then, the effect image 526 of the dragon appears from the pseudo reel in the expand wild state (E7), and the effect image 526 of the dragon moves to any of the pseudo reels 151 to 155 randomly determined (E2). Then, the pseudo reel on which the effect image 526 has moved to becomes an expand wild (E8). As shown in FIG. 41, the pseudo reel having become the expand wild stops with all of its symbols becoming a wild symbol (E9). Then, when a winning is achieved, a win effect is executed (E10), and then the next spin is started. If no winning is achieved, the next spin is started. In the win effect, the activatable line related to the winning is displayed.

Figure 42:
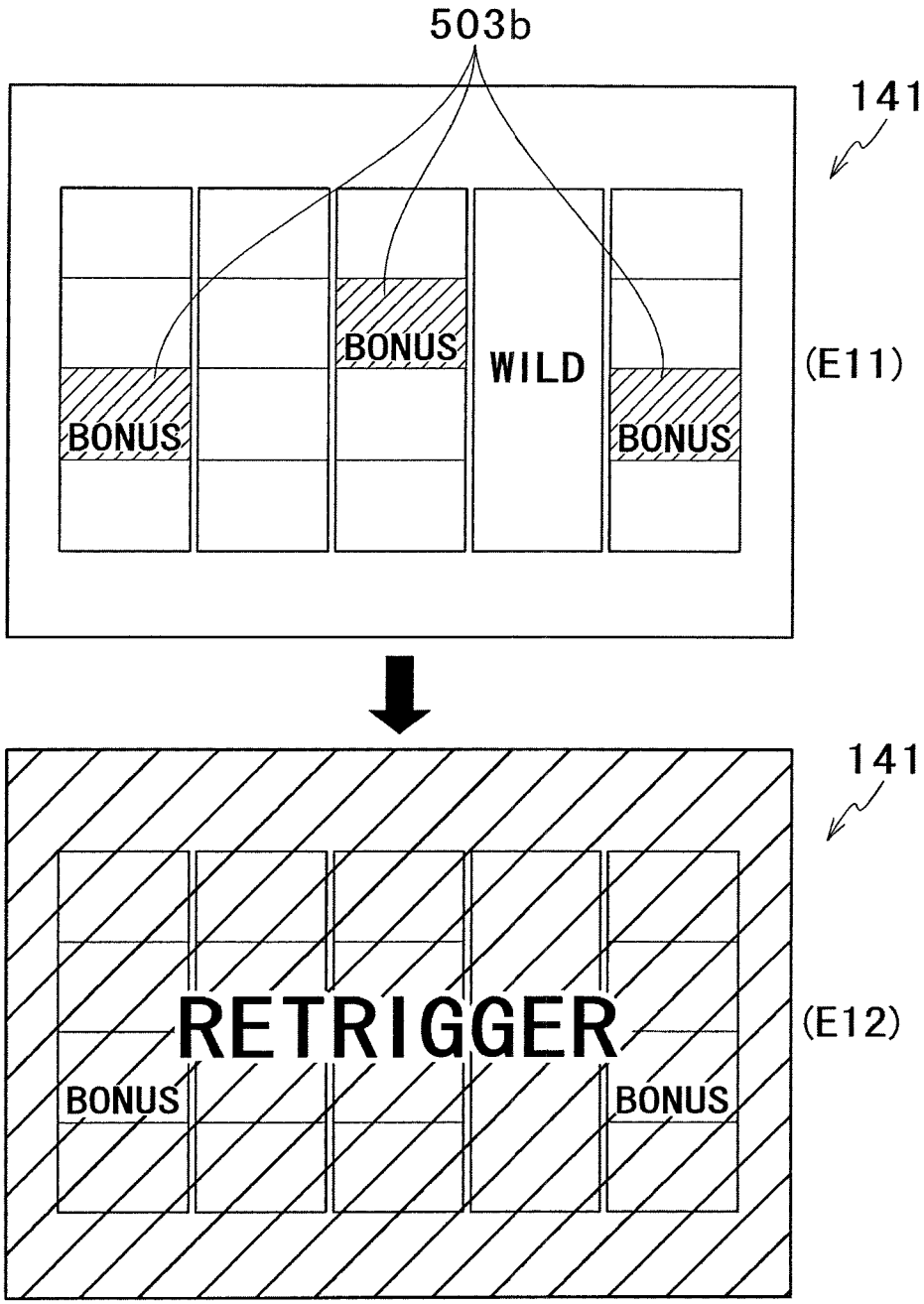
FIG. 42 is an explanatory diagram showing an exemplary display screen.
Figure 43:
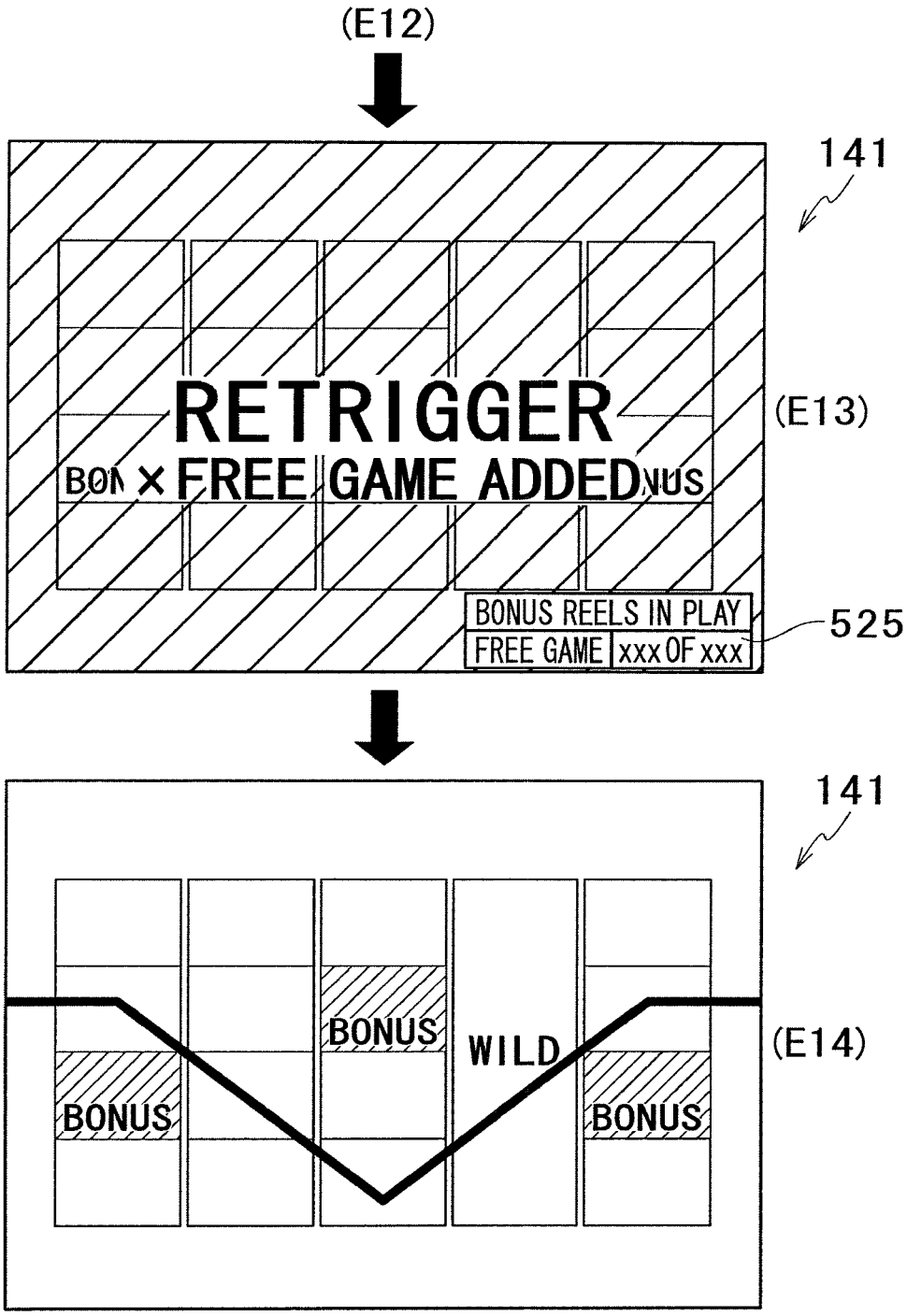
FIG. 43 is an explanatory diagram showing an exemplary display screen.

The following describes, with reference to FIG. 42 and FIG. 43, the retrigger in the free game. First, as shown in FIG. 42, the retrigger is achieved when three bonus symbols (trigger symbols 503*b*) are stopped (E11). When the retrigger is met, text reading "RETRIGGER" is displayed (E12). Then, as shown in FIG. 43, text ("x free game added") indicating the number of additional free games is displayed, and the number of free games indicated on the free game counter 525 is increased (E13). After that, when there is another winning in addition to the retrigger, a win effect is executed (E14), and then the next spin is started. If no winning is achieved, the next spin is started. In the win effect, the activatable line related to the winning is displayed.

Figure 44:
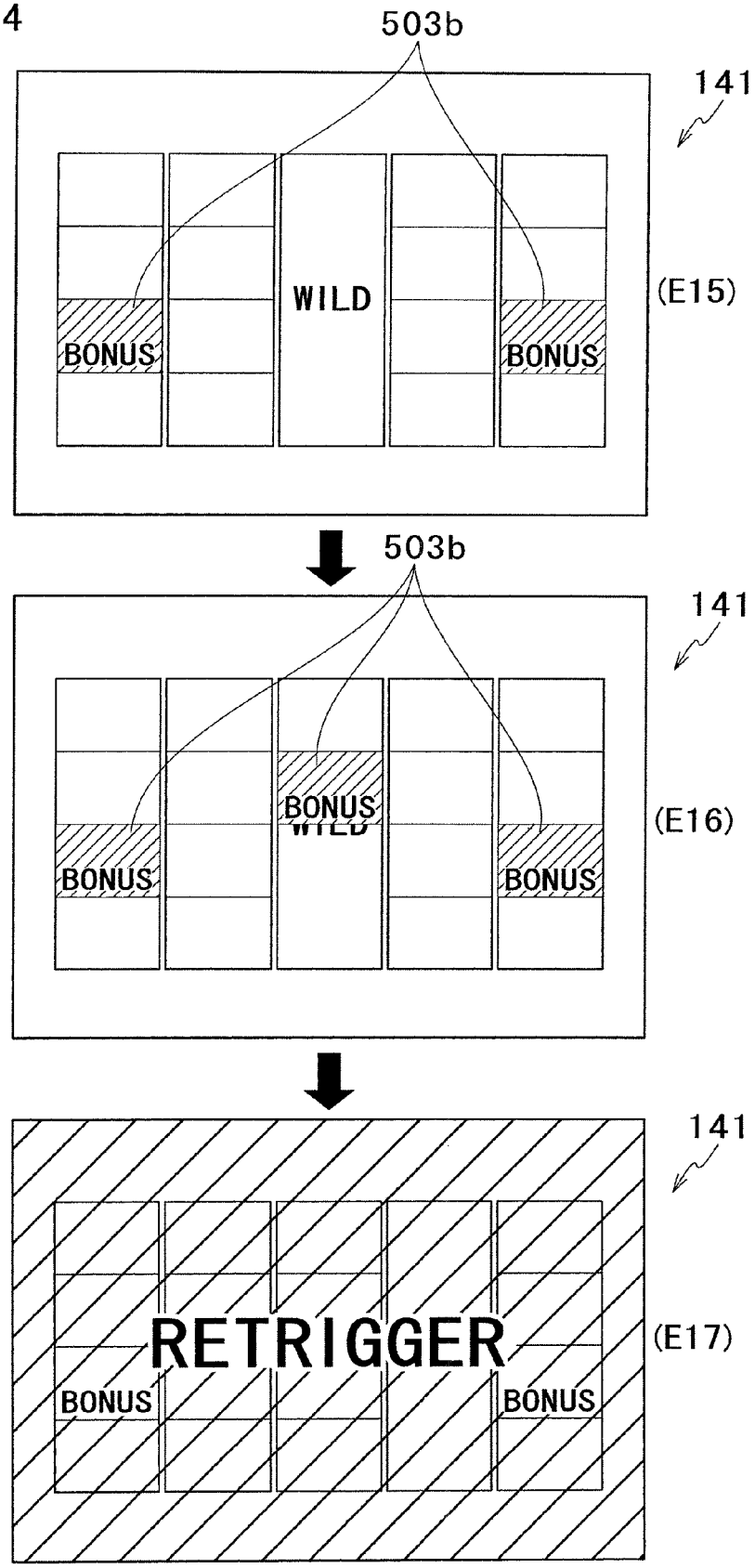
FIG. 44 is an explanatory diagram showing an exemplary display screen.
Figure 45:
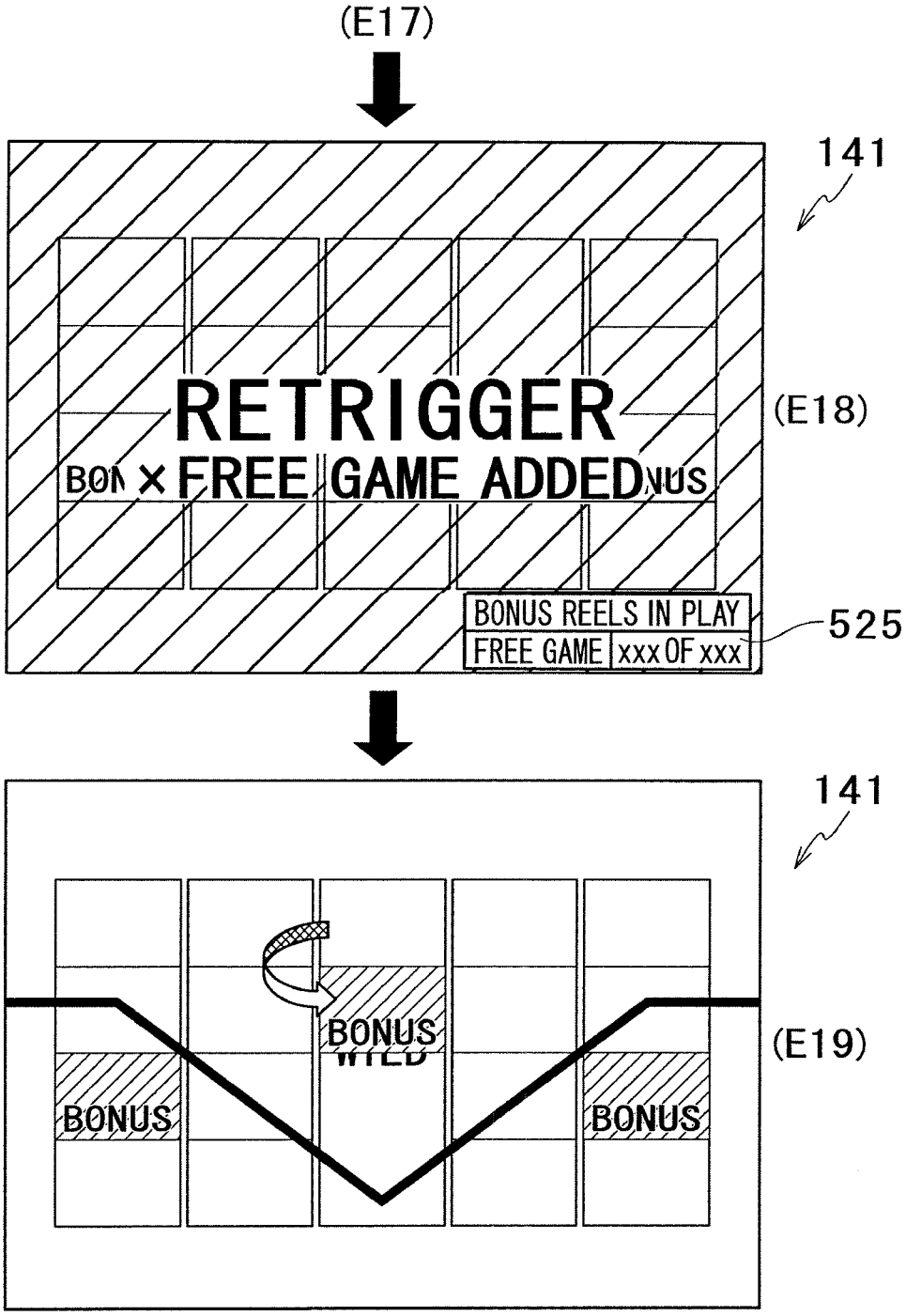
FIG. 45 is an explanatory diagram showing an exemplary display screen.

The following describes, with reference to FIG. 44 and FIG. 45, a case where a bonus symbol is on the pseudo reel having become the expand wild, when the retrigger occurs. As shown in FIG. 44, the retrigger occurs while the third reel 153 is the expand wild (E15). In such an occasion, the expand wild is displayed, overlapped with the trigger symbol 503*b*. In other words, the trigger symbol 503*b* on the pseudo reel having become the expand wild is not displayed in the initial state. Note however that, when the bonus symbol stops under the expand wild, a bonus symbol stop sound is reproduced. When the pseudo reel other than the fifth reel 155 is the expand wild, a long lizhi is executed. That is, when the fifth reel 155 is the expand wild, there will be no long lizhi. Next, the trigger symbol 503*b* rearranged under the expand wild is display on the expand wild in the form of animation (E16). Then, text "RETRIGGER" is displayed (E17). Then, as shown in FIG. 45, the text ("x free game added") indicating the number of additional free games is displayed, and the number of free games indicated on the free game counter 525 is increased (E18). After that, when there is another winning in addition to the retrigger, a win effect is executed (E14), and then the next spin is started. The win effect is such that the trigger symbol 503*b* and the expand wild are alternately displayed. If no winning is achieved, the next spin is started. In the win effect, the activatable line related to the winning is displayed.

Figure 46:
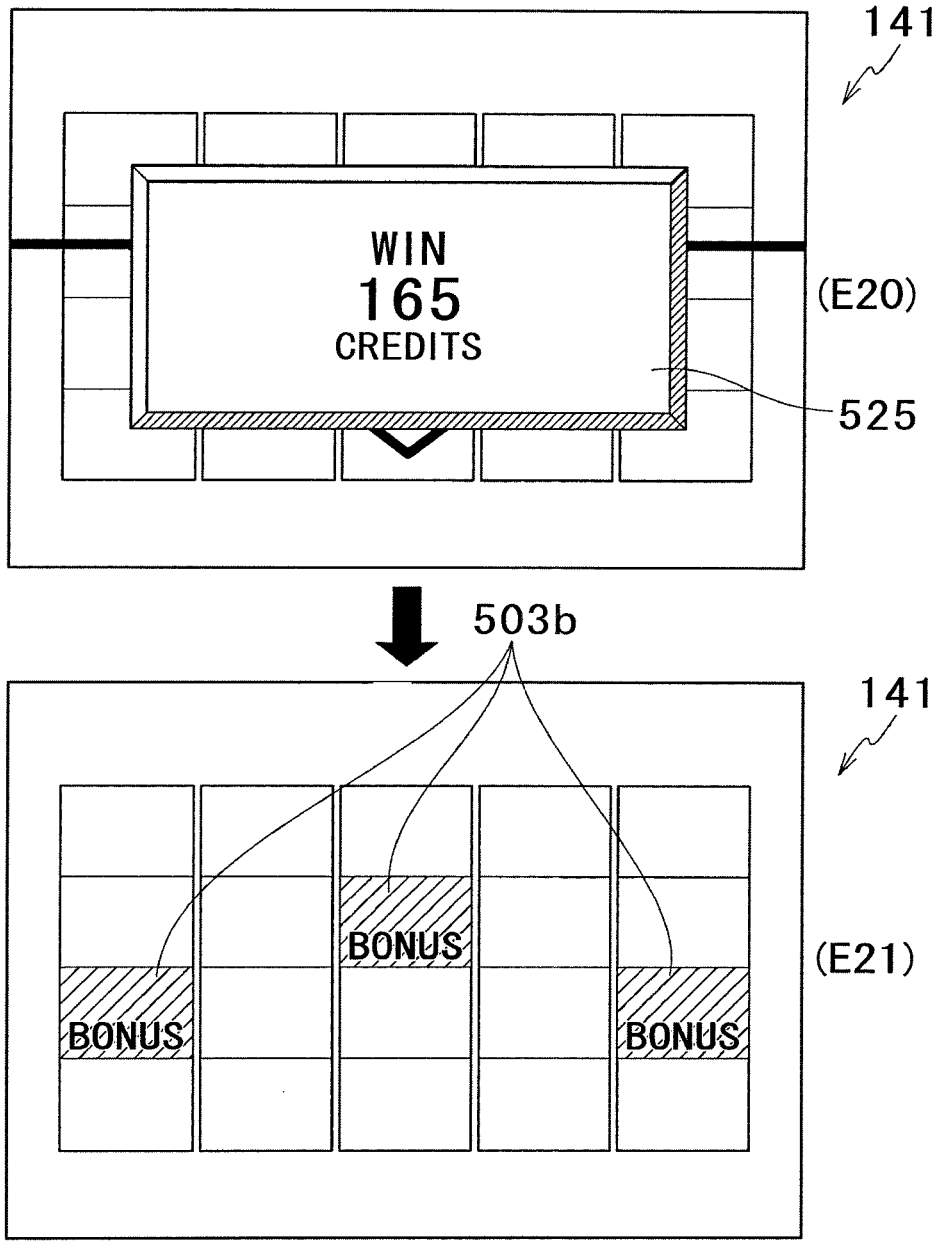
FIG. 46 is an explanatory diagram showing an exemplary display screen.
Figure 47:
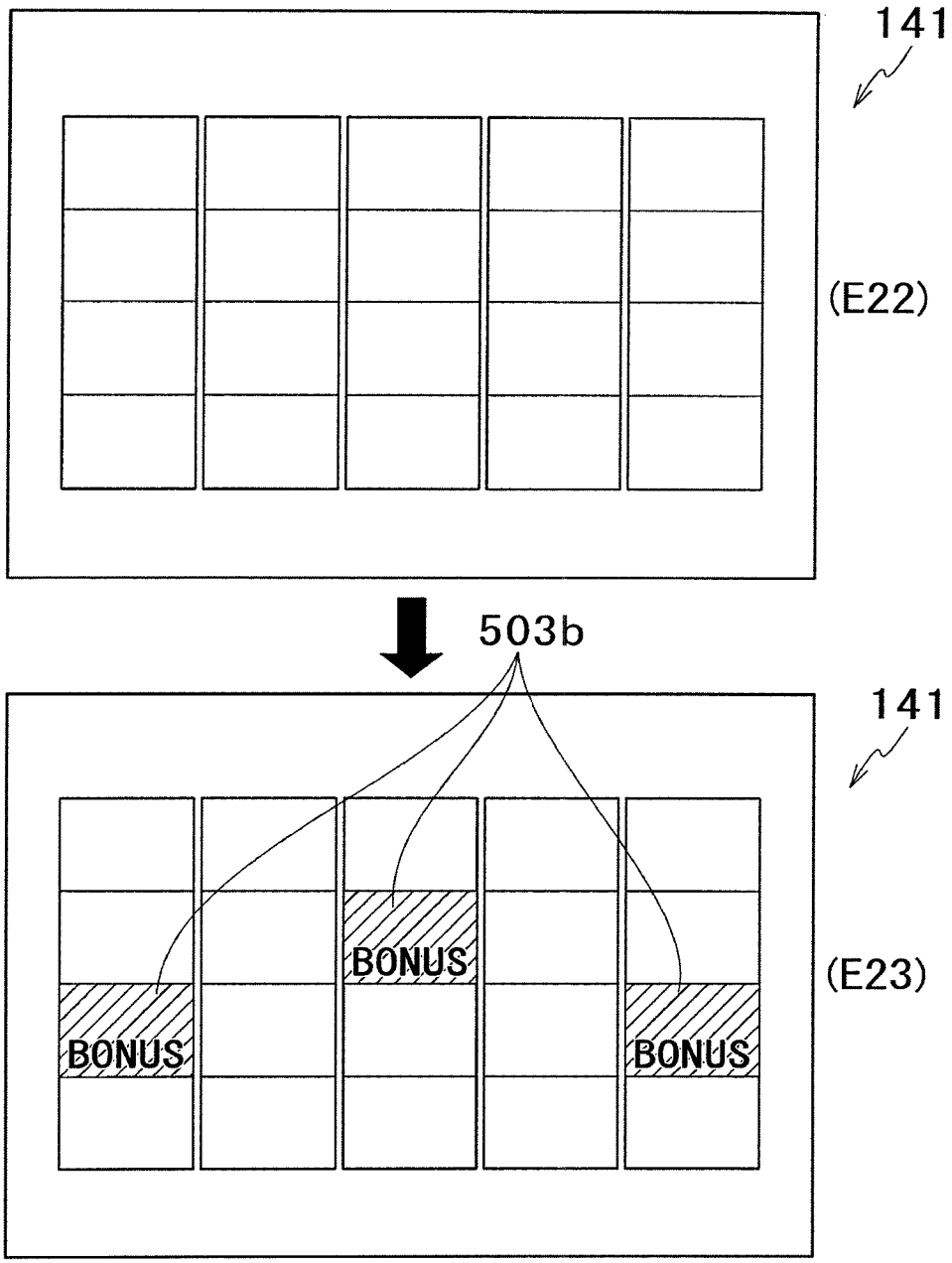
FIG. 47 is an explanatory diagram showing an exemplary display screen.

The following describes, with reference to FIG. 46 and FIG. 47, the result display when all the free games are ended. The ending of the free game varies depending on whether or not there was a winning during the free game. When there was a winning during the free game, a total win sign 527 according to the total amount won is displayed as shown in FIG. 46 (E20). On the total win sign 527 is displayed a total payout having been won. Then, the process returns to the normal game (E21). The arrangement of symbols on the pseudo reels 151 to 155 are maintained at the state where the bonus pick is triggered before the bonus game. On the other hand, when there was no winning during the free game, the total win sign 527 according to the total amount won is not displayed as shown in FIG. 47 (E22). Then, the process returns to the normal game (E23). The arrangement of the symbols on the pseudo reels 151 to 155 are maintained at the state where the bonus pick is triggered before the bonus game is started.

(Bonus Game: Bonus Choice)

The following describes cases where the bonus choice is selected in the bonus pick. When the "bonus choice" appears in the bonus pick, there is a shift to the bonus choice. In the bonus choice, there are further three bonus games, and the player is able to select one of them. Selecting any of the three bonus games may lead to "CHALLENGE FOR JACKPOT".

Figure 48:
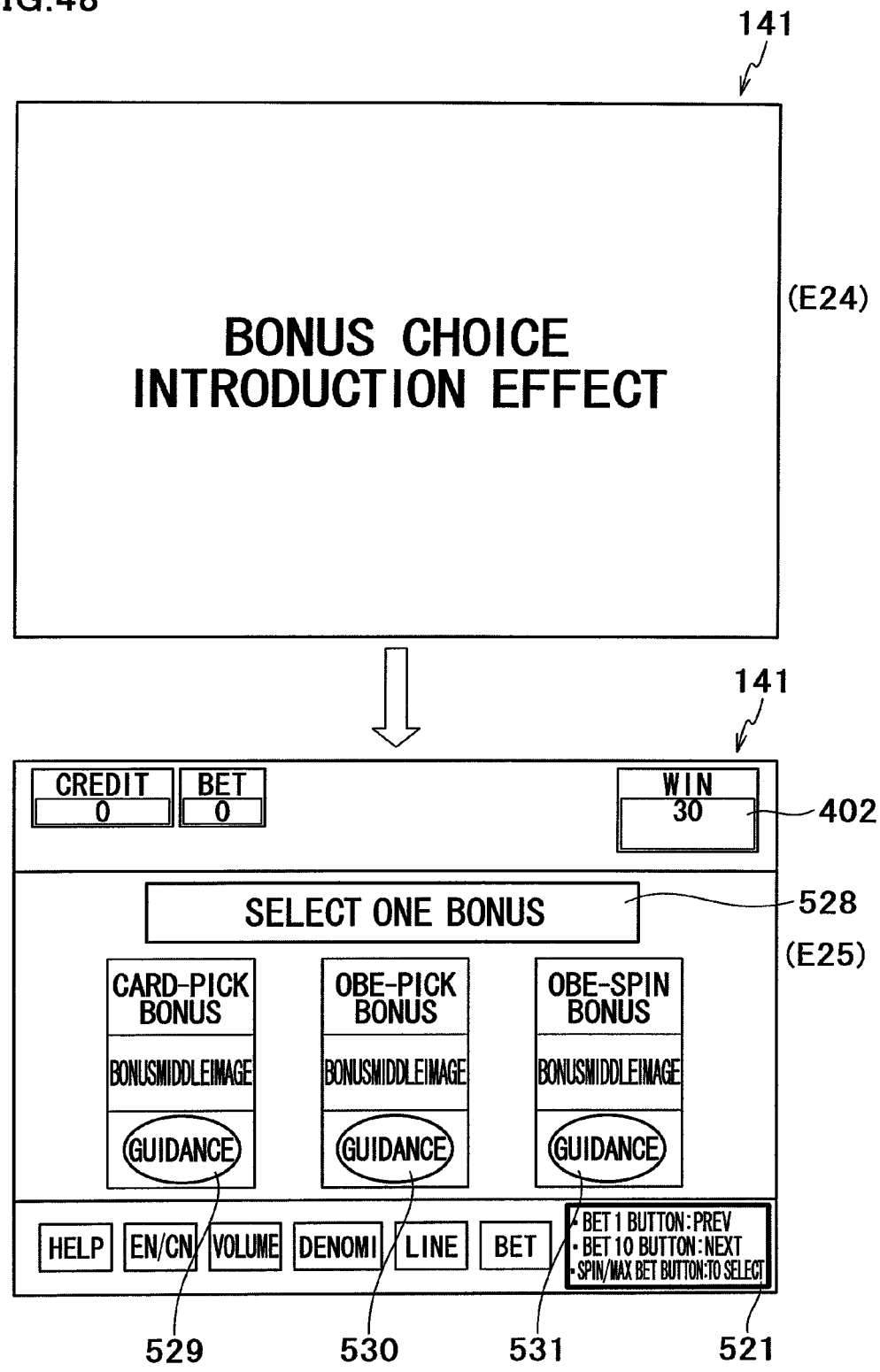
FIG. 48 is an explanatory diagram showing an exemplary display screen.

As shown in FIG. 48, when the bonus choice is started, the introduction effect of the bonus choice is displayed (E24). After the introduction effect, a selection from three-choices is waited (E25). The three choices displayed are: a card-pick bonus 529, an obe-pick bonus 530, and an obe-spin bonus 531. The win meter 402 displays the amount of credit earned until the point where the bonus choice is started. In the top part of the screen is displayed a message 528 prompting selection of the one of the bonus, which reads "SELECT ONE BONUS". Further, in the lower right part of the screen, i.e., on the right side of a group of touch buttons, is displayed the operation navigation 521 of the control panel 30. The value of "X" in the "BET X BUTTON" of the navigation 521 is variable depending on the configuration.

Figure 49:
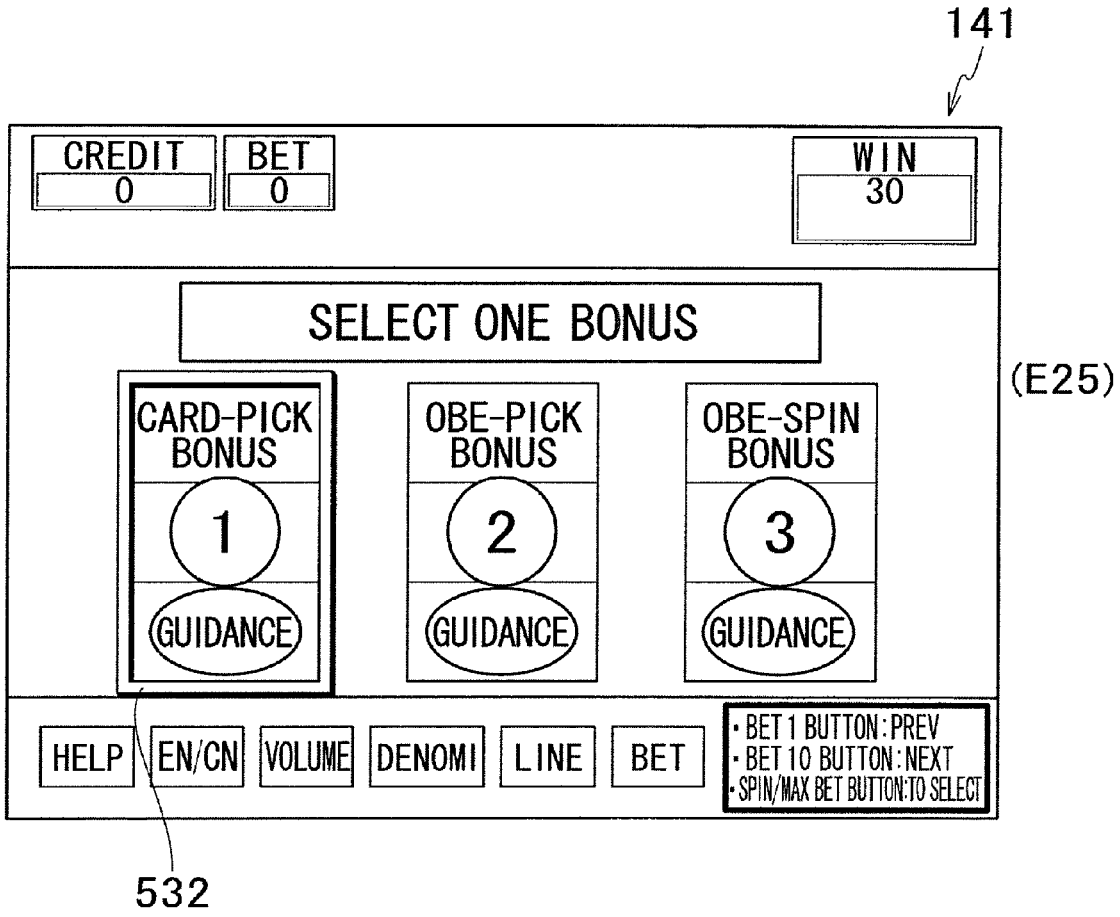
FIG. 49 is an explanatory diagram showing an exemplary display screen.

Specifically, the player is able to change his/her selection out of the card-pick bonus 529, the obe-pick bonus 530, and the obe-spin bonus 531 by operating the 1-bet button 34, or the 10-bet button 39. As shown in FIG. 49, when the 1-bet button 34 or the 10-bet button 39 is operated, the rectangular cursor 532 surrounding the card-pick bonus 529 is displayed. That is, the card-pick bonus 529 on which the cursor 532 is displayed is being selected. When the player further operates the 1-bet button 34 or the 10-bet button 39, the position of the cursor 532 is shifted sequentially in the ascending or descending order of the numbers displayed in FIG. 49. The player selection is then determined by operating the spin button 46. Note that the choices are selectable by using the control panel 30 as well as by using the touch panel 69.

Figure 50:
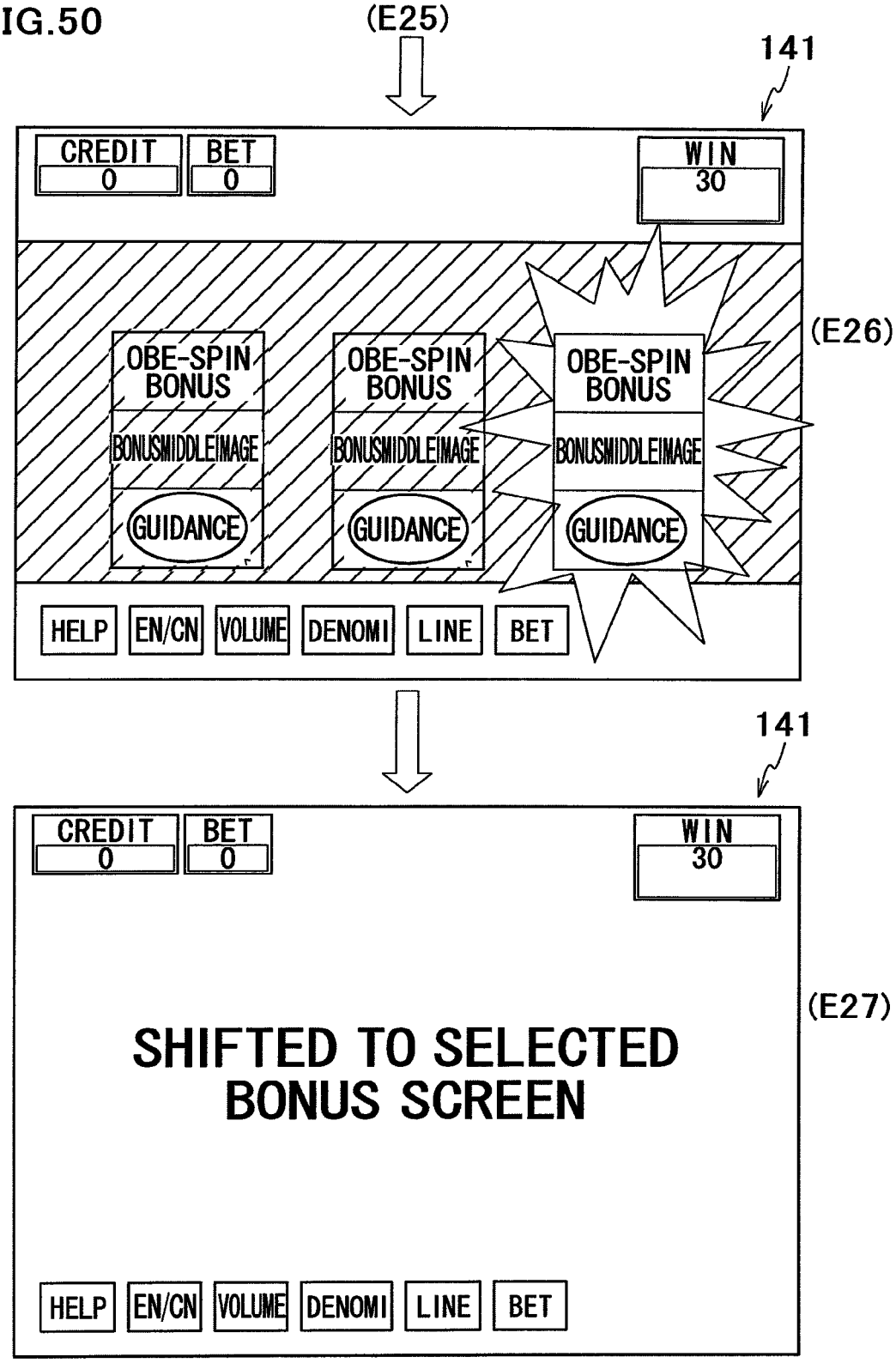
FIG. 50 is an explanatory diagram showing an exemplary display screen.

As shown in FIG. 50, when any of the card-pick bonus 529, the obe-pick bonus 530, and the obe-spin bonus 531 is selected, displaying of the selected choice is emphasized (E26). FIG. 50 shows an example where the obe-spin bonus 531 is selected. Unselected choices are displayed in gray. At the same time as the selection, the message 528 prompting selection displayed at the top part of the screen disappears. Then, there is a shift to the selected bonus screen (E27).

(Bonus Game: Card-Pick Bonus)

Figure 51:
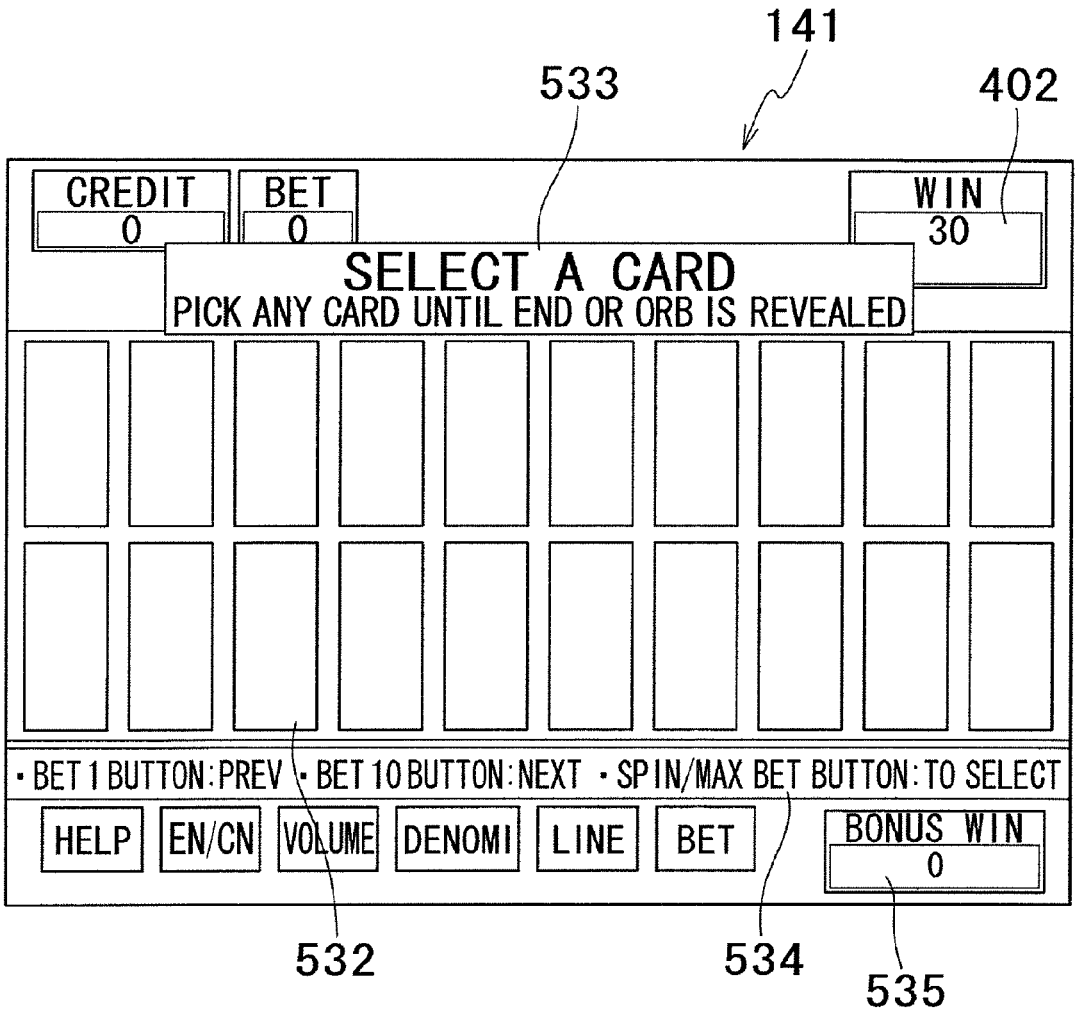
FIG. 51 is an explanatory diagram showing an exemplary display screen.

When the card-pick bonus 529 is selected in the bonus choice, there is a shift to the card-pick bonus. As shown in FIG. 51, twenty card-pick bonus choices 532 are displayed in the card-pick bonus. When the card-pick bonus choices 532 is selected, a credit payout, an obe, or an end is determined. When the credit payout is selected, a fixed payout according to the selected card-pick bonus choice 532 is awarded, and selection of another one of the card-pick bonus choices 532 becomes possible. When the obe or the end is selected, selection of the card-pick bonus choices 532 in the card-pick bonus is disabled. When the obe is selected, a roulette game according to the color of the obe is executed in the upper image display panel 142, and an amount of the payout stopped is awarded. Then, the card-pick bonus is ended. When the end is selected, a fixed payout is awarded, and the card-pick bonus is ended.

On the win meter 402 is displayed the amount of credit earned up to the point where the card-pick bonus is started. In the upper part of the screen is displayed a message 533 prompting selection of the card-pick bonus choices 532, which reads "SELECT A CARD". In the lower right part of the screen is displayed a bonus win meter 535. On the bonus win meter 535 is displayed an amount of credit earned in the bonus game. Further, above the group of touch buttons is displayed the operation navigation 534 of the control panel 30. The value of "x" in the "BET X BUTTON" on the navigation 534 is variable depending on the configuration.

Figure 52:
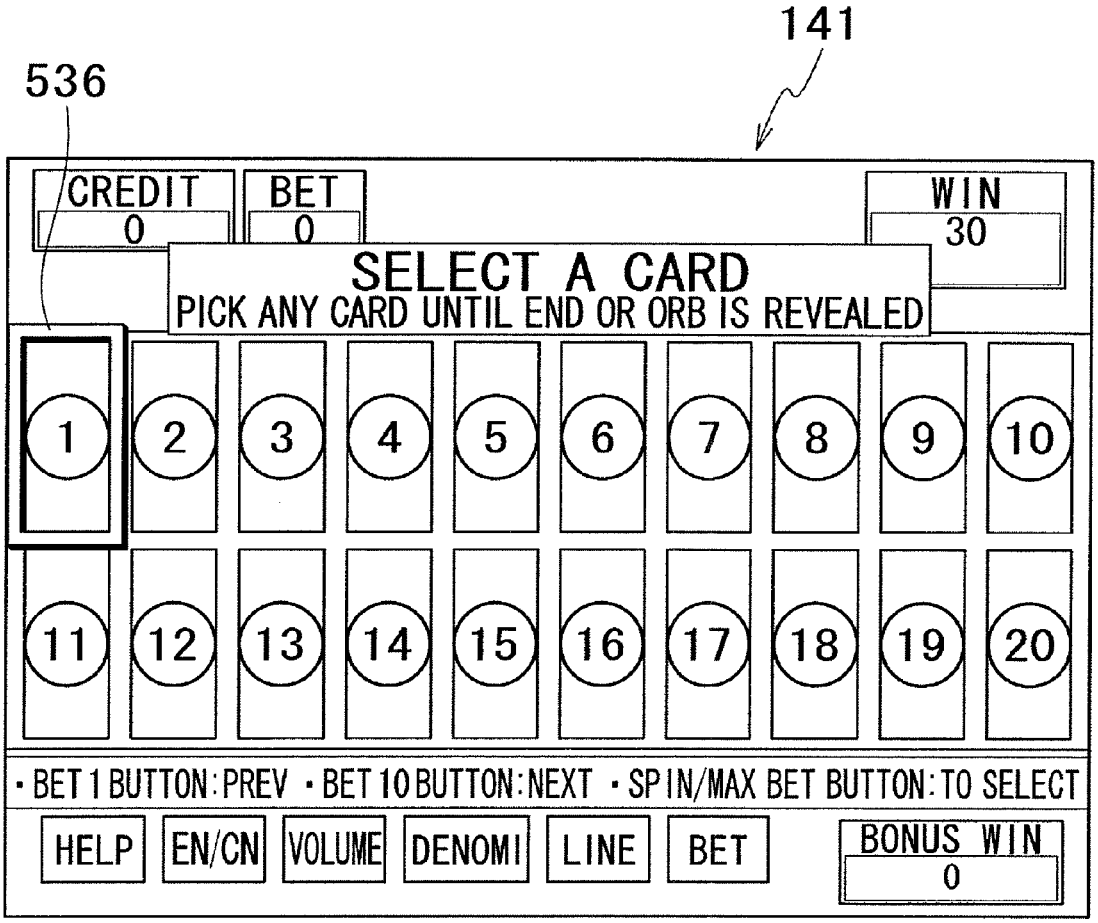
FIG. 52 is an explanatory diagram showing an exemplary display screen.

Specifically, the player is able to change his/her selection out of the card-pick bonus choices 532, by operating the 1-bet button 34 or the 10-bet button 39. As shown in FIG. 52, when the 1-bet button 34 or the 10-bet button 39 is operated, the rectangular cursor 536 surrounding the card-pick bonus choice 532 is displayed. That is, the card-pick bonus choice 532 on which the cursor 536 is displayed is being selected. When the player further operates the 1-bet button 34 or the 10-bet button 39, the cursor 522 on the card-pick bonus choices 532 is shifted sequentially in the ascending or descending order of the numbers displayed in FIG. 52. The card-pick bonus choices 532 being selected is then determined as the player selection by operating the spin button 46. Note that the card-pick bonus choices 532 are selectable by using the control panel 30 as well as by using the touch panel 69.

Figure 53:
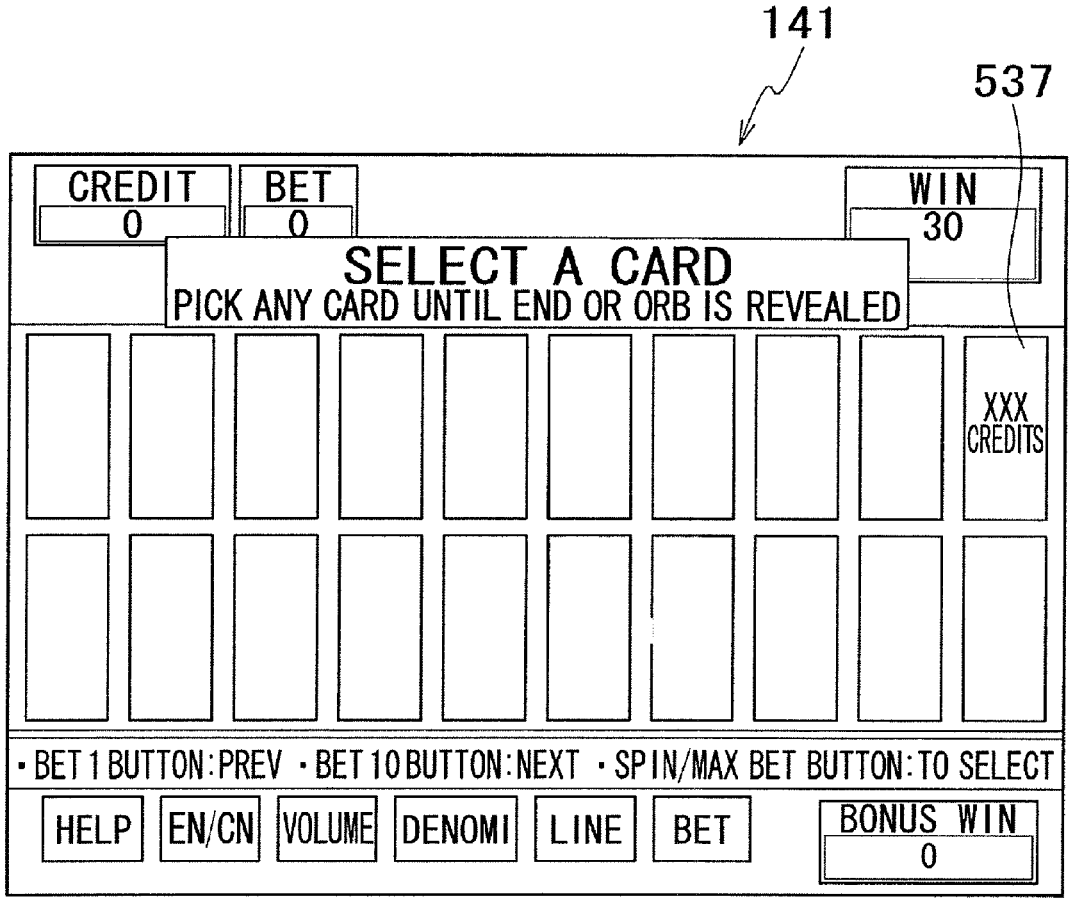
FIG. 53 is an explanatory diagram showing an exemplary display screen.

Next, the following describes a case where the credit payout is selected. When the credit payout is selected a fixed payout is awarded. The fixed payout is added to the value on the bonus win meter 535, and then the process returns to the state of waiting for the selection by the player (FIG. 51). Specifically, when the credit payout is selected, the credit payout 537 appears on the card-pick bonus choice 532 selected with an effect as shown in FIG. 53. The credit payout 537 shows the amount of payout, and this amount of payout is added to the value of the bonus win meter. At the same time as the value of the bonus win meter is incremented by the amount of the payout, the screen enters the state of waiting the player selection.

Figure 54:
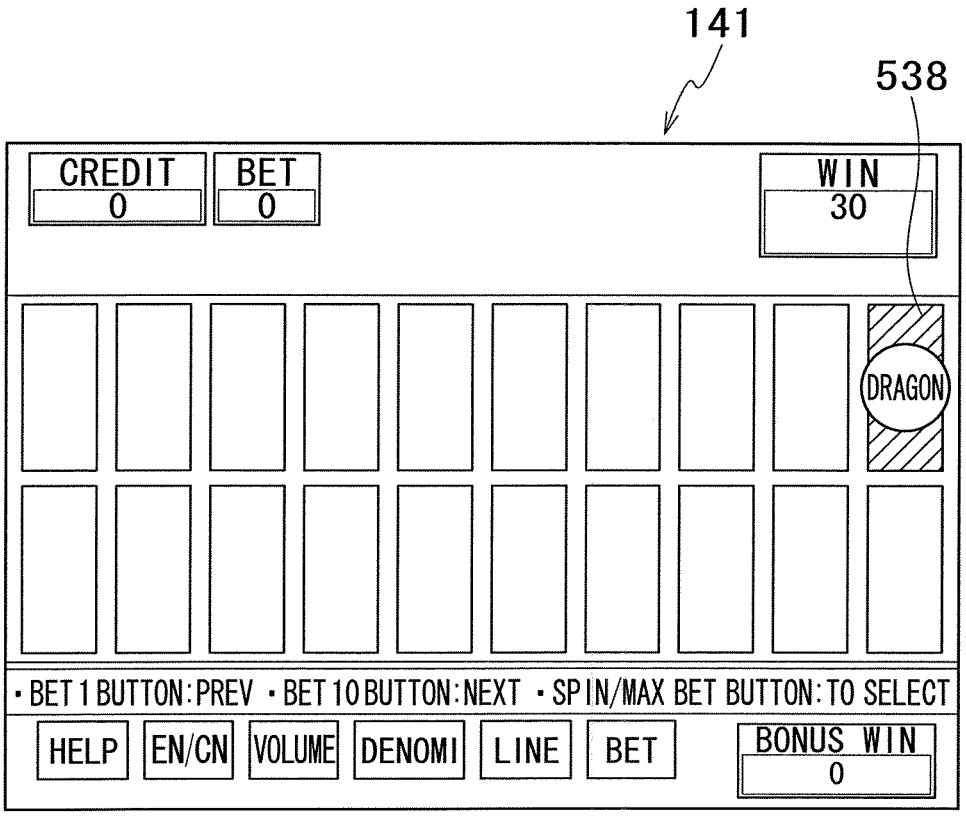
FIG. 54 is an explanatory diagram showing an exemplary display screen.
Figure 55:
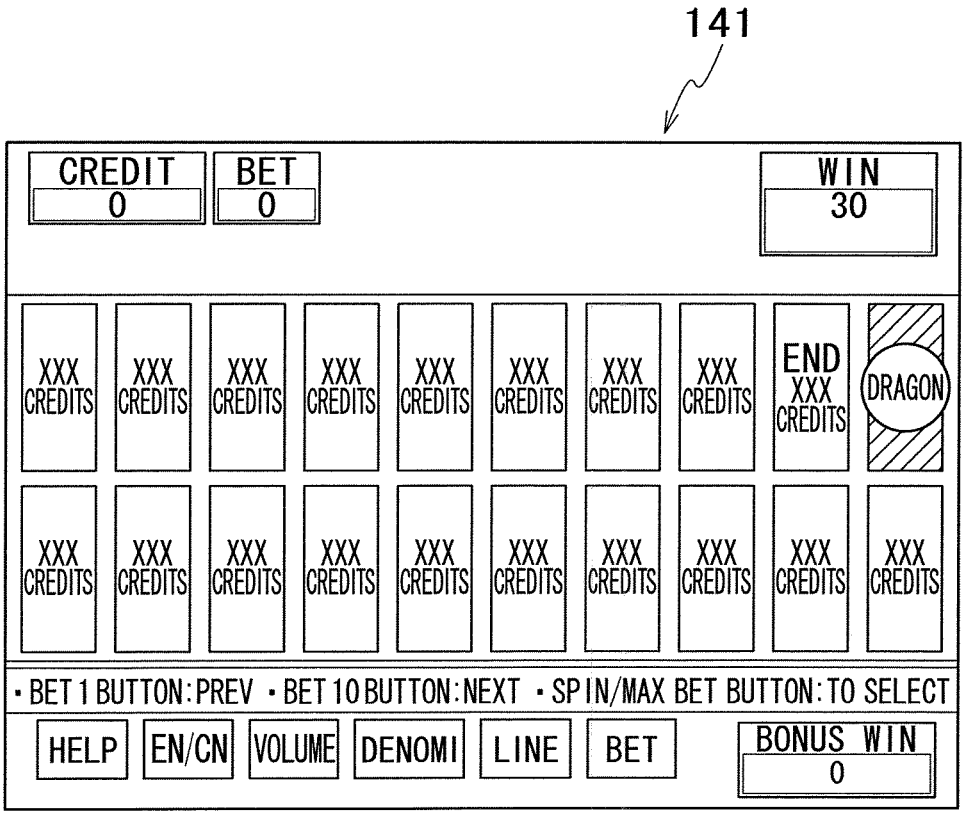
FIG. 55 is an explanatory diagram showing an exemplary display screen.
Figure 56:
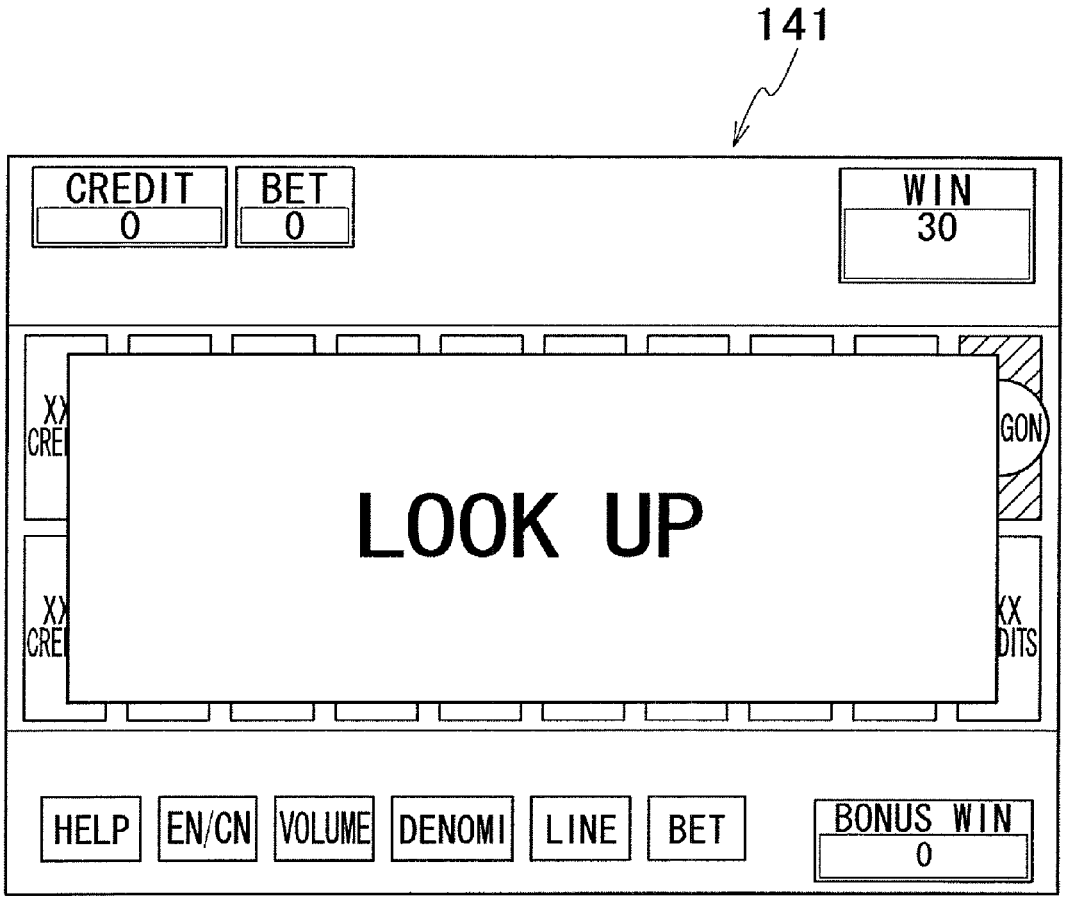
FIG. 56 is an explanatory diagram showing an exemplary display screen.
Figure 57:
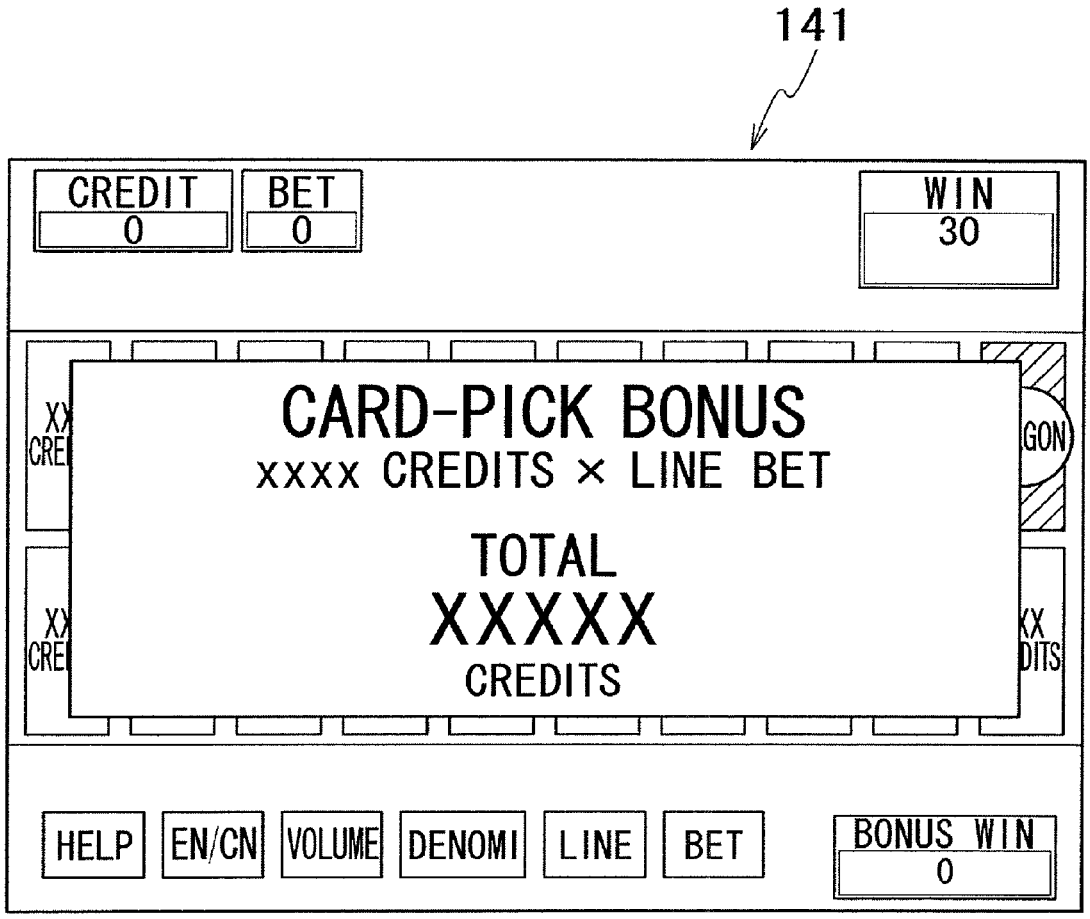
FIG. 57 is an explanatory diagram showing an exemplary display screen.

Next, the following describes a case of selecting the obe. As shown in FIG. 54, when the obe is selected, a credit payout of the position selected and an obe 538 appear with an effect. At this point, the message 533 in the upper part of the screen and the operation navigation 534 of the lower part of the screen disappear. Then, as shown in FIG. 55, the contents of the unselected card-pick bonus choices 532 is displayed in gray for a predetermined period (e.g., 4 seconds). After this, as shown in FIG. 56, text reading "LOOK UP" is displayed. On the upper image display panel 142, displaying of the text "LOOK UP" continues until the end of the roulette game. Then, as shown in FIG. 57, an "Account Report" indicating the total payout won in the card-pick bonus is displayed. At this point, the value on the bonus win meter 535 indicating the amount won in the card-pick bonus is transferred (added) to the win meter 402. Then, the process returns to the normal game. The arrangement of the symbols on the pseudo reels 151 to 155 is maintained as it is at the point where the bonus pick is triggered before the bonus game is started, as shown in FIG. 26.

Figure 58:
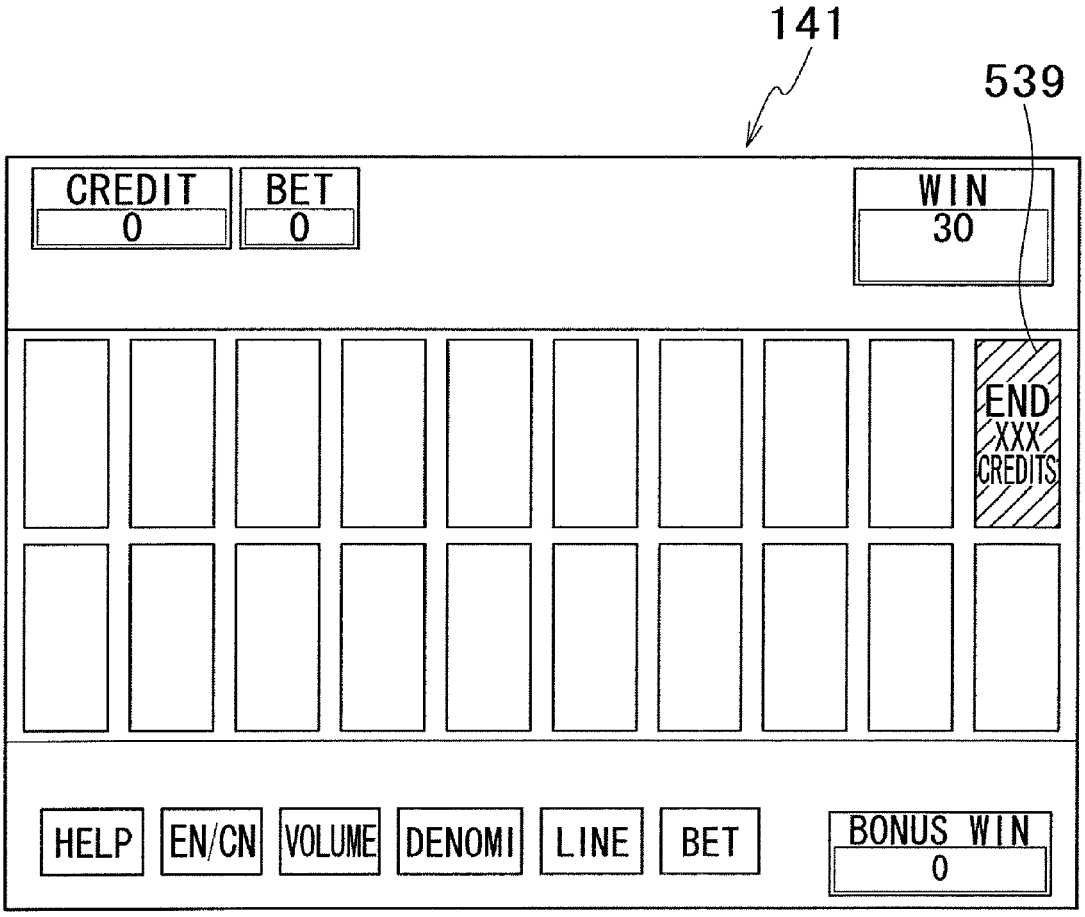
FIG. 58 is an explanatory diagram showing an exemplary display screen.
Figure 59:
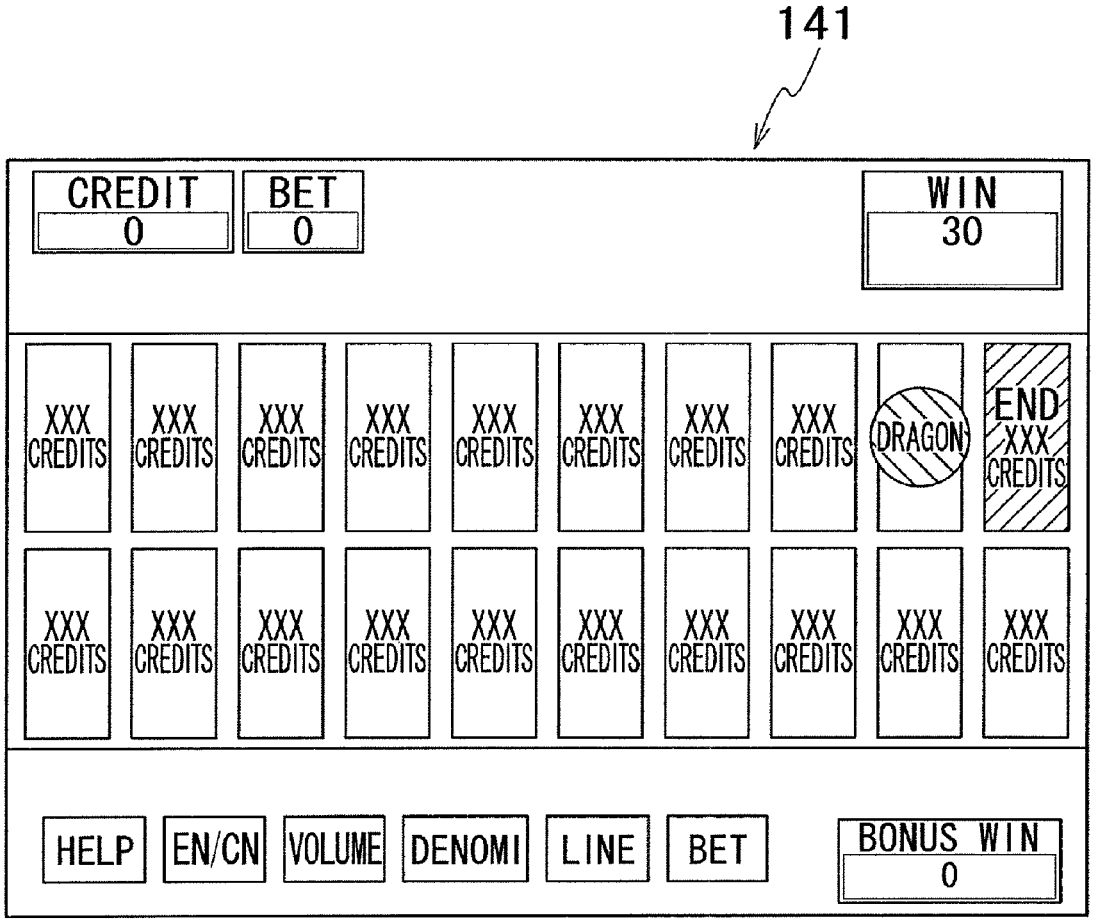
FIG. 59 is an explanatory diagram showing an exemplary display screen.

Next, the following describes when the end is selected. As shown in FIG. 58, when the end is selected, a credit payout of the position selected and an END 539 appear. The END 539 displays text indicating the fixed payout, and this fixed payout is added to the value of the bonus win meter 535. At this time, the message 533 in the upper part of the screen and the operation navigation 534 in the lower part disappear. Then, as shown in FIG. 59, the contents of unselected card-pick bonus choices 532 is displayed in gray for a predetermined period (e.g., 4 seconds). Then, as shown in FIG. 57, an "Account Report" indicating the total payout won in the card-pick bonus is displayed. Note that, the maximum number of digits displayed as the payout is five. At this point the value on the bonus win meter 535 indicating the total amount won in the card-pick bonus is transferred (added) to the win meter 402. Then, the process returns to the normal game. The arrangement of the symbols on the pseudo reels 151 to 155 is maintained as it is at the point where the bonus pick is triggered before the bonus game is started, as shown in FIG. 26.

Note that the card-pick bonus may randomly include a jackpot in the card-pick bonus choices 532. In this case, the card-pick bonus is "CARD-PICK BONUS CHALLENGE FOR JACKPOT". The difference of the "CARD-PICK BONUS CHALLENGE FOR JACKPOT" from the card-pick bonus is described.

Figure 60:
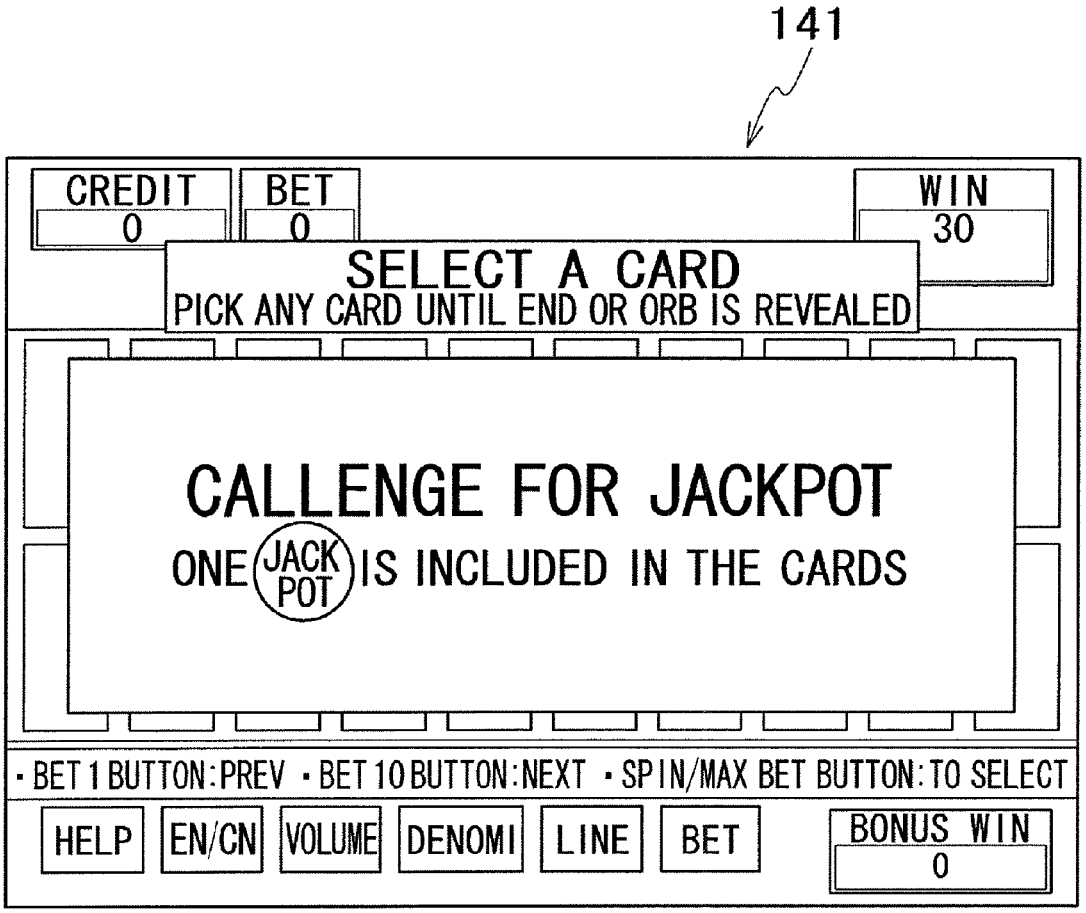
FIG. 60 is an explanatory diagram showing an exemplary display screen.

In "CARD-PICK BONUS CHALLENGE FOR JACKPOT", one of the choices associated with the credit payout is changed to a jackpot. As shown in FIG. 60, at the time of introducing "CARD-PICK BONUS CHALLENGE FOR JACKPOT", there is an indication that a jackpot is included in the card-pick bonus choices 532. Then, the screen changes to the selection waiting screen, as shown in FIG. 51.

Figure 61:
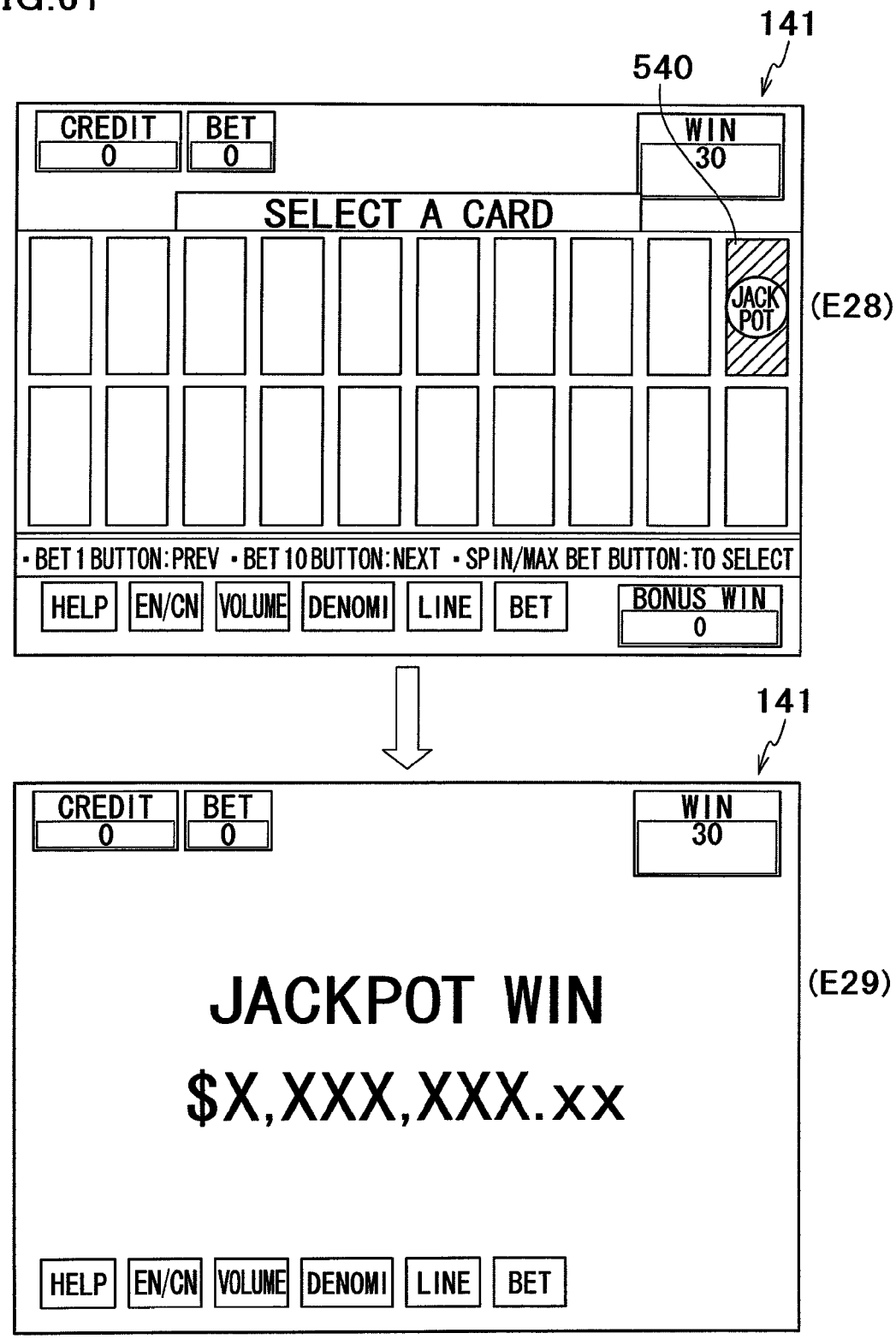
FIG. 61 is an explanatory diagram showing an exemplary display screen.
Figure 62:
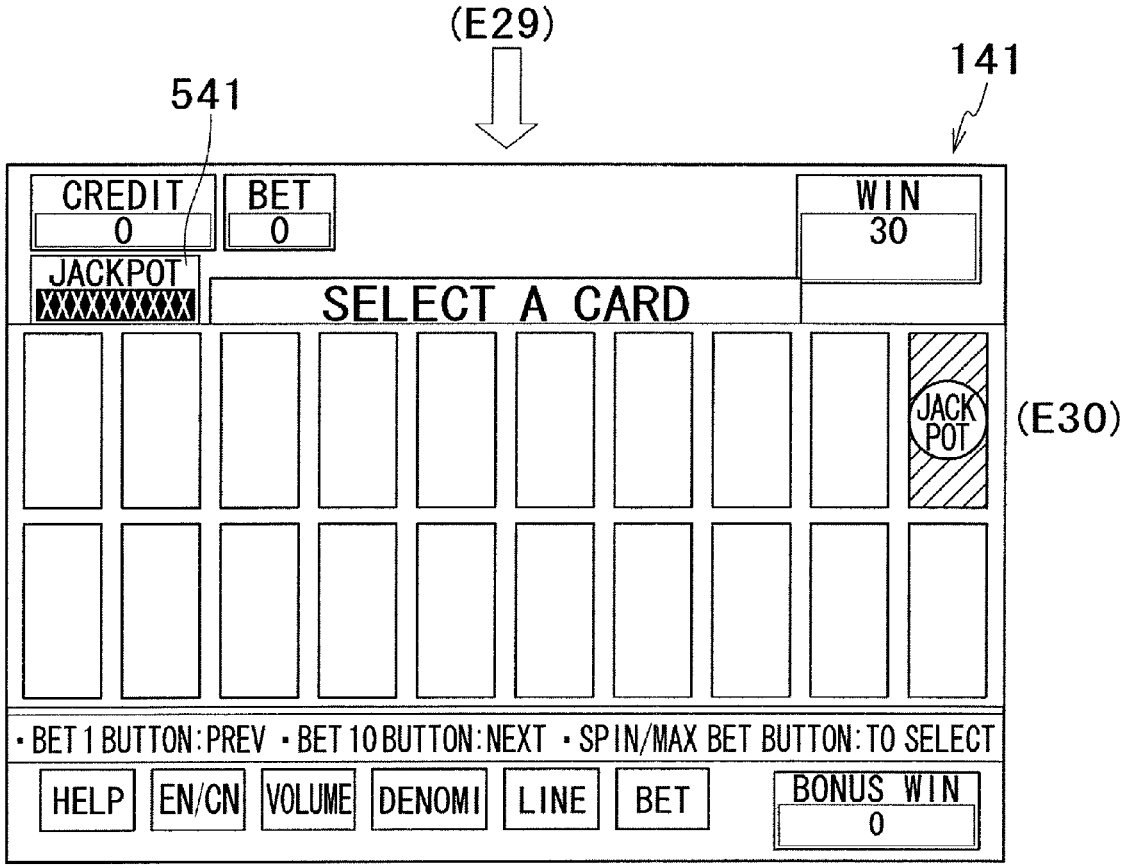
FIG. 62 is an explanatory diagram showing an exemplary display screen.

As shown in FIG. 61, when the jackpot is selected in the selection waiting screen, the jackpot 540 appears in the position selected with an effect (E28). Then, a Jackpot win screen is displayed (E29). Then, as shown in FIG. 62, the jackpot win meter 541 is displayed (E30), and the jackpot win meter 541 displays the amount won. Then, the screen enters the selection waiting state shown in FIG. 51.

(Bonus Game: Obe-Pick Bonus)

Figure 63:
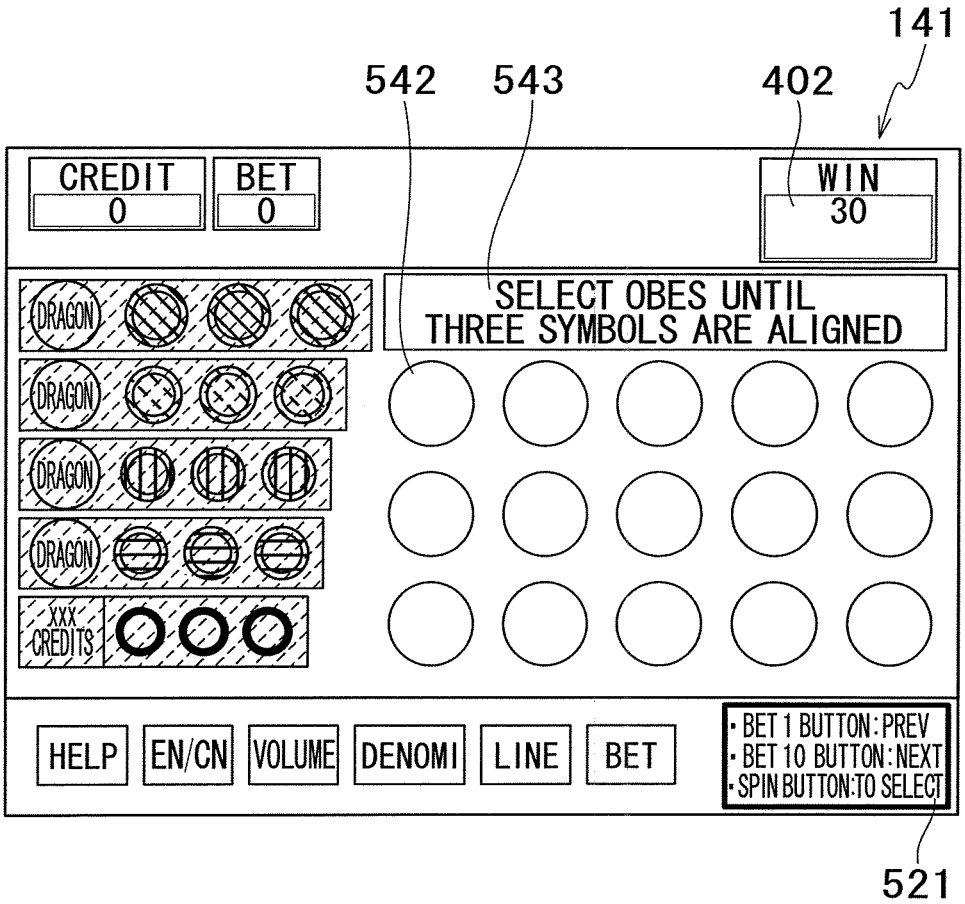
FIG. 63 is an explanatory diagram showing an exemplary display screen.

When the obe-pick bonus 530 is selected in the bonus choice, there is a shift to the obe-pick bonus (hereinafter also referred to as Shenlong Bonus or Shenlong Obe Bonus). The obe-pick bonus is a pickup bonus game including five steps of payouts, which awards a payout according to the symbols collected by selecting. As shown in FIG. 63, in the obe-pick bonus, fifteen obe-pick bonus choices 542 are displayed. Each of the obe-pick bonus choices 542 is displayed in the form of obe. The obe-pick bonus choices 542 include five kinds of symbols (red symbols, purple symbols, blue symbols, light blue symbols, carp symbols). For each kind of symbols, there are three. When the obe-pick bonus choices 542 are selected one by one, and when three of the same kind of symbols appear, a bonus according to the kind of the symbols is awarded. Specifically, when three of the red symbols, three of the purple symbols, three of the blue symbols, or three of the light blue symbols are selected, a roulette corresponding to the symbols is executed. When three of the carp symbols are selected, a fixed payout is awarded.

On the win meter 402 is displayed an amount of credit having been earned up to the point of starting the obe-pick bonus. In the upper part of the screen is displayed a message 543 reading "SELECT OBES UNTIL THREE SYMBOLS ARE ALIGNED" which prompts selection of the obe-pick bonus choices 542. In the lower right part of the screen is displayed a bonus win meter 535. On the bonus win meter 535 is displayed an amount of credit won during the bonus game. Further, in the lower right part of the screen is a control panel 30 which displays an operation navigation 521 for selecting the obe-pick bonus choices 542.

Figure 64:
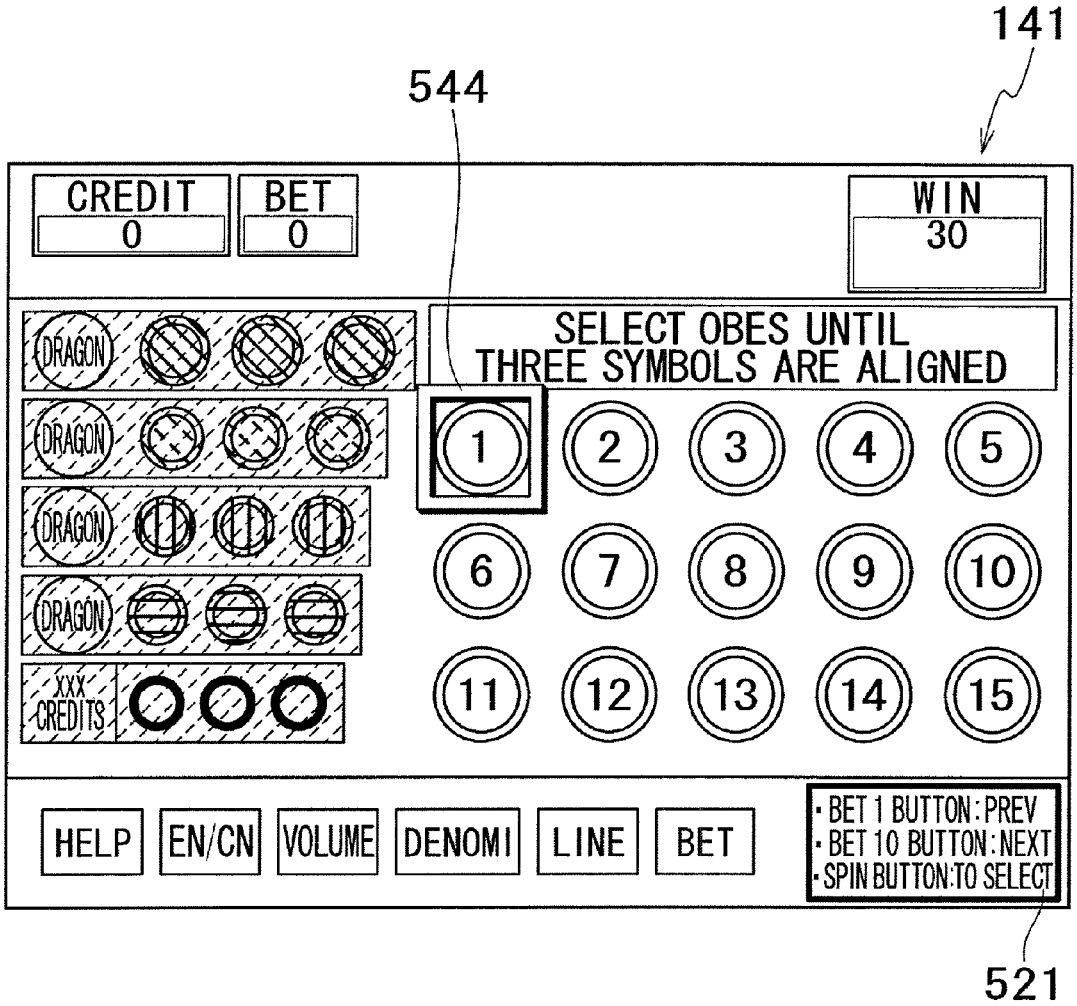
FIG. 64 is an explanatory diagram showing an exemplary display screen.

Specifically, the player changes his/her selection of the obe-pick bonus choices 542 by operating the 1-bet button 34 or the 10-bet button 39. As shown in FIG. 64, when the 1-bet button 34 or the 10-bet button 39 is operated, a rectangular cursor 544 surrounding the obe-pick bonus choice 542 is displayed. That is, the obe-pick bonus choice 542 on which the cursor 544 is displayed is being selected. When the player further operates the 1-bet button 34 or the 10-bet button 39, the cursor 544 is shifted sequentially in the ascending or descending order of the numbers displayed in FIG. 64. Note that, the obe-pick bonus choice 542 that has been already selected is skipped. The obe-pick bonus choice 542 being selected is then determined as the player selection by operating the spin button 46. Further, the obe-pick bonus choices 542 are selectable by using the control panel 30 as well as by using the touch panel 69.

Figure 65:
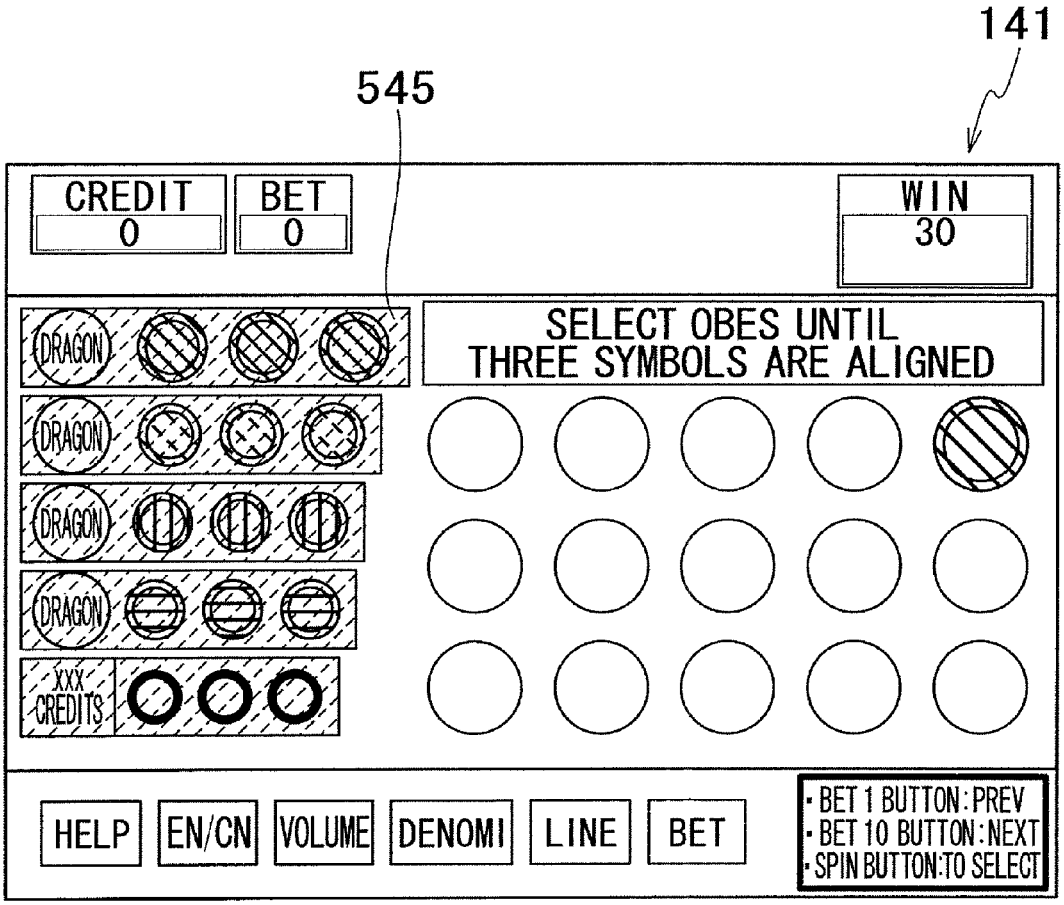
FIG. 65 is an explanatory diagram showing an exemplary display screen.

As shown in FIG. 65, when the obe-pick bonus choices 542 is selected, symbols are displayed. In the example of FIG. 65, the upper right obe-pick bonus choice 542 is selected. On the left of the screen are five symbol arrangement areas 545 corresponding to the symbols associated with the obe-pick bonus choices 542. Every time a symbol is selected, the corresponding one of the five symbol arrangement areas 545 is displayed brighter sequentially from the left side. The selection is continued until three symbols are displayed brightly in any of the symbol arrangement areas 545.

Figure 66:
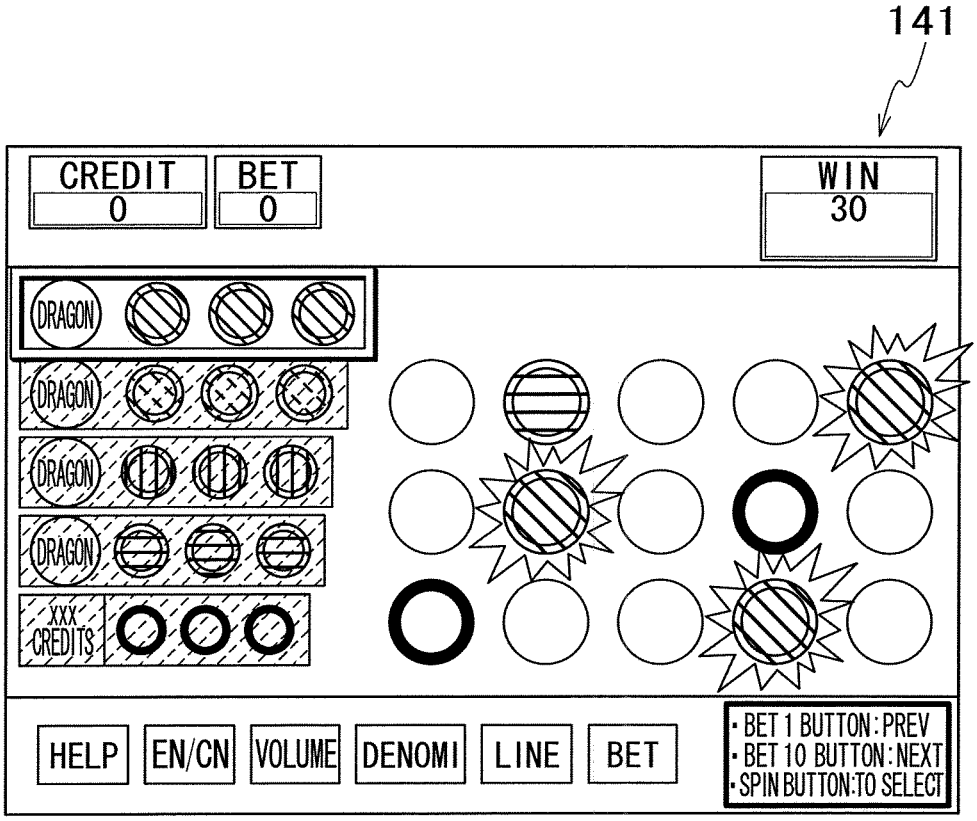
FIG. 66 is an explanatory diagram showing an exemplary display screen.
Figure 67:
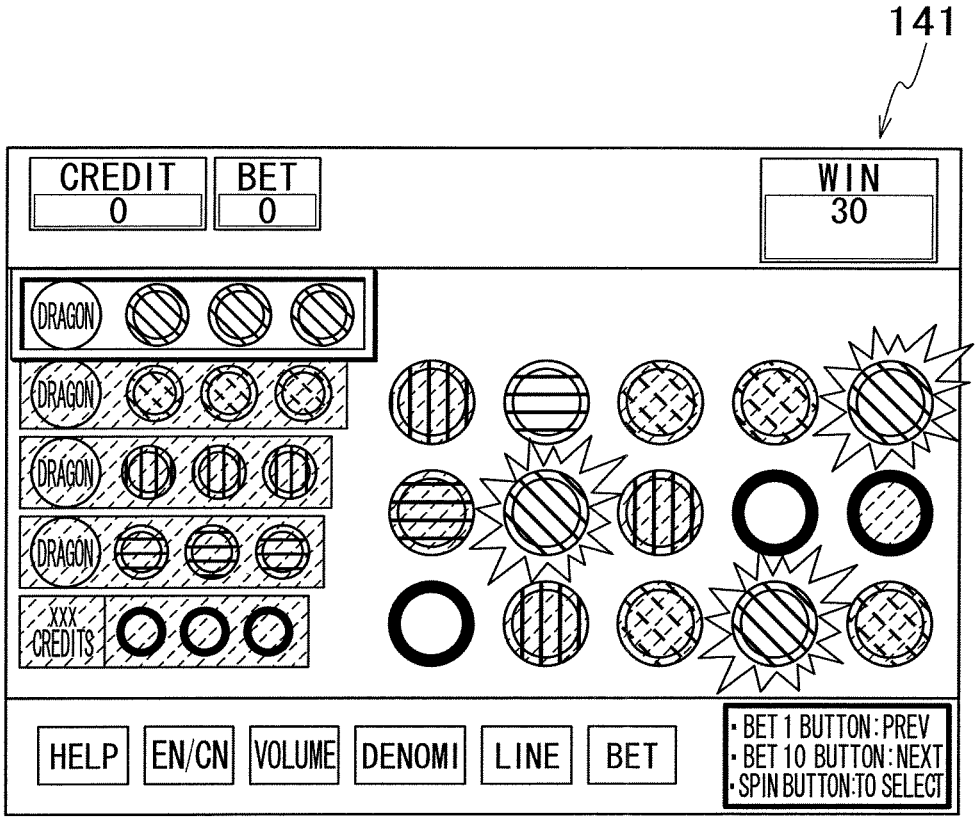
FIG. 67 is an explanatory diagram showing an exemplary display screen.
Figure 68:
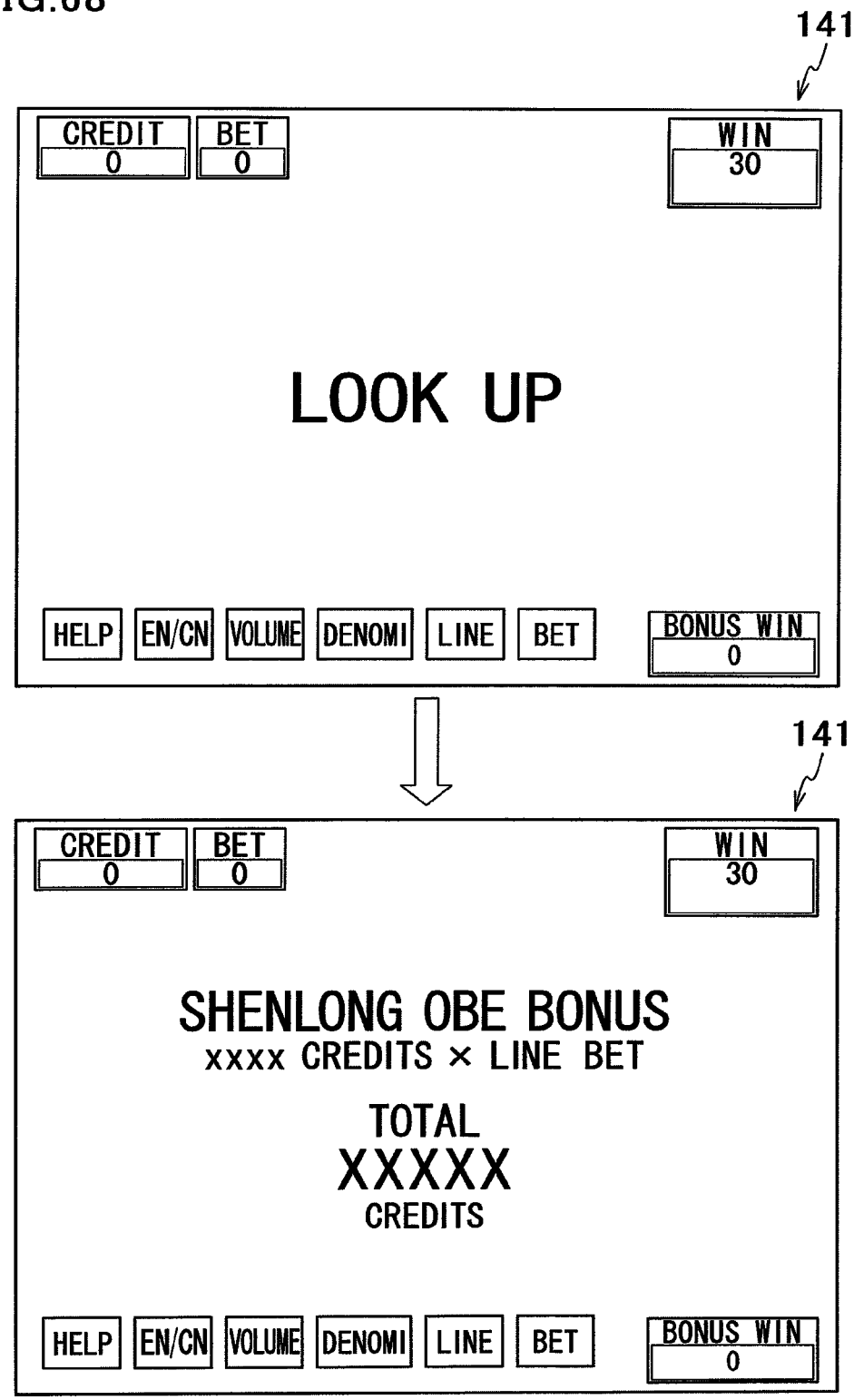
FIG. 68 is an explanatory diagram showing an exemplary display screen.

As shown in FIG. 66, of the five types of symbols, the red symbol, the purple symbol, the blue symbol, and the light blue symbol causes occurrence of a roulette game. When three of the same kind which causes the roulette game are selected, the corresponding symbol arrangement area 545 and the symbols selected in the obe-pick bonus choices 542 are emphasized. At this time, the message 543 "SELECT OBES UNTIL THREE SYMBOLS ARE ALIGNED" in the upper part of the screen and the operation navigation 521 in the screen lower part disappear. Then, as shown in FIG. 67, the contents of the unselected obe-pick bonus choices 542 is displayed in gray for a predetermined period (e.g., 3.5 seconds). At this time, the amount of the fixed payout by selecting the carp symbol is displayed in the symbol arrangement area 545. After that, as shown in FIG. 68, the "LOOK UP" is displayed. Displaying of the "LOOK UP" on the upper image display panel 142 continues until the roulette ends. Then, an "Account Report" indicating the total amount of payout won in the obe-pick bonus is displayed. At this time, the value on the bonus win meter 535 indicating the total amount won in the obe-pick bonus is transferred (added) to the win meter 402. Then, the process returns to the normal game. The arrangement of the symbols on the pseudo reels 151 to 155 is maintained as it is at the point where the bonus pick is triggered before the bonus game is started, as shown in FIG. 26.

Figure 69:
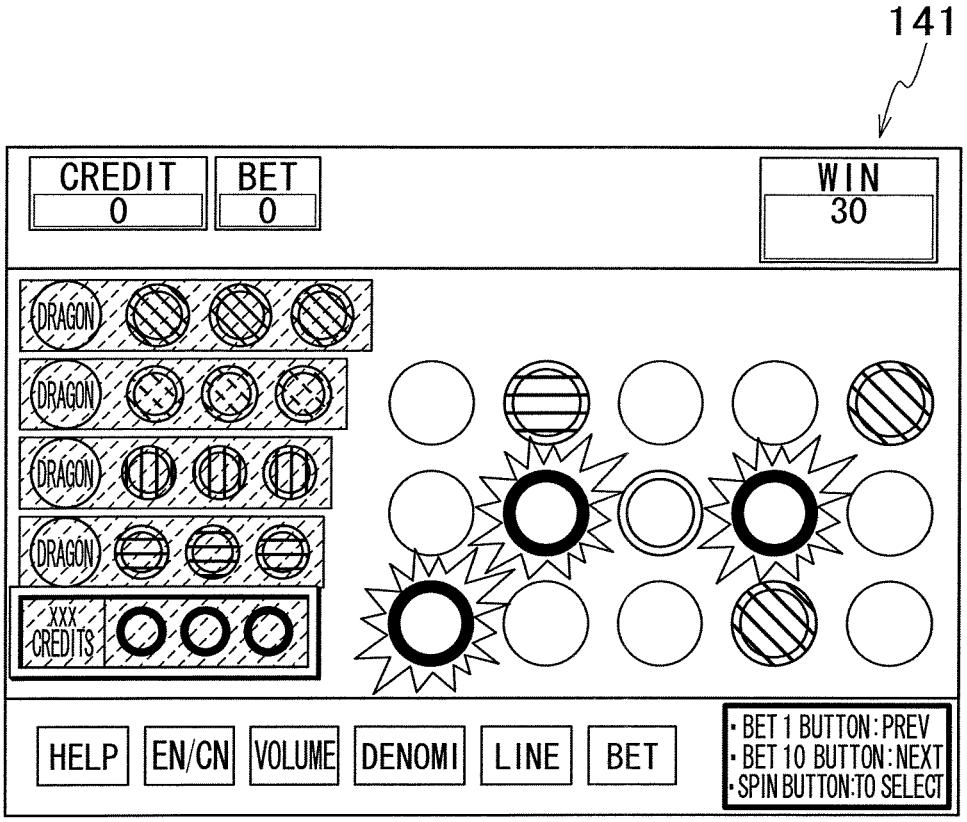
FIG. 69 is an explanatory diagram showing an exemplary display screen.
Figure 70:
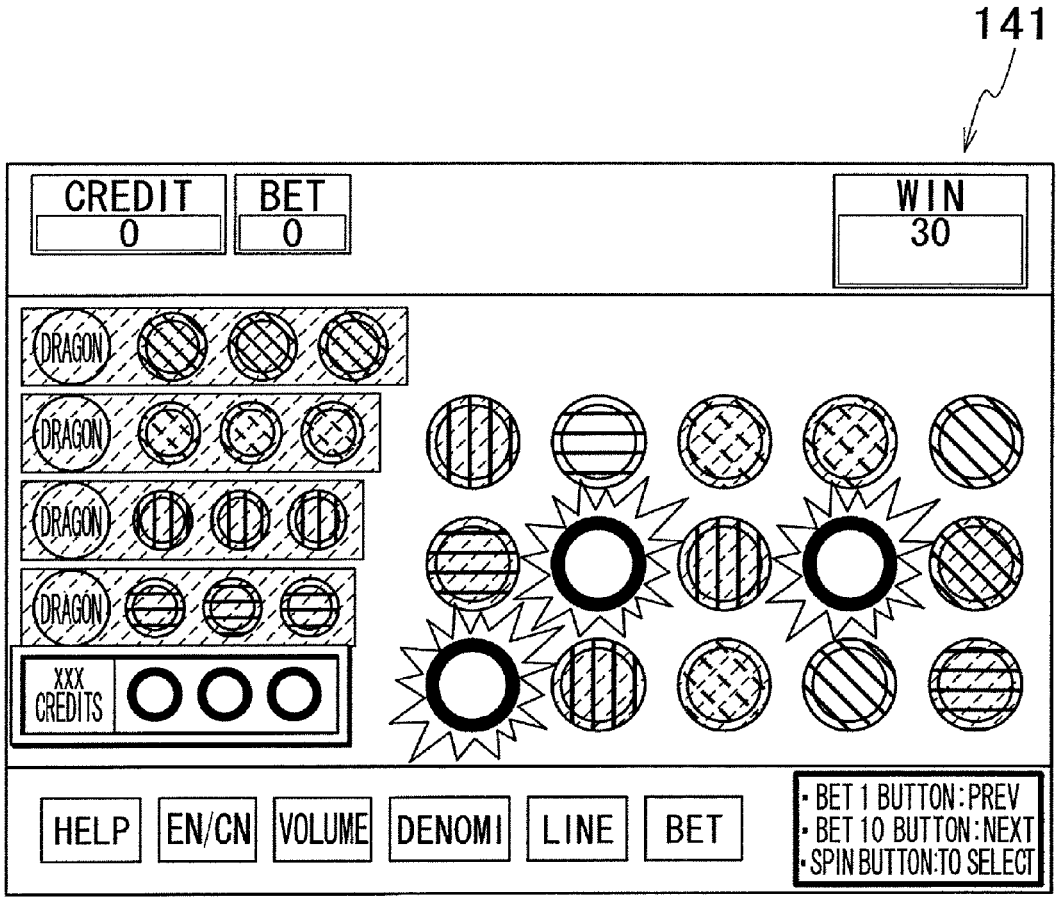
FIG. 70 is an explanatory diagram showing an exemplary display screen.
Figure 71:
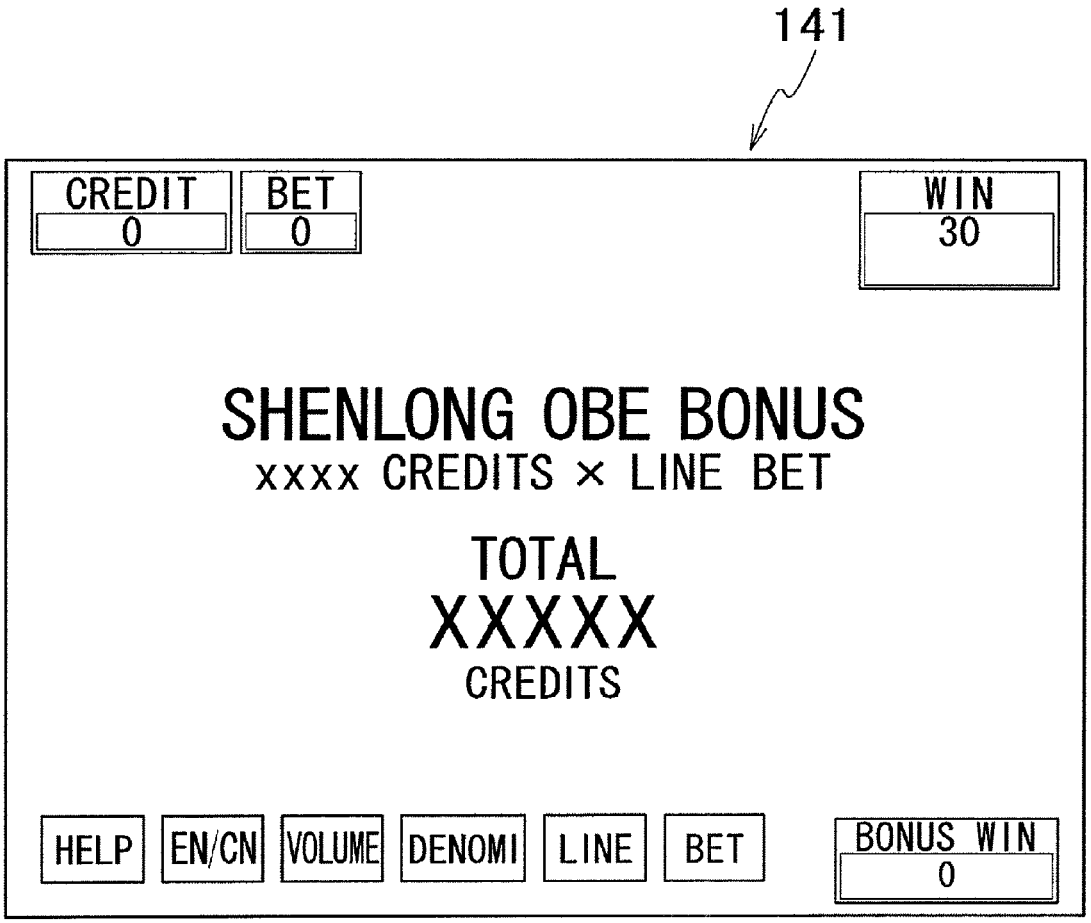
FIG. 71 is an explanatory diagram showing an exemplary display screen.

As shown in FIG. 69, of the five types of the symbols, the carp symbol leads to a fixed payout. When three of the carp symbols are selected, the corresponding symbol arrangement area 545 and the carp symbols associated with the obe-pick bonus choices 542 are emphasized. Note that the amount of fixed payout by the carp symbol is displayed and emphasized in the symbol arrangement area 545. Further, the message 543 "SELECT OBES UNTIL THREE SYMBOLS ARE ALIGNED" in the upper part of the screen and the operation navigation 521 in the screen lower part disappear. Then, as shown in FIG. 70, the contents of the unselected obe-pick bonus choices 542 is displayed in gray for a predetermined period (e.g., 3.5 seconds). As shown in FIG. 71, an "Account Report" indicating the total amount of payout won in the obe-pick bonus is displayed. At this time, the value on the bonus win meter 535 indicating the total amount won in the obe-pick bonus is transferred (added) to the win meter 402. Then, the process returns to the normal game. The arrangement of the symbols on the pseudo reels 151 to 155 is maintained as it is at the point where the bonus pick is triggered before the bonus game is started, as shown in FIG. 26.

The "Account Report" shown in FIG. 68 and FIG. 71 displays the bonus name, the equation, and the total credit won. The bonus name in this case is a Shenlong Obe Bonus. The equation is for deriving the total credit won, the number in the "XXXX" on the left side has four digits at most. The maximum digits of the total credit won is five.

Note that the obe-pick bonus may randomly include a jackpot in the obe-pick bonus choices 532. In this case, the obe-pick bonus is "OBE-PICK BONUS CHALLENGE FOR JACKPOT". The difference of the "OBE-PICK BONUS CHALLENGE FOR JACKPOT" from the obe-pick bonus is described.

Figure 72:
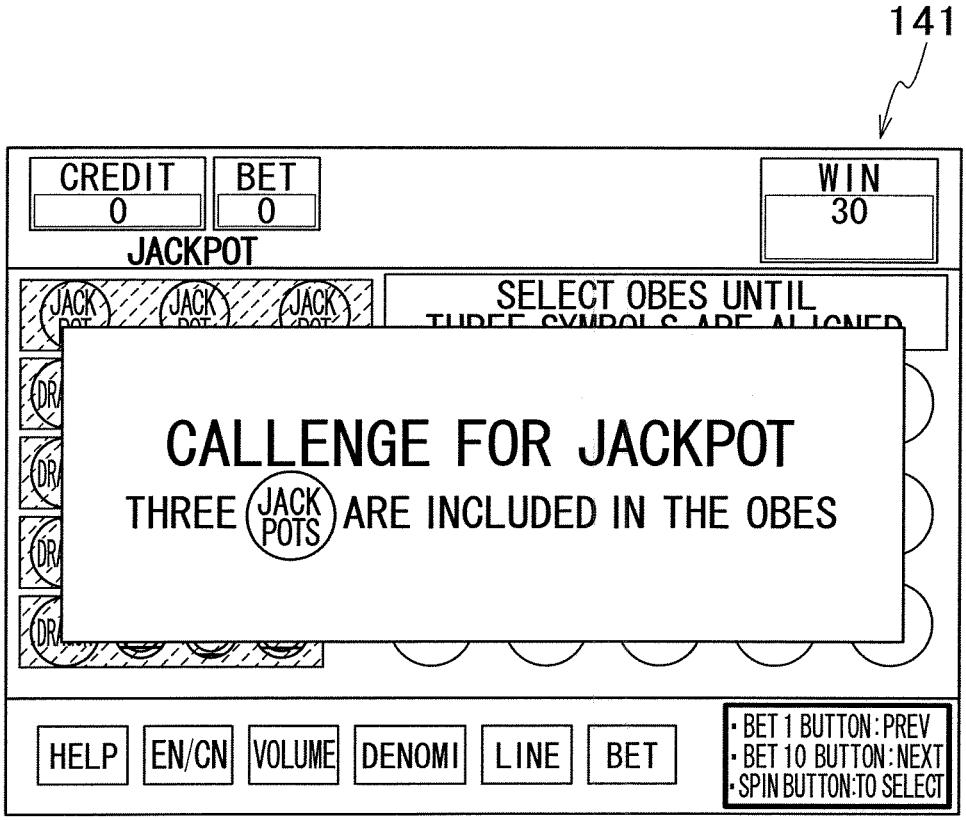
FIG. 72 is an explanatory diagram showing an exemplary display screen.
Figure 73:
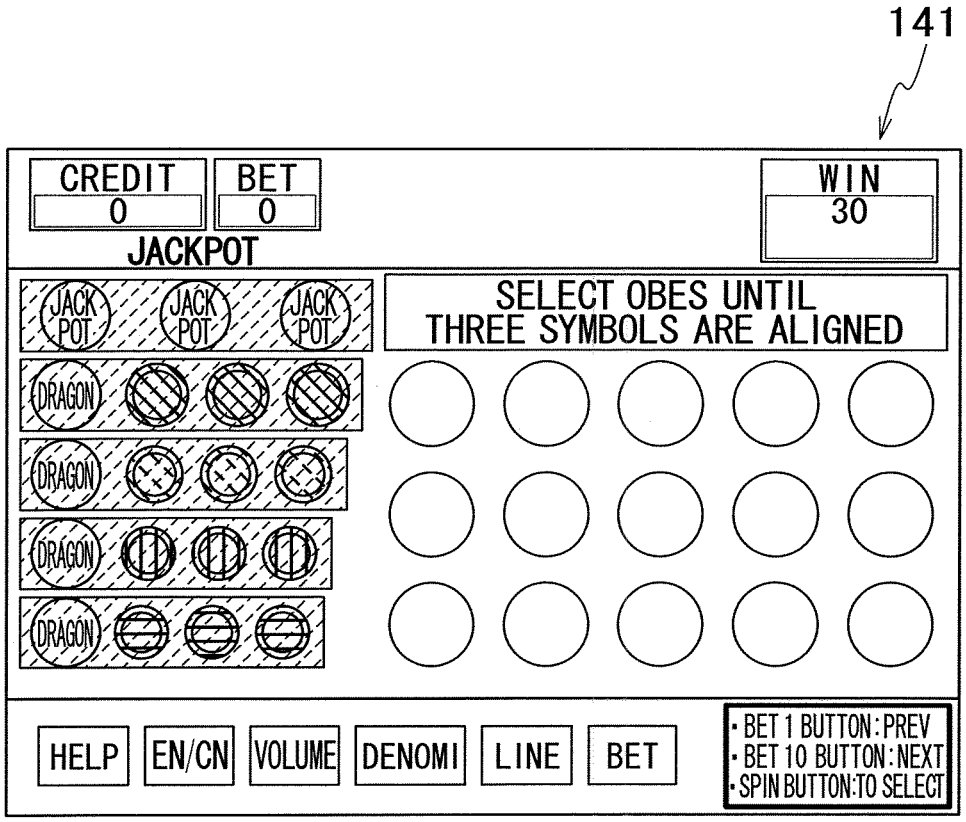
FIG. 73 is an explanatory diagram showing an exemplary display screen.

In "OBE-PICK BONUS CHALLENGE FOR JACKPOT", the carp symbol is changed to a jackpot symbol. As shown in FIG. 72, at the time of introducing "OBE-PICK BONUS CHALLENGE FOR JACKPOT", there is an indication that a jackpot symbol is included in the obe-pick bonus choices 532. Then, the screen changes to the selection waiting screen, as shown in FIG. 51. Note that, in "OBE-PICK BONUS CHALLENGE FOR JACKPOT", the symbol arrangement area 545 displays no area for arranging therein the carp symbol, and an area for arranging the jackpot symbol is displayed. The area for arranging the jackpot symbol is displayed in the uppermost stage.

Figure 74:
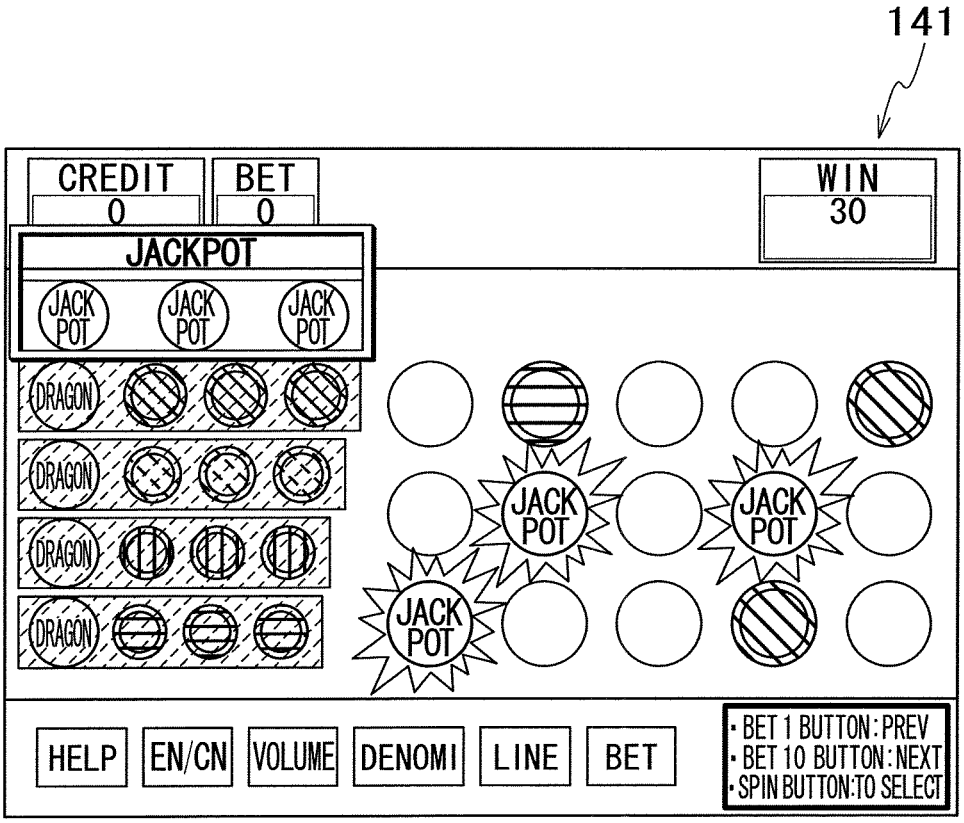
FIG. 74 is an explanatory diagram showing an exemplary display screen.
Figure 75:
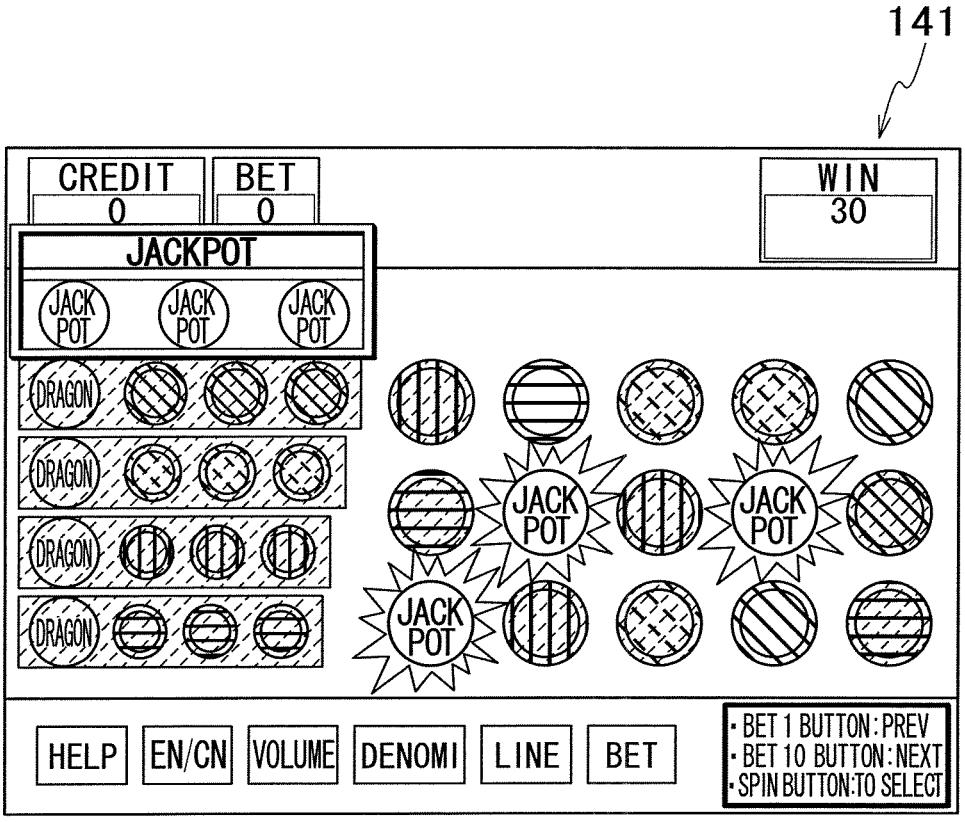
FIG. 75 is an explanatory diagram showing an exemplary display screen.
Figure 76:
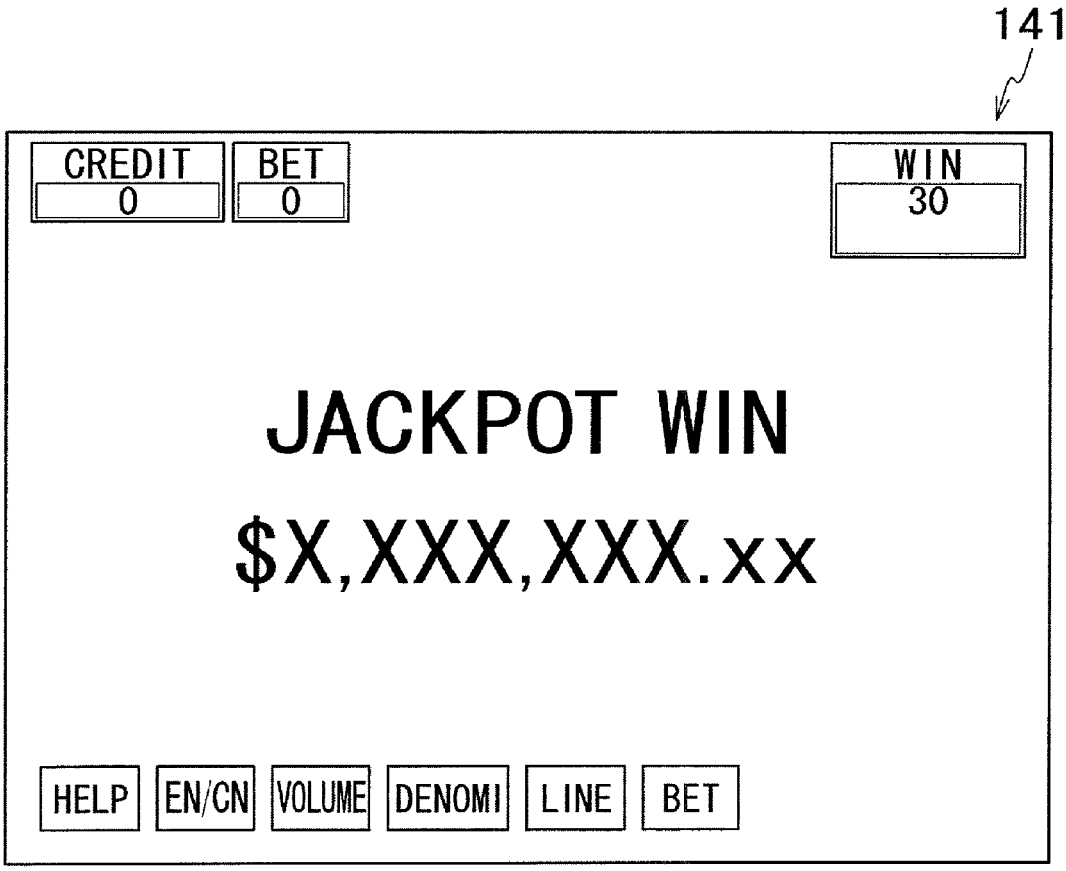
FIG. 76 is an explanatory diagram showing an exemplary display screen.
Figure 77:
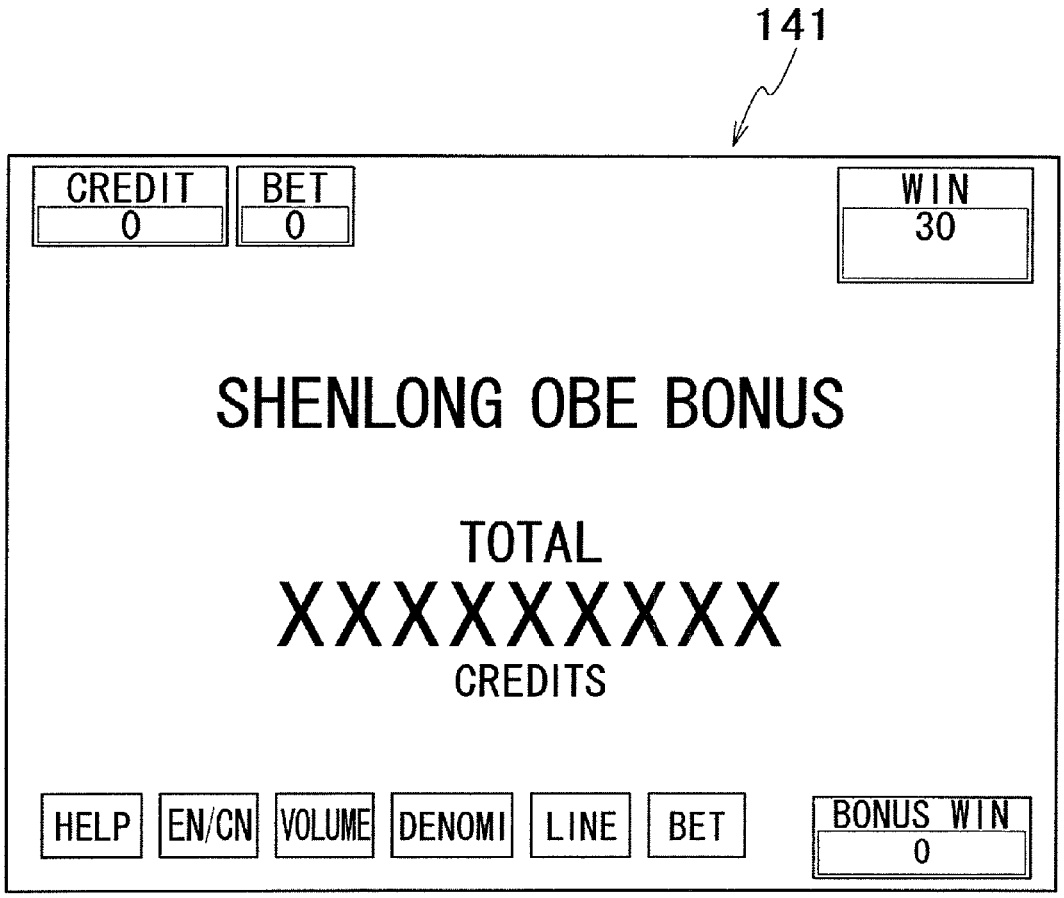
FIG. 77 is an explanatory diagram showing an exemplary display screen.

As shown in FIG. 74, of the five types of the symbols, the jackpot symbol leads to a jackpot. When three of the jackpot symbols are selected, the corresponding symbol arrangement area 545 and the carp symbols associated with the obe-pick bonus choices 542 are emphasized. Further, the message 543 "SELECT OBES UNTIL THREE SYMBOLS ARE ALIGNED" in the upper part of the screen and the operation navigation 521 in the screen lower part disappear. Then, as shown in FIG. 75, the contents of the unselected obe-pick bonus choices 542 is displayed in gray for a predetermined period (e.g., 3.5 seconds). Then, as shown in FIG. 76, the Jackpot win screen is displayed. As shown in FIG. 77, an "Account Report" indicating the total amount of payout won in the obe-pick bonus is displayed.

The "Account Report" displays the bonus name. The maximum digit of the total amount is nine. At this time, the value on the bonus win meter 535 indicating the total amount won in the obe-pick bonus is transferred (added) to the win meter 402. Then, the process returns to the normal game. The arrangement of the symbols on the pseudo reels 151 to 155 is maintained as it is at the point where the bonus pick is triggered before the bonus game is started, as shown in FIG. 26.

(Bonus Game: Obe-Spin Bonus)

Figure 78:
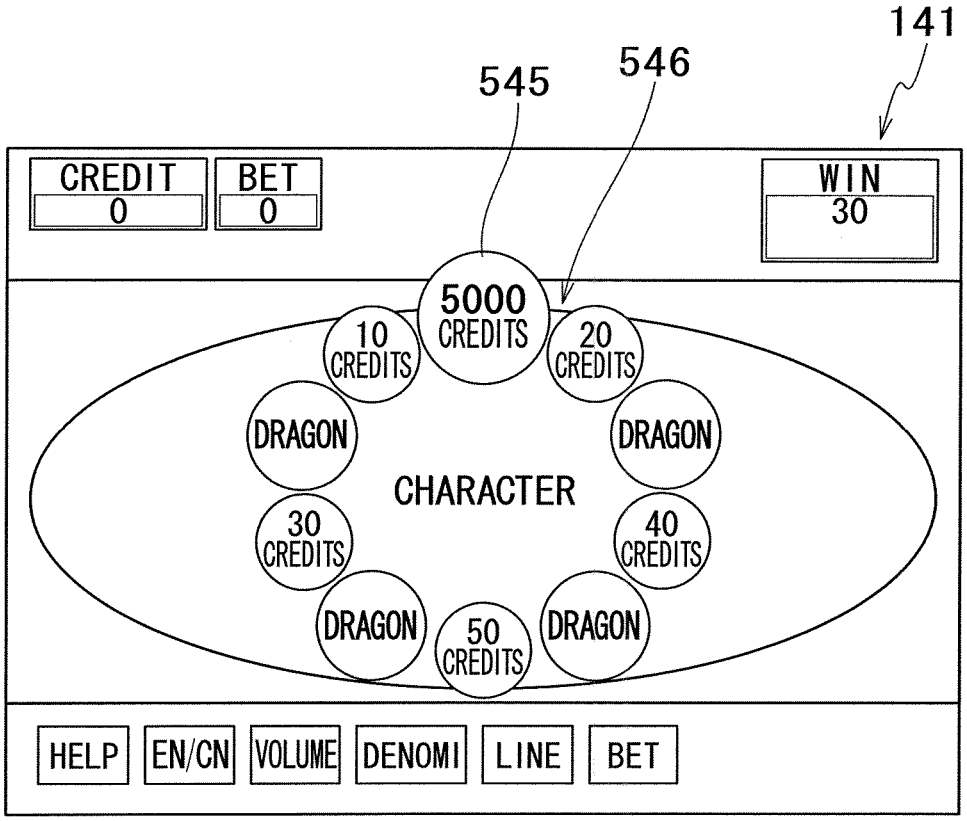
FIG. 78 is an explanatory diagram showing an exemplary display screen.

When the obe-spin bonus 531 is selected in the bonus choice, there is a shift to the obe-spin bonus (hereinafter also referred to as dragon spin bonus). As shown in FIG. 78, in the obe-spin bonus, an obe roulette 546 with ten obe-spin bonus choices 545 annularly arranged is displayed. In the obe-spin bonus, a roulette game using the obe roulette 546 is run, and one of the obe-spin bonus choices 545 is randomly determined. The obe-spin bonus choices 545 include five types of choices: i.e., "credit", "red obe", "yellow obe", "green obe", and "blue obe". When the credit is resulted in the roulette game, the amount of credit indicated in the obe-spin bonus choice 545 is awarded. When the roulette results in the "red obe", the "yellow obe", the "green obe", or the "blue obe", a roulette game corresponding to the resulting obe is run in the upper image display panel 142. On the win meter 402 is displayed the amount of credit having been earned until the obe-spin bonus is started.

Figure 79:
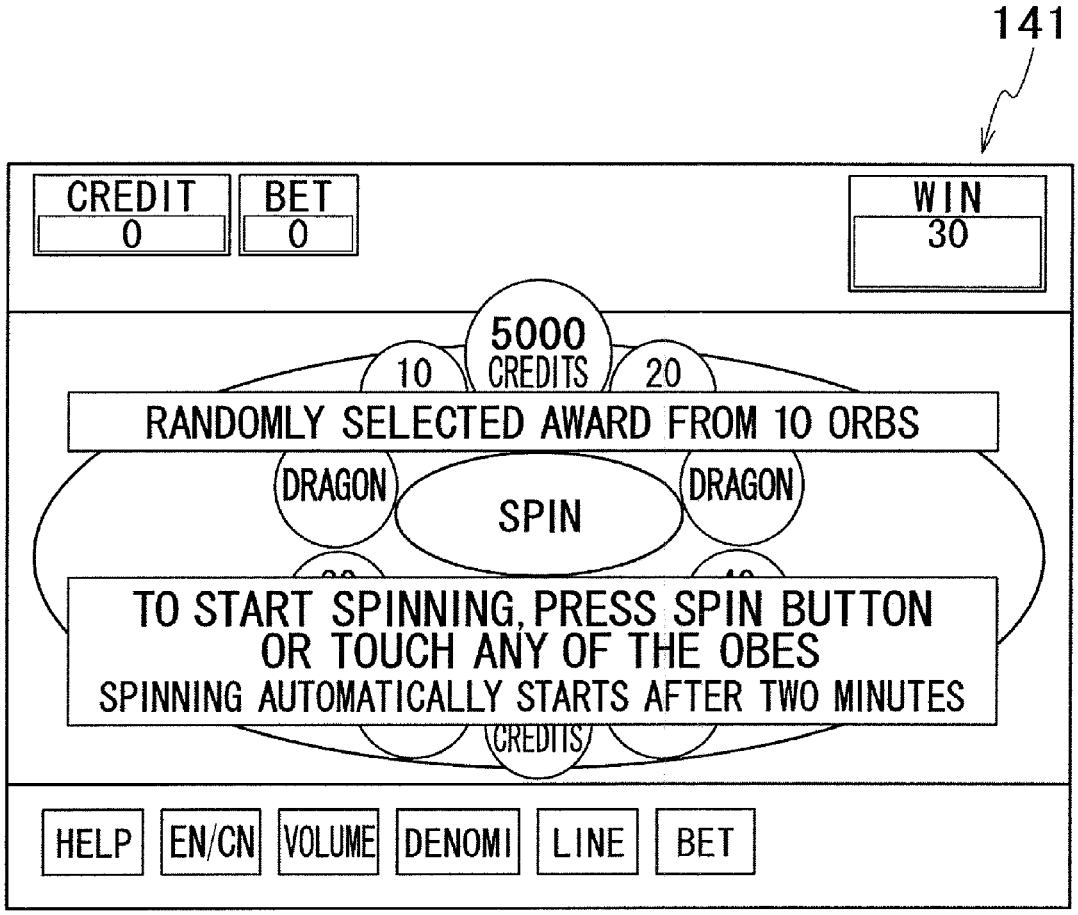
FIG. 79 is an explanatory diagram showing an exemplary display screen.
Figure 80:
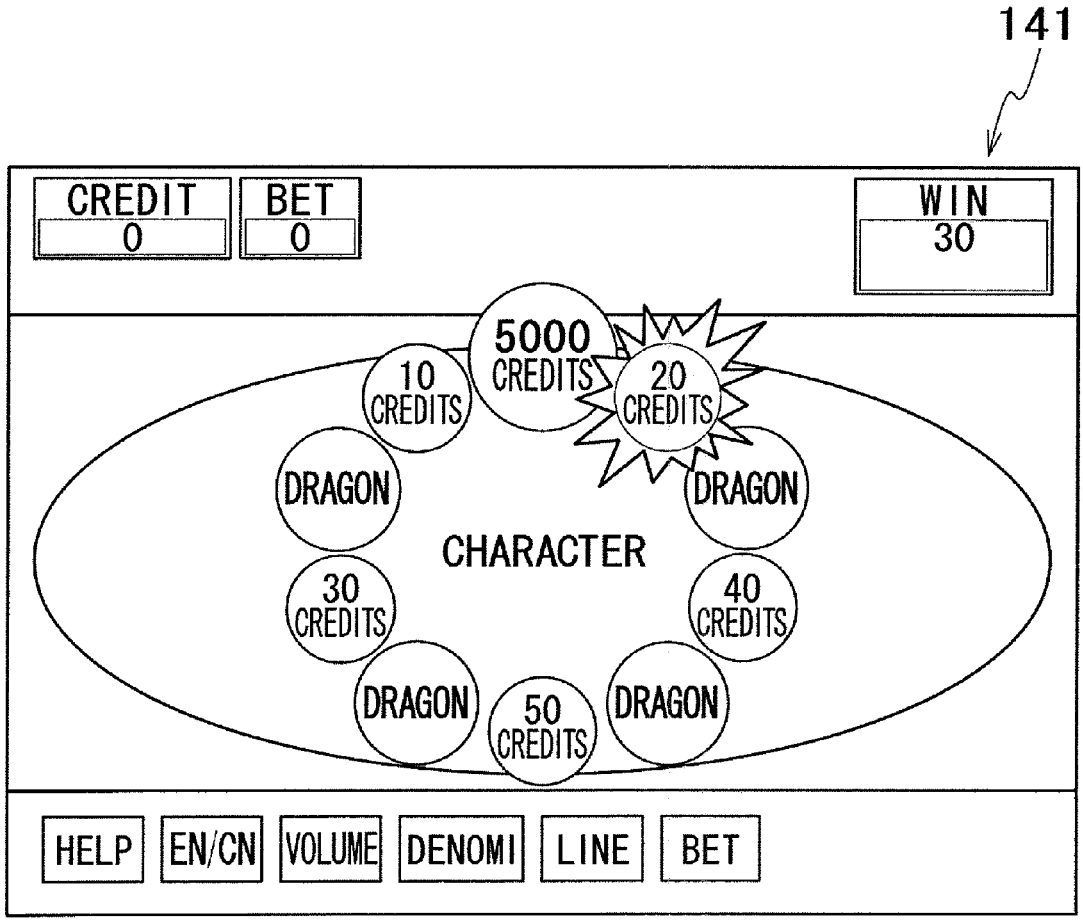
FIG. 80 is an explanatory diagram showing an exemplary display screen.

As shown in FIG. 79, a message informing that operation of the spin button 46 starts the roulette game is displayed before the roulette game is started. When the roulette game is started, the credit (5000 credit) at the top center of the screen shown in FIG. 80 and the obe-spin bonus choices 545 sequentially lights clockwise one after another starting from the credit.

Figure 81:
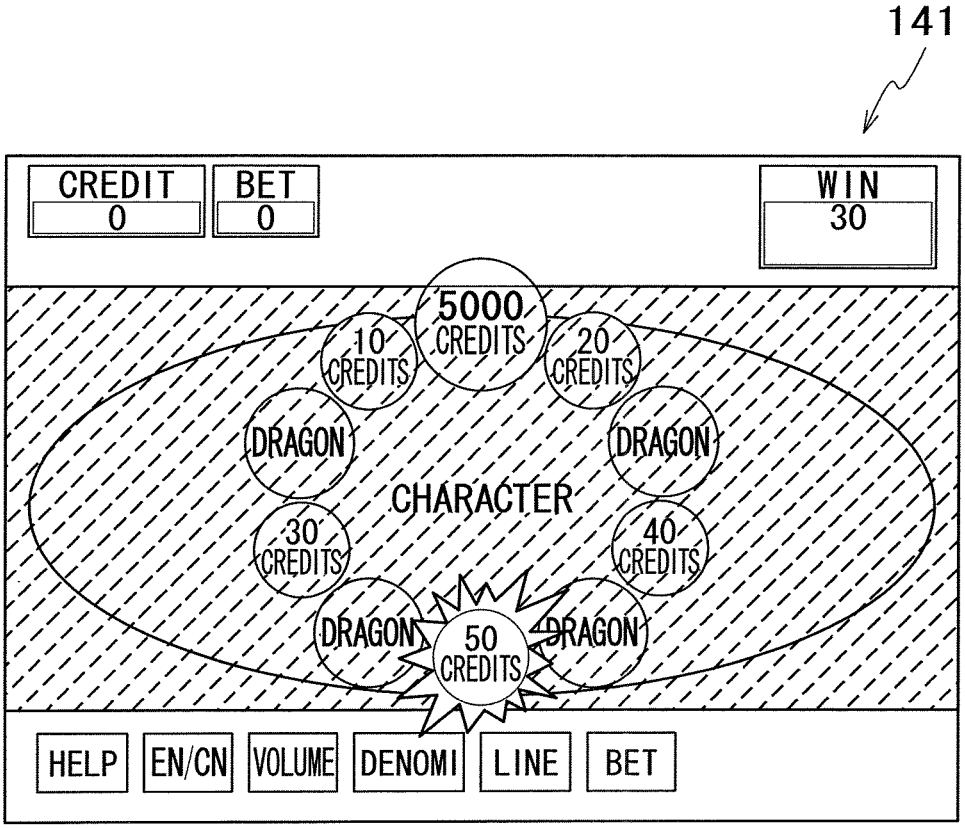
FIG. 81 is an explanatory diagram showing an exemplary display screen.
Figure 82:
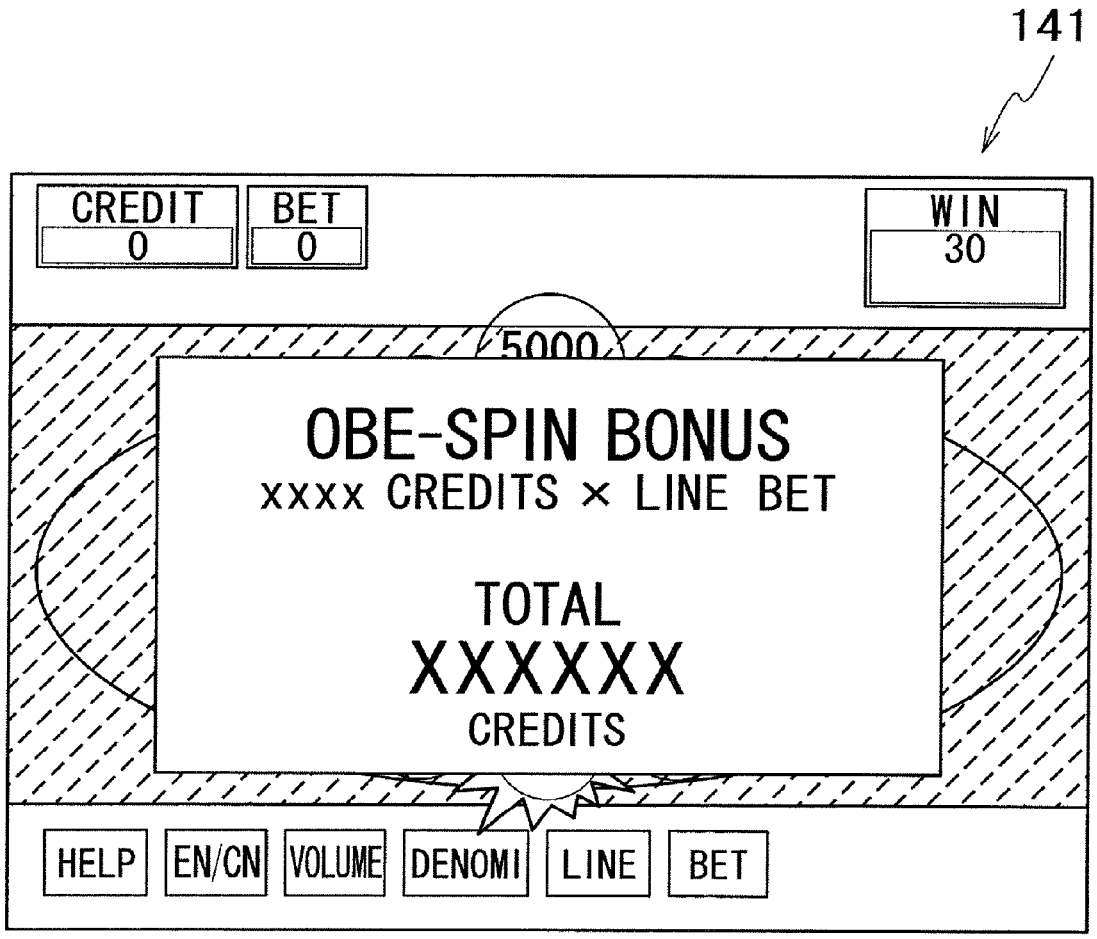
FIG. 82 is an explanatory diagram showing an exemplary display screen.

The following describes a case where the roulette game results in the credit. As shown in FIG. 81, when the credit is resulted, the obe-spin bonus choices 545 other than the one resulted are displayed less brightly so as to make the resulting obe-spin bonus choice 545 noticeable. Then, as shown in FIG. 82, an "Account Report" indicating the total payout won in the obe-spin bonus is displayed. The "Account Report" displays the bonus name, the equation, and the total credit won. The bonus name in this case is obe-spin bonus. The equation is for deriving the total credit won, the number in the "XXXX" on the left side has four digits at most. The maximum digits of the total credit won is five. Then, the process returns to the normal game. The arrangement of the symbols on the pseudo reels 151 to 155 is maintained as it is at the point where the bonus pick is triggered before the bonus game is started, as shown in FIG. 26.

Figure 83:
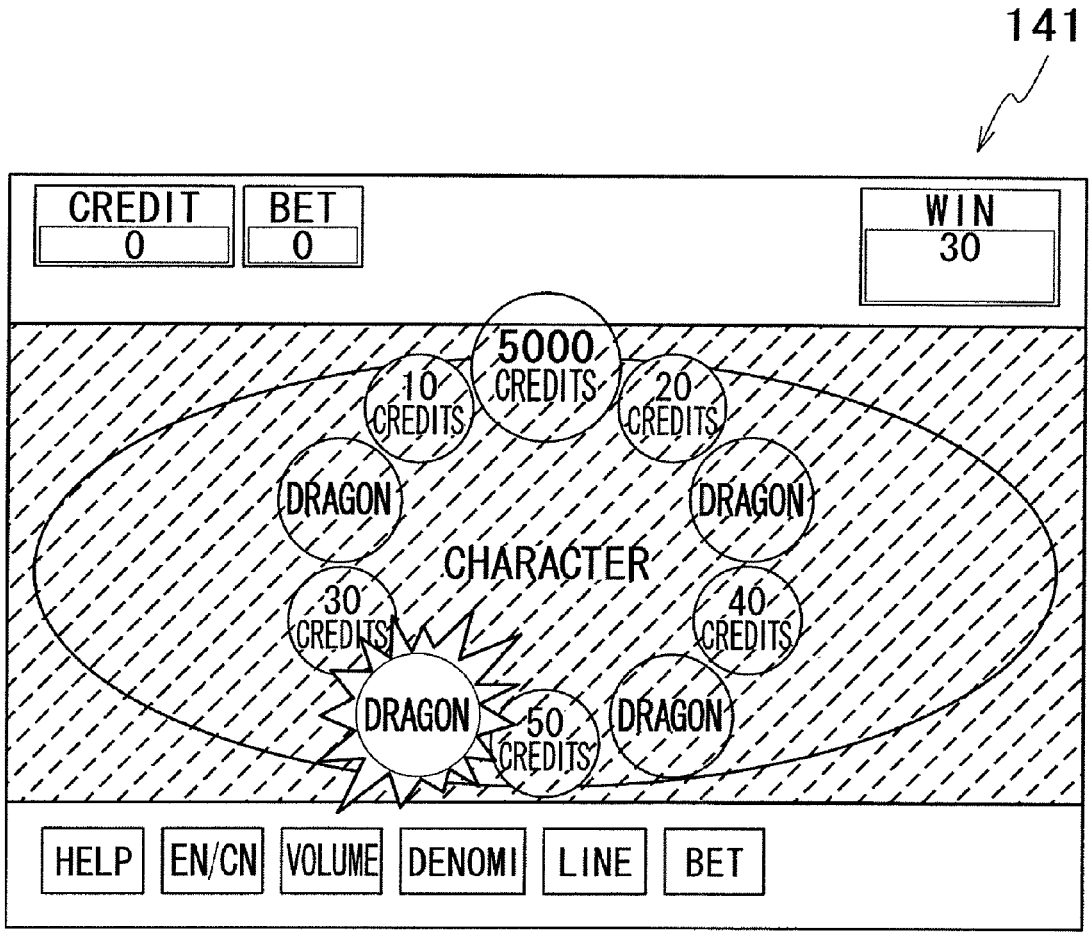
FIG. 83 is an explanatory diagram showing an exemplary display screen.
Figure 84:
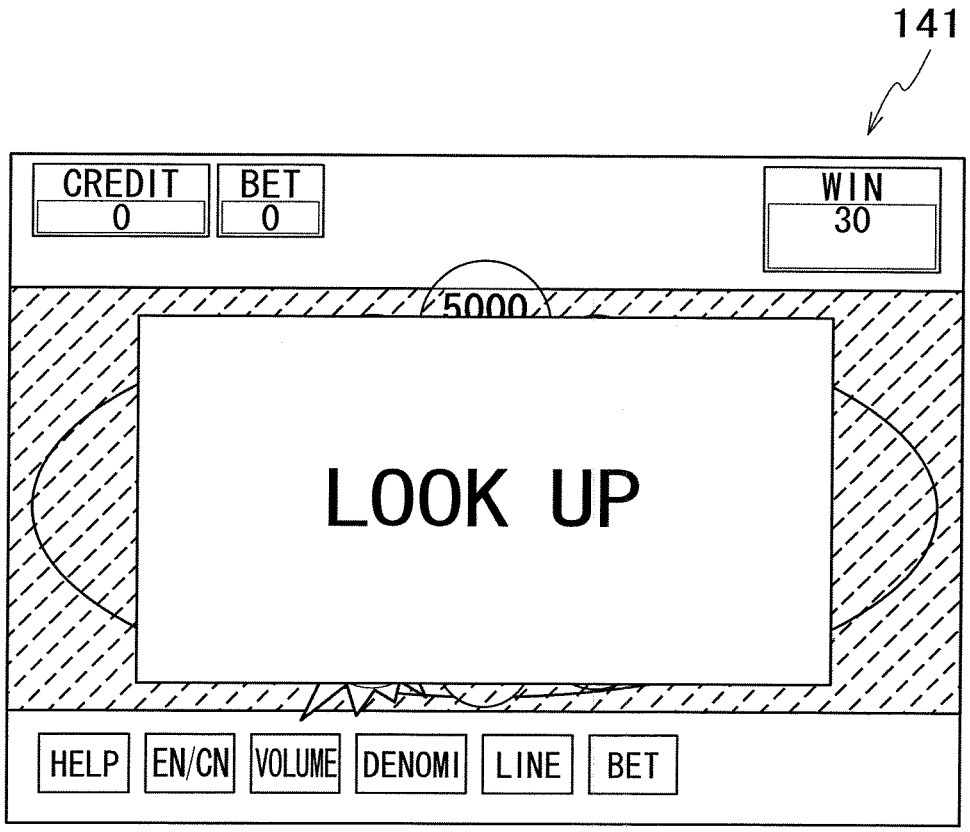
FIG. 84 is an explanatory diagram showing an exemplary display screen.

The following describes a case where the roulette game results in any of the "red obe", the "yellow obe", the "green obe", and the "blue obe". As shown in FIG. 83, when any of the "red obe", the "yellow obe", the "green obe", or the "blue obe" is resulted, the determine obe-spin bonus choices 545 other than the one resulted are displayed less brightly so as to make the resulting obe-spin bonus choices 545 noticeable. After this, as shown in FIG. 84, text reading "LOOK UP" is displayed. Displaying of the "LOOK UP" on the upper image display panel 142 continues until the roulette ends. Then, as shown in FIG. 82, an "Account Report" indicating the total payout won in the obe-spin bonus is displayed. Then, the process returns to the normal game. The arrangement of the symbols on the pseudo reels 151 to 155 is maintained as it is at the point where the bonus pick is triggered before the bonus game is started, as shown in FIG. 26.

Note that the obe-spin bonus may randomly include a jackpot in the obe-spin bonus choices 545. In this case, the obe-spin bonus in this case is "OBE-SPIN BONUS CHALLENGE FOR JACKPOT". The difference of the "OBE-SPIN BONUS CHALLENGE FOR JACKPOT" from the obe-spin bonus is described below.

Figure 85:
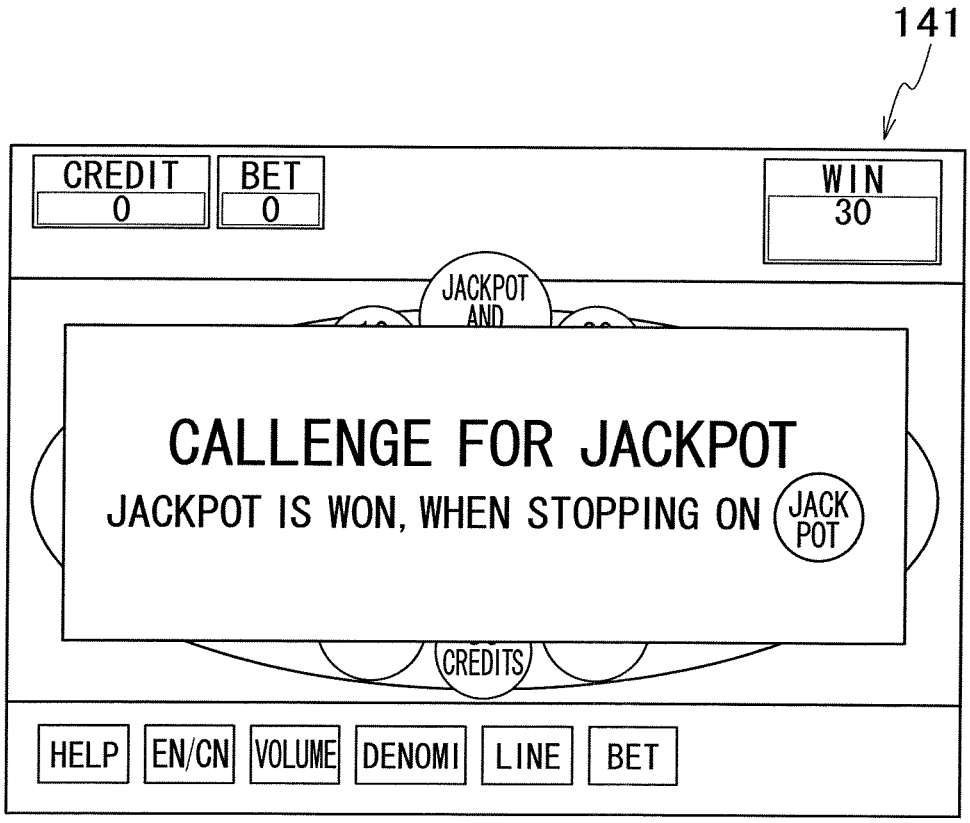
FIG. 85 is an explanatory diagram showing an exemplary display screen.
Figure 86:
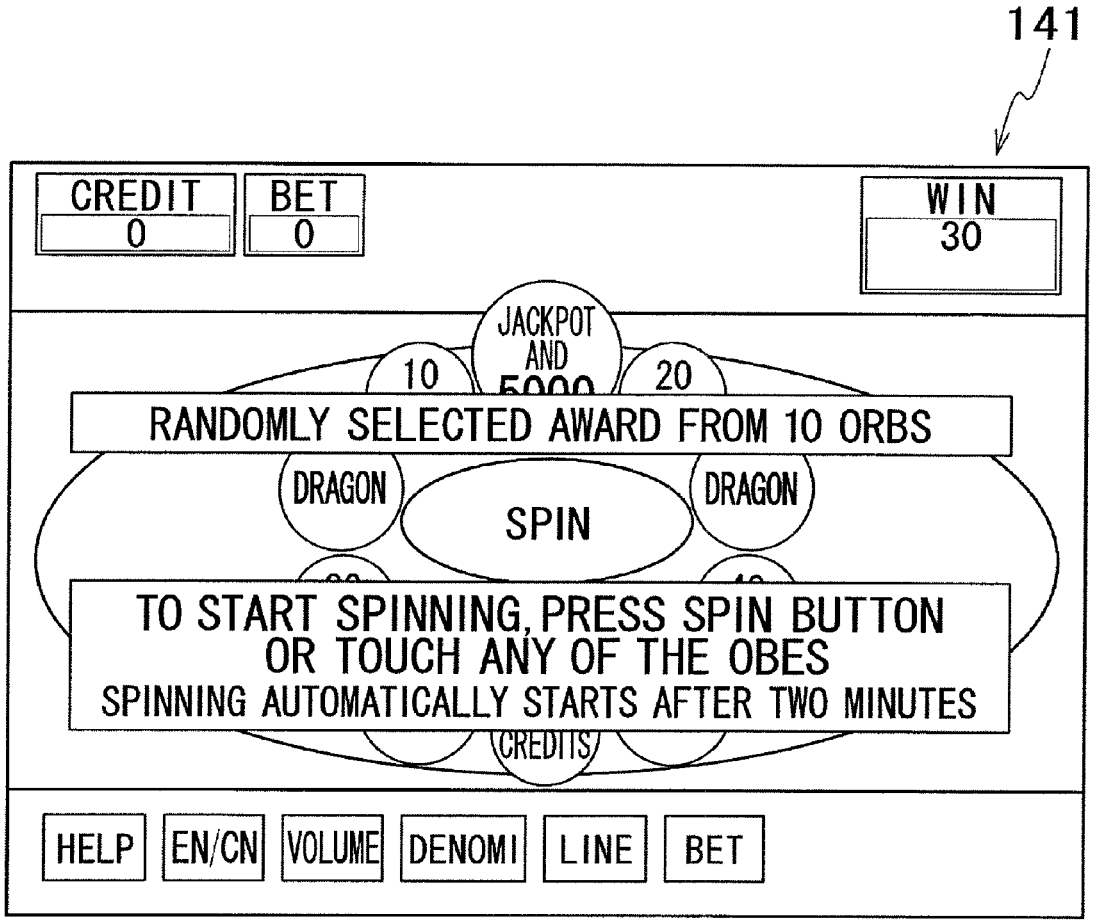
FIG. 86 is an explanatory diagram showing an exemplary display screen.

In "OBE-SPIN BONUS CHALLENGE FOR JACKPOT", one of the choices associated with the credit payout is changed to a jackpot. As shown in FIG. 85, at the time of introducing "OBE-SPIN BONUS CHALLENGE FOR JACKPOT", there is an indication that a jackpot is included in the obe-spin bonus choices 545. Specifically, of the obe-spin bonus choices 545 associated with credit, the obe-spin bonus choice 545 associated with the maximum payout is changed to jackpot payout+maximum payout. Then, as shown in FIG. 86, the screen enters the roulette start waiting screen.

Figure 87:
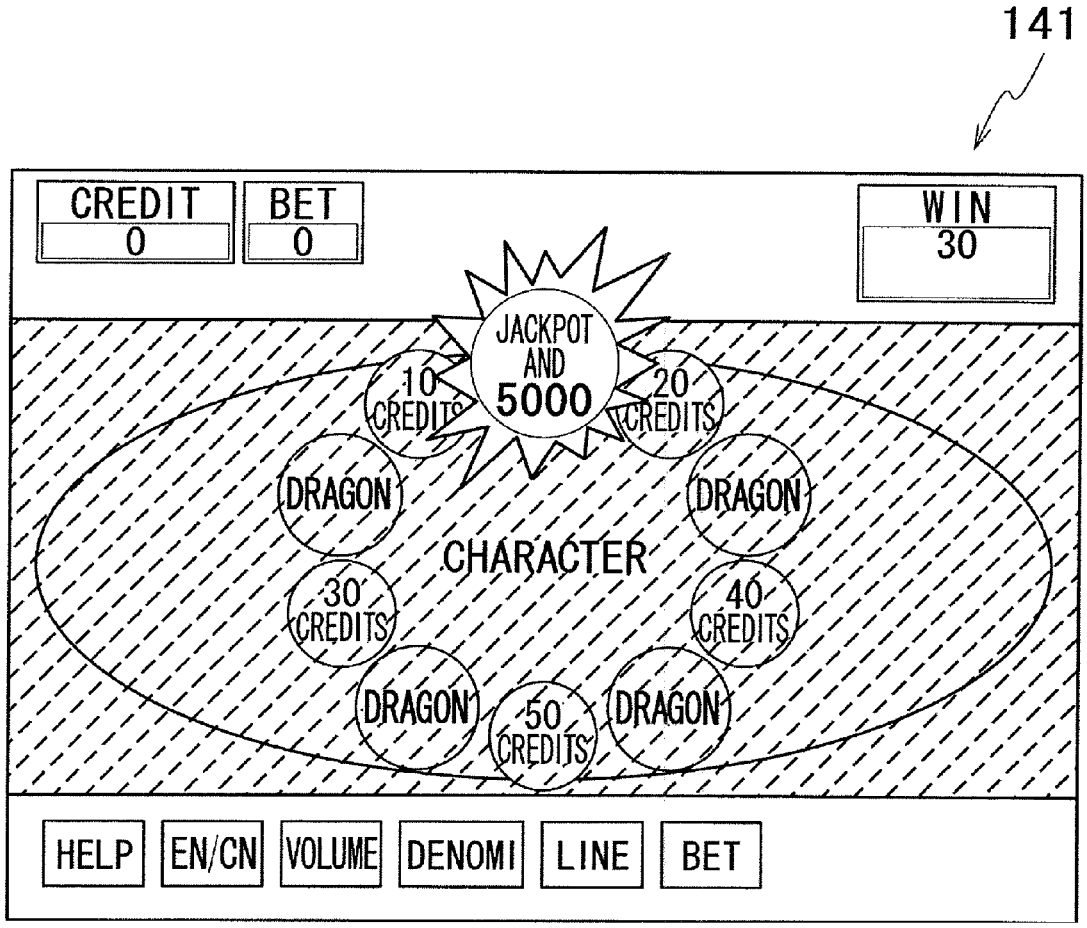
FIG. 87 is an explanatory diagram showing an exemplary display screen.
Figure 88:
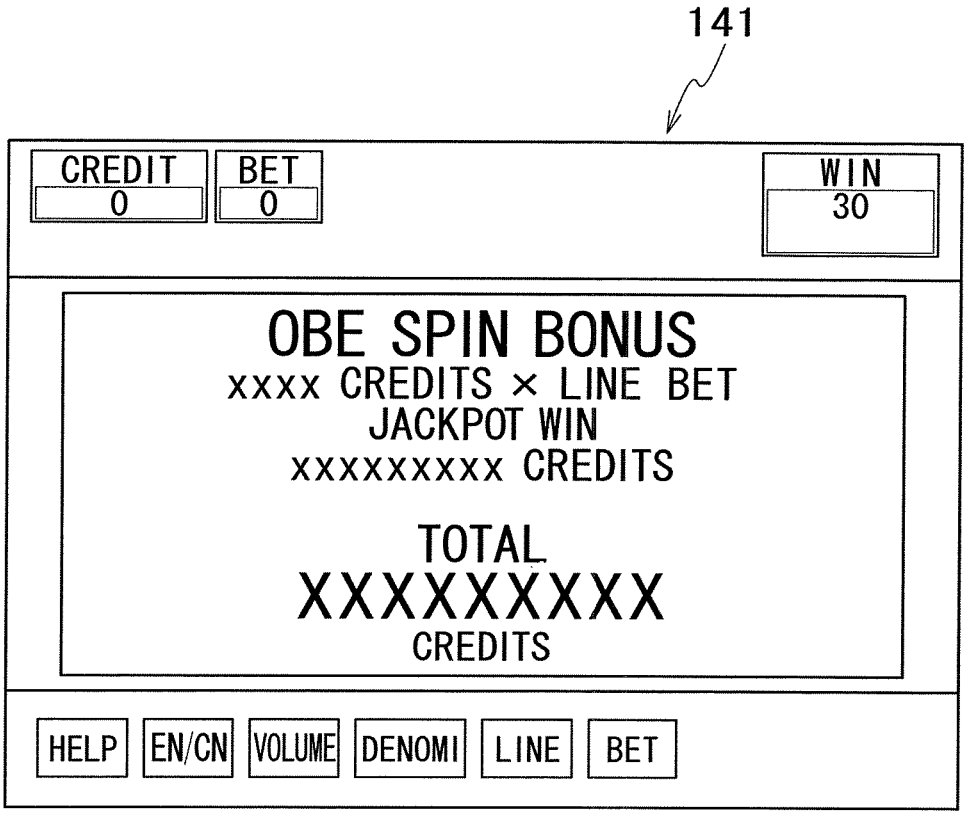
FIG. 88 is an explanatory diagram showing an exemplary display screen.

The following describes a case where the roulette results in the jackpot. As shown in FIG. 87, when the jackpot is resulted, the obe-spin bonus choices 545 other than the one resulted are displayed less brightly so as to make the resulting obe-spin bonus choices 545 noticeable. Then, as shown in FIG. 76, the Jackpot win screen is displayed. As shown in FIG. 88, an "Account Report" indicating the total amount of payout won in the obe-spin bonus is displayed. The "Account Report" displays the bonus name, the equation, the jackpot win display, and the total credit won. The bonus name in this case is obe-spin bonus. The equation is for deriving the total credit won, the number in the "XXXX" on the left side has four digits at most. Note that, the maximum number of digits displayed as the jackpot win display is nine. The maximum number of digits displayed as the total credit won is nine. Then, the process returns to the normal game. The arrangement of the symbols on the pseudo reels 151 to 155 is maintained as it is at the point where the bonus pick is triggered before the bonus game is started, as shown in FIG. 26.

(Operations of Slot machine 10: Normal Game Execution Process)

Figure 89:
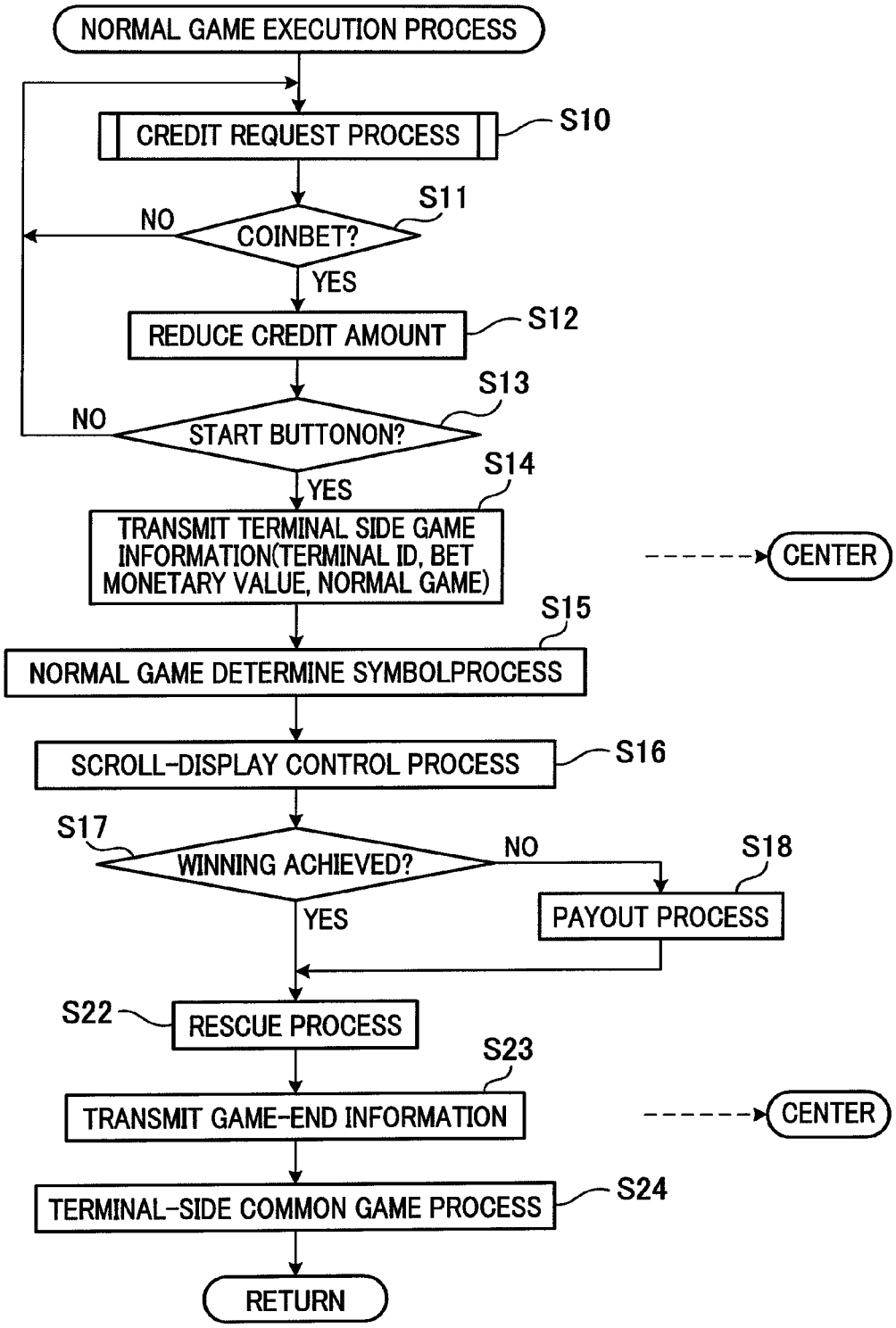
FIG. 89 is a flowchart of a normal game execution process.

The operation of the slot machine 10 arranged as above will be described. The normal game execution process shown in FIG. 89 is executed by the main CPU 71 of the slot machine 10. The slot machine 10 has been activated in advance.

To begin with, the main CPU 71 executes a credit request process (S10). In this process, the player determines how many credits are used from the credits stored in the IC card.

Then whether a coin is bet is determined (S11). In this process, the main CPU 71 determines whether an input signal output from the 1-bet switch 34S when the 1-bet button 34 is pressed and an input signal output from the 10-bet switch 39S when the 10-bet button 39 is pressed are received. When it is determined that no coin is bet, the process goes back to S10.

In the meanwhile, if it is determined in S11 that a coin is bet, the main CPU 71 executes a process of decreasing the number of credits stored in the RAM 73 in accordance with the number of coins bet (S12). When the number of coins bet is larger than the number of credits stored in the RAM 73, the step of decreasing the number of credits stored in the RAM 73 is not carried out and the process goes back to S11. When the number of coins bet is larger than the maximum number (maximum bet amount in the present embodiment) of coins on one game, the step of decreasing the number of credits stored in the RAM 73 is not carried out and the process proceeds to S13.

Then the main CPU 71 determines whether the spin button 46 is pressed (S13). In this step, the main CPU 71 determines whether an input signal output from the start switch 46S when the spin button 46 is pressed is received. When it is determined that the spin button 46 is not pressed, the process goes back to S11. It is noted that, when the spin button 46 is not pressed (e.g., when an instruction to end a game is input while the spin button 46 is not pressed), the main CPU 71 cancels the reduction result in S12.

In the meanwhile, if it is determined in S13 that the spin button 46 is pressed, the main CPU 71 sends terminal-side game information to the center controller 200 (S14), and then executes a normal game symbol determination process (S15). In the normal game symbol determination process, code numbers when the symbols are stopped are determined. More specifically, a random number is sampled, and the code number when each symbol array of the display block 28 stops is determined based on the sampled random number and a normal game symbol table. Then, based on the symbols determined, whether to perform the indication effect is determined.

Thereafter, in S16, the main CPU 71 executes a scroll-display control process. In this process, the display control is conducted so that, after the start of the scroll of the symbols 501, the symbols 501 are rearranged in accordance with S15. When the indication effect (the common indication effect and the individual indication effect) is to be executed, the indication effect is executed while the display control on the scroll of symbols 501 or the like is performed.

Thereafter, the main CPU 71 determines whether a prize is established (S17). In S17, the main CPU 71 counts, regarding the symbols 501 rearranged in accordance with S16, the number of symbols 501 of each type rearranged on each activatable line. Then the main CPU 71 determines whether the number of the symbols of each type is at least two.

When it is determined that a prize is established, the main CPU 71 executes a step concerning the payout of coins (S18). In this step, the main CPU 71 determines a payout rate with reference to odds data stored in the RAM 73 and based on the number of symbols 501 rearranged on an activatable line. The odds data indicates the relationship between the number of symbols 501 rearranged on an activatable line and a payout rate. Each time one "Wild" is displayed on an activatable line where winning is established, the payout is doubled. That is to say, when three "Wild" are displayed on an activatable line where winning is established, the payout is multiplied eight times.

The present embodiment assumes that a prize is established when at least one type of two or more symbols 501 are rearranged on an activatable line. Alternatively, the present invention may be arranged so that no activatable line is provided and a prize is established when at least one type of two or more symbols 501 are rearranged in the display blocks 28.

When it is determined in S17 that no prize is established or after S18, the main CPU 71 executes a rescue process to relieve the player if a predetermined rescue execution condition has been established (S22). After S22, the main CPU 71 sends game end information as information to cause all slot machines 10 to simultaneously start the common game (S23). Thereafter, a terminal-side common game process is executed (S24). The sub routine ends with this.

The gaming machine 300 may include the following structure in addition to the above described structure.

(Details of Display Screen: Payline Box)

Figure 90:
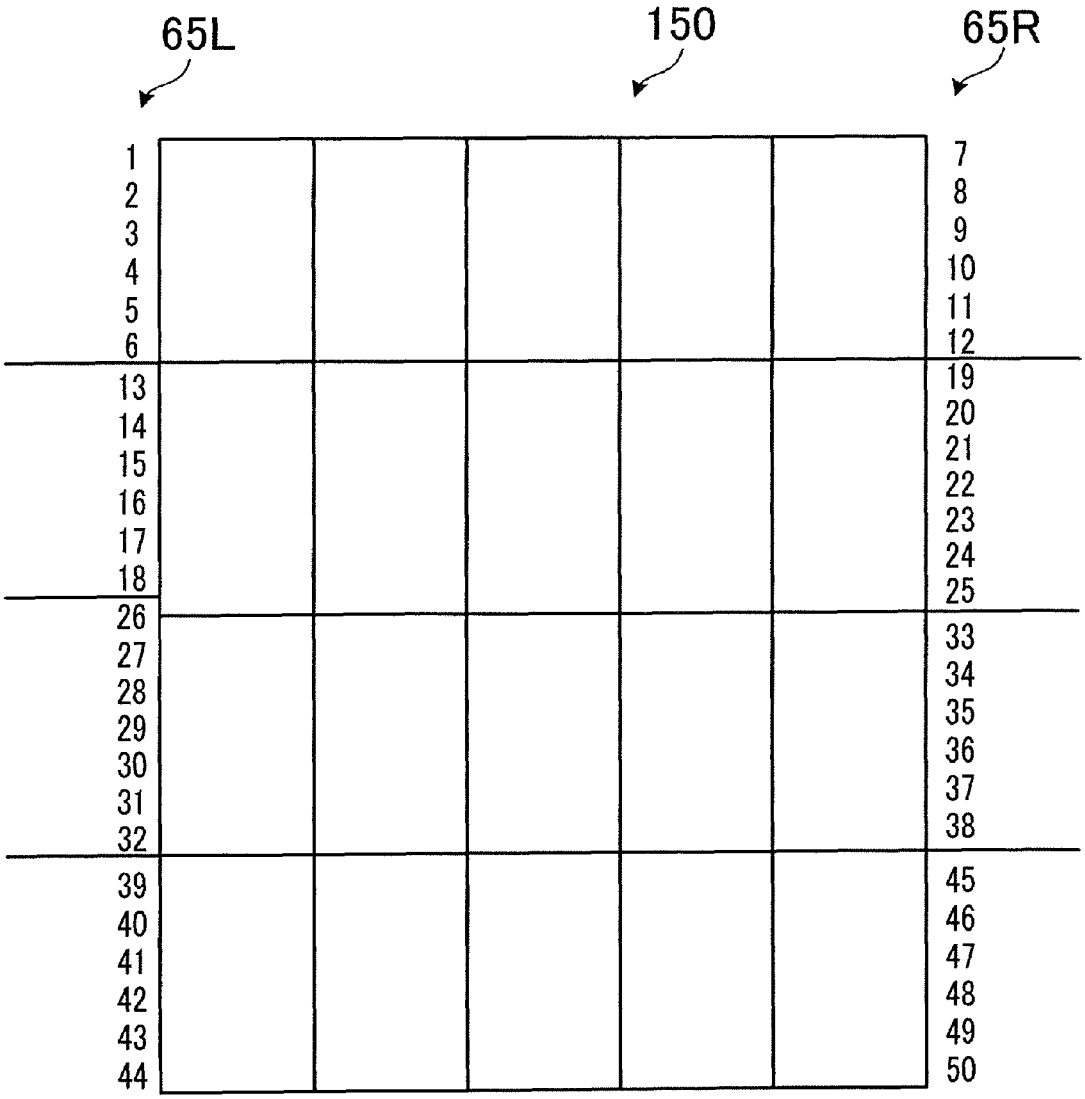
FIG. 90 is an explanatory diagram of a game screen.

The lower image display panel 141 described above forms, as shown in FIG. 11, payline boxes in the reel display area 150. As the payline boxes forming four rows and five columns are combined, 50 paylines are formed. Furthermore, as shown in FIG. 90, at the left and right edges of the reel display area 150, payline occurrence columns are provided in a symmetrical manner on the left and right. The left payline occurrence column on the left side when viewed from the player has 25 payline occurrence parts 65L. The right payline occurrence column on the right side when viewed from the player has 25 payline occurrence parts 65R. An activated payline allows various winning combination of the symbols 501.

In the present embodiment, the 50 paylines are active; however, the present invention is not limited to this. For example, each payline may be activated when a payline occurrence part 65L and a payline occurrence part 65R are activated. The payline L in other occasions may be inactive. The number of active paylines may be determined by the bet amount. When the bet amount is a MAX bet which is the maximum bet amount, the maximum of 50 paylines may be activated.

(Details of Display Screen: Displaying Line)

Displaying of the lines at the occurrence of winning is carried out in the following cases: (1) during the normal game, (2) during the free game, (3) in the normal game when the free game is obtained (with a trigger), (4) in the normal game when a mystery bonus is obtained (non-trigger), (5) and when re-trigger is obtained.

(Details of Display Screen: Displaying Line: When Winning is Achieved at a Single Line)

Figure 91:
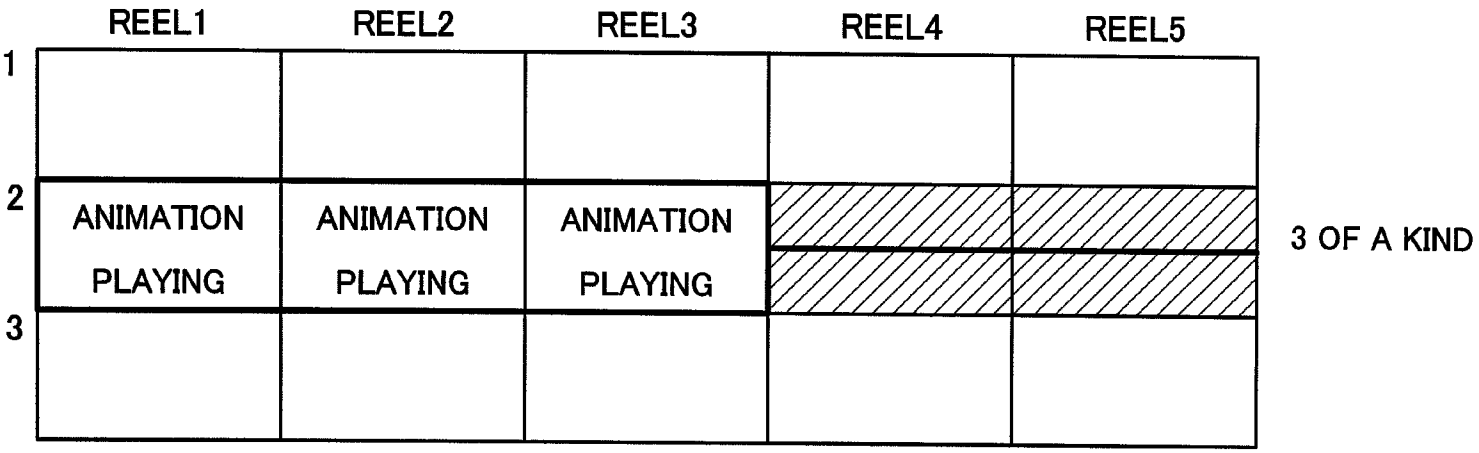
FIG. 91 is an explanatory diagram of reels in the game screen.

As an example of cases where a winning is achieved at a single line, when, as shown in FIG. 91, a winning is achieved at the line 2 in a 3-line game, the following two single line processes 1 and 2 are executed. That is to say, in the single line process 1, the line where the winning is achieved and the frame enclosing the target symbol are illuminated (but not flicker). In the single line process 2, the animation of the symbol which is the target of winning starts. In a winning involving a scatter symbol such as the bonus symbol, only the frame enclosing the symbol is displayed. The line display is continued until the next game starts. In the gray display region in the figure, the symbol display is below the activatable line.

In the free game, each of the single line processes 1 and 2 is executed at least once. After the end of these processes, whether the WIN increment has been finished and whether the waiting time has been elapsed are checked, and the shifting to the next game is conducted when both of these conditions are satisfied. In case of a minor WIN (in a single line or the like), since the execution of each of the single line processes 1 and 2 once finishes promptly and the next game starts, the state at the occurrence of winning is maintained for five seconds, and the shifting to the next game starts after five seconds elapse. The instructions "Skip" and "Cancellation of WIN Increment" by the player while the winning line is illuminated (WIN increment) are accepted and the corresponding operations are performed. This, however, is carried out only when these functions are available.

(Details of Display Screen: Displaying Lines: When Winning is Achieved at Plural Lines)

Figure 92:
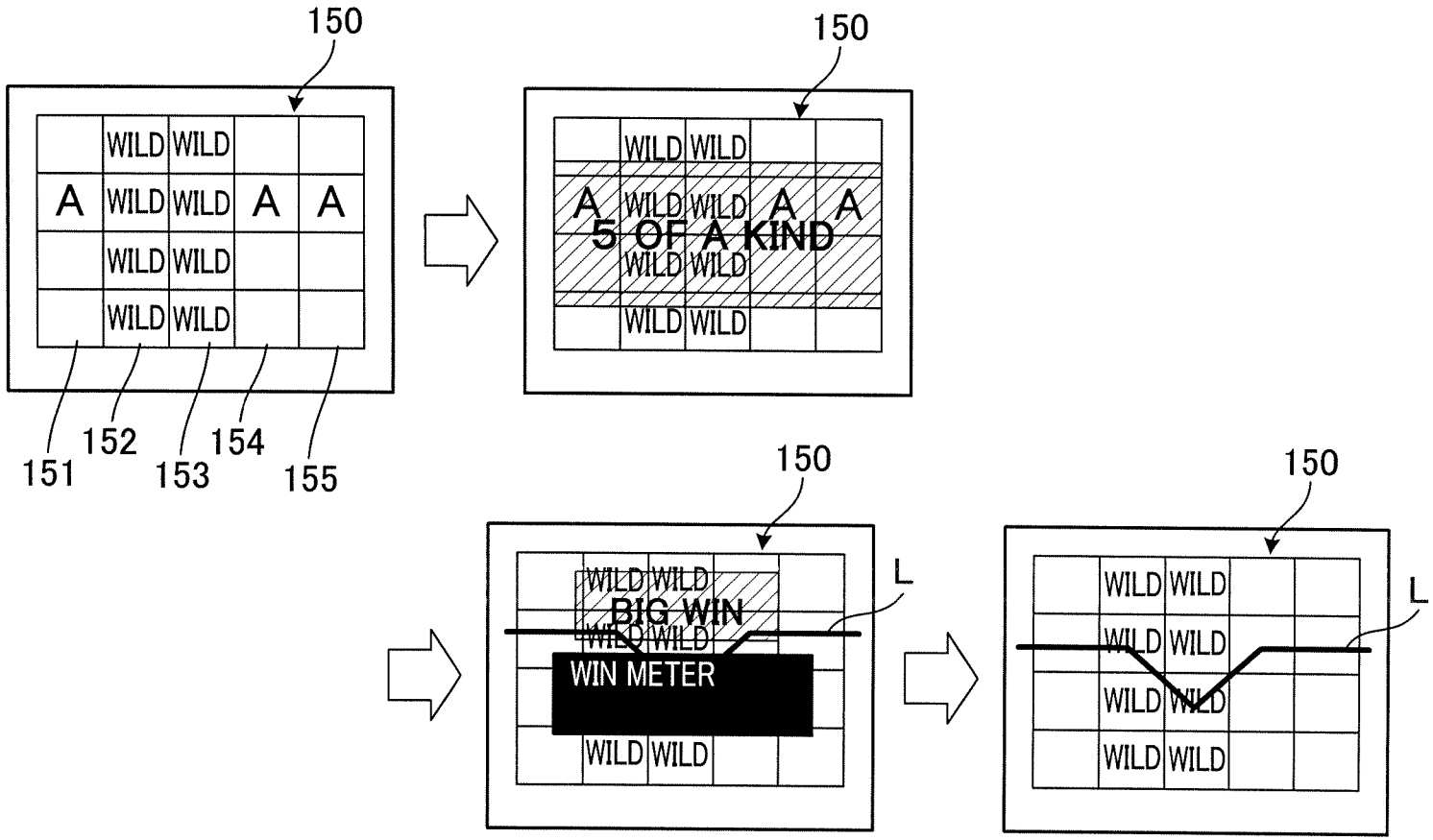
FIG. 92 is an explanatory diagram of reels in the game screen.

As an example of cases where winning is achieved at plural lines, as shown in FIG. 92, when in the 3-line game winning is achieved at the lines 1 and 2, plural line processes 1, 2, and 3 are executed. In the plural line process 1, the lines where the winning is achieved are illuminated for one second one by one. Furthermore, the animations of all symbols that are the target of winning are continued. The line WIN is serially performed from the line having the smallest line number. When a bonus WIN not related to the lines occurs, the effect of this bonus WIN is executed first. In so doing, the win meter 402 displays "bonus WIN=XXXXX". In the gray display region, the symbol display is provided below the activatable line.

Figure 93:
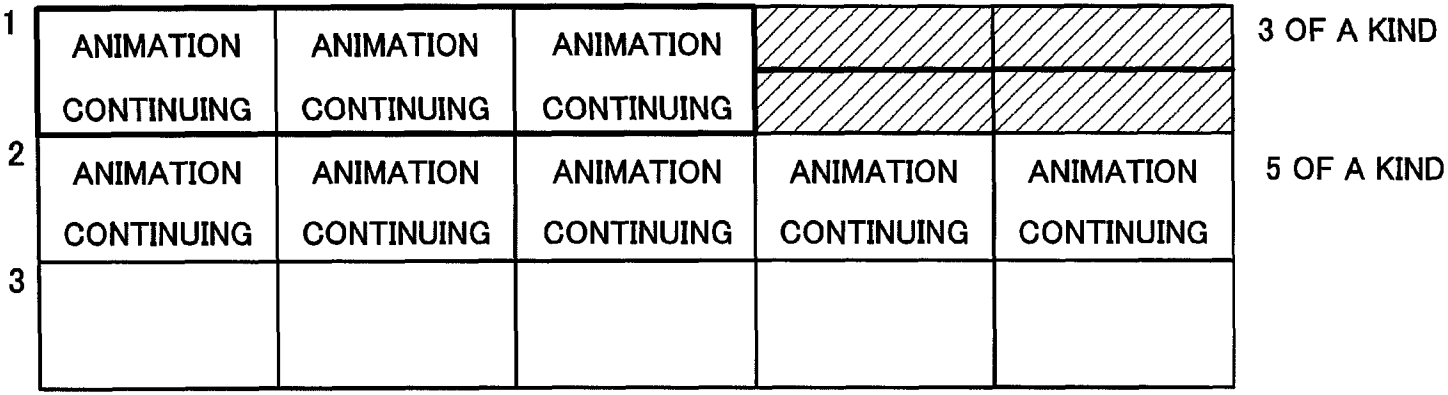
FIG. 93 is an explanatory diagram of reels in the game screen.

In the plural line process 2, as shown in FIG. 93, the next target line is illuminated for one second. Furthermore, the animations of all symbols that are the target of winning are continued. In the gray display region, the symbol display is provided below the activatable line.

In the plural line process 3, the plural line process 1 which is the first line display is carried out again after the display of all lines finishes. The line display in accordance with the plural line processes 1, 2, and 3 is repeated until the next game starts.

Each winning line is illuminated during the free game, and whether the WIN increment has finished and where the waiting time has been elapsed are checked after the illumination of all winning lines finishes. The shifting to the next game is conducted when both of these conditions are satisfied. The instructions "Skip" and "Cancellation of WIN Increment" by the player while the winning line is illuminated (WIN increment) are accepted and the corresponding operation is performed. This, however, is carried out only when these functions are available.

(Details of Display Screen: Displaying Lines: When 5-of-a-Kind WIN Occurs)

Irrespective of the grade of the combination, video and sound effects are executed when the symbols 501 form 5 of a kind. The sound volume is changed in accordance with the type of the combination. For example, as shown in FIG. 94, a 5 of a kind is achieved when the reel stops. Thereafter, the image and sound of the 5 of a kind are output. More specifically, "5 OF A KIND" is displayed and, the voice pronouncing "5 OF A KIND" is reproduced. This process cannot be skipped. Furthermore, the increment display and the line display are not executed at this stage. Then a payout occurs. More specifically, the increment of the payout is carried out and the line WIN is displayed. This process can be skipped.

(Details of Display Screen: Displaying Lines: When Big WIN Occurs)

The following effect is executed in accordance with the payout rate of the winning. One of these types of texts is displayed. The animation operates in the same manner in both cases. Winning with the payout ratio of 10/1 to 25/1 is termed "High Payout". In the meanwhile, winning with the payout rate of 1/25 or higher is termed "Great".

Figure 95:
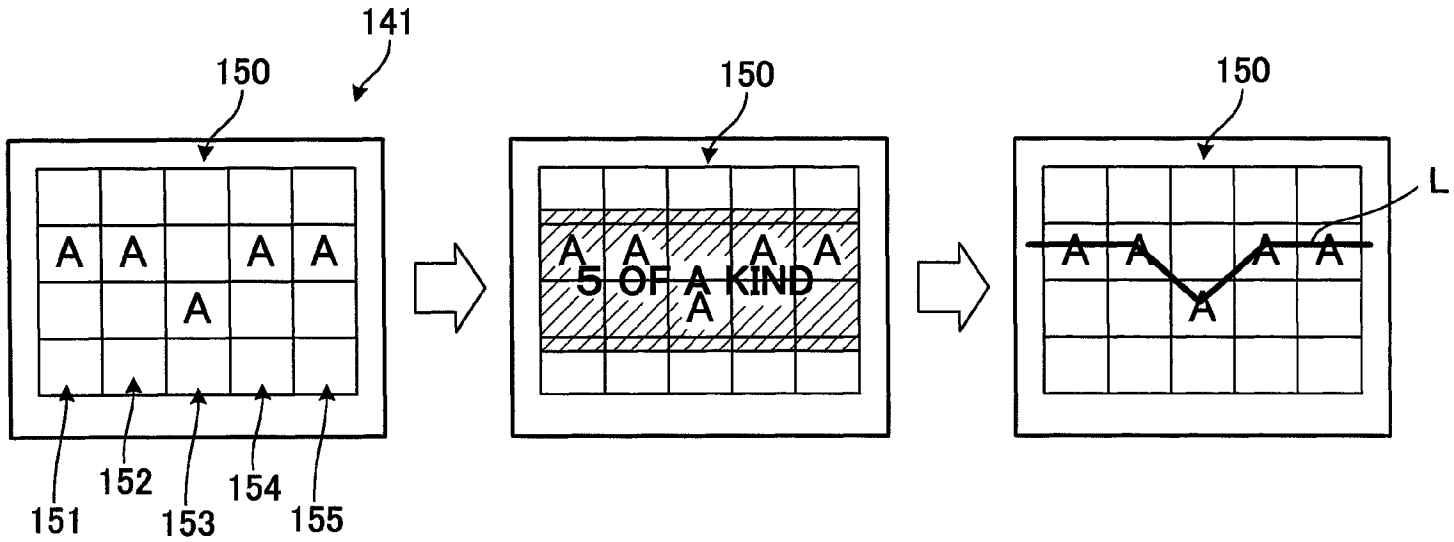
FIG. 95 is an explanatory diagram of the game screen.

The following will described a case where 5 of a kind is not achieved. For example, as shown in FIG. 95, winning with 10/1 or higher and smaller than 25/1 occurs when the reel stops. Then the increment display starts and "Big WIN", a Big WIN dedicated meter (large meter), and the line WIN are displayed. Displaying them can be skipped. The speed of the increment display in the Big WIN dedicated meter is carried out in accordance with the increment operation in the win meter 402. Details of the increment operation will be given later. When three seconds have elapsed after the end of the increment, the Big WIN and the large meter disappear. The line WIN is displayed continuously.

Figure 96:
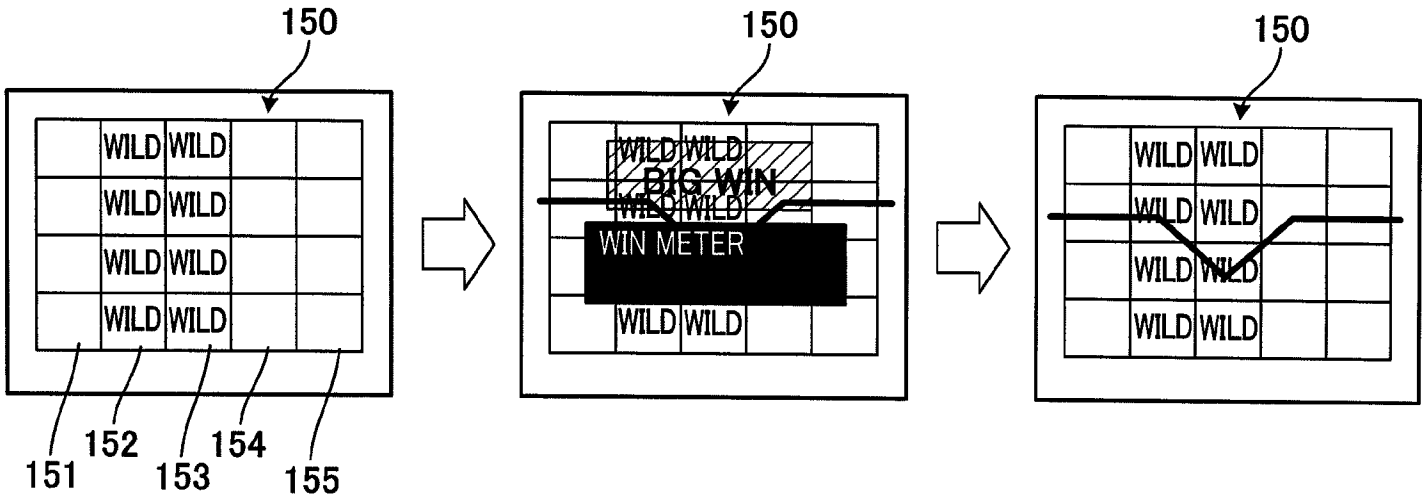
FIG. 96 is an explanatory diagram of the game screen.

The following will describe a case where a 5 of a kind is achieved. For example, as shown in FIG. 96, winning with 10/1 or higher and smaller than 25/1 occurs when the reel stops. Then, an image and sound for the 5 of a kind are output. More specifically, "5 OF A KIND" is displayed and, the voice pronouncing "5 OF A KIND" is reproduced. This process cannot be skipped. the increment display and the line display are not executed at this stage.

Subsequently, the increment display starts and the Big WIN and the large meter are displayed. More specifically, the increment display starts. The speed of the increment is in conformity with the increment in the win meter 402. "Big WIN" and the line WIN are displayed. This process can be skipped. When three seconds have elapsed after the end of the increment, the Big WIN and the large meter disappear. The line WIN is continuously displayed.

(Details of Display Screen: Win Meter 402)

Figure 97:
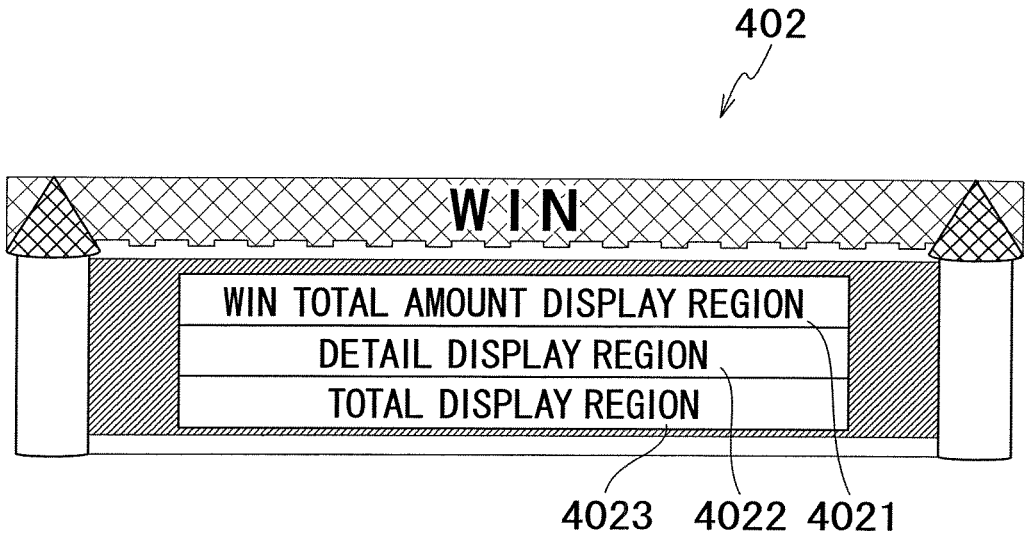
FIG. 97 is an explanatory diagram of a win meter.

As shown in FIG. 97, the win meter 402 displays a obtained credit and the details thereof in an integrated meter, when a winning is achieved. The win meter 402 includes a WIN totally amount display region 4021, a detail display region 4022, and a total display region 4023.

(Details of Display Screen: Win Meter 402: WIN Totally Amount Display Region 4021)

The WIN totally amount display region 4021 displays the obtained credit and money. Details of the display screen will be given below. In the idle state, the total amount of winning displayed is "0" immediately after the winning, and "0" is continuously displayed thereafter. When the spin button 46 is pressed, "0" is displayed. The increment display is executed during the WIN increment. "0" is displayed during a bonus pick trigger (because no winning is achieved during the trigger).

At the introduction of the free game, the total amount of immediately preceding winning is displayed. The total amount of immediately preceding winning is displayed during the rotation of the reels in the free game. At the moment immediately after the rotation of the reels and immediately after the winning in the free game, the winning achieved in the free game is added to the total amount of the preceding winning, and the increment display is carried out. In other cases, the total amount of the winning in the immediately preceding game is displayed. At the introduction of a bonus, the total amount of the immediately preceding winning is displayed. Immediately after the end of the bonus, the credits obtained in a bonus or jackpot are added to the total amount of immediately preceding winning, and the increment display is carried out.

For example, credit display such as "12345678" is displayed on the upper stage, and money display such as "$123, 456, 78" is displayed in the lower stage.

(Details of Display Screen: Win Meter 402: Detail Display Region 4022)

The detail display region 4022 displays the number of the winning line and the WIN credit after the stop of the fifth reel, when winning is achieved in the normal game or the free game. When more than one line payout simultaneously occurs, the line payouts are displayed one by one at intervals of 0.5 second. The line payouts are serially displayed from the one having the smallest number, and the one having the smallest number is displayed again after the one having the largest number is displayed. The detail display region 4022 displays a text string "bonus WIN" and WIN credits in case of winning with a bonus and credit payout. Furthermore, the detail display region 4022 displays a text string "jackpot WIN" and WIN credits in case of obtaining a bonus in the jackpot.

Details of the image displays will be described below. In case of immediately after a normal winning in the idle state, the detail of the payout is displayed. When there are more than one payout, the details of the payouts are switched at intervals of 0.5 second. Nothing is displayed in other cases. Furthermore, nothing is displayed when the spin button 46 is pressed. Detail of the payout is displayed during the WIN increment. When there are more than one WIN increment, the WIN increments are switched at intervals of 0.5 second. Furthermore, nothing is displayed at the time of a bonus pick trigger. Furthermore, nothing is displayed at the time of the introduction of a free game. Furthermore, nothing is displayed during the rotation of the reels in a free game. When a line winning exists immediately after the stop of the reels in a free game, the detail of the payout is displayed. When there are more than one payout, the details of the payouts are switched at intervals of 0.5 second. Nothing is displayed in other cases.

Nothing is displayed at the time of the introduction of a bonus. When a bonus (excluding jackpot) exists immediately after the end of the bonus, a bonus WIN is displayed, and a jackpot WIN is displayed when the jackpot is achieved. The bonus WIN is displayed immediately after achieving a credit payout. Nothing is displayed at the end of a bonus game (i.e., when returning to the game screen).

An example of the displayed image is "line xx WIN=12345678". This image display indicates a winning in a normal game or in a free game. Another example of the displayed image is "bonus WIN=12345678". This image display indicates a winning of a bonus or a credit payout. Another example of the displayed image is "jackpot WIN=12345678". This image display indicates a winning at the time of obtaining jackpot in a bonus.

(Details of Display Screen: Win Meter 402: Total Display Region 4023)

The total display region 4023 displays the sum total of the amounts in the detail display region. Details of the image displays will be given below. The total winning is displayed in case of immediately after a normal winning in the idle state. Nothing is displayed in other cases. Nothing is displayed when the spin button 46 is pressed. The total winning is displayed during the WIN increment. Nothing is displayed at the time of a bonus pick trigger. Nothing is displayed at the introduction of a free game. Nothing is displayed during the rotation of the reels in a free game. When a line winning exists immediately after the stop of the rotation of the reels in a free game, the total winning is displayed. Nothing is displayed in other cases. Nothing is displayed at the introduction of a bonus. The total winning is displayed immediately after the end of a bonus. The total winning is displayed immediately after winning a credit payout. Nothing is displayed at the end of a bonus game (i.e., returning to the game screen). An example of the displayed image is "total WIN=12345678".

(Details of Display Screen: WIN Meter 402, Progressive Meter Increment)

(Basic Setting)

The count up is smoothly carried out upward. The control is executed in consideration of a difference between an actual amount of money (real amount of money) and an amount of money displayed at that time (displayed amount of money). The operation of the carry of a digit is done at the same time as the operation for lower digits. When a displayed amount of money is larger than a real amount of money (e.g., at the time of resetting in response to a winning), rewriting is immediately carried out.

(Details of Increment Operation)

The speed of the increment is determined in accordance with a remaining count number. When the remaining count number is increased during the operation, the speed of the increment is immediately changed to correspond to the increased remaining count number. The rewriting is performed when the remaining count number exceeds "101". More specifically, as shown in FIG. 98, the increment operation is carried out at a speed of increment (seconds) corresponding to each remaining count number.

(Details of Rewriting)

When the remaining count number exceeds "101", the rewriting is carried out with the value (remaining count number −60), and the count up is carried out based on a data table for the remaining 60 counts. For example, when the remaining count number is 110 counts, the target amount is rewritten so that 50 counts calculated by subtracting 60 from 110 are added to the target amount. At the same time as the rewriting, the remaining 60 counts are counted up. In the meanwhile, when the display amount becomes larger than the real amount due to resetting on account of progressive winning or the like, rewriting is immediately carried out. It is noted that the numbers above such as "101" and "60" are mere examples, and "101" may be any predetermined number and "60" may be any number to be subtracted.

When a progressive winning occurs, the increment is interrupted, the rewriting to the amount of money having been won is carried out, and a flickering effect starts. The flickering is not performed while the increment is being interrupted.

The speed of increment may be managed based on the ratio between the bet and the amount won. For example, when an amount won by winning is four times larger than a bet, the speed of the increment is set at four seconds with reference to the relationship between control thresholds and seconds defined in, for example, a data table shown in FIG. 99. Furthermore, after the speed of the increment is determined based on the data table of FIG. 99, the data table of FIG. 99 may be rewritten based on the determined value. For example, when the speed of the increment is determined to be four seconds in the case where an amount won by winning is four times larger than the bet as above, the second for the remaining count number (1 to 2) in the data table of FIG. 98 is set at four seconds, and the other remaining count numbers are changed to values calculated based on a predetermined ratio.

(Details of Display Screen: Sound Volume Switching Touch Button 412)

Figure 100:
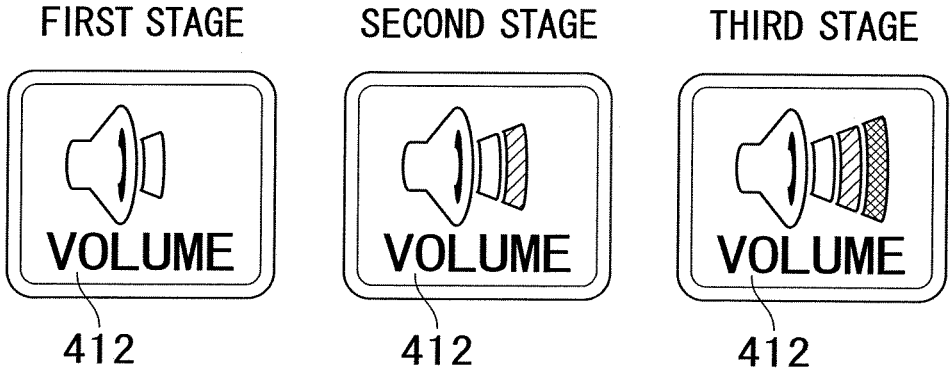
FIG. 100 is an explanatory diagram of a volume-switching touch button.
Figure 101A:
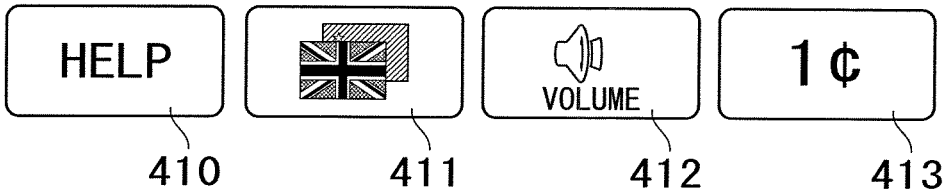
FIG. 101A is an explanatory diagram of a language switch touch button.
Figure 101B:
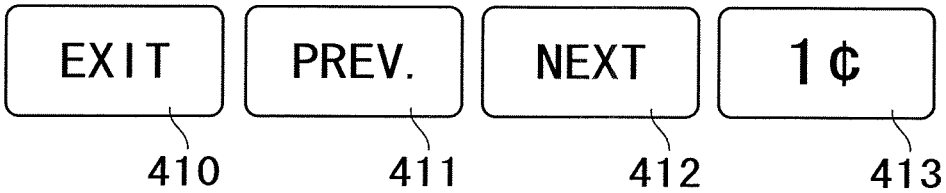
FIG. 101B is an explanatory diagram of the language switch touch button.
Figure 101C:
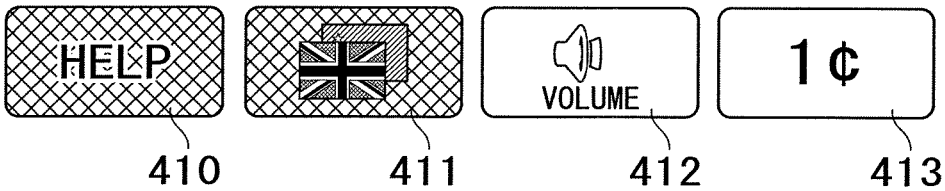
FIG. 101C is an explanatory diagram of the language switch touch button.
Figure 101D:
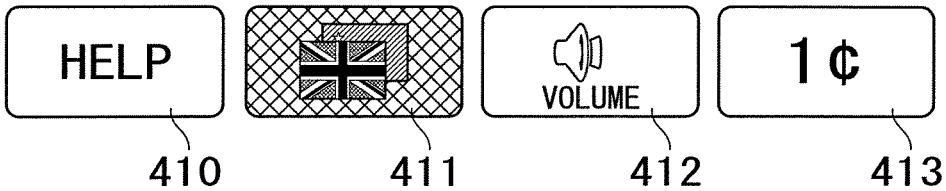
FIG. 101D is an explanatory diagram of the language switch touch button.
Figure 101E:
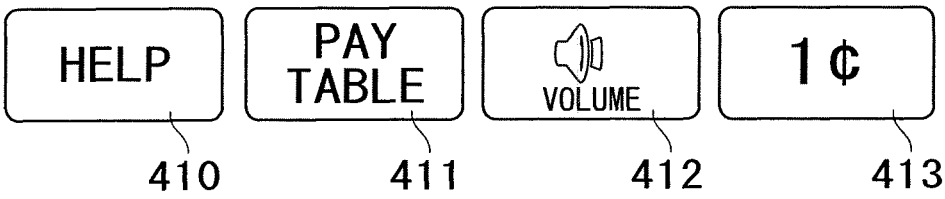
FIG. 101E is an explanatory diagram of the language switch touch button.
Figure 101F:
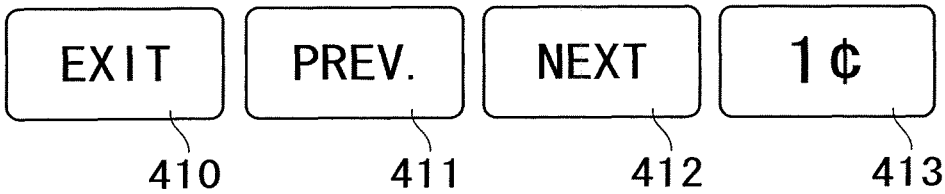
FIG. 101F is an explanatory diagram of the language switch touch button.
Figure 101G:
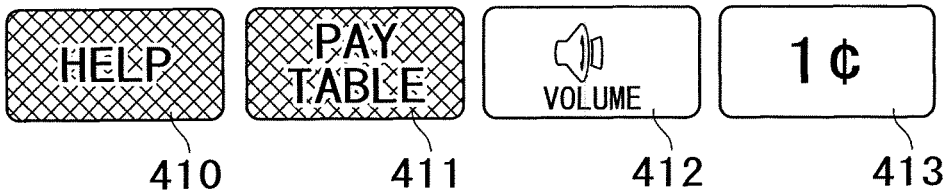
FIG. 101G is an explanatory diagram of the language switch touch button.
Figure 101H:
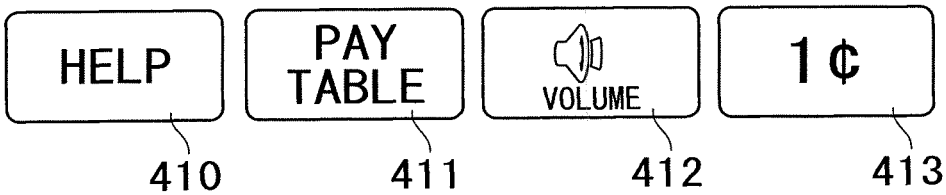
FIG. 101H is an explanatory diagram of the language switch touch button.
Figure 104:
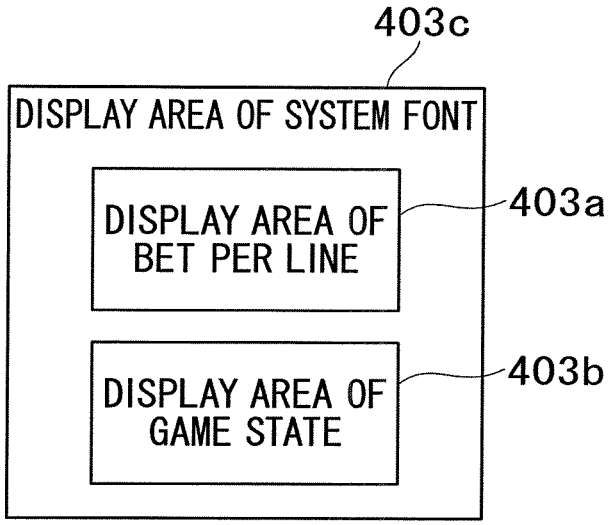
FIG. 104 is an explanatory diagram of a system font area.

As shown in FIG. 100, the sound volume switching touch button 412 has a function of allowing the player to switch the sound volume at will. The volume is switchable in, for example, three stages. The volume may be linearly changeable. The first stage corresponds to the minimum volume. The second stage corresponds to the medium volume. The third stage corresponds to the maximum volume. The volume stages are switched such that the first stage→second stage→third stage→first stage.

The default volume stage is the first stage. The default bonus stage is set when (1) a game is activated and (2) at the return from the AUDIT (regardless of whether the volume in the AUDIT is changed). The coefficients of volume changes are 30% in the first stage, 70% in the second stage, and 100% in the third stage. The sound volume switching touch button 412 is always activated unless the button is hidden. The button is activated when GUI (Graphical User Interface) such as the help touch button 410 is displayed. However, when a help screen is displayed, the sound volume switching touch button 412 disappears from the GUI (i.e., is covered with the NEXT button), the button is not operable. The operation invalidation time of the sound volume switching touch button 412 after the touch, i.e., the minimum interval between serial touching is 0.15 second (150 msec). The default sound volume setting value in the AUDIT is 12. The default value is 5 when no sound volume adjustment touch panel function is provided. The reproduction sound volume of the volume setting change sound in the AUDIT is identical with the default volume of the sound volume switching touch button 412 (i.e., the volume reflecting the coefficient in the default stage).

(Details of Display Screen: Details of Screen Touch Buttons)

The positions and operations of the help touch button 410, the language switching touch button 411, the sound volume switching touch button 412, and the denomination button 413 are based on the positions in the operation states shown in FIGS. 101A to 101H, a lighting table shown in FIG. 102, and the language setting shown in FIG. 103. For example, the buttons are operable only in the idle state (game over state) regardless of the presence of credits. The switching is impossible during the help, during games, during an error, and during the AUDIT. (The buttons are not illuminated and invalidated, or are replaced with other buttons). The switching is impossible during the help, during games, during an error, and during the AUDIT. (The buttons are not illuminated and invalidated, or are replaced with other buttons). The national flag associated with the currently used language is displayed on the top. The states of the previous game are maintained even after the switching. The default language in English-speaking countries is English. The default language in Chinese-speaking countries is Chinese.

(Details of Display Screen: System Font Area 403*c*)

As shown in FIG. 58, the system font area 403*c* has a bet information display region 403*a* and a game state display region 403*b*. The system font area 403*c* shows the bet information of a game (or the last game) to the player. In the system font area 403*c*, a display region for the bet per line is provided in the bet information display region 403*a* and a display region for the game stage is provided in the game state display region 403*b*.

The display contents on the bet information display region 403*a* of the system font area 403*c* are as follows. Immediately after the RAM is cleared, 1 Credit Per Line or XX CREDITS PER LINE (XX is the minimum value of the set betting patterns) is displayed. As the BET buttons 34 to 39 are pressed, the 1 Credit Per Line or the XX CREDITS PER LINE (indicating different values in accordance with the BET buttons) is displayed. In other cases, the immediately preceding display content is kept displayed.

The display contents on the game state display region 403*b* of the system font area 403*c* are as follows. Immediately after the RAM is cleared, GAME OVER is displayed. When the spin button 46 is pressed, nothing is displayed if the reel is rotating, and GAME OVER is displayed in other cases. When Gamble is possible immediately if winning is achieved after the reel stop (without trigger), "PLAY ON, GAMBLE or TAKE WIN" is displayed. GAME OVER is displayed in other cases.

Nothing is displayed at the time of bonus trigger. Immediately after the bonus, if Gamble is possible on condition that winning is achieved, "PLAY ON, GAMBLE or TAKE WIN" is displayed. GAME OVER is displayed in other cases. Immediately after the end of the jackpot, GAME OVER is displayed. When the help button 33 is pressed (to display the help screen 4101), nothing is displayed if Gamble is possible on condition that winning is achieved. GAME OVER is displayed in other cases.

When the help button 33 is pressed (the return to the game screen), the state before the help screen 4101 is displayed comes back. When the gamble button 44 is pressed (to display the gamble screen), nothing is displayed if Gamble is possible on condition that winning is achieved. GAME OVER is displayed when the BET buttons 34 to 39 are pressed. GAME OVER is displayed when Take Win is selected. The previous states come back when returning from the AUFIT and power failure.

(Details of Display Screen: Help Screen 4101)

Figure 105:
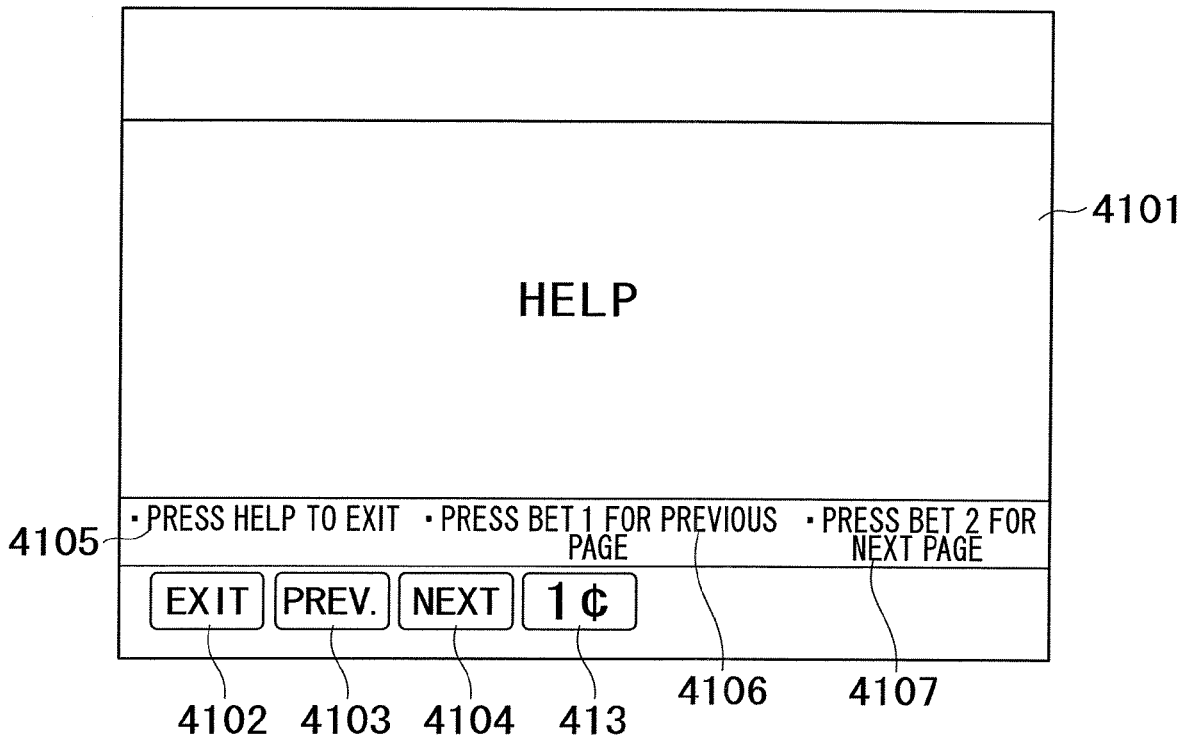
FIG. 105 is an explanatory diagram of a help screen.

As shown in FIG. 105, the lower image display panel 141 displays a help screen 4101 as the help touch button 410 is operated. Below the help screen 4101 are provided text display regions 4105, 4106, and 4107. On the text display regions 4105, 4106, and 4107, texts are displayed with the system font. The help touch button 410 is switched to an EXIT button 4102, the language switching touch button 411 is switched to a PREV button 4103, and the sound volume switching touch button 412 is switched to a NEXT button 4104. When the EXIT button 4102 is touched, the help is terminated and the normal game screen comes back. As the PREV button 4103 is touched, the previous help page is displayed. As the NEXT button 4104 is touched, the next help page is displayed.

An example of the text displayed on the text display region 4105 is PRESS HELP TO EXIT. The maximum number of characters is 25. An example of the text displayed on the text display region 4106 is PRESS BET 1 FOR PREVIOUS PAGE. The maximum number of characters is 36. An example of the text displayed on the text display region 4107 is PRESS BET 2 FOR NEXT PAGE. The maximum number of characters is 33.

Figure 107:
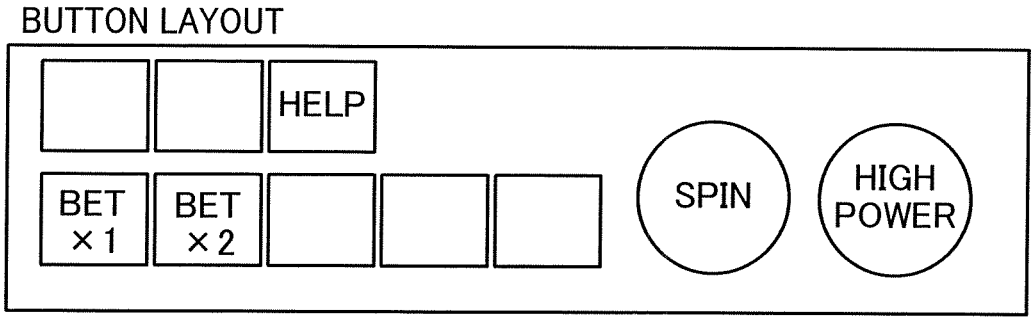
FIG. 107 is an explanatory diagram showing an operation status of the control panel.

As shown in FIG. 106 and FIG. 107, these buttons 4102, 4103, and 4104 and the text display regions 4105, 4106, and 4107 are linked to the control panel 30. Even if the patterns are altered and the values are changed, the text display regions 4105, 4106, and 4107 display correct contents in accordance with the changes.

(Details of Display Screen: Help Screen 4101: Operations)

Operation when entering the help screen 4101: When the help touch button 410 is pressed in the idle state, only the 1st screen is changed to the help screen 4101 while the 2nd screen is kept displaying the basic screen of the idle state. The help screen 4101 is displayed only on the 1st screen. During an error or AUDIT, the help touch button 410LED is not illuminated so as not to allow the player to enter the help screen 4101. Whether it is possible to enter the help screen 4101 during games is different in each game. Basically, at the destinations of shipment, it is possible to enter the help screen 4101 only in the idle state. The help screen 4101 must be displayed from the first page.

Operation in the help screen 4101: When an error or door open occurs, the help screen 4101 is terminated (i.e., the game screen is reinstated and ERROR/DOOR OPEN is displayed. When a bill or a coin is inserted, the help screen 4101 is terminated and the credit is received. When an AUDIT key is turned, the help screen 4101 is terminated and the AUDIT is displayed. After the end of the AUDIT, the idle state comes back. When power interruption occurs, the help screen 4101 is not displayed when the power is turned on and the machine becomes in the idle state. When no input is made for three minutes while the help screen 4101 is being displayed, the help screen 4101 disappears and the machine becomes in the idle state.

(Details of Display Screen: Help Screen 4101: Page Structure)

The required items, i.e., a payout table item, a basic rule item, a winning line item, a feature item, a unique benefit feature item, and a bet-number item are structured into pages in this order. Some items are described over plural pages.

The payout table item describes all winning combinations. The winning combinations are listed from the highest one to the lowest one. For example, picture symbol→royal symbol. The basic rule item describes how to play games and the basic play of the gamble game. The winning line item describes the activatable lines. In the feature item, each feature is described in a different page when there are plural features. When a payout table different from that of the normal game is used, such a table is described after the feature rules. The unique benefit feature item describes feature rules unique to the games, such as High Power, max bet Special, and RESCUE. The bet-number item describes the range of money playable in a game. For example, the item shows the minimum and the maximum of the BET buttons.

(Details of Display Screen: AUDIT Screen)

Figure 108:
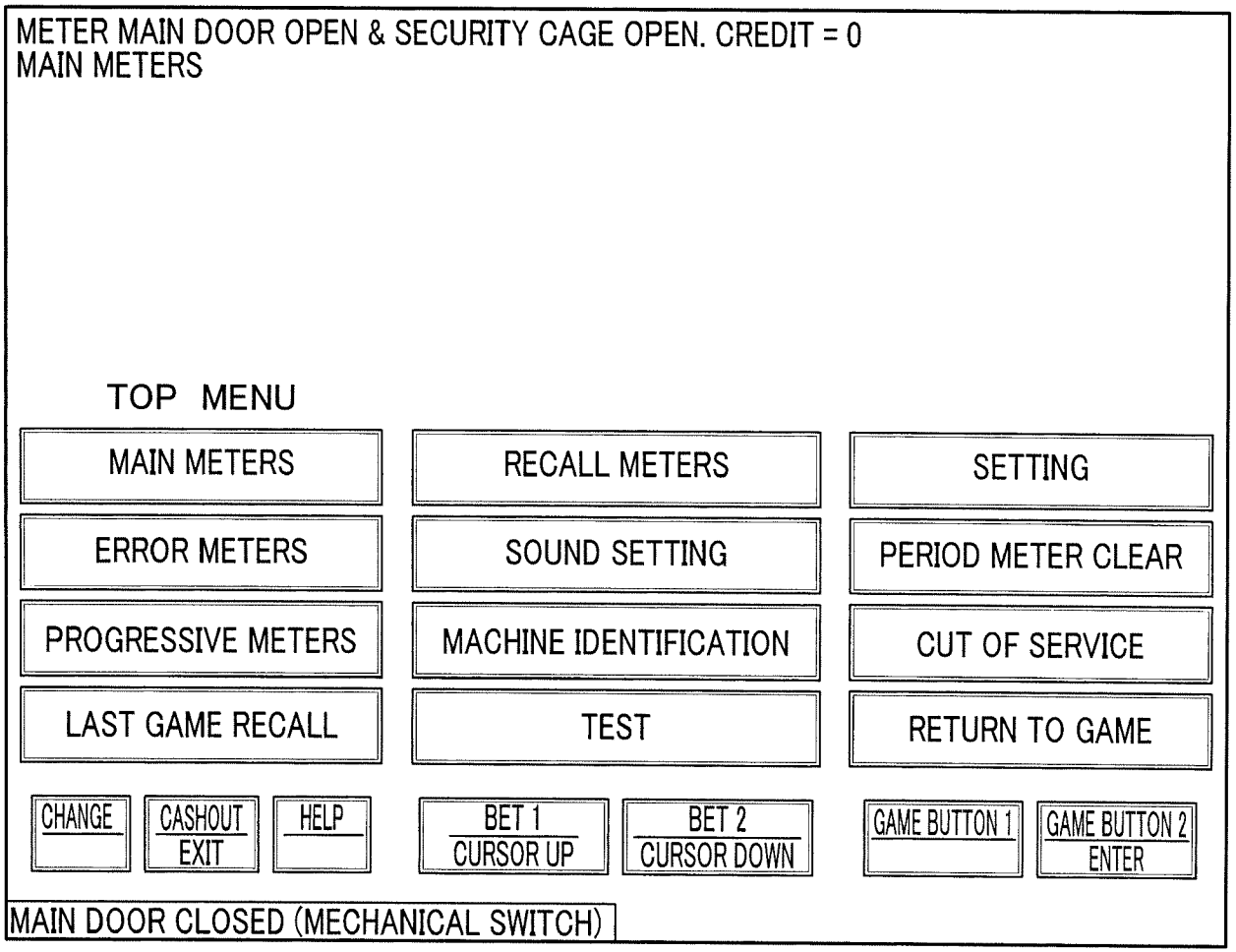
FIG. 108 is an explanatory diagram of an audit screen.
Figure 109:
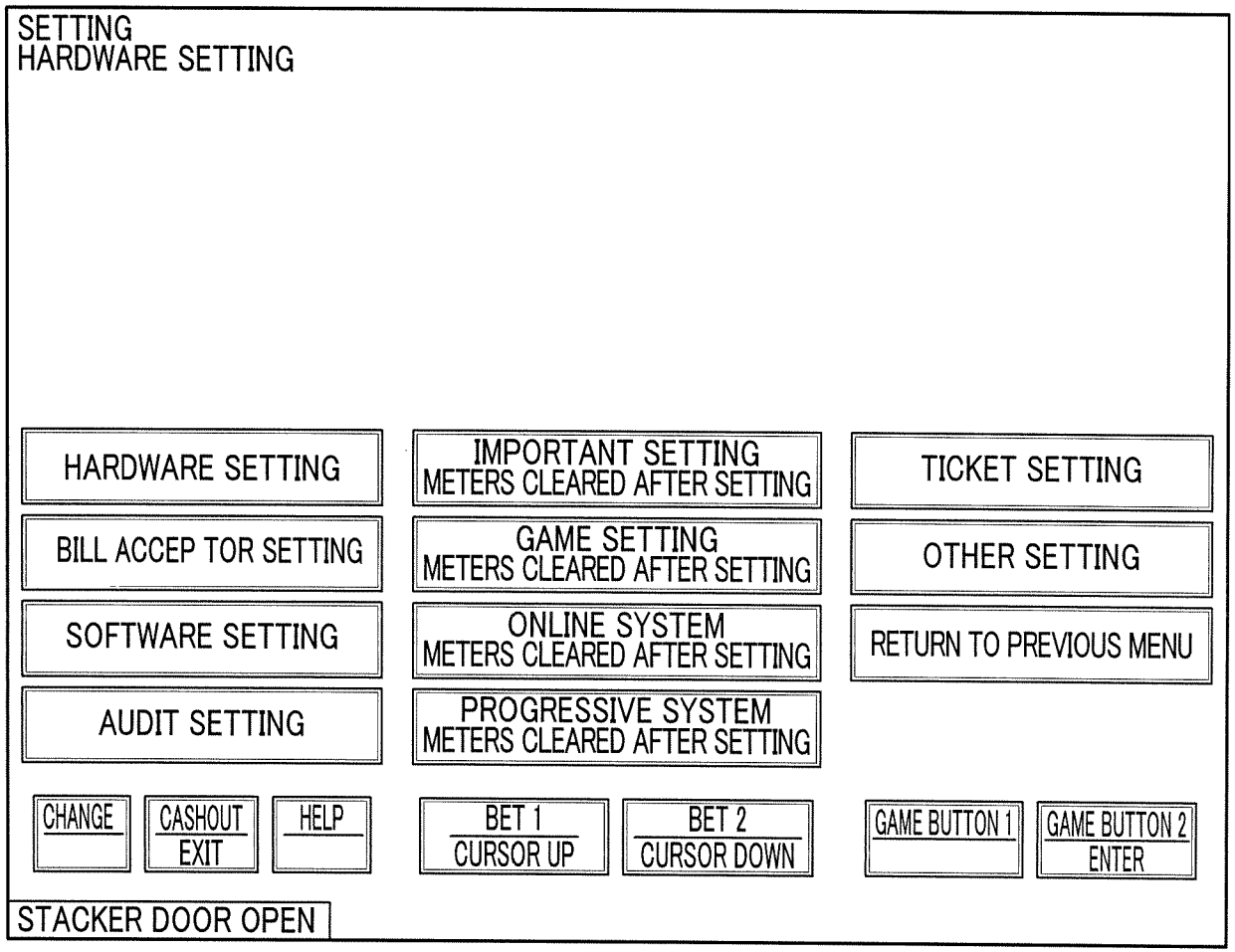
FIG. 109 is an explanatory diagram of an audit screen.

As shown in FIG. 108, the AUDIT screen allows the switching of the national flag on an AUDIT menu. In the switching of the national flag on the AUDIT menu, "national flag" displayed on the touch button at the switching of the language can be set on the AUDIT menu. For example, the operator enters the "AUDIT menu". Then "SETTING" is pressed, and "SOFTWARE SETTING" is pressed as shown in FIG. 109, a screen shown in FIG. 110 appears. It is noted that the operations by the control panel 30 or the like are not changed from the current settings.

Figure 110:
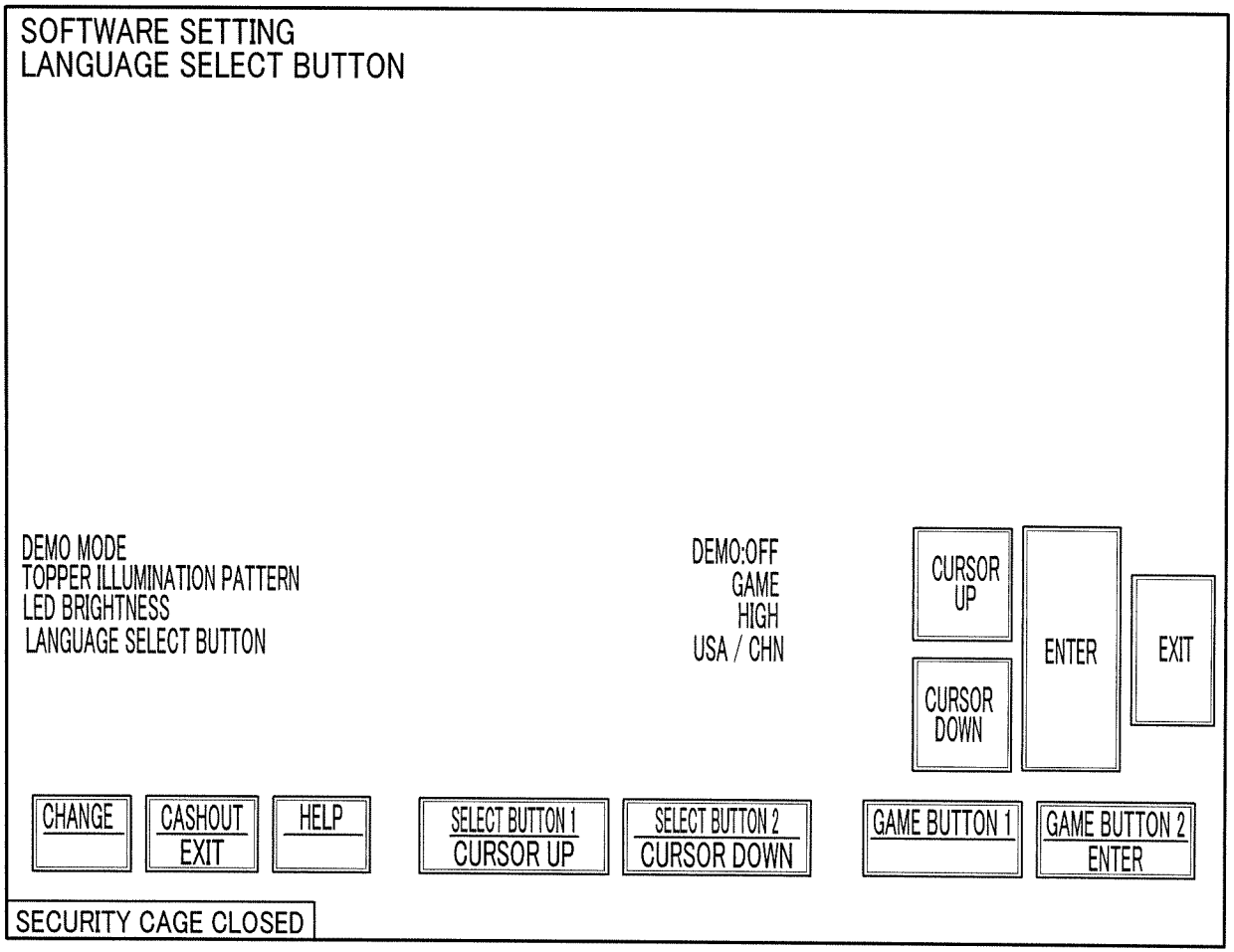
FIG. 110 is an explanatory diagram of an audit screen.

In the screen shown in FIG. 110, the item "LANGUAGE SELECT BUTTON DISPLAY" is added. In regard to the language switching button, the display content in this later is one of the followings. That is, "LANGUAGE SELECT BUTTON DISPLAY" is one of "DISABLED", "UK/CHN", and "US/CHN".

In addition to the above, the initial display at the clearance of the RAM is shown in FIG. 111. That is to say, in North America, the display language is English, the national flags are U.S./China, and the U.S. flag is on the front on the function touch button. In the Macau area, the display language is English, the national flags are U.K./China, and the U.K. flag is on the front on the function touch button. In the other areas, the display language is English, the national flags are U.K./China, and the U.K. flag is on the front on the function touch button.

Figure 112:
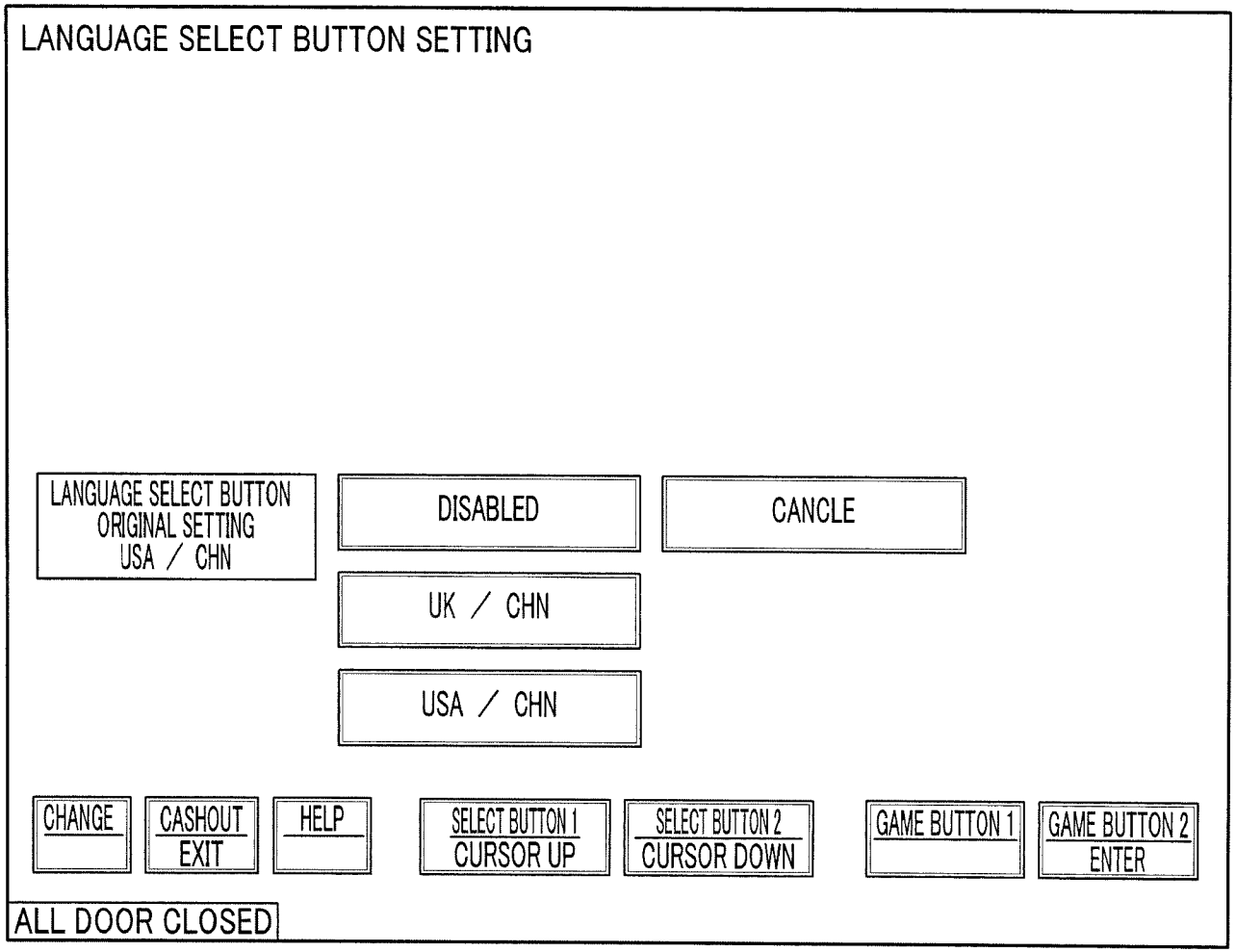
FIG. 112 is an explanatory diagram of an audit screen.

When the item "LANGUAGE SELECT BUTTON DISPLAY" is selected, a screen shown in FIG. 112 is displayed. It is noted that the selected item is enclosed by a red frame. It is noted that the operations by the control panel 30 or the like are not changed from the current settings. "DISABLED" is setting with which the switching function is disabled (only English). The language switching touch button is switched to "PAYTABLE touch button. After the touch (i.e., the determination by the button), the screen of the immediately above layer is displayed and the determination is confirmed. "UK/CHN" indicates that the U.K. flag is set. "USA/CHN" indicates that the U.S. flag is set. The button also functions as the activation of the switching function (i.e., the switching touch button is displayed). After the touch (i.e., the determination by the button), the screen of the immediately above layer is displayed and the determination is confirmed. The selected national flag is on the front of the touch button (Chinese flag is on the behind). By "CANCEL", the screen is canceled and the screen of the immediately above layer comes back. The contents that were previously set remain the same.

(Control Panel 30)

Figure 113:
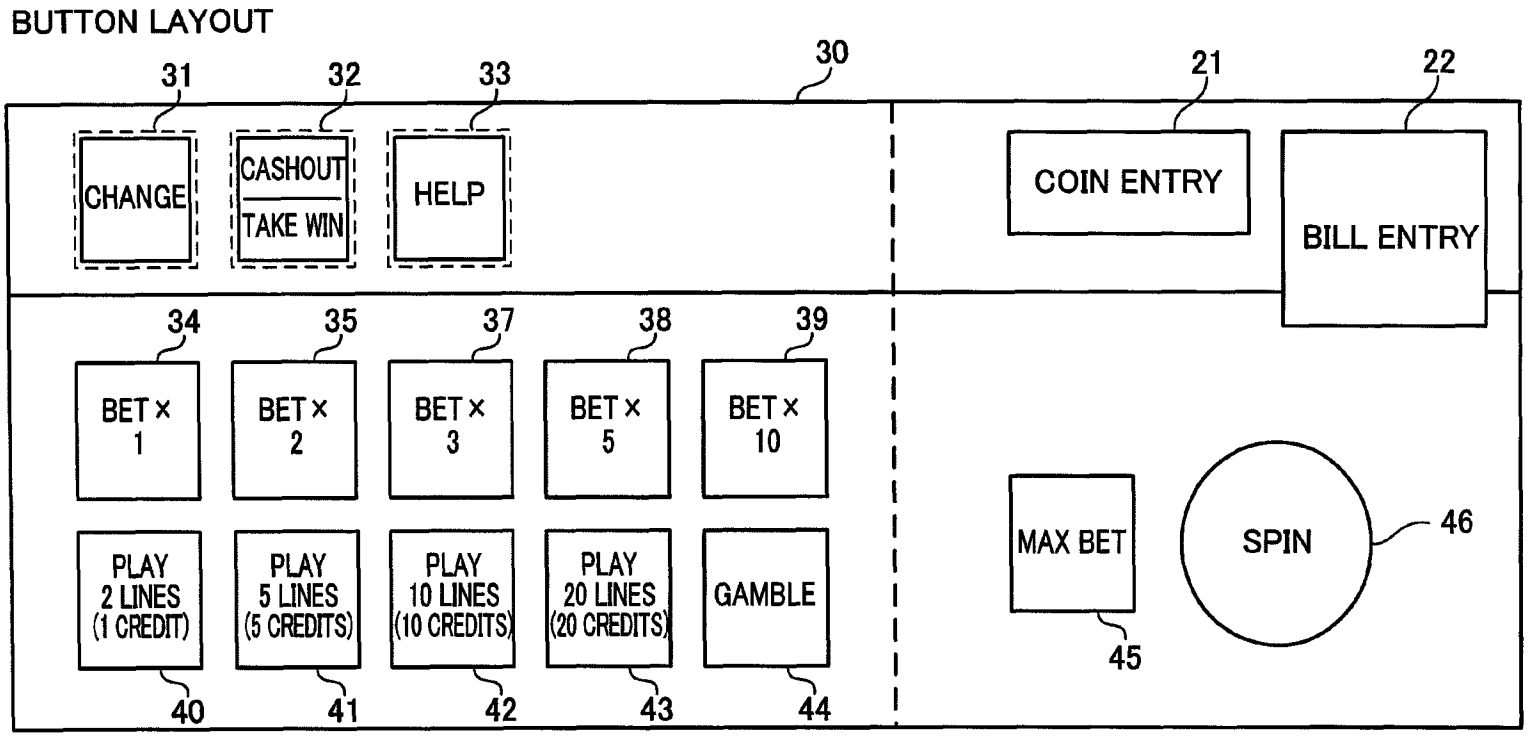
Figure 114:
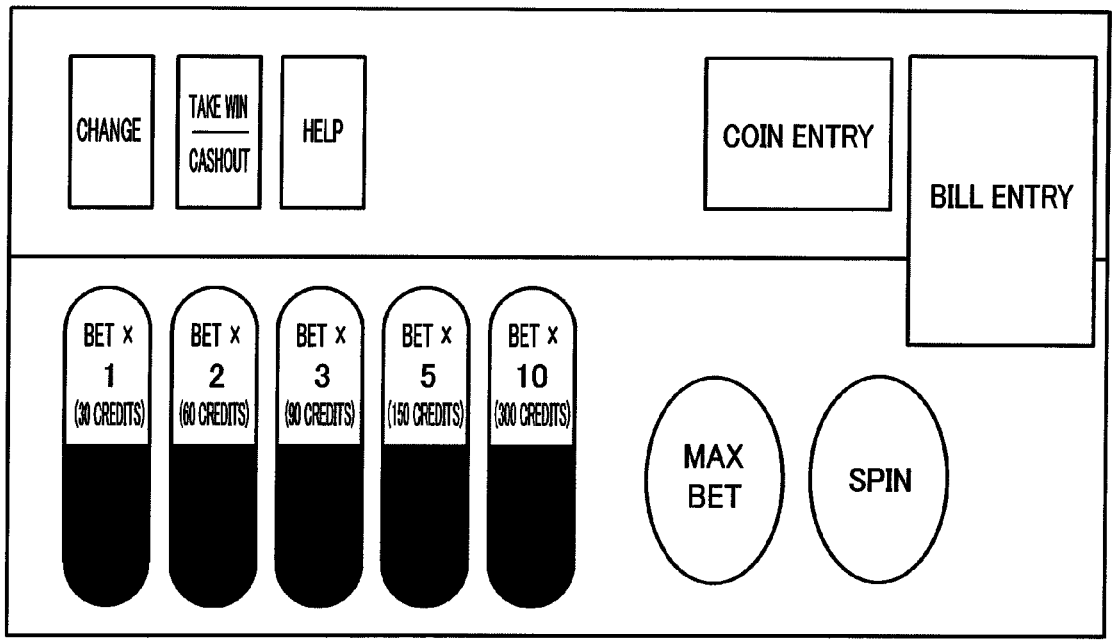
Figure 115:
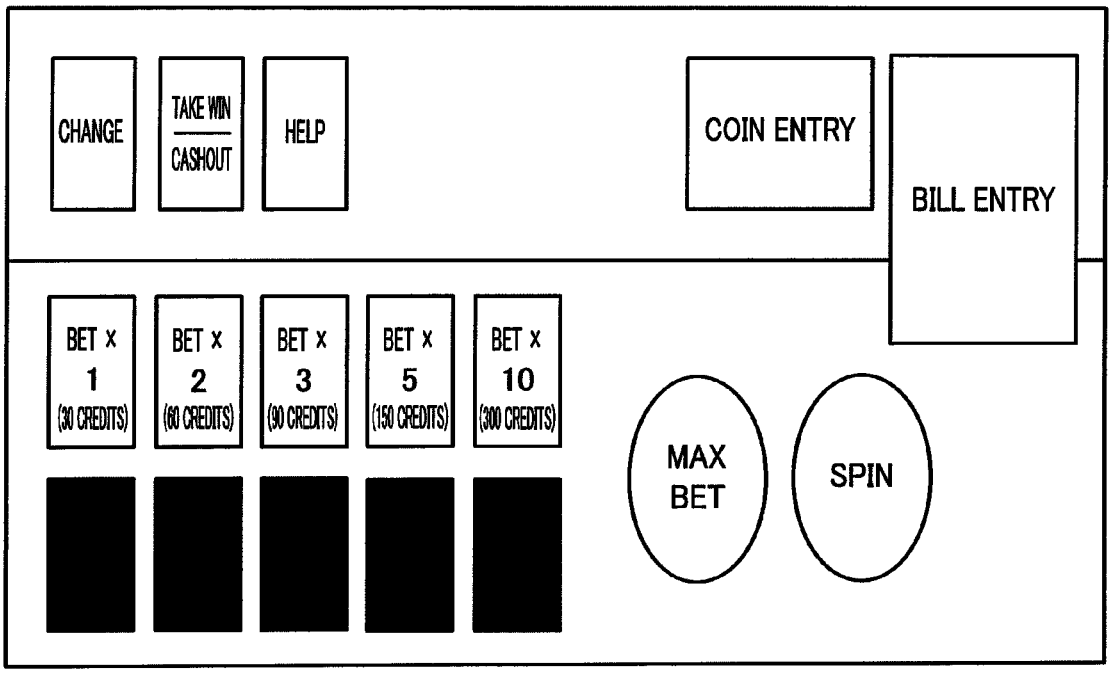
Figure 116:
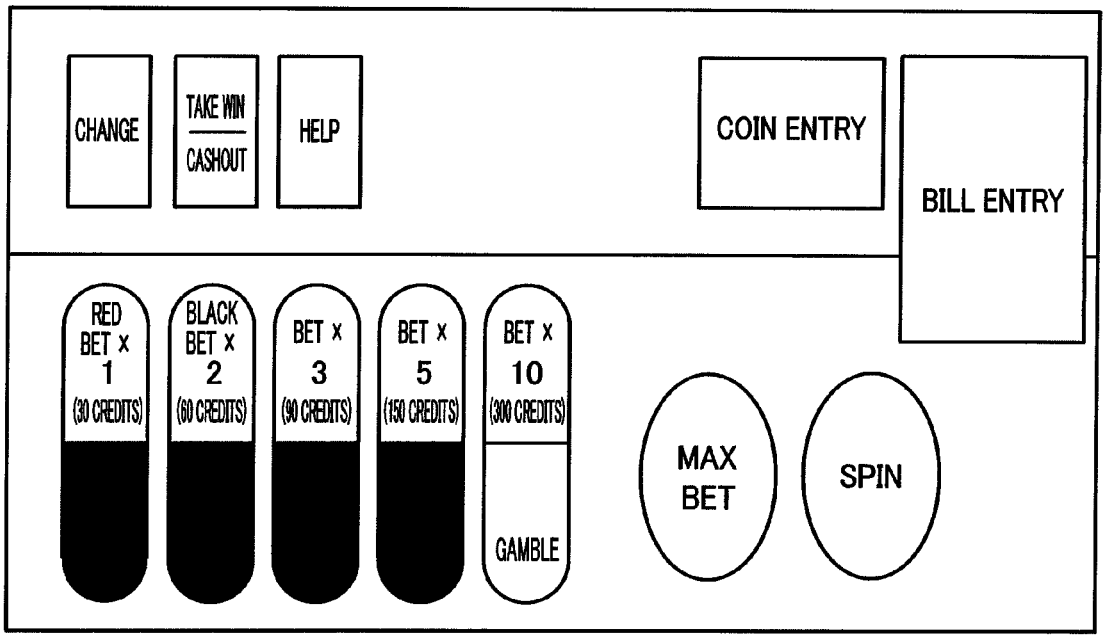
Figure 117:
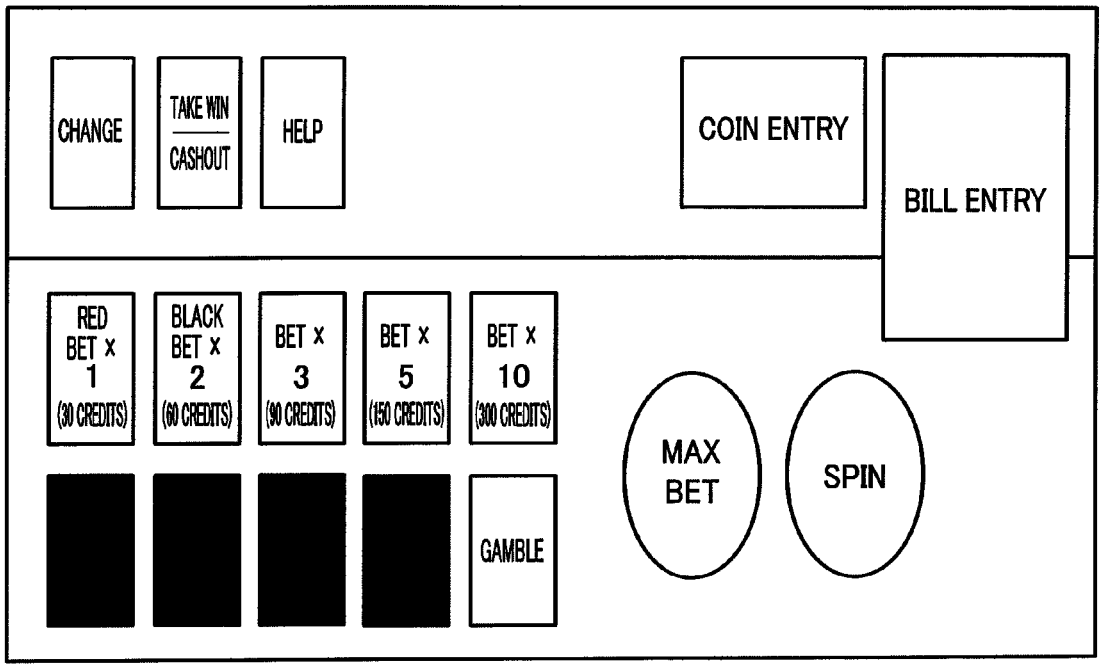

Below the lower image display panel 141 that displays the AUDIT screen above or the like, as shown in FIG. 113, a control panel 30 is provided. The control panel 30 is provided not only with buttons but also units such as a coin entry 21 that allows coins to enter the cabinet 11 and a bill entry 22.

More specifically, on the control panel 30, a change button 31, a cashout button 32, and a help button 33 are provided on the upper stage of the left area in front elevation, a 1-bet button 34, a 2-bet button 35, a 3-bet button 37, and a 5-bet button 38 are provided in the middle stage of the left area. Furthermore, on the control panel 30, a play-2-lines button 40, a play-5-lines button 41, a play-10-lines button 42, a play-20-lines button 43, and a gamble button 44 are provided in the lower stage of the left area. It is noted that, as shown in FIG. 114 to FIG. 117, the control panel 30 may have a different design of buttons in accordance with the type of the game.

The control panel 30 makes it possible to conduct selections in the same manner as those by the touch panel, on various types of selection screens. For example, the cursor is moved leftward as the 1-bet button 34 is touched, and the cursor is moved rightward as the 10-bet button 39 is touched. When the operation is carried out, the light source in each button is preferably turned on.

In addition to the above, as shown in FIG. 113, on the control panel 30, the coin entry 21 and the bill entry 22 are provided on the upper stage of the right area, whereas a maximum BET button 45 and a spin button 46 are provided on the lower stage of the right area.

The change button 31 is used when a player leaves the machine or when the player asks a staff person of the gaming facility to exchange money. The cashout button 32 is a so-called settlement button by which credit data concerning credits obtained in games is added to the credit data stored in an IC card inserted into the PTS terminal 700. The help button 33 is pressed when, for example, it is unclear how to play a game. As the help button 33 is pressed, various help information is displayed on a later-described effect mechanism 131 and lower image display panel 141.

Each time the 1-bet button 34 is pressed, one of the credits currently owned by the player is bet on each activatable line. The 2-bet button 35 is used to start a game with two credits bet on each activatable line. The 3-bet button 37 is used to start a game with three credits bet on each activatable line. The 5-bet button 38 is used to start a game with five credits bet on each activatable line. The 10-bet button 39 is used to start a game with ten credits bet on each activatable line. The maximum BET button 45 is used to activate the maximum number of paylines, i.e., 20 paylines. With this, the number of activated paylines becomes the maximum, i.e., 20. As such, the number of credits bet on each activatable line determined by pressing the 1-bet button 34, the 2-bet button 35, the 3-bet button 37, the 5-bet button 38, the 10-bet button 39, and the maximum BET button 45.

The play-2-lines button 40 is pressed for activating two activatable lines. As a result, the number of active activatable lines becomes two. The play-5-lines button 41 is pressed for activating five activatable lines. As a result, the number of active activatable lines becomes five. The play 10-lines button 42 is pressed for activating ten activatable lines. As a result, the number of active activatable lines becomes ten. The play 20-lines button 43 is pressed for activating 20 activatable lines. As a result, the number of active activatable lines becomes 20.

The gamble button 44 is an operation button used for, for example, shifting to the gamble game after the end of the bonus game or the like. The gamble game is a game played with the consumption of an obtained credit.

The spin button 46 is a button used for starting the scroll of the symbols 501. This spin button 46 also functions as a button for starting a bonus game and for adding a payout awarded in a bonus game to the credits. The coin entry 21 is used for receiving coins into the cabinet 11. The bill entry 22 validate bills and receives genuine bills into the cabinet 11.

(Details of Operation of Control Panel 30)

The operations of the control panel 30 are changed or restricted in accordance with the content of the display screen and the operations on the lower image display panel 141.

(Details of Operation of Control Panel 30: Immediately after Clearance of RAM)

Figure 118:
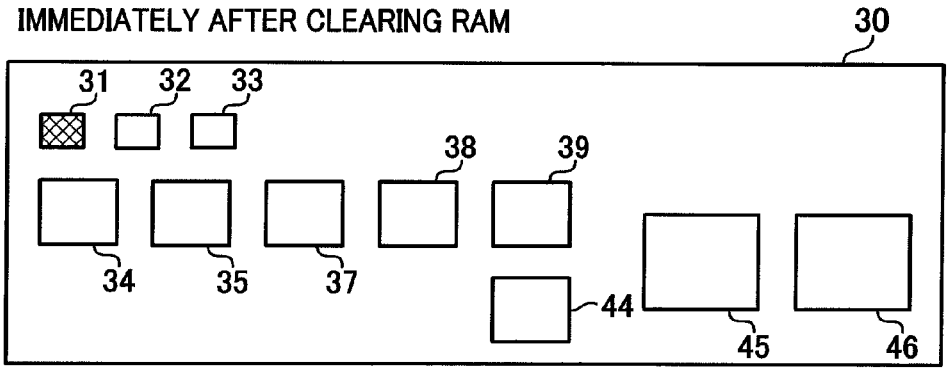

As shown in FIG. 118, the change button 31 is in the off state and disabled, and is turned on/off as pressed. The cashout button 32 is in the off state and disabled. The help button 33 is in the on state and active. The 1-bet button 34 to 10-bet button 39 are in the off state but active. The gamble button 44 is turned off and disabled. The maximum BET button 45 is in the off state and disabled. The spin button 46 is in the off state and disabled.

The gamble button 44 appears only when GAMBLE ENABLE is set. The gamble button 44 is basically in the on state and active only when "PLAY ON, GAMBLE OR TAKE WIN" is displayed. The button is in the off state and disabled in other cases.

(Details of Operation of Control Panel 30: Idle State (without Credits))

Figure 119:
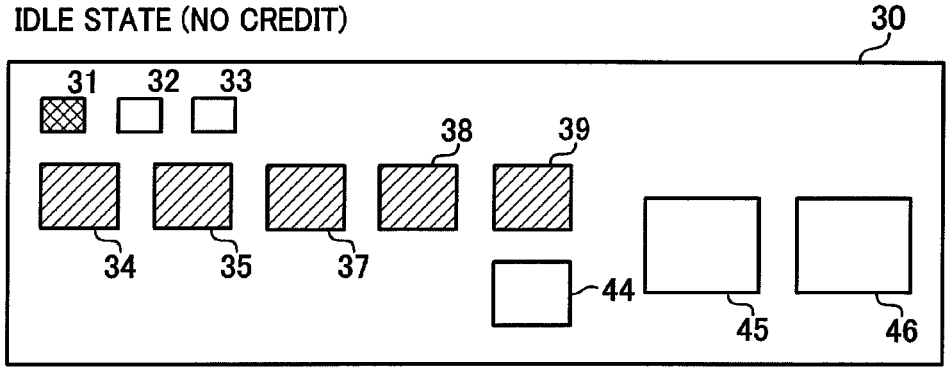

As shown in FIG. 119, the change button 31 is in the off state but active. The button is turned on/off as pressed. The cashout button 32 is in the off state but active. The help button 33 is in the on state and active. The 1-bet button 34 to 10-bet button 39 are in the off state or are in the on state and active. In other words, these buttons retain the state of the previous game play. The gamble button 44 is in the off state but active. The maximum BET button 45 is in the off state but active. The spin button 46 is in the off state but active.

(Details of Operation of Control Panel 30: Idle State (with Credits))

Figure 120:
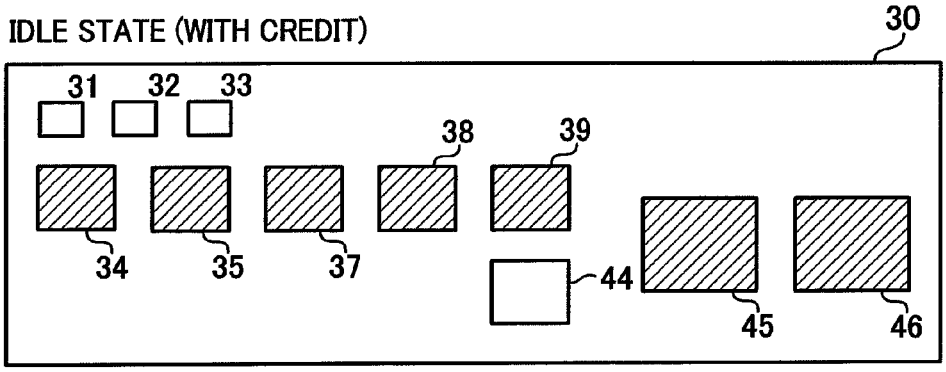

As shown in FIG. 120, the change button 31 is in the off state but active. The button is turned on/off as pressed. The cashout button 32 is in the on state and active. The help button 33 is in the on state and active. The 1-bet button 34 to 10-bet button 39 are in the off state or are in the on state and active. In other words, these buttons retain the state of the previous game play. The gamble button 44 is in the off state and disabled. The maximum BET button 45 is turned on when max bet is possible, and a game starts with "max bet" when the button pressed. When the credits are less than max bet, the button is turned on, and the maximum credits bettable are selected when the button is pressed. When the credits are less than the amount for one bet, the button is in the off state and disabled. The spin button 46 is in the on state and active in a bet pattern in which the remaining credits are selected. When the remaining credits are smaller than the selected bet pattern, the button is in the off state and disabled.

(Details of Operation of Control Panel 30: Continuous Pressing of Spin Button 46)

Figure 121:
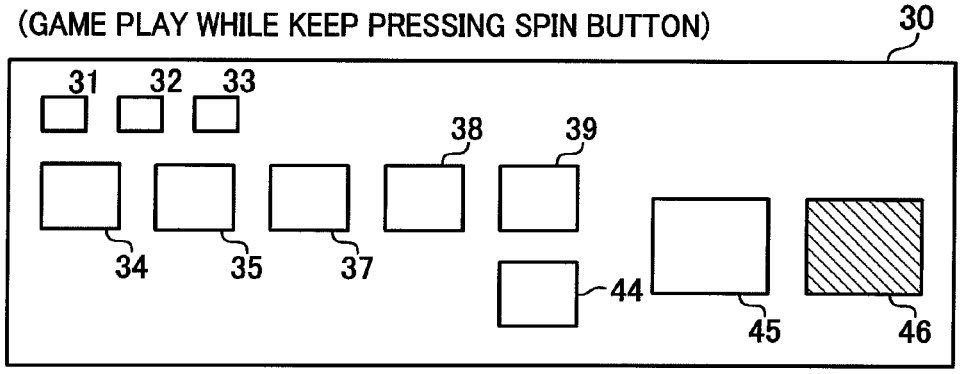

As shown in FIG. 121, auto bet starts as the spin button 46 is continuously pressed. The maximum BET button 45 is in the off state and disabled. The other buttons are in the off state and disabled. The auto bet function (button) is the operation identical with those during the reel spin and the WIN increment. However, during the WIN increment, the next game starts rather than the GAME OVER, when the illuminated button is pressed. The button operation when a payout occurs is identical with that of the WIN increment. The button operation when losing in the game is identical with the operation during the reel spin. When the feature is waited for, it is necessary to press the bottom at the time of the pressing of the spin button 46.

(Details of Operation of Control Panel 30: During Help Screen)

Figure 122:
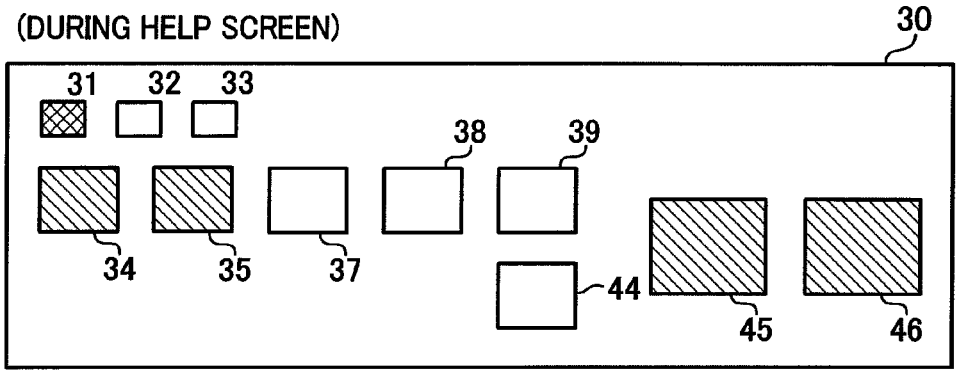

As shown in FIG. 122, the change button 31 is in the off state but active. The button is turned on/off as pressed. The cashout button 32 is in the off state and disabled. The help button 33 is in the on state and active. The help ends when the button is pressed. The 1-bet button 34 is in the on state and active. The next page of the help screen is displayed when the button is pressed. The 2-bet button 35 is in the on state and active. The previous page of the help screen is displayed when the button is pressed. The maximum BET button 45 is in the on state and active. The help ends when the button is pressed. The spin button 46 is in the on state and active. The help ends when the button is pressed. The other buttons are in the off state and disabled.

(Details of Operation of Control Panel 30: During Reel Spin (the Same Applies During Free Game))

Figure 123:
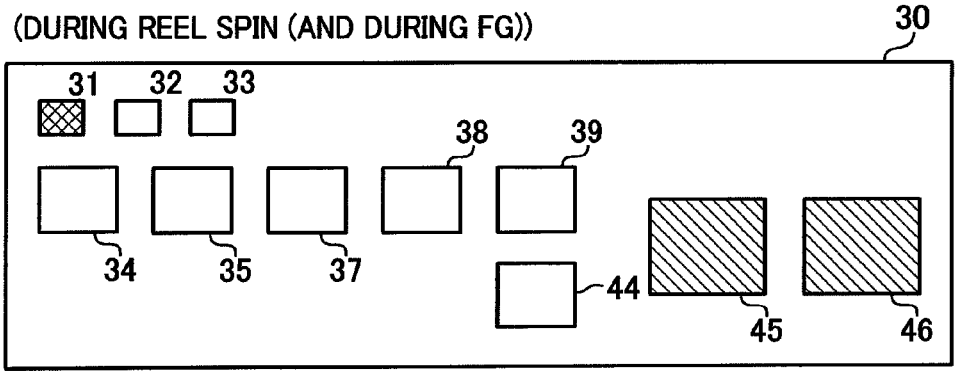

As shown in FIG. 123, the change button 31 is in the off state but active. The button is turned on/off as pressed. The cashout button 32 is in the off state and disabled. The help button 33 is in the off state and disabled. The maximum BET button 45 is in the on state and active. Quick stop is executed when the button is pressed. The spin button 46 is in the on state and active. Quick stop is executed when the button is pressed. The other buttons are in the off state and disabled.

(Details of Operation of Control Panel 30: During Cancelable Effect Screen)

Figure 124:
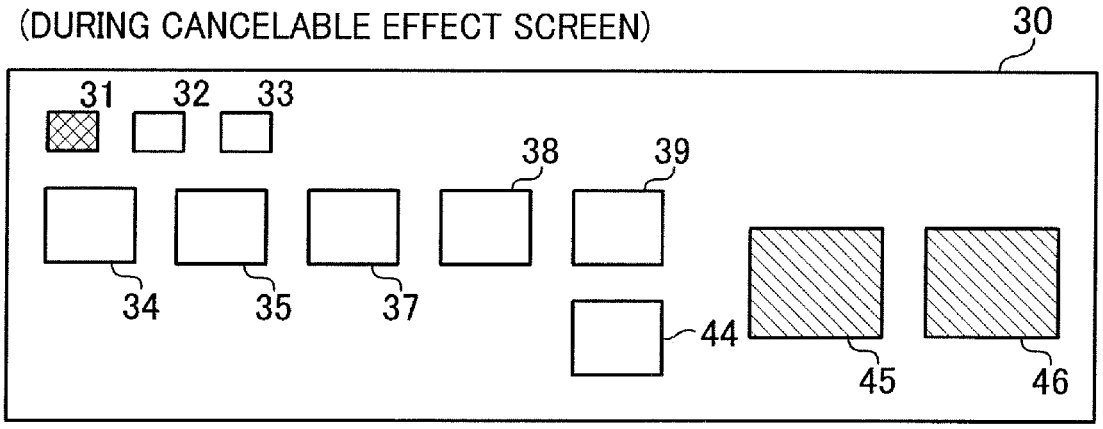

As shown in FIG. 124, the change button 31 is in the off state but active. The button is turned on/off as pressed. The cashout button 32 is in the off state and disabled. The help button 33 is in the off state and disabled. The maximum BET button 45 is in the on state and active. The effect is canceled when the button is pressed. The spin button 46 is in the on state and active. The effect is canceled when the button is pressed. The other buttons are in the off state and disabled.

(Details of Operation of Control Panel 30: In WIN Increment—During Normal Game)

As shown in FIG. 125, the change button 31 is in the off state but active. The button is turned on/off as pressed. The cashout button 32 is in the on state and active. The increment is canceled when the button is pressed. The help button 33 is in the off state but active. The 1-bet button 34 to the 10-bet button 39 are in the off state or are in the on state and active. The increment is canceled when one of the buttons is pressed, and the GAME OVER is executed and the selected bet is set and the button is turned on. In other words, these buttons retain the state of the previous game play. Alternatively, the buttons are in the off state or are in the on state and active, and the increment is canceled and the GAME OVER is executed when the button is pressed. The maximum BET button 45 is in the on state and active. The increment is canceled when the button is pressed, and the processes from Take WIN to GAME OVER are executed. The spin button 46 is in the on state and active. The increment is canceled when the button is pressed, and the processes from Take WIN to GAME OVER are executed. When credits allowing repeat bet are retained, the next game starts. The spin button 46 may be in the on state and active, and the increment may be canceled when pressed and the GAME OVER may be executed. The gamble button 44 is in the on state and active when Gamble is active. The increment is canceled when the button is pressed, and a gamble screen is displayed. The button is in the off state and disabled when Gamble is disabled.

(Details of Operation of Control Panel 30: In WIN Increment—During Free Game)

As shown in FIG. 126, the change button 31 is in the off state but active. The button is turned on/off as pressed. The cashout button 32 is in the on state and active. The next game starts when the number of remaining games is not zero. When the number of remaining games is zero, the shifting to a total WIN signboard is executed. The help button 33 is in the off state and disabled. The 1-bet button 34 to the 10-bet button 39 are in the off state or are in the on state and active. Each button is turned on only at the time of betting with the triggering of a free game. The next game starts when the number of remaining games is not zero. When the number of remaining games is zero, the shifting to a total WIN signboard is executed. The maximum BET button 45 is in the on state and active. The next game starts when the number of remaining games is not zero. When the number of remaining games is zero, the shifting to a total WIN signboard is executed. The spin button 46 is in the on state and active. The next game starts when the number of remaining games is not zero. When the number of remaining games is zero, the shifting to a total WIN signboard is executed. The gamble button 44 is in the off state and disabled.

(Details of Operation of Control Panel 30: In Trigger Payout Increment after Winning Free Game)

As shown in FIG. 127, the change button 31 is in the off state but active. The button is turned on/off as pressed. The cashout button 32 is in the on state and active. The increment is canceled when the button is pressed, and the shifting to the next step is executed. The help button 33 is in the off state and disabled. The 1-bet button 34 to the 10-bet button 39 are in the off state or are in the on state and active. Each button is turned on only at the time of betting with the triggering of a free game. The increment is canceled when the button is pressed, and the shifting to the next step is executed. The maximum BET button 45 is in the on state and active. The increment is canceled when the button is pressed, and the shifting to the next step is executed. The spin button 46 is in the on state and active. The increment is canceled when the button is pressed, and the shifting to the next step is executed. The gamble button 44 is in the off state and disabled.

(Details of Operation of Control Panel 30: Waiting for Selection—Direct Selection of Control Panel 30)

As shown in FIG. 128, the change button 31 is in the off state but active. The button is turned on/off as pressed. The cashout button 32 is in the off state and disabled. The help button 33 is in the off state and disabled. The 1-bet button 34 to the 10-bet button 39 are in the on state and active when allocated to selection buttons. The buttons are in the off state and disabled when not allocated to selection buttons. The maximum BET button 45 is in the off state and disabled. The spin button 46 is in the off state and disabled. The gamble button 44 is in the off state and disabled.

(Details of Operation of Control Panel 30: Waiting for Selection—Selection by Moving Cursor)

As shown in FIG. 129, the change button 31 is in the off state but active. The button is turned on/off as pressed. The cashout button 32 is in the off state and disabled. The help button 33 is in the off state and disabled. The 1-bet button 34 is in the on state and active. The cursor is moved to the next option when the button is pressed. The 10-bet button 39 is in the on state and active. The cursor is moved to the next option when the button is pressed. The maximum BET button 45 is in the on state and active when an icon is selected by the cursor. When no icon is selected by the cursor, the button is in the off state and disabled. The spin button 46 is in the on state and active when an icon is selected by the cursor. When no icon is selected by the cursor, the button is in the off state and disabled. The gamble button 44 is in the off state and disabled.

(Details of Operation of Control Panel 30: When Total WIN Signboard is Displayed after Free Game)

As shown in FIG. 130, the change button 31 is in the off state but active. The button is turned on/off as pressed. The cashout button 32 is in the off state and disabled. The help button 33 is in the off state and disabled. The maximum BET button 45 is in the off state and disabled until four seconds elapse. The button is in the on state and active after four seconds elapses. The spin button 46 is in the off state and disabled until four seconds elapse. The determination is confirmed when the button is pressed. The button is in the on state and active after four seconds elapses. The increment is canceled when the button is pressed. The gamble button 44 is in the off state and disabled.

(Details of Operation of Control Panel 30: When PLAYON, GAMBLE or TAKEWIN is Displayed)

As shown in FIG. 131, the change button 31 is in the off state but active. The button is turned on/off as pressed. The cashout button 32 is in the on state and active. Take WIN and GAME OVER are conducted when the button is pressed. The help button 33 is in the on state and active. The help is displayed when the button is pressed. The 1-bet button 34 to the 10-bet button 39 are in the off state or are in the on state and active. In other words, these buttons retain the state of the previous game play. Take WIN and GAME OVER are conducted when the button is pressed. The maximum BET button 45 is in the on state and active. The increment is canceled when the button is pressed and the GAME OVER is executed. The spin button 46 is in the on state and active. Take WIN and GAME OVER are conducted when the button is pressed. Then the next game starts. The increment may be canceled and the GAME OVER may be executed when the spin button 46 is pressed. The gamble button 44 is in the on state and active. Gamble is executed when the button is pressed.

(Details of Operation of Control Panel 30: In Gamble)

As shown in FIG. 132, the change button 31 is in the off state but active. The button is turned on/off as pressed. The cashout button 32 is in the on state and active. Take WIN and GAME OVER are conducted when the button is pressed. The help button 33 is in the on state and active. The help is displayed when the button is pressed. The 1-bet button 34 is in the on state and active. Red is selected when the button is pressed. The 2-bet button 35 is in the on state and active. Black is selected when the button is pressed. The maximum BET button 45 is in the on state and active. Take WIN and GAME OVER are conducted when the button is pressed. The spin button 46 is in the on state and active. Take WIN is conducted when the button is pressed, and the next game starts. Take WIN and GAME OVER may be conducted when the spin button 46 is pressed. The other buttons are in the off state and disabled.

(Details of Operation of Control Panel 30: In RESIDUAL GAMBLE)

As shown in FIG. 133, the change button 31 is in the off state but active. The button is turned on/off as pressed. The cashout button 32 is in the on state and active in case of GAMBLE-ODD SUM. ATTENDANT PAY is conducted when the button is pressed. The button is in the off state and disabled in case of GAMBLE-NONE. The help button 33 is in the off state and disabled. The maximum BET button 45 is in the off state and disabled. The spin button 46 is in the on state and active. The normal game comes back when the button is pressed. The gamble button 44 is in the on state and active. A RESIDUAL GAMBLE starts when the button is pressed. The other buttons are in the off state and disabled.

(Details of Operation of Control Panel 30: When Error Occurs)

As shown in FIG. 134, the change button 31 is in the off state but active. The button is turned on/off as pressed. The cashout button 32 is in the off state and disabled. The other buttons are in the off state and disabled.

(Details of Operation of Control Panel 30: After Return from Error)

As shown in FIG. 135, the change button 31 is in the off state and disabled. The button remains in the off state but active after 120 seconds elapses. The cashout button 32 is in the on state and active. The help button 33 is in the on state and active. The 1-bet button 34 to the 10-bet button 39 are in the off state or are in the on state and active. In other words, these buttons retain the state of the previous game play. The gamble button 44 is in the off state and disabled. The maximum BET button 45 is turned on when max bet is possible. A game starts with "max bet" when the button is pressed. When the credits are smaller than max bet, the button is turned on and the maximum bettable bet is selected when the button is pressed. The button is in the off state and disabled when the credits are not sufficient for one bet. The spin button 46 is in the on state and active when the remaining credits>selected bet pattern. The button is in the off state and disabled when the remaining credits<selected bet pattern.

(Operations of Slot Machine 10: Gamble Game)

As shown in FIG. 136, when the money is lower than the processable value such as one dollar, a "RESIDUAL GAMBLE" screen is displayed if a gamble start condition such as the pressing of a collect button is satisfied (F253). When the gamble button is pressed, Gamble starts. On the other hand, when the collect button is pressed, Call Attendant is displayed (F254). When the spin button 46 is pressed, the screen of the normal game comes back (F255).

When "WIN" is achieved in Gamble (F256), a predetermined amount of money such as one cent is awarded and a token is paid out through the hopper. In addition to the above, the addition to the credit meter is executed (F257). Thereafter, after a predetermined time such as two seconds elapses, the screen of the normal game comes back (F258). On the other hand, when "LOSE" appears in Gamble (F259), a LOSE screen is displayed (F260). Thereafter, after a predetermined time such as two seconds elapses, the screen of the normal game comes back (F261).

The roles of the buttons in the progress of the gamble game will be described. In the cashout button 32, GAMBLE ON corresponds to "TAKE WIN" and GAMBLE OFF corresponds to "TAKE WIN". In the gamble button 44, GAMBLE ON corresponds to "Gamble Start" and GAMBLE OFF corresponds to "-". IN the maximum BET button 45, GAMBLE ON corresponds to "Invalidated" and GAMBLE OFF corresponds to "Gamble Start". In the spin button 46, GAMBLE ON corresponds to "To Normal Game" and GAMBLE OFF corresponds to "To Normal Game".

As shown in FIG. 137, the "RESIDUAL GAMBLE" screen has a card display area, a navigation area, and a meter area. In the card area is displayed a card image. The entirety of the card area has a touch sensor function. On the navigation area, various navigation texts are displayed.

The limit of the value winnable in Gamble is set in the AUDIT. The maximum number of times of Gamble is also set in the AUDIT. For example, the maximum number of times is set at five and the number of times of Gamble is set so as to be five or lower. Whether the touch panel can be used is switchable in some countries.

As shown in FIG. 138, when the shifting to the gamble game occurs, the message "PLAY ON, GAMBLE or TAKE WIN RED" disappears. Immediately after the clearance of the RAM, the card history is empty until the gamble game is played. A message "SELECT RED OR BLACK OR TAKE WIN" is displayed. In the gamble screen, a heart-shaped red button and a spade-shaped black button are turned on and a TAKE WIN button at the center is turned on. The other buttons are turned off.

Subsequently, as shown in FIG. 139, the amount bet on "GAMBLE AMOUNT" is displayed. Then one of the heart-shaped red button, the spade-shaped black button, and the TAKE WIN button at the center on the gamble screen is selected. When the TAKE WIN button is selected, the amount of WIN is added to the credits at once and the idle state comes back.

In case of Miss in Gamble, as shown in FIG. 140, non-selected options are darkened. At the left edge of the gamble history field, the card history is displayed at once. The preceding card history moves right. The trace of the movement is not illustrated in animation, and hence the history is rewritten at once. The central card result is displayed at once. At this stage, there are no changes in the win meter and the gamble meter. Sound indicating hard luck is output and the shifting to the normal game occurs after several seconds.

In case of Success in Gamble, as shown in FIG. 141, non-selected options are darkened. At the left edge of the gamble history field, the card history is displayed at once. The preceding card history moves right. The trace of the movement is not illustrated in animation, and hence the history is rewritten at once. On the central card, a normal card and a card with a WIN text are alternately displayed at intervals of one frame, and success sound is output for a predetermined time. To the win meter, the value increase as a result of Gamble is added at once. When the player plays the gamble game until reaching the maximum number to times, the value won is added to the credits at once and the idle state comes back. As shown in FIG. 141, when the player has not played the gamble game until reaching the maximum number to times, a card is turned inside out and the gamble game is continued.

(Details of Display Screen: Progressive Meter)

As shown in FIG. 142, a progressive value in the progressive meter is displayed in 16 digits at the most, which includes a currency indicator (1 to 3 digits) of each country, a number of 10 digits at the most including comma, and values of the first and second decimal places. Modifying the setting by audit or the like enables modification of the displaying. The value according to the setting of the game (progressive initial value, increment %) is displayed as the amount of money. That is, every time the game is played, increment % relating to the bet is added, and the progressive value of the progressive meter is updated.

Note that the progressive meter performs displaying by means of dot matrix. The incrementing is stopped upon occurrence of the progressive winning, and the value is rewritten into the amount of money immediately, and blinking effect is started. Note that the blinking effect is not performed in the state the incrementing is stopped. Blinking stops upon returning to the idling state, and the displaying of the money amount is initialized at once.

(LED Effect)

The LEDs provided to the top box 12 or the like are controlled based on an LED table shown in FIGS. 143 to 145. In the LED table are File Name and Used Position for controlling the LEDs, a start condition, and a turning-off (ending) condition.

(Spin Table)

The variably display of the pseudo reels 151 to 155 is controlled based on the variable-display table as shown in FIG. 146. In the variable-display table, files (Normal) for controlling the modes of the pseudo reels 151 to 155, game states, and using conditions are associated with one another.

(Presentation Commands)

To use the gaming machine at a show, a presentation, or the like, the gaming machine may be one that allows occurrence of a specific winning easily, or one having such a mode. This allows occurrence of a feature at high possibilities, and allows players at the venue or the like of the show who only plays the game for a short period of time to confirm the feature.

Presentation commands are specifically as shown in FIG. 147. For example, in a show mode, three bonus symbols are rearranged at a probability of one over 20. These commands are each given an identification number and are aligned in an ascending order by pressing the change button, these commands loop after reaching the last one. Note that, the first mode (show mode) is automatically activated at the time of powering on.

(Debug Commands)

The gaming machine may be one that enables more detailed execution of a specific operation, or one that has such a mode. The debug commands are specifically as shown in FIG. 148. This allows easier confirmation of the operation of the gaming machine.

While in the present embodiment the number of activatable lines is 50, the number of paylines is not limited; the number of activatable lines may be a predetermined number such as 25.

Although in the present embodiment the bonus winning is a case where three trigger symbols are rearranged, the disclosure is not limited to this arrangement. For example, the bonus winning may indicate the state in which a predetermined time elapses after the end of the previous bonus game.

In addition to the above, according to the present embodiment, the free game is arranged so that, symbols are variably displayed in the display block 28 and the variation is stopped, and a payout amount is determined in accordance with the symbols having stopped or a combination thereof (i.e., a game usually run on a slot machine). The free game of the disclosure, however, is not limited to the arrangement above. The free game may be a game different from a slot game. For example, card games such as Poker, shooting games, fighting games may be run. As a result of the free game, a game medium may be paid out or may not be paid out.

In addition to the above, when a free game is run based on the fact that the number of times of the normal game counted in the insurance mode reaches a predetermined number and then the number of times of the normal game counted in the insurance mode reaches the predetermined number again, a free game different from the previous free game may be run. The free game of the present invention may be designed in various ways, as long as the game does not presuppose the betting of a game medium.

The above embodiment thus described solely serves as a specific example of the present invention, and the present invention is not limited to such an example. Specific structures and various means may be suitably designed or modified. Further, the effects of the present invention described in the above embodiment are not more than examples of most preferable effects achievable by the present invention. The effects of the present invention are not limited to those described in the embodiments described above.

Further, the detailed description above is mainly focused on characteristics of the present invention to fore the sake of easier understanding. The present invention is not limited to the above embodiments, and is applicable to diversity of other embodiments. Further, the terms and phraseology used in the present specification are adopted solely to provide specific illustration of the present invention, and in no case should the scope of the present invention be limited by such terms and phraseology. Further, it will be obvious for those skilled in the art that the other structures, systems, methods or the like are possible, within the spirit of the invention described in the present specification. The description of claims therefore shall encompass structures equivalent to the present invention, unless otherwise such structures are regarded as to depart from the spirit and scope of the present invention. Further, the abstract is provided to allow, through a simple investigation, quick analysis of the technical features and essences of the present invention by an intellectual property office, a general public institution, or one skilled in the art who is not fully familiarized with patent and legal or professional terminology. It is therefore not an intention of the abstract to limit the scope of the present invention which shall be construed on the basis of the description of the claims. To fully understand the object and effects of the present invention, it is strongly encouraged to sufficiently refer to disclosures of documents already made available.

The detailed description of the present invention provided hereinabove includes a process executed on a computer. The above descriptions and expressions are provided to allow the one skilled in the art to most efficiently understand the present invention. A process performed in or by respective steps yielding one result or blocks with a predetermined processing function described in the present specification shall be understood as a process with no self-contradiction. Further, the electrical or magnetic signal is transmitted/received and written in the respective steps or blocks. It should be noted that such a signal is expressed in the form of bit, value, symbol, text, terms, number, or the like solely for the sake of convenience. Although the present specification occasionally personifies the processes carried out in the steps or blocks, these processes are essentially executed by various devices. Further, the other structures necessary for the steps or blocks are obvious from the above descriptions.

What is claimed is:

1. A method of controlling a gaming machine having a symbol display device configured to variably display a plurality of symbols and then rearrange the same, an indication effect device configured to perform indication effects, and a controller, the method comprising the steps of, via the controller:

controlling the symbol display device to variably display the symbols in response to an external input;

randomly determining symbols to be rearranged on the symbol display device;

determining one game result out of a plurality of game results based on the symbols randomly determined;

selecting one individual indication effect from among a plurality of individual indication effects based on said one game result;

specifying one common indication effect from among a plurality of common indication effects which correspond to respective ones of said plurality of individual indication effects, said one common indication effect being specified based on the one selected individual indication effect;

executing said one common indication effect; and after said one common indication effect is executed and while the symbols are being variably displayed, executing said one individual indication effect.

2. A gaming machine, comprising:

a symbol display device configured to display one game result out of a plurality of game results by variably displaying a plurality of symbols and rearranging them thereafter;

an indication data storage device storing a plurality of sets of individual indication data associated with the plurality of game results and storing a plurality of sets of common indication data associated with respective ones of the sets of individual indication data;

an indication effect device configured to execute indication effects based on any one of the sets of common indication data and any one of the sets of individual indication data; and a controller configured to start a game, the controller being programmed to execute the following processes of:

(A) randomly determining symbols to be rearranged on the symbol display device;

(B) determining said one game result based on the symbols determined in step (A);

(C) when said one game result determined in step (B) is a game result associated with any set of the individual indication data, determining whether to execute an individual indication effect, selected from among a plurality of individual indication effects, based on that set of the individual indication data; and (D) when it is determined in step (C) that the individual indication effect is to be executed based on said that set of individual indication data, executing the individual indication effect based on said that set of individual indication data after executing one common indication effect, specified from among a plurality of common indication effects, based on the common indication data associated with said that set of individual indication data and while the symbols are being variably displayed on the symbol display device.

3. A gaming machine, comprising:

a symbol display device having activatable lines, which is configured to display one game result out of a plurality of game results by variably displaying a plurality of symbols and rearranging them in a matrix thereafter;

an indication data storage device storing sets of individual indication data associated with the plurality of game results and storing a set of common indication data associated with the sets of individual indication data;

an indication effect device configured to execute a common indication effect based on the common indication data and an individual indication effect based on any one of the sets of individual indication data; and a controller configured to start a game and 1) when said one game result is such that a first predetermined number or more of identical symbols are rearranged on any of the activatable lines, to award a payout according to the symbols; and 2) when said one game result is such that a second predetermined number or more of special symbols are rearranged on an activatable line, to award a bonus game;

the controller being programmed to execute the following processes of:

(A) randomly determining symbols to be rearranged on the symbol display device;

(B) determining said one game result based on the symbols determined in step (A);

(C) when said one game result determined in step (B) is a game result associated with any of the sets of individual indication data, determining whether to execute an individual indication effect based on that set of the individual indication data; and (D) when it is determined in step (C) that the individual indication effect is to be executed based on said that set of individual indication data, executing the individual indication effect based on said that set of individual indication data, after executing the common indication effect based on the common indication data associated with said that set of individual indication data while the symbols are being variably displayed on the symbol display device; and (E) when it is determined in step (C) that the individual indication effect based on said that set of individual indication data corresponding to said one game result determined in step (B) is not executed, determining to execute at a predetermined probability an individual indication effect based on the common indication data associated with said that set of individual indication data and another set of individual indication data associated with the common indication data while the symbols are being variably displayed on the symbol display device.

4. The gaming machine according to claim 3, wherein the sets of individual indication data stored in the indication data storage device and associated with the set of common indication data include 1) first individual indication data associated with a game result where the second predetermined number or more of the special symbols are rearranged on the activated line; and 2) second individual indication data associated with a game result where one less than the second predetermined number of special symbols are rearranged on the activated line.

5. The gaming machine according to claim 3, wherein the sets of individual indication data stored in the indication data storage device and associated with the set of common indication data include 1) third individual indication data associated with a game result where a scaling factor of the payout is a third predetermined number or more; and 2) fourth individual indication data associated with a game result where the scaling factor of payout is at least a fourth predetermined number which is less than the third predetermined number.

6. A gaming machine, including:

a display, a storage device configured to store sets of data to display, on the display, an effect movie in which one of a plurality of individual indication effects branches off from a common effect; and a controller configured to execute control program steps including:

(a) selecting one individual indication effect from among the plurality of individual indication effects based on a game result of the gaming machine;

(b) specifying the common indication effect in association with the individual indication effect selected in step (a);

(c) reading the sets of data from the storage device so that the individual indication effect selected in step (a) is displayed in such a manner that it branches off from the common indication effect specified in step (b); and (d) before displaying a game result, displaying said movie based on the sets of data read in step (c), with the individual indication effect selected in step (a) branching off from the common indication effect specified in step (b).

* * * * *